US012797669B2

(12) United States Patent
Pohl et al.

(10) Patent No.: US 12,797,669 B2
(45) Date of Patent: Nov. 17, 2026

(54) ADJUSTABLE DUMBBELL SYSTEM

(71) Applicant: Johnson Health Tech Retail, Inc., Cottage Grove, WI (US)

(72) Inventors: Ryan J. Pohl, Ridgefield, WA (US); Jeffrey A. Tracy, Troutdale, OR (US); Todd D. Anderson, Brush Prairie, WA (US)

(73) Assignee: Johnson Health Tech Retail, Inc., Cottage Grove, WI (US)

( * ) Notice: Subject to any disclaimer, the term of this patent is extended or adjusted under 35 U.S.C. 154(b) by 0 days.

(21) Appl. No.: 19/375,857

(22) Filed: Oct. 31, 2025

(65) Prior Publication Data

US 2026/0083998 A1 Mar. 26, 2026

Related U.S. Application Data

(63) Continuation of application No. 18/420,315, filed on Jan. 23, 2024, now Pat. No. 12,465,805.

(60) Provisional application No. 63/585,872, filed on Sep. 27, 2023, provisional application No. 63/481,541, filed on Jan. 25, 2023.

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/075; A63B 71/0036
See application file for complete search history.

(56) References Cited

U.S. PATENT DOCUMENTS

| | | | |
|---|---|---|---|
| 6,039,679 | A | 3/2000 | Yu |
| 6,132,345 | A | 10/2000 | Beierschmitt et al. |
| 6,149,558 | A | 11/2000 | Chen |
| 6,261,022 | B1 | 7/2001 | Dalebout et al. |
| 6,416,446 | B1 | 7/2002 | Krull |
| 6,540,650 | B1 | 4/2003 | Krull |
| 6,656,093 | B2 | 12/2003 | Chen |
| 6,872,173 | B2 | 3/2005 | Krull |
| 7,090,625 | B2 | 8/2006 | Chermack |

(Continued)

FOREIGN PATENT DOCUMENTS

| | | | |
|---|---|---|---|
| AU | 2021100261 | A4 | 4/2021 |
| CN | 201482056 | U | 5/2010 |

(Continued)

OTHER PUBLICATIONS

"International Search Report and Written Opinion for PCT/US2024/012598, mailed on Jun. 27, 2024".

*Primary Examiner* — Evan P Dzierzynski
(74) *Attorney, Agent, or Firm* — Dorsey & Whitney LLP

(57) ABSTRACT

An adjustable dumbbell may include a handle assembly and multiple weights connected to the handle assembly. The weights may be selected in sequence in order to determine the desired weight for use. The weights may be positioned on ends of the handle assembly and may rest within a base when not in use. The handle assembly itself may be removed while the weights remain in the base. The system may be controlled manually by a rotational motion or may be controlled by an automated or semi-automated system.

20 Claims, 106 Drawing Sheets

(56) References Cited

U.S. PATENT DOCUMENTS

| | | | | |
|---|---|---|---|---|
| 7,223,214 | B2 | 5/2007 | Chen | |
| 7,264,578 | B1 | 9/2007 | Krull | |
| 7,291,098 | B1 | 11/2007 | Krull | |
| 7,497,814 | B1 | 3/2009 | Krull | |
| 7,549,952 | B2 | 6/2009 | Towley et al. | |
| 7,578,771 | B1 | 8/2009 | Towley et al. | |
| 7,588,520 | B2 | 9/2009 | Nalley | |
| 7,604,578 | B2 | 10/2009 | Liu | |
| 7,621,855 | B1 | 11/2009 | Krull | |
| 7,625,322 | B1 | 12/2009 | Krull | |
| 8,025,613 | B1 | 9/2011 | Wang | |
| 8,206,274 | B2 | 6/2012 | Svenberg et al. | |
| 8,529,415 | B2 | 9/2013 | Svenberg et al. | |
| 8,690,740 | B2 | 4/2014 | Yu | |
| 8,790,223 | B2 | 7/2014 | Wang | |
| 8,992,396 | B2 | 3/2015 | Wang | |
| 9,022,907 | B2 | 5/2015 | Wang | |
| 9,126,072 | B2 | 9/2015 | Watterson | |
| 9,135,347 | B2 | 9/2015 | Damman et al. | |
| 9,504,868 | B2 | 11/2016 | Liu | |
| 9,616,273 | B2 | 4/2017 | Chen | |
| 9,643,042 | B2 | 5/2017 | Madden | |
| 9,795,822 | B2 | 10/2017 | Smith et al. | |
| 9,895,571 | B2 | 2/2018 | Wang | |
| 9,943,719 | B2 | 4/2018 | Smith et al. | |
| 10,022,583 | B2 | 7/2018 | Wang | |
| 10,071,285 | B2 | 9/2018 | Smith et al. | |
| 10,099,083 | B1 | 10/2018 | Owusu | |
| 10,328,299 | B2 | 6/2019 | Wang | |
| 10,343,010 | B2 | 7/2019 | Chen | |
| 10,583,318 | B2 | 3/2020 | Nalley | |
| 10,688,345 | B1 | 6/2020 | Lynch | |
| 10,799,760 | B2 | 10/2020 | Canavan et al. | |
| 10,843,027 | B2 | 11/2020 | Wang | |
| 10,843,028 | B2 | 11/2020 | Nalley et al. | |
| 10,902,741 | B2 | 1/2021 | Rubinstein et al. | |
| 10,974,093 | B2 | 4/2021 | Wang | |
| 11,007,397 | B2 | 5/2021 | Liu | |
| 11,013,947 | B2 | 5/2021 | Svenberg | |
| 11,040,235 | B2 | 6/2021 | Wang | |
| 11,065,499 | B2 | 7/2021 | Chen | |
| 11,167,167 | B1 | 11/2021 | Weng | |
| 11,179,594 | B2 | 11/2021 | Chen | |
| 11,219,795 | B1 | 1/2022 | Yao | |
| 11,247,093 | B2 | 2/2022 | Chiang | |
| 11,253,749 | B2 | 2/2022 | Lynch | |
| 11,260,259 | B2 | 3/2022 | Benoit | |
| 11,273,355 | B2 | 3/2022 | Myre | |
| 11,285,354 | B1 * | 3/2022 | Tseng | A63B 21/0726 |
| D953,754 | S | 6/2022 | Asikainen et al. | |
| RE49,161 | E | 8/2022 | Myre | |
| 11,478,675 | B2 | 10/2022 | Chen | |
| 11,484,745 | B1 | 11/2022 | Weng | |
| 11,496,870 | B2 | 11/2022 | Tran et al. | |
| 11,534,651 | B2 | 12/2022 | Ercanbrack et al. | |
| 11,602,661 | B2 | 3/2023 | Svenberg | |
| 2004/0005968 | A1 | 1/2004 | Crawford et al. | |
| 2004/0198569 | A1 | 10/2004 | Sanford-schwentke et al. | |
| 2006/0135328 | A1 * | 6/2006 | Doudiet | A63B 21/0728 482/107 |
| 2006/0189458 | A1 | 8/2006 | Walkerdine | |
| 2007/0167300 | A1 | 7/2007 | Krull | |
| 2007/0184945 | A1 | 8/2007 | Lin | |
| 2007/0254785 | A1 * | 11/2007 | Lin | A63B 21/0728 482/108 |
| 2010/0234699 | A1 | 9/2010 | Lanfermann et al. | |
| 2011/0092337 | A1 | 4/2011 | Srinivasan et al. | |
| 2012/0021877 | A1 * | 1/2012 | Lundquist | A63B 21/0728 482/107 |
| 2015/0360073 | A1 * | 12/2015 | Moran | A63B 21/075 |
| 2015/0367164 | A1 | 12/2015 | Myre | |
| 2016/0166873 | A1 | 6/2016 | Liu | |
| 2017/0072243 | A1 | 3/2017 | Chen | |
| 2018/0117386 | A1 | 5/2018 | Wang | |
| 2018/0169459 | A1 | 6/2018 | Wang | |
| 2018/0353794 | A1 | 12/2018 | Wang | |
| 2020/0289891 | A1 | 9/2020 | Owusu | |
| 2021/0008413 | A1 | 1/2021 | Asikainen et al. | |
| 2021/0077848 | A1 | 3/2021 | Owusu | |
| 2021/0093920 | A1 | 4/2021 | Poulin et al. | |
| 2021/0187340 | A1 | 6/2021 | Chen | |
| 2021/0402243 | A1 | 12/2021 | Svenberg et al. | |
| 2022/0047920 | A1 | 2/2022 | Poulin et al. | |
| 2022/0076666 | A1 | 3/2022 | Trehan | |
| 2022/0088432 | A1 | 3/2022 | Wang | |
| 2022/0134185 | A1 | 5/2022 | Owusu | |
| 2022/0152443 | A1 | 5/2022 | Casagrande | |
| 2022/0176200 | A1 | 6/2022 | Jiang | |
| 2022/0193479 | A1 * | 6/2022 | Wu | A63B 21/075 |
| 2022/0193480 | A1 | 6/2022 | Wu et al. | |
| 2022/0193481 | A1 | 6/2022 | Wu et al. | |
| 2022/0193482 | A1 | 6/2022 | Wu et al. | |
| 2022/0212052 | A1 | 7/2022 | Ercanbrack et al. | |
| 2022/0219046 | A1 | 7/2022 | Loh et al. | |
| 2022/0241640 | A1 | 8/2022 | Yang | |
| 2022/0249934 | A1 | 8/2022 | Augustin et al. | |
| 2022/0257993 | A1 | 8/2022 | Geng | |
| 2022/0277845 | A1 | 9/2022 | Liu et al. | |
| 2022/0296966 | A1 | 9/2022 | Asikainen et al. | |
| 2022/0314058 | A1 | 10/2022 | Svenberg | |
| 2022/0331642 | A1 | 10/2022 | Casagrande | |
| 2022/0339499 | A1 | 10/2022 | Malis et al. | |
| 2022/0355163 | A1 | 11/2022 | Aly et al. | |
| 2022/0401785 | A1 | 12/2022 | Gottehrer | |
| 2023/0027679 | A1 | 1/2023 | Chen | |
| 2023/0031956 | A1 | 2/2023 | Luo et al. | |
| 2023/0046695 | A1 | 2/2023 | Zhou | |
| 2023/0052772 | A1 | 2/2023 | Wang | |
| 2023/0120364 | A1 | 4/2023 | Sun | |
| 2023/0137222 | A1 | 5/2023 | D'Ambrosio-correll et al. | |
| 2024/0252873 | A1 | 8/2024 | Pohl et al. | |

FOREIGN PATENT DOCUMENTS

| | | | |
|---|---|---|---|
| EP | 2455138 | A1 | 5/2012 |
| EP | 3042360 | A4 | 6/2017 |
| WO | 2015139089 | A1 | 9/2015 |
| WO | 2021232966 | A1 | 11/2021 |
| WO | 2024158803 | | 8/2024 |

* cited by examiner

ADJUSTABLE DUMBBELL SYSTEM

CROSS-REFERENCE TO RELATED APPLICATION(S)

This application is a continuation of U.S. patent application Ser. No. 18/420,315, filed on Jan. 23, 2024, which claims the benefit of U.S. Provisional Application No. 63/481,541, filed Jan. 25, 2023, and which also claims the benefit of U.S. Provisional Application No. 63/585,872, filed Sep. 27, 2023, the disclosures of which are hereby incorporated by reference in their entireties.

FIELD

The present disclosure relates generally to an adjustable dumbbell system, and more specifically to an adjustable dumbbell system that may include add-on weights and different mechanisms for connecting the weights to the dumbbells system.

BACKGROUND

Dumbbells and other free weights are widely used exercise devices for providing resistance training in a wide variety of exercises such as bicep curls, bench presses, shoulder presses, triceps extensions, squats, lunges, and the like. Due to the number of exercises that may be performed with dumbbells, users often need many different dumbbells, each with a different amount of mass, to perform a full exercise routine. Traditional dumbbells can be inconvenient to use because each time the user desires to change the load or resistance, he or she has to select a different dumbbell or disassemble and reassemble the dumbbell.

In response to these issues, adjustable dumbbells have been produced which allow the user to perform a varied exercise routine without requiring a large number of different-load dumbbells. These adjustable dumbbells typically are delineated into lighter load adjustable dumbbells and heavier load adjustable dumbbells due to length and load-increment constraints. The lighter load adjustable dumbbells typically have smaller load increments between load settings and a shorter length, but have a limited overall load range. The heavier load adjustable dumbbells have a larger overall load range, but typically have relatively large load increments between load settings to maintain a reasonable overall size of the dumbbell.

As may be appreciated, the safe movement of an adjustable dumbbell system and the retention of the add-on weights are important to the end user. Accordingly, many examples may include safety devices that may help ensure only that the desired weights are selected and that unselected weights remain secured within a dumbbell base or platform. Some examples of a safety subsystem may include engagement pins that engage and disengage with the handle assembly when the handle assembly is in a base unit. Other examples may include resilient engaging interlocks that cooperatively engage with one or more weights to prevent the unwanted movement of those weights when not selected for use.

Many existing selectable load dumbbell systems have a number of different methods for selecting the load. Some systems will use a magnetic pin system that has to be manually adjusted for each subsequent weight. Other systems have used mechanical engagement systems where a selector may be adjusted to a particular weight and then the dumbbell handle engages with weight plates to meet the selected weight. Some of these mechanical systems may involve rotational selectors, linear-movement selectors, or just a moveable selector that may be moved between weights. In each of the systems the weight plates are selected and then engaged with the handle mechanism. Some traditional systems involve manually placing new weights onto the handle and then securing the weights with a screw or cap that holds the weights on the handle. Many such systems may have a handle that extends beyond the selected weights making the system bulky and awkward to use.

There is a constant need for improvements in the field of adjustable free weights.

SUMMARY

One aspect of the disclosure relates to an adjustable dumbbell including a handle assembly, a first selector mechanism, and a second selector mechanism. The handle assembly may have a first end and an opposing second end. The first selector mechanism may be at the first end and at least partially rotatable to selectively couple a first weight to the first end. The second selector mechanism may be at the second end and at least partially rotatable to selectively couple a second weight to the first end.

In some embodiments, the first weight includes a first engagement structure, and the second weight includes a second engagement structure different than the first engagement structure.

In some embodiments, the handle assembly includes a housing. The first selector mechanism may couple the first weight within the housing. The second selector mechanism may couple the second weight outside of the housing.

In some embodiments, the first selector mechanism or the second selector mechanism is operable to sequentially couple multiple weights to the first end via an interconnection between the weights. The adjustable dumbbell may include a knob operable to drive the first selector mechanism and the second selector mechanism. The knob may be coupled to an outermost weight of the multiple weights.

In some embodiments, the first selector mechanism or the second selector mechanism is operable to sequentially couple multiple weights to each of the first end and the second end. The first selector mechanism or the second selector mechanism may be driven from an outermost weight of the multiple weights. The adjustable dumbbell may include a gear train tying the selective coupling of the multiple weights on the first end and the second end. The gear train may reverse a rotation direction of the first selector mechanism or the second selector mechanism across the first end and the second end.

In some embodiments, the handle assembly includes a central axis. The first weight may include a first body. The first weight may include a first disc rotatably coupled to the first body. The first disc may include a first flange extending at least partially around the first disc, the first flange defining an interior region and an opening to the interior region. The first disc may include a pocket defined by a second flange. The second weight may include a second body. The second weight may include a tab extending from the second body. The second weight may include a key extending from the second body. The second weight may include a second disc rotatably coupled to the second body, with the key positionable within the pocket. When the key is positioned in the pocket, the key may be rotatable about the central axis to rotate the first disc between a retaining position and a releasing position. In the retaining position, the first flange may engage the tab to provide an engagement for lifting the second weight with the first weight. In the releasing position, the tab may be aligned with the opening to decouple the second weight from the first weight.

In some embodiments, the pocket is aligned with the opening to receive the key through the opening. In some embodiments, the tab is positioned between the second disc and a bottom of the second weight. In some embodiments, the first flange extends circumferentially along a perimeter of the first disc.

In some embodiments, the second weight includes a third disc rotatably coupled to the second body. The third disc may include a third flange extending at least partially around the third disc. The third flange may define a second interior region and a second opening to the second interior region. The third disc may include a second pocket defined by a fourth flange.

In some embodiments, the adjustable dumbbell includes a third weight. The third weight may include a third body. The third weight may include a second tab extending from the third body. The third weight may include a second key extending from the third body. The third weight may include a fourth disc rotatably coupled to the third body, with the second key positionable within the second pocket. When the second key is positioned in the second pocket, the second key may be rotatable with the key about the central axis to rotate the third disc between a retaining position and a releasing position. In the retaining position, the third flange may engage the second tab to provide an engagement for lifting the third weight with the second weight. In the releasing position, the second tab may be aligned with the second opening to decouple the third weight from the second weight.

In some embodiments, the handle assembly includes a central axis. The handle assembly may include a rotatable handle disc including a pocket and a flange extending at least partially around the handle disc. The flange may define an interior region and an opening to the interior region. The adjustable dumbbell may include a weight plate. The weight plate may include a rotatable inner disc including a key positionable within the pocket. The weight plate may include a tab adjacent the inner disc. When the key is positioned in the pocket, the key may be rotatable about the central axis to rotate the handle disc between a retaining position and a releasing position. In the retaining position, the flange may engage the tab to provide an engagement for lifting the weight plate with the handle assembly. In the releasing position, the tab may be aligned with the opening to decouple the weight plate from the handle assembly.

In some embodiments, the weight plate is a first weight plate and includes a rotatable outer disc including a second pocket and a second flange extending at least partially around the outer disc. The second flange may define a second interior region and a second opening to the second interior region. The adjustable dumbbell may include a second weight plate. The second weight plate may include a rotatable inner disc including a second key positionable within the second pocket. The second weight plate may include a second tab adjacent the inner disc. When the second key is positioned in the second pocket, the second key may be rotatable about the central axis to rotate the outer disc between a retaining position and a releasing position. In the retaining position, the second flange may engage the second tab to provide an engagement for lifting the second weight plate with the first weight plate. In the releasing position, the second tab may be aligned with the second opening to decouple the second weight plate from the first weight plate.

In some embodiments, the adjustable dumbbell includes an end plate operable to rotate the key in response to an adjustment of a weight selector assembly. In some embodiments, the adjustable dumbbell includes at least one handle weight and a selector disc coupled to rotate with the handle disc. The selector disc may include a plurality of tabs that selectively engage the at least one handle weight based on a rotational position of the selector disc relative to the at least one handle weight.

In some embodiments, the adjustable dumbbell includes a base and a weight stack. The base may include a weight selector assembly. The weight selector assembly may include a gear train configured to adjust the weight stack when the adjustable dumbbell is positioned on the base. The adjustable dumbbell may include a pawl to selectively engage the gear train. When the adjustable dumbbell is removed from the base, the weight selector assembly may be locked by the pawl to limit a loss of weight selection synchronization between the adjustable dumbbell and the base. The adjustable dumbbell may include a first weight stack and a second weight stack. The weight selector assembly may include a first gear train configured to adjust the first weight stack, and a second gear train configured to adjust the second weight stack. The weight selector assembly may include a shaft extending from the first gear train to the second gear train to tie adjustment of the first weight stack with adjustment of the second weight stack.

In embodiments, the adjustable dumbbell includes the first weight or the second weight. The first weight or the second weight may include a body defining an aperture having a central axis. The first weight or the second weight may include a first disc coupled to a first side of the body to rotate about the central axis, the first disc including a key offset laterally from the central axis. The first weight or the second weight may include a second disc coupled to an opposite second side of the body to rotate about the central axis, the second disc including a pocket at a peripheral edge of the second disc. The pocket may be configured to receive the key of an adjacent weight when positioned in a weight stack with the adjacent weight. The second disc may include a flange configured to selectively engage a tab of the adjacent weight to provide an engagement for lifting the adjacent weight with the weight. The second disc may be rotatable about the central axis between a retaining position and a releasing position. In the retaining position, the flange may engage the tab to couple the weight to the adjacent weight. In the releasing position, the flange may disengage the tab to decouple the weight from the adjacent weight.

In embodiments, the adjustable dumbbell includes a handle weight. The adjustable dumbbell may include a plurality of weights. Each weight of the plurality of weights may include an interconnection mechanism operable between an engaged configuration and a disengaged configuration to selectively couple the weight to the handle assembly. In the engaged configuration, the interconnection mechanism may couple the weight to the handle assembly via the handle weight or another weight coupled to the handle weight. In the disengaged configuration, the weight may be decoupled from the handle assembly. Each weight of the plurality of weights may include a recess to at least partially receive the interconnection mechanism of an adjacent weight. The interconnection mechanism may include a pawl sprung to a first position to engage a notch of the handle weight or the another weight coupled to the handle weight. The interconnection mechanism may include a pair of pawls operable to engage respective notches of the handle weight or the another weight coupled to the handle weight.

The interconnection mechanism may include a lock member positioned between the pair of pawls and movable between a first position and a second position. In the first position, the lock member may prevent the pawls from moving inward to couple the weight to the handle weight or the another weight coupled to the handle weight. In the second position, the lock member may allow the pawls to collapse inward to decouple the weight from the handle weight or the another weight coupled to the handle weight. The adjustable dumbbell may include a slide coupled to the lock member to slide the lock member between the first and second positions. The adjustable dumbbell may include a spring biasing the lock member to the first position.

Another aspect of the disclosure relates to an adjustable dumbbell including a handle assembly including a handle weight, and a plurality of weights. Each weight may include an interconnection mechanism operable between an engaged configuration and a disengaged configuration to selectively couple the weight to the handle assembly. In the engaged configuration, the interconnection mechanism may couple the weight to the handle assembly via the handle weight or another weight coupled to the handle weight. In the disengaged configuration, the weight may be decoupled from the handle assembly.

In some embodiments, each weight includes a recess to at least partially receive the interconnection mechanism of an adjacent weight.

In some embodiments, the interconnection mechanism includes a pawl sprung to a first position to engage a notch of the handle weight or the another weight coupled to the handle weight. The pawl may be ramped in both directions to facilitate engagement with and disengagement from the notch.

In some embodiments, the interconnection mechanism includes a pair of pawls operable to engage respective notches of the handle weight or the another weight coupled to the handle weight, and a lock member positioned between the pair of pawls and movable between a first position and a second position. In the first position, the lock member prevents the pawls from moving inward to couple the weight to the handle weight or the another weight coupled to the handle weight. In the second position, the lock member allows the pawls to collapse inward to decouple the weight from the handle weight or the another weight coupled to the handle weight. The lock member may include a wedge. The lock member may include a linkage coupled to the pawls. The first position includes an over-center configuration of the linkage. The adjustable dumbbell may include a slide coupled to the lock member to slide the lock member between the first and second positions. The adjustable dumbbell may include a spring biasing the lock member to the first position.

Another aspect of the disclosure relates to an adjustable dumbbell including a handle assembly, a first weight, and a second weight. The handle assembly may include a central axis. The first weight may include a first body and a first disc rotatably coupled to the first body. The first disc may include a first flange extending at least partially around the first disc, the first flange defining an interior region and an opening to the interior region. The first disc may include a pocket defined by a second flange. The second weight may include a second body, a tab extending from the second body, a key extending from the second body, and a second disc rotatably coupled to the second body, with the key positionable within the pocket. When the key is positioned in the pocket, the key may be rotatable about the central axis to rotate the first disc between a retaining position and a releasing position. In the retaining position, the first flange may engage the tab to provide an engagement for lifting the second weight with the first weight. In the releasing position, the tab may be aligned with the opening to decouple the second weight from the first weight.

In some embodiments, the lateral opening defines less than a 90-degree window where the tab can exit a flange profile of the first flange.

In some embodiments, the pocket is aligned with the opening to receive the key through the opening.

In some embodiments, the tab is positioned between the second disc and a bottom of the second weight.

In some embodiments, the first flange extends circumferentially along a perimeter of the first disc.

In some embodiments, the second weight includes a third disc rotatably coupled to the second body. The third disc may include a third flange extending at least partially around the third disc, the third flange defining a second interior region and a second opening to the second interior region. The third disc may include a second pocket defined by a fourth flange. In some embodiments, the adjustable dumbbell includes a third weight. The third weight may include a third body, a second tab extending from the third body, a second key extending from the third body, and a fourth disc rotatably coupled to the third body, with the second key positionable within the second pocket. When the second key is positioned in the second pocket, the second key may be rotatable with the key about the central axis to rotate the third disc between a retaining position and a releasing position. In the retaining position, the third flange may engage the second tab to provide an engagement for lifting the third weight with the second weight. In the releasing position, the second tab may be aligned with the second opening to decouple the third weight from the second weight.

Another aspect of the disclosure relates to a dumbbell system including an adjustable dumbbell and a base configured to receive the adjustable dumbbell. The adjustable dumbbell may include a handle assembly defining a central axis. The adjustable dumbbell may include a first weight including a rotatable first disc. The first disc may include a first flange extending at least partially around the first disc, the first flange defining an interior region and an opening to the interior region. The first disc may include a second flange defining a pocket. The adjustable dumbbell may include a second weight. The second weight may include a rotatable second disc including a key positionable within the pocket and rotatable about the central axis. The second weight may include a tab adjacent the second disc. The base may include a weight selector assembly configured to rotate the second disc. When the key is positioned in the pocket, the key may engage the second flange to rotate the first disc, via the weight selector assembly, between a retaining position and a releasing position. In the retaining position, the first flange may engage the tab to provide an engagement for lifting the second weight with the first weight. In the releasing position, the tab may be aligned with the lateral opening to decouple the second weight from the first weight.

In some embodiments, the second weight includes a first gear coupled to the second disc. In some embodiments, the weight selector assembly includes a second gear configured to rotate the first gear.

In some embodiments, the dumbbell system includes a first weight stack and a second weight stack. The weight selector assembly may include a first gear train on a first side of the base and configured to adjust the first weight stack. The weight selector assembly may include a second gear train on a second side of the base and configured to adjust the second weight stack. In some embodiments, the weight selector assembly includes a shaft extending from the first gear train to the second gear train. In some embodiments, operation of the second gear train is tied to operation of the first gear train via the shaft to tie adjustment of the first weight stack with adjustment of the second weight stack. In some embodiments, the dumbbell system includes a pawl to selectively engage the first gear train. When the handle assembly is removed from the base, the weight selector assembly may be locked by the pawl to limit a loss of weight selection synchronization between the handle assembly and the base.

Another aspect of the disclosure relates to an adjustable dumbbell including a handle assembly and a weight plate. The handle assembly may include a central axis and a rotatable handle disc including a pocket and a flange extending at least partially around the handle disc, the flange defining an interior region and an opening to the interior region. The weight plate may include a rotatable inner disc comprising a key positionable within the pocket, and a tab adjacent the inner disc. When the key is positioned in the pocket, the key may be rotatable about the central axis to rotate the handle disc between a retaining position and a releasing position. In the retaining position, the flange may engage the tab to provide an engagement for lifting the weight plate with the handle assembly. In the releasing position, the tab may be aligned with the opening to decouple the weight plate from the handle assembly.

In some embodiments, the weight plate is a first weight plate and includes a rotatable outer disc comprising a second pocket and a second flange extending at least partially around the outer disc, the second flange defining a second interior region and a second opening to the second interior region. In some embodiments, the adjustable dumbbell includes a second weight plate, including a rotatable inner disc including a second key positionable within the second pocket, and a second tab adjacent the inner disc. When the second key is positioned in the second pocket, the second key may be rotatable about the central axis to rotate the outer disc between a retaining position and a releasing position. In the retaining position, the second flange may engage the second tab to provide an engagement for lifting the second weight plate with the first weight plate. In the releasing position, the second tab may be aligned with the opening to decouple the second weight plate from the first weight plate.

In some embodiments, the adjustable dumbbell includes an end plate operable to rotate the key in response to an adjustment of a weight selector assembly.

In some embodiments, the adjustable dumbbell includes a selector disc coupled to rotate with the handle disc. In some embodiments, the adjustable dumbbell includes at least one handle weight selectively coupled to the selector disc. In some embodiments, the selector disc includes a plurality of tabs that selectively engage the at least one handle weight based on a rotational position of the selector disc relative to the at least one handle weight.

In some embodiments, the adjustable dumbbell includes a base including a weight selector assembly. In some embodiments, the adjustable dumbbell includes a weight stack. The weight selector assembly may include a gear train configured to adjust the weight stack when the adjustable dumbbell is positioned on the base. In some embodiments, the adjustable dumbbell includes a pawl to selectively engage the gear train. When the adjustable dumbbell is removed from the base, the weight selector assembly may be locked by the pawl to limit a loss of weight selection synchronization between the adjustable dumbbell and the base. In some embodiments, the adjustable dumbbell includes a first weight stack and a second weight stack. In some embodiments, the weight selector assembly includes a first gear train configured to adjust the first weight stack, and a second gear train configured to adjust the second weight stack. In some embodiments, the adjustable dumbbell includes a shaft extending from the first gear train to the second gear train to tie adjustment of the first weight stack with adjustment of the second weight stack.

Another aspect of the disclosure relates to an adjustable dumbbell including a first weight, a second weight, and a key structure to selectively couple the first weight to the second weight. The key structure may include a first disc configured to rotate about a first axis, the first disc including a flange and a pocket, the pocket defined at a peripheral edge of the first disc. The key structure may include a second disc configured to rotate about a second axis, the second disc including a key offset laterally from the second axis and positioned within the pocket to engage the flange. A rotation of the key about the second axis may rotate the first disc about the first axis.

In some embodiments, the rotation of the key about the second axis rotates the first disc between a retaining position and a releasing position. In the retaining position, the flange may engage a tab of one of the first weight or the second weight to couple the first weight to the second weight. In the releasing position, the flange may disengage the tab to decouple the first weight from the first weight. In some embodiments, in the retaining position, the flange engages the tab to provide an engagement for lifting the one of the first weight or the second weight with the other of the first weight or the second weight.

In some embodiments, the first and second axes are aligned coaxially when the first and second weights are coupled together.

Another aspect of the disclosure relates to a weight for an adjustable dumbbell. The weight may include a body defining an aperture having a central axis. The weight may include a first disc coupled to a first side of the body to rotate about the central axis, the first disc including a key offset laterally from the central axis. The weight may include a second disc coupled to an opposite second side of the body to rotate about the central axis, the second disc including a pocket at a peripheral edge of the second disc. The pocket may be configured to receive the key of an adjacent weight when positioned in a weight stack with the adjacent weight.

In some embodiments, the second disc includes a flange configured to selectively engage a tab of the adjacent weight to provide an engagement for lifting the adjacent weight with the weight. In some embodiments, the second disc is rotatable about the central axis between a retaining position and a releasing position. In the retaining position, the flange may engage the tab to couple the weight to the adjacent weight. In the releasing position, the flange may disengage the tab to decouple the weight from the adjacent weight.

In some embodiments, the first disc is an outer disc, and the second disc is an inner disc.

Another aspect of the present disclosure relates to a dumbbell system, including: a dumbbell including a handle coupled to a handle weight; a base including a weight selector assembly coupled to the base and a plurality of weights, each of the weights including: a weight body and a weight interconnection mechanism operable between an engaged configuration and a disengaged configuration by operation of the weight selector assembly; wherein in the engaged configuration, the weight interconnection mechanism couples the weight body to the handle via the handle weight or via another weight body of the plurality of weights coupled to the handle weight; and wherein in the disengaged configuration, the weight body is decoupled from the handle.

In some embodiments, the weight selector assembly includes a cam shaft having a length extending along and offset from the handle, the cam shaft includes a plurality of cam surfaces spaced along the length, the cam shaft is axially rotatable, and in response to rotation of the cam shaft, a cam surface of the plurality of cam surfaces transitions the weight selector mechanism of a respective weight between the disengaged configuration and the engaged configuration.

In some embodiments, the weight interconnection mechanism includes a pawl movable relative to a recess between the engaged configuration and the disengaged configuration. In some embodiments, each cam surface of the plurality of cam surfaces is configured to come into contact with a pawl of the plurality of weights to move the pawl between the engaged configuration and the disengaged configuration.

In some embodiments, the system may further comprise an input member coupled to the base and operable to axially rotate the cam shaft.

In some embodiments, a motor is coupled to the base and operable to axially rotate the cam shaft.

In some embodiments, each weight body of the plurality of weights includes a first undercut interlock configured to engage a corresponding second undercut interlock of the another weight body or a corresponding second undercut interlock of the handle weight. The first undercut interlock of each weight body of the plurality of weights may axially and laterally restrain movement of the weight body relative to the corresponding second undercut interlock of the another weight body or the corresponding second undercut interlock of the handle weight.

Another aspect of the disclosure relates to a weighted bar system, including: a handle assembly; a plurality of weights, each weight of the plurality of weights including: a first side including at least one recess; and a second side including at least one pawl configured to be received by at least one adjacent recess on an adjacent first side of an adjacent weight of the plurality of weights or on a side of the handle assembly; wherein the at least one pawl is movable relative to the at least one adjacent recess of the adjacent weight between: a first position wherein the weight is liftable away from a support surface via the handle assembly; and a second position wherein the weight remains on the support surface in response to lifting the handle assembly away from the support surface.

In some embodiments, each weight of the plurality of weights further includes at least one second pawl configured to be received by at least one second recess on the adjacent first side of the adjacent weight of the plurality of weights or on the side of the handle assembly. In some embodiments, the at least one pawl is movable into contact with the at least one second pawl to move the at least one second pawl relative to the at least one second recess.

In some embodiments, the at least one pawl is biased toward the second position.

In some embodiments, a weight selector assembly is included which includes a cam shaft rotatable between a first rotated position and a second rotated position, wherein in the first rotated position a cam surface actuates the at least one pawl to the first position, and wherein in the second rotated position, the cam surface is out of contact with the at least one pawl.

In some embodiments, each weight of the plurality of weights includes a first dovetail surface configured to engage a second corresponding dovetail surface of the adjacent weight of the plurality of weights or a corresponding second dovetail surface of the side of the handle assembly.

In some embodiments, the at least one pawl is positioned within a compartment in the weight.

Another aspect of the disclosure relates to an adjustable dumbbell, including: a handle assembly; a weight selector mechanism including a cam surface, the cam surface having a first portion having a first radius and a second portion having a second radius, the first radius being greater than the second radius; a weight including a cam follower, the cam follower including an interlock portion and an end portion, the end portion extending into contact with the cam surface; wherein with the first portion of the cam surface contacting the end portion of the cam follower, the interlock portion attaches the weight to the handle assembly; and wherein with the second portion of the cam surface contacting the end portion of the cam follower or out of contact with the cam follower, the weight is detached from the handle assembly.

In some embodiments, the weight selector mechanism is positioned in a base platform.

In some embodiments, with the first portion of the cam surface contacting the tip portion of the cam follower, a recess of the handle assembly receives the interlock portion of the cam follower.

In some embodiments, the cam follower is biased toward the cam surface.

In some embodiments, the cam surface is rotatable about an axis offset from a central longitudinal axis of the handle assembly.

In some embodiments, the cam surface includes a plurality of circumferentially spaced apart portions having a plurality of radii, with the plurality of radii including the first radius and the second radius.

Another aspect of the disclosure relates to a weighted bar system, including: a handle coupled to a handle weight; a plurality of main weights, each of the main weights including: a weight body and a weight selector mechanism operable between an engaged configuration and a disengaged configuration; wherein in the engaged configuration, the weight selector mechanism couples the weight body to the handle via the handle weight or via another weight body of the plurality of main weights coupled to the handle weight; and wherein in the disengaged configuration, the weight body is decoupled from the handle; and a weight selector assembly including: a cam shaft having a length extending along and offset from the handle, the cam shaft including a plurality of cam surfaces spaced along the length, the cam shaft being axially rotatable; wherein in response to rotation of the elongated shaft, a cam surface of the plurality of cam surfaces transitions the weight selector mechanism of a respective main weight between the disengaged configuration and the engaged configuration.

Another aspect of the disclosure relates to an adjustable exercise weight, including: a handle tube having a central axis; a plurality of weights, each weight of the plurality of weights having an aperture; a rod positioned within the handle tube and including an outer surface defining a helical path; and a follower rotatably coupled with the handle tube and engaging the outer surface of the rod on the helical path; wherein in response to axial rotation of the handle tube, the follower rotates about the central axis and drives axial translation of the rod relative to the handle tube and into at least one aperture of the plurality of weights.

In some embodiments, the weight further includes: an outer gear coupled with the handle tube; at least one planet gear enmeshed with the outer gear; and a sun gear; wherein the follower is positioned on the sun gear; and wherein axial rotation of the handle tube drives axial rotation of the sun gear via the outer gear and via the at least one planet gear.

In some embodiments, the plurality of weights includes a first weight and a second weight, the first weight being coupleable to the second weight via a protrusion of the first weight nested within a recess of the second weight.

In some embodiments, contact between the protrusion and the recess prevents axial movement of the first weight relative to the second weight.

In some embodiments, the helical path includes a plurality of angled portions and a plurality of straight portions.

In some embodiments, the adjustable exercise weight further includes a detent mechanism including at least one follower and a plurality of detent recesses, wherein the plurality of detent recesses includes a detent recess for each of the plurality of angled portions and for each of the plurality of straight portions.

In some embodiments, the helical path includes one angled portion and one straight portion for each weight of the plurality of weights.

In some embodiments, the rod axially translates in response to movement of the follower along the plurality of angled portions and the rod is axially stationary in response to movement of the follower along the plurality of straight portions.

In some embodiments, the adjustable exercise weight further includes at least one supplemental weight, wherein for each of the plurality of straight portions of the helical path, the follower is movable between a first position and a second position, wherein: with the follower in the first position of the straight portion, the at least one supplemental weight is coupled with the handle tube; and with the follower in the second position of the straight portion, the at least one supplemental weight is decoupled from the handle tube.

In some embodiments, the aperture is centrally located on each weight.

In some embodiments, the rod includes a substantially rectangular cross-section.

In some embodiments, the adjustable exercise weight further includes a base assembly receiving the plurality of weights, with the base assembly including a selector mechanism operable to rotate the follower in response to rotation of a selector handle extending from the base assembly.

Another aspect of the disclosure relates to an adjustable dumbbell, including: a handle assembly; a first weight plate including a first side including a protrusion and a first pair of undercut surfaces defined on opposite sides of the protrusion; and a second weight plate including a second side defining a recess and a second pair of undercut surfaces defined on opposite sides of the recess, wherein the first pair of undercut surfaces engage the second pair of undercut surfaces.

In some embodiments, the protrusion defines a first substantially trapezoidal cross-section with the first side and the recess defines a second substantially trapezoidal cross-section with the second side.

In some embodiments, the protrusion is defined on an at least partially downward-facing portion of the first side of the first weight plate, and the recess is defined on at least partially upward-facing portion of the second side of the second weight plate.

In some embodiments, the first side of the first weight includes a second recess and a third pair of undercut surfaces defined on opposite sides of the second recess; the second side of the second weight includes a second protrusion and a fourth pair of undercut surfaces defined on opposite sides of the second protrusion; and the third pair of undercut surfaces is engageable with the fourth pair of undercut surfaces when the first pair of undercut surfaces engages the second pair of undercut surfaces.

In some embodiments, the first pair of undercut surfaces is nestable with the second pair of undercut surfaces in response to lateral movement of the first weight plate relative to the second weight plate.

In some embodiments, at least the first weight plate includes a third side positioned opposite the first side and defining a third undercut surface.

In some embodiments, an upper portion of the first side is angled relative to a central portion of the first side in a first direction and a lower portion of the first side is angled relative to the central portion in a second direction, with the first direction being opposite the second direction.

In some embodiments, the dumbbell further includes a shaft axially translatable through the first weight plate and through the second weight plate. In some embodiments, each of the first weight plate and the second weight plate comprise a non-circular aperture through which the shaft is positionable.

In some embodiments, the first pair of undercut surfaces and the second pair of undercut surfaces axially retain the first weight plate to the second weight plate.

In some embodiments, the first pair of undercut surfaces and the second pair of undercut surfaces have a common line of symmetry.

Another aspect of the disclosure relates to an adjustable exercise weight, including: a handle assembly including a central axis; a first weight including: a first weight body coupled to the handle assembly; and a key extending radially relative to the central axis of the handle assembly; a second weight including: a second weight body defining a sidewall and a lateral opening through the sidewall; and a retainer rotatably coupled with the second weight body within the sidewall and defining a slot; wherein, when the key is positioned in the slot, the key is rotatable about the central axis to rotate the retainer between a releasing position and a retaining position; wherein in the releasing position, the slot of the retainer opens to the lateral opening of the second weight body and the key is removable from the second weight; and wherein in the retaining position, the slot of the retainer opens to the sidewall of the second weight body and the key is retained in the second weight.

In some embodiments, the lateral opening is in an upper end of the second weight body.

In some embodiments, the sidewall is substantially circular.

In some embodiments, the slot opens on two opposite sides of the retainer.

In some embodiments, the slot opens on only one side of the retainer.

In some embodiments, the first weight further includes: a first side from which the key axially extends; and a first undercut surface extending from the first side; and the second weight further includes: a second side from which the sidewall axially extends; and a second undercut surface extending from the second side, and the first undercut surface is engageable with the second undercut surface.

In some embodiments, the key includes a radial portion extending radially from the central axis and a longitudinal portion extending along the central axis and positioned at a radially outer end of the radial portion.

In some embodiments, the second weight body further includes a second key extending radially relative to the central axis of the handle assembly.

In some embodiments, the second key is angularly offset from the key of the first weight relative to the central axis.

In some embodiments, the adjustable exercise weight may further comprise: a third weight including: a third weight body defining a second sidewall and a second lateral opening through the second sidewall; and a second retainer rotatably coupled with the third weight body within the second sidewall and defining a second slot; wherein the second key is operable to rotate the second retainer.

In some embodiments, the adjustable exercise weight may further comprise a base assembly supporting the handle assembly and including a selector handle and a mechanism operable to rotate the key of the first weight in response to rotation of the selector handle.

Another aspect of the present disclosure relates to an adjustable weight bar, including: a handle bar having a central axis; a main weight including a selector key; a first rotor rotationally coupled to the handle bar and including a first drive surface and a first set of ramped protrusions circumferentially spaced around the first rotor; a second rotor rotationally coupled to the selector key and including a second drive surface; and a ramp ring including a second set of ramped protrusions circumferentially spaced around the ramp ring, the second set of ramped protrusions being biased toward the first set of ramped protrusions; wherein rotation of the handle bar about the central axis rotates the first rotor between a decoupled position and a coupled position; wherein in the decoupled position, at least one ramped protrusion of the first set of ramped protrusions engages at least one ramped protrusion of the second set of ramped protrusions and the first drive surface is out of contact with the second drive surface; and wherein in the coupled position, the first set of ramped protrusions is out of contact with the second set of ramped protrusions and the first drive surface is in contact with the second drive surface.

In some embodiments, the adjustable weight bar further includes a second weight having an engagement surface; wherein the first rotor includes a set of tabs circumferentially spaced around the first rotor; and wherein the first rotor is rotatable between a first angular position with the engagement surface supported by the a tab of the set of tabs and a second angular position with the engagement surface positioned in a gap between two tabs of the set of tabs.

In some embodiments, in response to rotation of the first rotor from the decoupled position to the coupled position, or vice versa, the ramp ring and second rotor are displaced along the central axis relative to the first rotor.

In some embodiments, the first rotor is rotatable to a third position, wherein the first drive surface remains in contact with the second drive surface as the first rotor rotates from the coupled position to the third position.

In some embodiments, the first rotor is rotatable to a third position, wherein the first drive surface remains out of contact with the second drive surface as the first rotor rotates from the decoupled position to the third position.

In some embodiments, the adjustable weight bar includes a biased pin, wherein an outer surface of the first rotor or the second rotor includes a set of spaced apart ramped detents, and wherein the outer surface is biased by the biased pin toward a position wherein the biased pin is seated in one of the set of spaced apart ramped detents.

In some embodiments, the adjustable weight bar further includes a second weight and a selector plate rotatably mounted to the second weight, wherein the selector plate includes a slot, wherein the selector key is positioned in the slot and is rotatable between a first position wherein the selector key is removable from the slot in an upward direction and a second position wherein the selector key is prevented from removal from the slot in the upward direction.

Another aspect of the disclosure relates to an adjustable dumbbell system, including: a handle assembly; a set of weights, each weight of the set of weights including: a weight body having a dovetail interface; and a rotor including a retainer recess and a key, the rotor being rotatable relative to the weight body; wherein the key of a first weight of the set of weights is received in the retainer recess of a second weight of the set of weights and is rotatable between a locked position in which the first weight is not laterally removable from the second weight and an unlocked position in which the first weight is laterally removable from the second weight; and wherein the first weight is axially coupled with the second weight via the dovetail interface of the first weight being coupled with the dovetail interface of the second weight.

In some embodiments, the key of the second weight is angularly offset from the key of the first weight relative to an axis of rotation of the rotors of the first weight and the second weight. In some embodiments, the key of the second weight is received in the retainer recess of a third weight of the set of weights and is rotatable between a locked position in which the second weight is not laterally removable from the third weight and an unlocked position in which the second weight is laterally removable from the third weight. In some embodiments, the unlocked position of the key of the second weight corresponds to the locked position of the key of the first weight.

In some embodiments, the dovetail interface includes a dovetailed protrusion and a dovetailed recess, wherein the dovetailed protrusion of the first weight is configured to be received by the dovetailed recess of the second weight.

In some embodiments, the dovetail interface of the first weight is laterally mountable with the dovetail interface of the second weight.

Another aspect of the disclosure relates to an adjustable dumbbell having any combination of features disclosed herein.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 80B is an end view of the weight assembly of FIG. 79 and illustrates the interconnection mechanism in a second configuration.

FIG. 81 is an isometric view of another weight assembly of the dumbbell system of FIG. 75.

FIG. 82A is a partial isometric view of another interconnection mechanism in a first configuration.

FIG. 82B is a partial isometric view of the interconnection mechanism of FIG. 82A in a second configuration.

Figure 1:
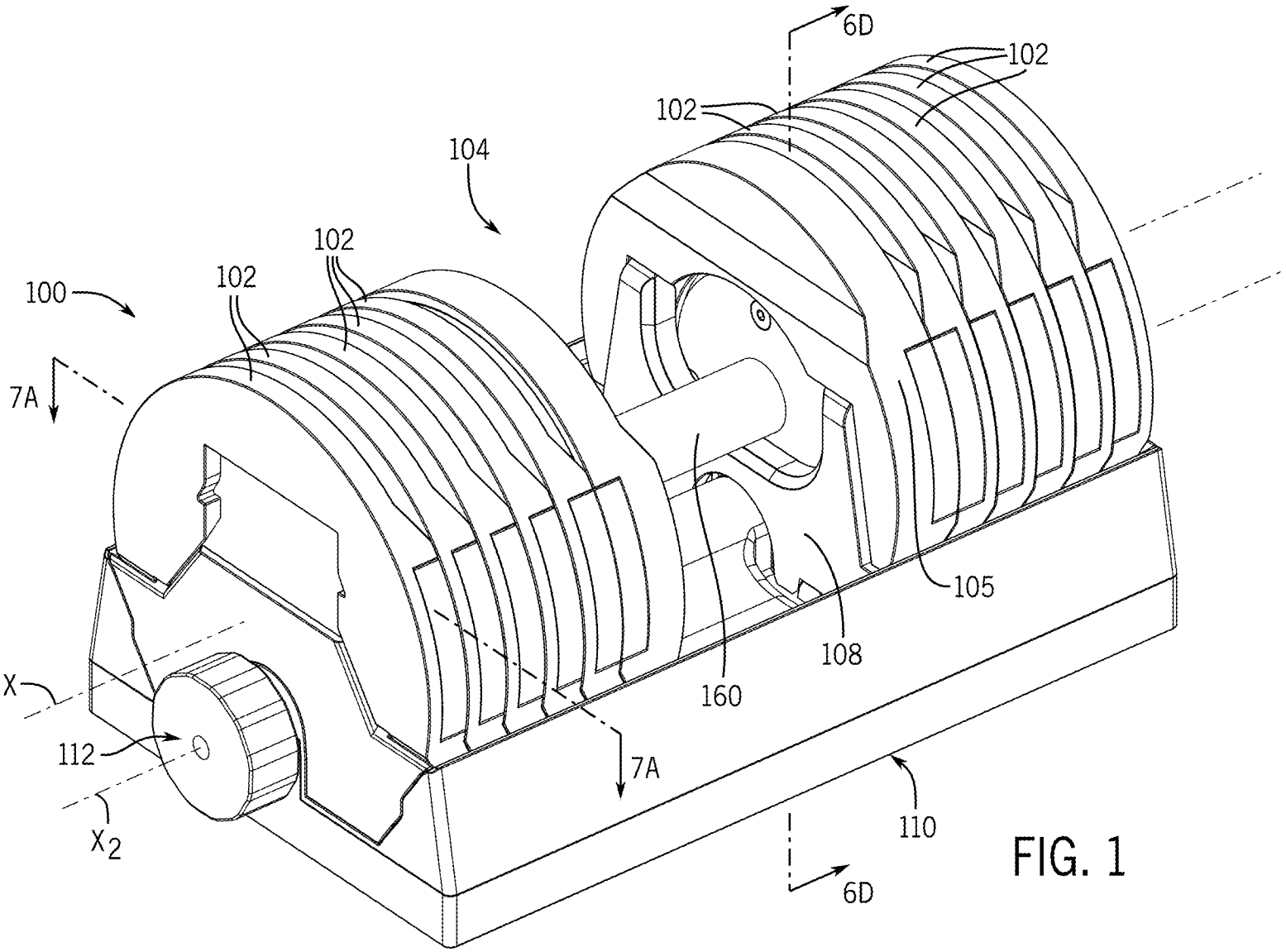
FIG. 1 is an isometric view of an adjustable dumbbell system.

The drawings are not necessarily to scale. In certain instances, details unnecessary for understanding the disclosure or rendering other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The claimed subject matter is not necessarily limited to the particular examples or arrangements illustrated herein.

DETAILED DESCRIPTION

The present disclosure provides adjustable free weight systems, such as for example exercise weights or weighted bars. The exercise weights or weighted bars may include adjustable dumbbell systems or adjustable barbell systems, which allow a user to select and control the mass, load, or resistance of the equipment by selectively attaching or detaching weight assemblies (e.g., plates or weights) to and from a grip or handle assembly. The handle assembly may have a weight selector mechanism that is configured to engage with the weights and allow one or more weights on each side of the handle assembly to be selected, thus changing the overall load of the dumbbell system when the handle assembly is lifted away from a base station or other excess weight storage platform.

In some example embodiments, the weight selector mechanism may be positioned in and coupled to the base. The handle may be removable from the base independent of all or part of the weight selector mechanism. In one example, the handle may be removable by being liftable away from or separable from the base. In another example, the weight selector mechanism may comprise a cam shaft coupled to the base platform and configured to rotate to attach or detach individual weight assemblies to and from the handle. In some embodiments, the weight selector mechanism may be manually operated via a handle or other input member, and in some embodiments, the weight selector mechanism can be motorized via operation of a motor positioned on the base. These configurations may help minimize bulk and excess load that must be carried with the handle by the user while exercising.

In some example embodiments, the attachable weights can be attached to the handle assembly via at least one movable pawl being received in a recess in an adjacent weight or handle assembly portion. For example, each weight may include a first side including at least one recess and a second side including at least one pawl configured to be received by a recess on an adjacent weight of the set of weights or on the handle assembly. When the pawl is moved into a position received in a recess, the weight is secured to the adjacent weight via the pawl, and the weight is vertically liftable along with the adjacent weight attached to it. When the pawl is moved out of the recess, the weight is released from the adjacent weight, and vertically lifting the weight does not also lift the adjacent weight. Thus, the pawl and recess interface can selectively or optionally secure one weight to another (or to the handle assembly) in a lateral or radial direction.

A plate can be axially secured to an adjacent plate or to the handle assembly by a set of interlocking or nesting surfaces (e.g., undercut surfaces or dovetailed surfaces) that may be formed on a protrusion on one weight and on a corresponding recess on another plate. When the weights are assembled and brought together (e.g., via a lateral movement of one weight relative to another), a protrusion on one weight is inserted into a recess on another plate, and the interlocking surfaces hold the plates together in the axial direction. In some embodiments, the interlocking surfaces include corresponding pairs of undercut surfaces relative to the sides or axial faces of the weights. These pairs of surfaces can help make the assembled weights feel more solid, with less wobble and noise when the assembled weights are shaken or jiggled. As used herein, a surface is "undercut" when, relative to another nearby surface, the undercut surface is at least partially oriented along an axis parallel to the nearby surface. Thus, an undercut surface can at least partially overhang another nearby surface, or an undercut surface can be at least partially behind or underneath the other nearby surface. Generally, undercut surfaces described herein are undercut relative to an axially-facing surface on a side of a weight of an adjustable dumbbell system.

Some embodiments can include a set of weights that are supplemental to the other weights, such as by being lighter or more compact than the main weights attachable to the handle assembly. For example, a weight selector mechanism may be implemented with a cam surface to selectively engage and disengage a weight based on the positioning of a cam follower on the weight that is biased into contact with the cam surface. When the cam surface is in one position, the cam follower may extend and interlock the weight to the handle assembly. When the cam surface is in a second position, the cam follower may be depressed or retracted, and the weight is detached from the handle assembly.

In some embodiments, the adjustable exercise weight can include a handle tube with a rod positioned therein, and the rod may have an outer surface defining a helical path. The handle tube may be rotatably coupled with a follower that engages the outer surface of the rod on the path. As the handle tube axially rotates, the follower rotates with the handle tube and drives axial translation of the rod relative to the handle tube. The axial position of the rod can extend into apertures extending through a plurality of weights, and the axial position of the end of the rod may therefore determine how many of the weights are coupled to the handle tube and how many remain decoupled when the handle tube is lifted away from the weights.

Furthermore, in some example embodiments, each weight assembly in a set thereof may include a key that extends radially from a central axis of the weight. The key can be laterally inserted into a slot in a retainer, such as for example a rotor, coupled with an adjacent weight assembly. Then, while the key is in the slot, the retainer can then be rotated into another orientation wherein the key is not laterally removable from the slot. Thus, the two weights are prevented from significant lateral movement relative to each other by interference between the body of the adjacent weight and the lateral sides of the key of the first weight. These plates may also be axially retained to each other by a set of undercut surfaces or dovetail features. Thus, rotation of the retainer and/or key may attach or detach one weight to or from another weight.

In some configurations, the adjustable free weight may include a clutch system that enables a weight selector assembly to engage or disengage a supplemental weight by rotation of the handle bar while temporarily preventing rotation of the key of the weight assembly. The clutch system can include a first rotor rotationally coupled to the handle bar and having a first drive surface and a first set of ramped protrusions, a second rotor rotationally coupled to the selector key and having a second drive surface, and a ramp ring including a second set of ramped protrusions that is biased toward the first set of ramped protrusions. As the handle bar is turned, the interaction between the first and second sets of ramped protrusions selectively engages or disengages the first rotor and the second rotor, so rotation of the key (as driven by the handle bar movement) is correspondingly engaged or disengaged with the supplemental weight at predetermined angular displacement intervals or positions. This feature enables the equipment to include more incrementally attachable main weight plates while also allowing the supplemental weight to provide even smaller change increments to the overall load.

In some examples, the weight selector may be positioned within a base assembly of the system and be rotatable between a number of different positions, each position corresponding to a particular selected weight or load value. In some examples, the weight selector may engage with corresponding elements attached to the weights such as pawls.

Various examples may include a weight selector mechanism that may be embedded within the handle assembly. Accordingly, some examples may include a hollow space within the handle that may house a selector shaft that extends outward from the handle and engages with the weights. In some examples, the selector shaft may be moved by a gearing system that engages with a portion of the shaft to extend and retract the shaft based on the load or weights selected.

In numerous examples, the weight selector mechanism may be a subassembly that is connected to a portion of the handle assembly and may engage with the weights through one or more keys. According to some examples, the keys may be part of a weight assembly that may be rotated and engage with a portion of the weight based on the desired load of the adjustable dumbbell system. The keys may take on a number of different forms and may engage with the weights in a number of engagement structures.

Additionally, various combinations of the above-indicated features can be implemented together in a single embodiment, such as an adjustable weight system including selector-key-and-retainer features and also a clutch system for controlling the coupling of auxiliary/supplemental weights. Similarly, in a single embodiment, a pawl-and-recess linking assembly can be used in conjunction with pairs of undercut surfaces on weight assemblies to retain weights to each other in a chain-like, successive, interlinking manner. Furthermore, many examples can include a detent subsystem or detent features operable to bias the rotation of the weight selector or rotatable handle into positions optimized for retaining different sets of weights before the dumbbell system is lifted from a base or lifted away from decoupled weight plates. In some embodiments, the handle can be locked to a base or platform unless the weight selector mechanism has appropriately retained individual weights to the handle, in which case the handle can be unlocked and movable from the base or platform.

Turning now to the drawings, many embodiments disclosed herein include an adjustable dumbbell system that may have a number of different components that cooperatively engage in order to allow the sequential selection of weights. The weights may be adjusted from a number of different increments, including 2.5 pounds, 5 pounds, 10 pounds, etc., and may also be relatively small in size in the adjustable weight assembly. The size of the weight bar can be minimized due to only being as long as the necessary number of weight plates required to attain a particular load for the desired workout resistance.

As used herein, a "weight" refers to an object or device (e.g., a plate or related assembly built onto the plate) moved for resistance exercising, such as for example weightlifting or other resistance training. A "load" or "weighting" of a weight or assembly refers to a property of the weight that represents its resistance to being moved due to gravity acting on the object (e.g., the mass of the object multiplied by earth's gravitational constant (e.g., in pounds) or simply its mass (e.g., in grams)). A "weighted" object refers to an object which has had its weighting or mass intentionally increased or supplemented, such as, for example, by adding one or more weights to the bar. Thus, a weighted dumbbell is a dumbbell with at least one weight coupled to it.

Adjustable weighted bars of the present disclosure can include assemblies such as, for example, adjustably weighted dumbbells or adjustably weighted barbells (e.g., Olympic bars, powerlifter bars, trap bars, hex bars, Swiss bars, safety squat bars, curl bars, arched or cambered bars, log bars, etc.). The adjustable weighted bars can be attachable to sets of weights (e.g., weight plates or weight assemblies) on each end of the central handle assembly or handle bar of the systems of the present disclosure.

FIG. 1, for example, illustrates an adjustable dumbbell system 100 with a group of separate main weights 102, such as for example main weight plates or main weight assemblies, that may be selectively coupled to a handle assembly 104 to adjust the mass of the handle assembly 104 when it is lifted away from a base assembly 110. In some examples a base assembly may be a platform or tray assembly. The base assembly 110 may include a weight selector assembly 112 operable to selectively attach or detach main weights from the handle assembly 104. Additionally, in some embodiments at least one supplemental or auxiliary weight 108 can be attachable to the handle assembly 104 in addition to, or instead of, one or more of the main weights 102.

Figure 4:
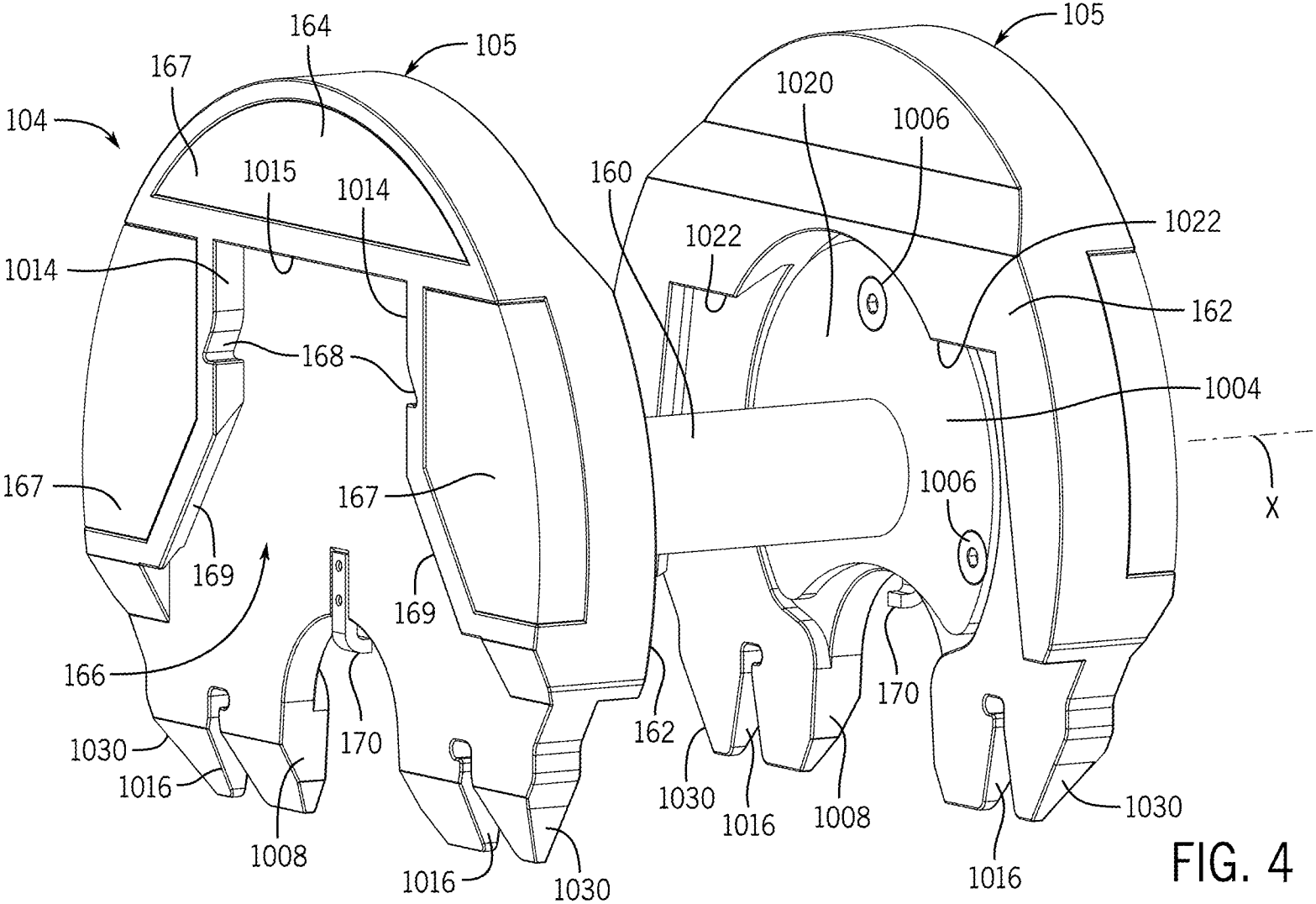
FIG. 4 is an isometric view of a handle assembly of the system of FIG. 1.

Referring now to FIG. 4, in some embodiments, the handle assembly 104 may include at least one handle weight 105 coupled with a handle 160 (such as for example a grip portion, hand grip, or handle bar). The handle weight 105 may act as a default, minimum, or primary weight for the handle assembly 104. The main weights 102 and supplemental weight 108 can be added to the handle weights 105 to increase the overall mass of the handle assembly 104. In other words, the handle weight 105 may be fixed to the handle such that when a user picks up the handle the handle weight 105 will always be retained by the handle assembly. The main weights 102 may also be removable, wherein they may or may not be selected by the user when altering the mass of the handle assembly 104. The weights 102 may vary in size and configuration. For example, some weights may be a main weight 102 that may be a subassembly of the system and may include structures and mechanisms (e.g., a weight interconnection mechanism) operable between an engaged configuration and a disengaged configuration by operation of the weight selector assembly in the base assembly 110. In an engaged configuration, the weight interconnection mechanism couples the body of the main weight 102 to the handle assembly 104 via the handle weight 105 or via another main weight 102 that is coupled (directly or in a daisy-chain-like successive, indirect manner via other main weights) with the handle assembly 104.

The supplemental weights 108 may be included to allow the user to select a variety of smaller incremental weight resistance values across an overall range of possible weight values. For example, some supplemental weights 108 (such as for example auxiliary or "add-on" weights) may weigh 1.25 pounds, allowing for 2.5-pound incremental adjustments to the handle assembly 104 by attaching or detaching the supplemental weights 108 in pairs. Some supplemental weights may be 2.5 pounds each to allow for 5-pound adjustments to the handle assembly 104. Thus, the system can include main weights 102 that are coupled to the handle assembly 104 to incrementally increase the mass of the system by 5 to 10 pounds (about 2.26 to 4.53 kilograms) per additional pair of main weights 102, and the supplemental weights 108 can be coupled the handle assembly 104 to permit selection of weights between those 5 to 10 pound (2.26 to 4.53 kilogram) intervals. The supplemental weights 108 may be coupled and decoupled from the handle assembly 104 via a different portion of the weight selector mechanism used to couple the main weights 102, or the supplemental weights 108 can be coupled and decoupled via an independent (e.g., second) weight selection system. Some examples may have supplemental weights 108 with a variety of masses to allow for many desired incremental adjustments. Likewise, the main weights 102 may vary in size to allow for a number different incremental mass or load adjustments for the dumbbell system 100.

Figure 2:
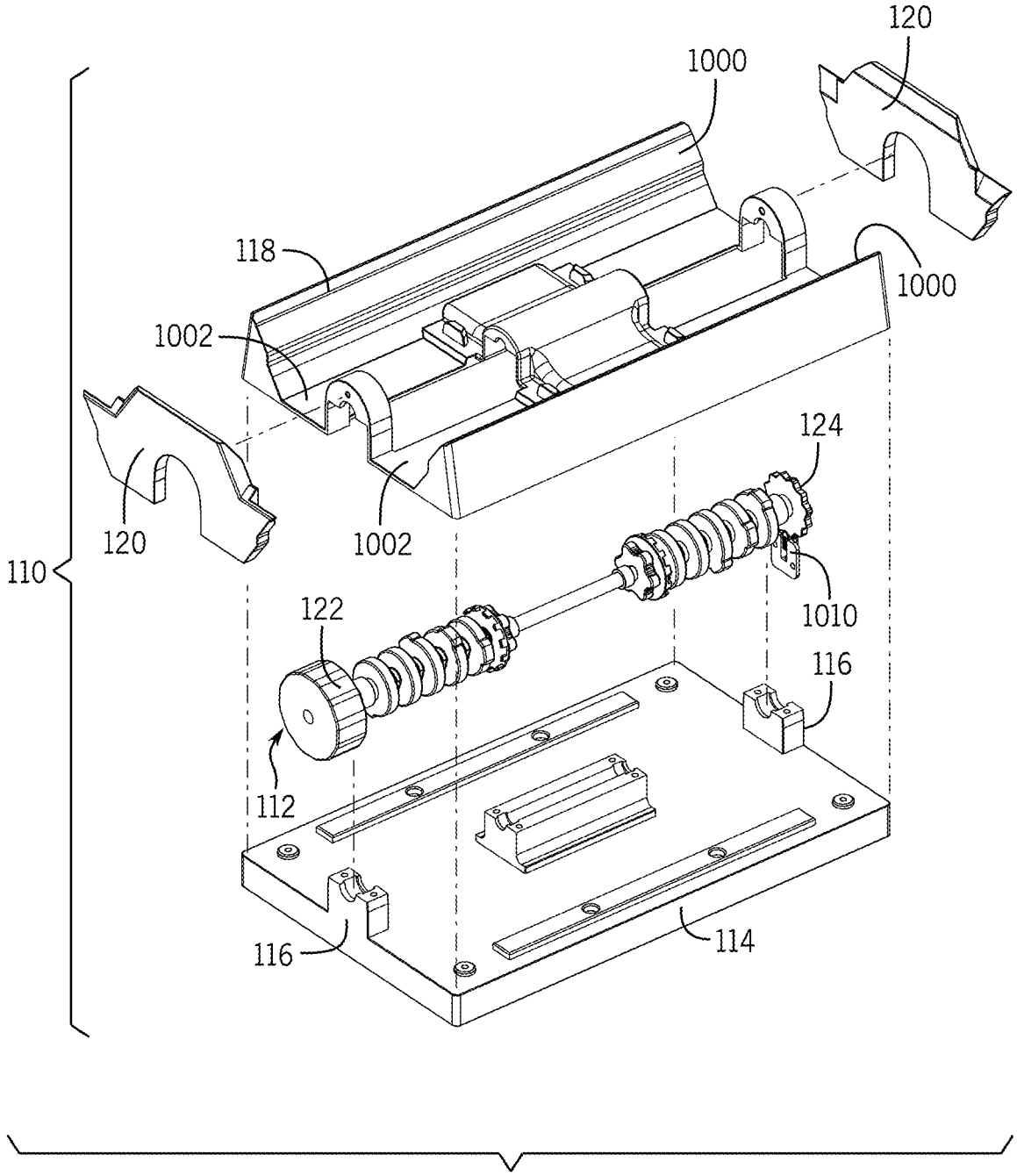
FIG. 2 is an exploded view of a base assembly of the system of FIG. 1.

The dumbbell system 100 may include a base assembly 110, which is shown in an exploded perspective view in FIG. 2. The base assembly 110 may support the handle assembly 104 and weights 102, 105, 108 using an upper housing or cover 118 with a pair of side walls 1000 and floor portions 1002 configured to engage the weights 102, 105, 108 and to hold the handle assembly 104 in place without rolling and without contacting a support surface under the base assembly 110. The upper housing or cover 118 may be mounted to a base element 114 configured to rest on a flat support surface under the base assembly 110.

Figure 3:
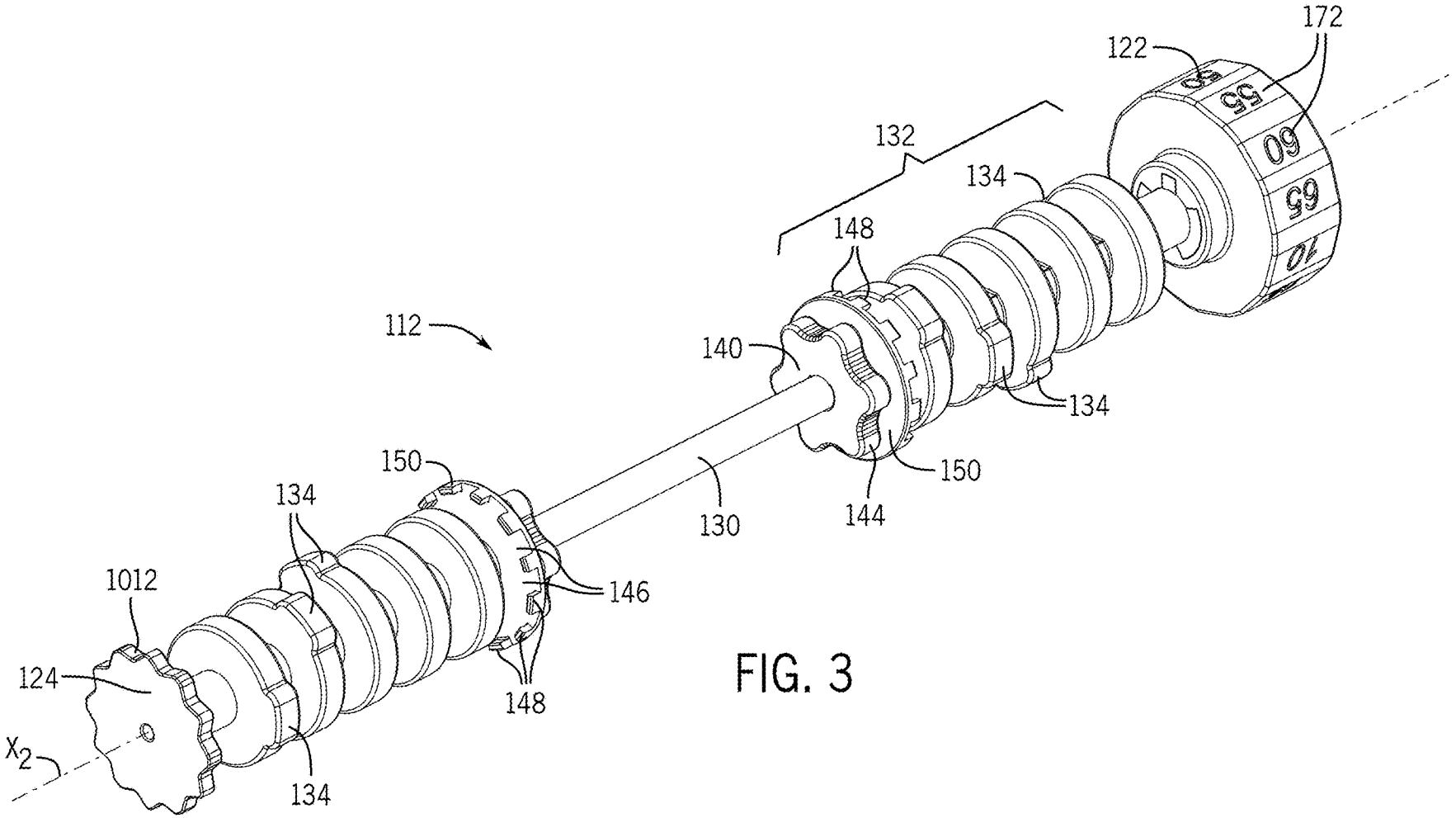
FIG. 3 is an isometric view of a weight selector assembly of the system of FIG. 1.

Some embodiments may include a weight selector assembly 112 within and at least partially contained by the base assembly 110. As shown in FIG. 3, the weight selector assembly 112 can include a cam shaft 130, a set of main cams 132 corresponding to the positions of the main weights 102, supplemental cams 140 corresponding to the positions of the supplemental weights 108, locking discs 150 (which may be integrated with the supplemental cams 140), an end gear element 124, and an input member 122. The weight selector assembly 112 may be positioned centrally below the weights 102 and handle assembly 104. Operation (e.g., rotation about a longitudinal axis) of the weight selector assembly 112 by turning the input member 122 may cause the engagement or disengagement of the weights 102, 108 with the handle assembly 104 by interaction between the cams 132, 140 and their respective weights 102, 108. The rotated position of the weight selector assembly 112 can also determine whether the handle assembly 104 is locked or released relative to the base assembly 110 via interaction between the locking discs 150 and a set of tabs 170 (see FIG. 4) on the handle assembly 104.

The base assembly 110 may include a number of different components, as illustrated in FIG. 2. For example, some embodiments may have a base element 114 for supporting the various components. The base element 114 may have one or more support portions 116 (e.g., brackets or bearings) for supporting and permitting axial rotation of the weight selector assembly 112. The support portions 116 may extend upward from the base element 114 to support the weight selector assembly 112. Base assembly 110 may also have an upper housing or cover 118 that may be configured to cover and protect portions of the weight selector 112. The upper housing or cover 118 may be secured to the base element 114 by any variety of means such as fasteners, adhesives, and/or bonding techniques. Some embodiments of the base assembly 110 may also have additional end covers 120 that may provide additional support and protection for the various components of the base assembly 110.

In many embodiments, the weight selector assembly 112 may extend across substantially the entire length of the base assembly 110. An input member 122 may be positioned at one end (as in FIG. 2) or at each opposite end of the cam shaft 130. The input member 122 (e.g., a handle, knob, crank, similar structure, or combinations thereof) may be marked with various visual or tactile indicators 172 (e.g., numbers, symbols, glyphs, tactile bumps, braille, engravings, colored portions, similar indicators, and combinations thereof) that may allow a user to discern the total amount of mass or load of the handle assembly 104 and all coupled additional weights 102, 108. The weight selector assembly 112, as will be further illustrated, may have a gear element 124 on an end opposite the input member 122. Although the gear element 124 and input member 122 are illustrated at opposite ends, in some embodiments, the gear element 124 and input member 122 may be adjacent to each other or may be part of the same subassembly that may be used to select the desired mass.

In accordance with various embodiments, the weight selector assembly 112 may take on a number of different forms and configurations in order to accommodate many different weights and/or weight assemblies. FIG. 3, for example, illustrates an embodiment of a weight selector assembly 112 that may be used in an adjustable load dumbbell system 100. The weight selector assembly 112 may be a shaft-and-cam system including a central cam shaft 130 with a number different main cams 132 that are located along the length of the cam shaft 130. The cam shaft 130 can extend along and can, in some embodiments, be parallel to, the handle 160 and its longitudinal axis X, as shown by the axis of rotation X2 indicated in FIG. 1.

In various embodiments, the main cams 132 may be positioned about spaced apart segments of the cam shaft 130, and each of the main cams 132 may be positioned to engage with a main weight 102. The main cams 132 may each define a protrusion 134 (e.g., a lobe, bump, or other similar portion having a different radius as compared to another portion of the cam 132) that may be indexed at various angles or positions of the cam shaft 130 such that the rotation of the cam shaft 130 will cause the protrusion 134 to actuate a weight interconnection mechanism (such as for example a weight coupling mechanism or weight engagement mechanism) of a main weight 102. See FIGS. 4-6D and their related descriptions below. Thus, the main weights 102 may be referred to as weight assemblies that comprise a weight body and the weight interconnection mechanism (such as for example a coupling subassembly) operable between different configurations by the weight selector assembly 112. A weight interconnection mechanism of one main weight 102 can be operated to couple a weight body of one main weight 102 to another weight 102 or 105. The rotated positions of the main cams 132 can correspond to different states of engagement or disengagement of certain main weights 102 relative to the handle assembly 104. In other words, once the protrusion 134 of a cam 132 is in a coupling position which operates the weight interconnection mechanism of a main weight 102, that main weight 102 can be coupled to the handle assembly 104 and allow the handle assembly 104 to carry the weight away from the base assembly 110 when the user lifts the handle 160 up and away from the upper housing or cover 118.

In some embodiments, the weight selector assembly 112 may include supplemental cams 140 configured to engage or disengage the supplemental weights 108 with the handle assembly 104. A supplemental cam 140 may be positioned on each end of the shaft 130, such as for example at opposite ends of the handle. Each of the supplemental cams 140 may include protrusions, lobes, or similar engagement features (e.g., 144) that may be circumferentially spaced apart around the cam 140 such that as the supplemental cam 140 rotates, the engagement features 144 may engage a supplemental weight 108 in some positions and disengage in others. See also FIGS. 8-10C and their related descriptions herein.

Referring again to FIG. 4, the handle assembly 104 may have a number of different components that are configured to engage with the weight selector assembly/mechanism 112 as well as with the main weights 102 and supplemental weights 108. For example, the handle assembly 104 may have a handle 160 connected on both ends to handle weights 105, such as via end plates 1004 and fasteners 1006. The handle weights 105 may be affixed to the handle 160, wherein they remain attached to and movable with the handle irrespective of the mass or load selected by the user. In other words, the handle assembly 104, including the handle weights 105, may have a fixed, constant load.

The handle weights 105 may provide a minimum or default load or mass for the handle assembly 104, such that the addition of the main weights 102 and/or the supplemental weights 108 may incrementally increase the weight of the system for the user from that minimum level. The handle weights 105 may each define a handle-facing side 162 (such as for example an inner axially-facing side) that faces the other handle weight 105 and between which the handle 160 may be disposed.

A bottom end of each handle weight 105 may include a recess 1008 (such as for example a central gap or arched opening) through which the cam shaft 130 of the weight selector assembly 112 can be positioned. The tabs 170 for locking the handle assembly 104 to the base assembly 110 can be positioned in or around the recess 1008 on each handle weight 105. The locking discs 150 can define a set of circumferentially spaced apart axial protrusions (e.g., 148; see FIG. 3) that are separated from each other by a set of circumferentially spaced apart gaps (e.g., 146). In some rotated positions of the weight selector assembly 112, a protrusion 148 on each disc 150 can be positioned radially between the tab 170 and the central axis X (see FIGS. 1 and 7A) of the handle 160, and the handle assembly 104 can therefore be locked to the base assembly 110 due to interference between the tabs 170 and the protrusions 148. In other rotated positions, the protrusions 148 are rotated away so that the gaps 146 are radially between the tabs 170 and the central axis X of the handle 160, in which case the handle assembly 104 is not prevented from being separated from the base assembly 110. As will be appreciated, the number and positioning of the protrusions 148 and the gaps 146 can be optimized to ensure that the handle assembly 104 is only liftable from the base assembly 110 when the main weights 102 are properly, completely coupled or decoupled to/from the handle assembly 104 to avoid unintended loading or damaging system components.

In some embodiments, the end gear element 124 can engage a cam follower or protrusion 1010 (see FIGS. 2 and 2A) that is biased into engagement with the end gear element 124 (such as for example the end cam or positional detent element) at its outer lateral surface 1012 (due to biasing member 1011 (e.g., a spring)). That radially-inward-directed biasing force applied by the protrusion 1010 and biasing member 1011 can bias the entire weight selector assembly 112 into predetermined axially rotated positions (corresponding to stable, low-potential energy positions of the protrusion 1010 relative to the end gear element 124 where the protrusion 1010 is within one of the local radial minima of the outer lateral surface 1012). Those stable positions of the protrusion 1010 relative to the outer lateral surface 1012 can correspond to the positions in which the gaps 146 are aligned with the tabs 170 on the handle assembly 104, and the unstable positions between the stable positions can correspond to positions in which the protrusions 148 are aligned with the tabs 170 on the handle assembly 104. The bias of the protrusion 1010 into or between detents of the outer lateral surface 1012 can also provide a "click" or other tactile feel to the user as he or she operates the input member 122 due to the bias of the cam shaft 130 "snapping" or "jumping" toward the stable positions (at the minima) as it turns and due to the end gear element 124 resisting rotation away from a stable position. This can be used to give the user a tactile indication that they have changed the mass and to require a minimum threshold of torque and angular deflection to be applied to the input member 122 in order to make a new change to the loading or mass.

Referring again to FIG. 4, the outer sides 164 (such as for example the outer axially-facing sides or the main-weight-facing sides) of the handle weights 105 can face outward, toward the main weights 102, and may include engagement features to connect and couple the main weights 102 to the handle assembly 104. For example, the outer sides 164 may include a recess 166 surrounded on three lateral sides by body portions 167 of the handle weight 105. The recess 166 may include opposite lateral sides 1014 each defining an engagement recess 168 and an undercut surface 169 (such as for example an undercut interlock or axial retainer surface). As shown in FIG. 4, the engagement recess 168 can include a horizontal lower surface and an angled upper surface. An upper lateral side 1015 can define another undercut surface. The undercut surfaces 169 (and on 1015) may have a pitch or overhanging surface portion that faces or is angled, at least partially, along the axis X of the handle 160 (see FIGS. 1 and 7A), such as a ramped/dovetailed surface or a surface defining a hook-like cross-sectional profile.

As explained in further detail in connection with FIGS. 5A-7B, a protruding portion (e.g., protrusion 228) of a main weight 102 can be laterally inserted into the recess 166 from the bottom of the handle weight, and that protruding portion can fit under the undercut surfaces 169 (and at 1015) to prevent axial displacement of the main weight 102 away from the handle weight 105. Also described below, pawls (e.g., 202, 204) of the main weight 102 can be positioned in the engagement recesses 168 to prevent lateral removal of the main weight 102 from the handle weight 105 due to engagement between the pawls and the horizontal lower surfaces. Thus, the recess 166 can be referred to as an engagement feature, and the outer side 164 can be referred to as a weight-coupling side of the handle weight 105. Furthermore, as explained in connection with FIGS. 8-10C, the supplemental weights 108 can be coupled to or decoupled from segmented slots 1016 in the bottom end of the handle weights 105. Thus, the handle weights 105 provide a connection link used for joining various other weights 102, 108 to the handle 160.

Figure 5B:
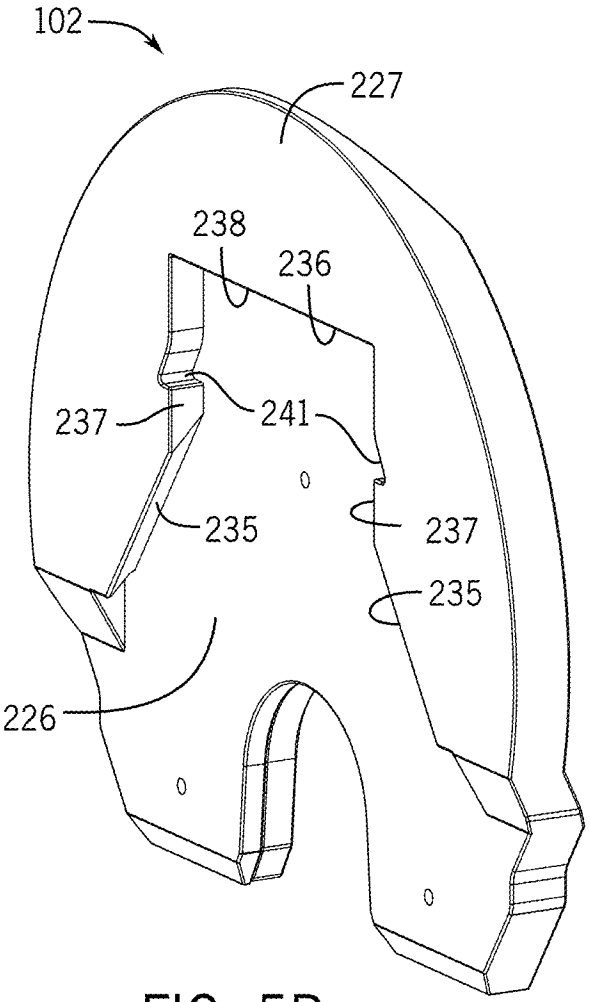
FIG. 5B is an isometric view of a main weight of the system of FIG. 1.
Figure 5A:
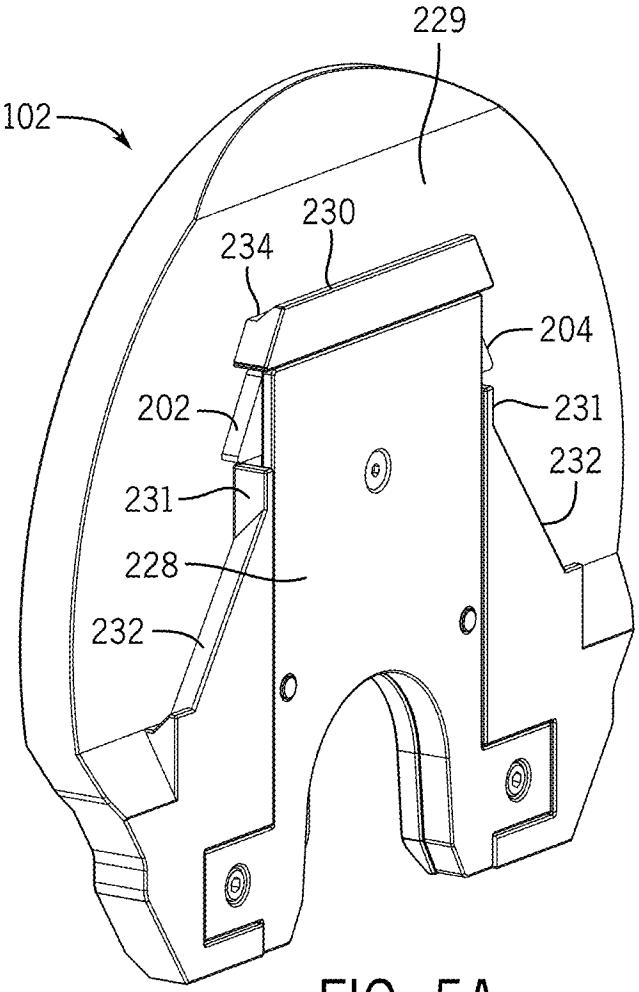
FIG. 5A is an isometric view of a main weight of the system of FIG. 1.
Figure 6A:
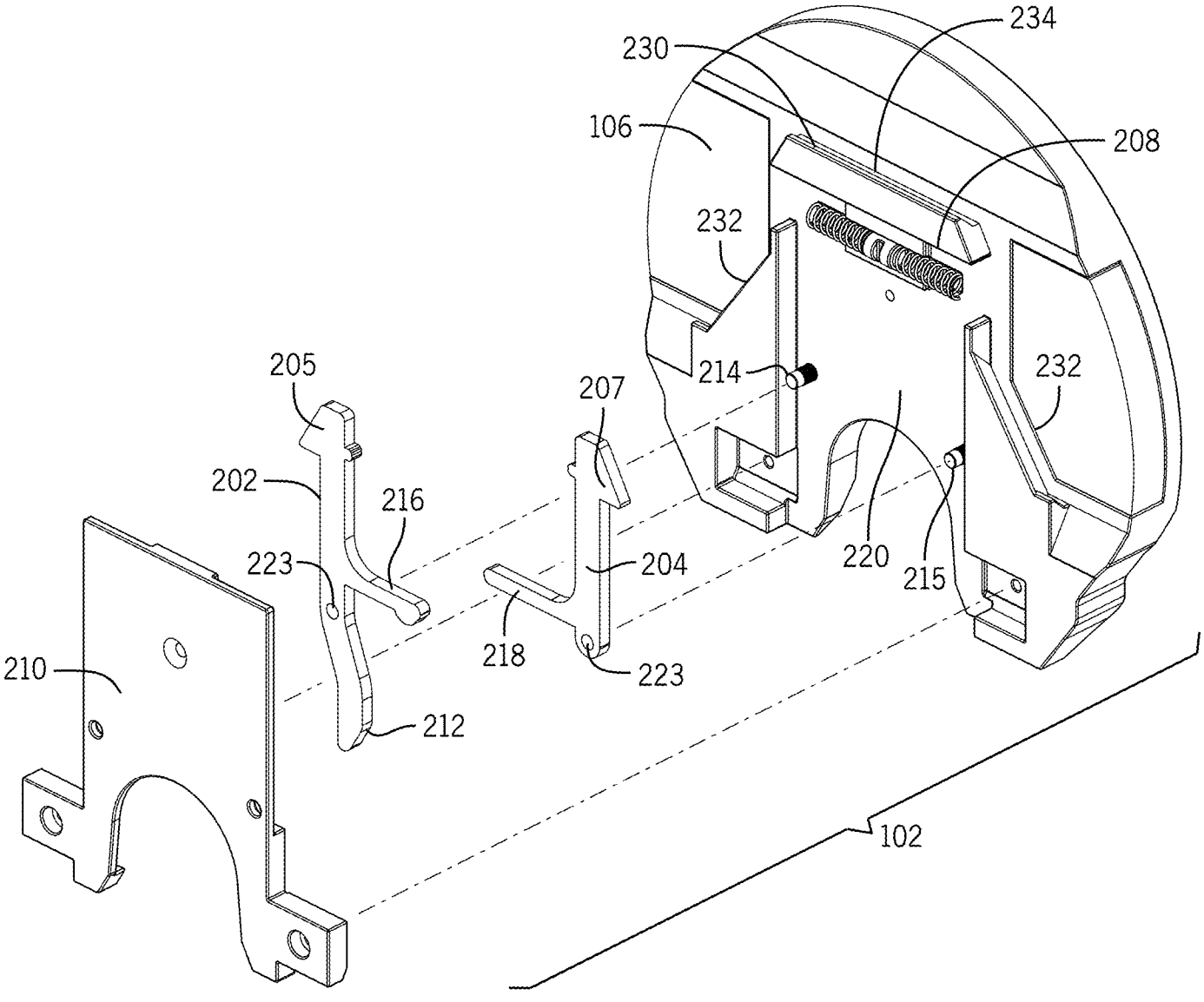
FIG. 6A is an exploded view of a main weight of the system of FIG. 1.
Figure 6C:
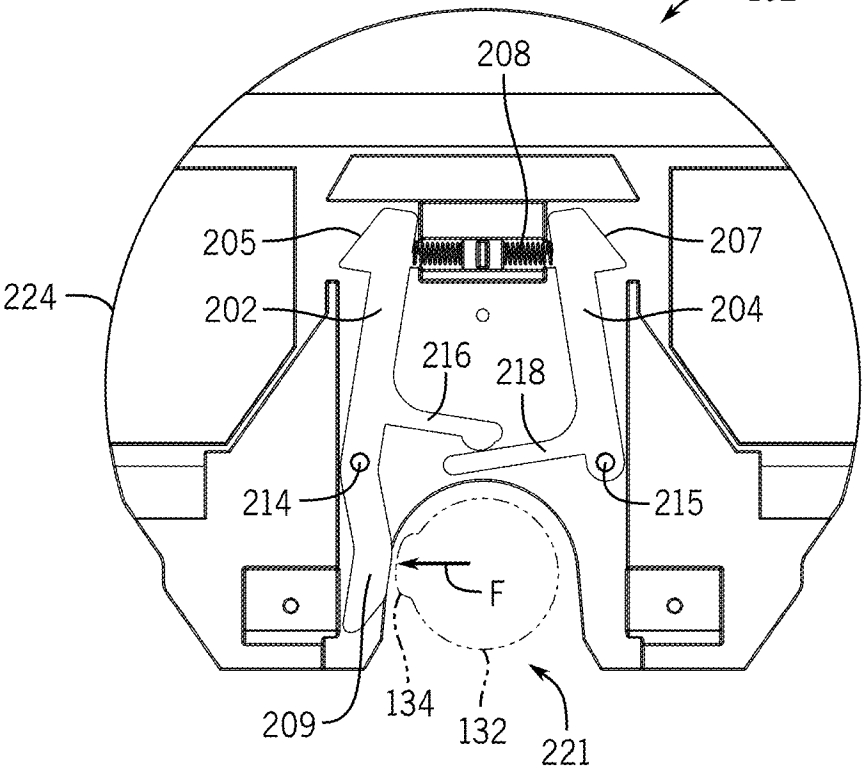
FIG. 6C is an end view of the main weight of FIG. 6B in a second configuration.

Referring now to FIGS. 5A-6C, various views of a main weight 102 are shown. FIG. 5A is a perspective view of a handle-facing side (such as for example an inward-facing side) of the main weight 102, and FIG. 5B is a perspective view of an outward-facing side of the main weight 102. FIG. 6A is an exploded view, and FIGS. 6B-6C show partially disassembled views of the interaction of internal parts of the main weight 102. FIG. 6D shows a partial section view of a protrusion 228 of a main weight 102 to show its interaction with a recess 226 of adjacent main weight 102, as indicated by section lines 6D-6D in FIG. 1.

Each main weight 102 may include a protrusion 228 (such as for example a protruding portion, raised portion, or axially-inwardly-extended portion) that is axially offset from a surrounding face 229 that surrounds three sides of the protrusion 228 on the handle-facing side. The protrusion 228 may have two horizontally-oriented lateral sides 231 and a vertically-oriented lateral side 230. Each of the lateral sides 231, 230 may define a corresponding undercut surface 232, 234 (such as for example a corresponding undercut interlock or corresponding axial retainer portion) that, as explained above, at least partially faces axially and that can be formed with a dovetail, latching, toothed, or hooking shape. The width between the undercut surfaces 232 in a particular horizontal plane is greater at axially inward parts of the undercut surfaces 232 as compared to relatively outward parts thereof. The handle-facing side also includes an upper end with a first surface sloping (e.g., tapering) longitudinally outward from the protrusion 228 and a second surface parallel to the inward-facing side of the main weight 102. See also FIG. 7B.

Figure 7A:
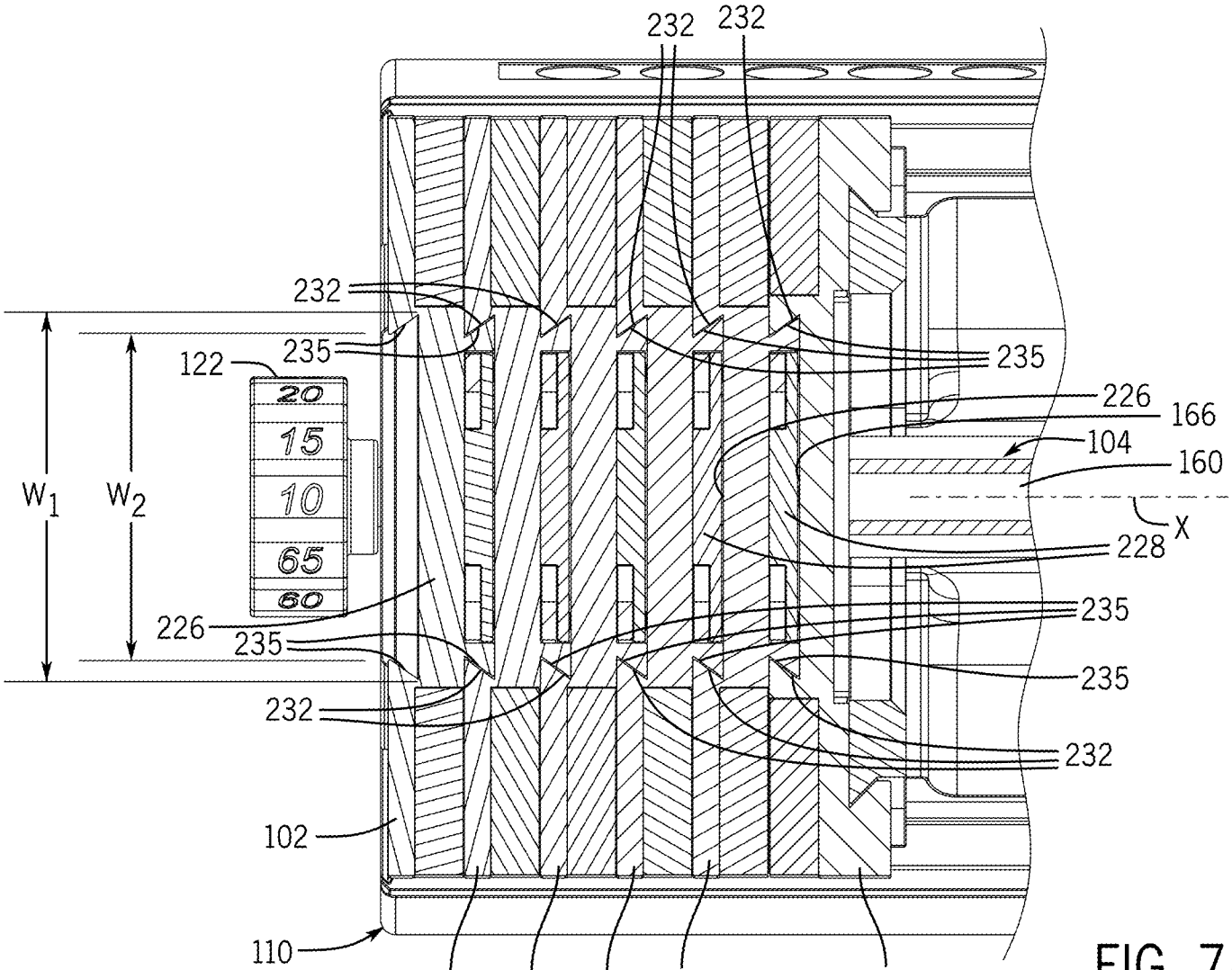
FIG. 7A is a partial section view of the system of FIG. 1 as taken through section lines 7A-7A in FIG. 1.

On the outward-facing side of the main weight 102, a recess 226 (such as for example a recessed portion, protrusion-receiving portion, or axially-inwardly-recessed portion) can be defined axially offset from a surrounding face 227 that extends around three sides of the recess 226 on the outward-facing side. Similar to recess 166, the recess 226 may comprise lateral sides 237, 238 including undercut surfaces 235, 236. As shown in FIG. 7A, which shows a top view cross-section as taken through section lines 7A-7A in FIG. 1, the width $W_1$ between the undercut surfaces 235 in a horizontal plane is less at axially outer parts of the undercut surfaces 235 as compared to a width $W_2$ at relatively inward parts thereof. The width $W_1$ is also substantially equal to the maximum width of the undercut surfaces 232, and width $W_2$ is substantially equal to the minimum width of undercut surfaces 235. Width $W_1$ is greater than $W_2$ in the same horizontal plane. Accordingly, a protrusion 228 cannot be axially inserted to (or removed from) a recess 226 in an adjacent main weight 102 (or to/from the recess 166 in a handle weight 105). A protrusion 228 can only be inserted into an adjacent recess 226 by a vertical lateral/radial movement that brings the vertically-oriented lateral side 230 of one main plate 102 vertically toward vertically-oriented lateral side 238 of another main plate 102 (or upper lateral side 1015 of a handle weight 105). The adjacent weights slide together until the undercut surfaces 232, 234, 235, 236 engage and interlock with each other. In that position, the undercut nature of those surfaces 232, 234, 235, 236 prevents axial movement of one weight relative to another due to mechanical interference of the at least partially axially-facing areas of those surfaces 232, 234, 235, 236.

The bottom end of the outward-facing side of the main weight 102 may include a recess 221 (see FIG. 6B) with a pair of weight portions on each lateral side of the recess 221. The pair of weight portions may each include a sloped surface on the outward-facing sides thereof that narrows the thickness of the weight 102 at the bottom ends of the pair of weight portions. Accordingly, the main weights 102 may include tapered bottom ends in addition to tapering in their upper ends.

Figure 7B:
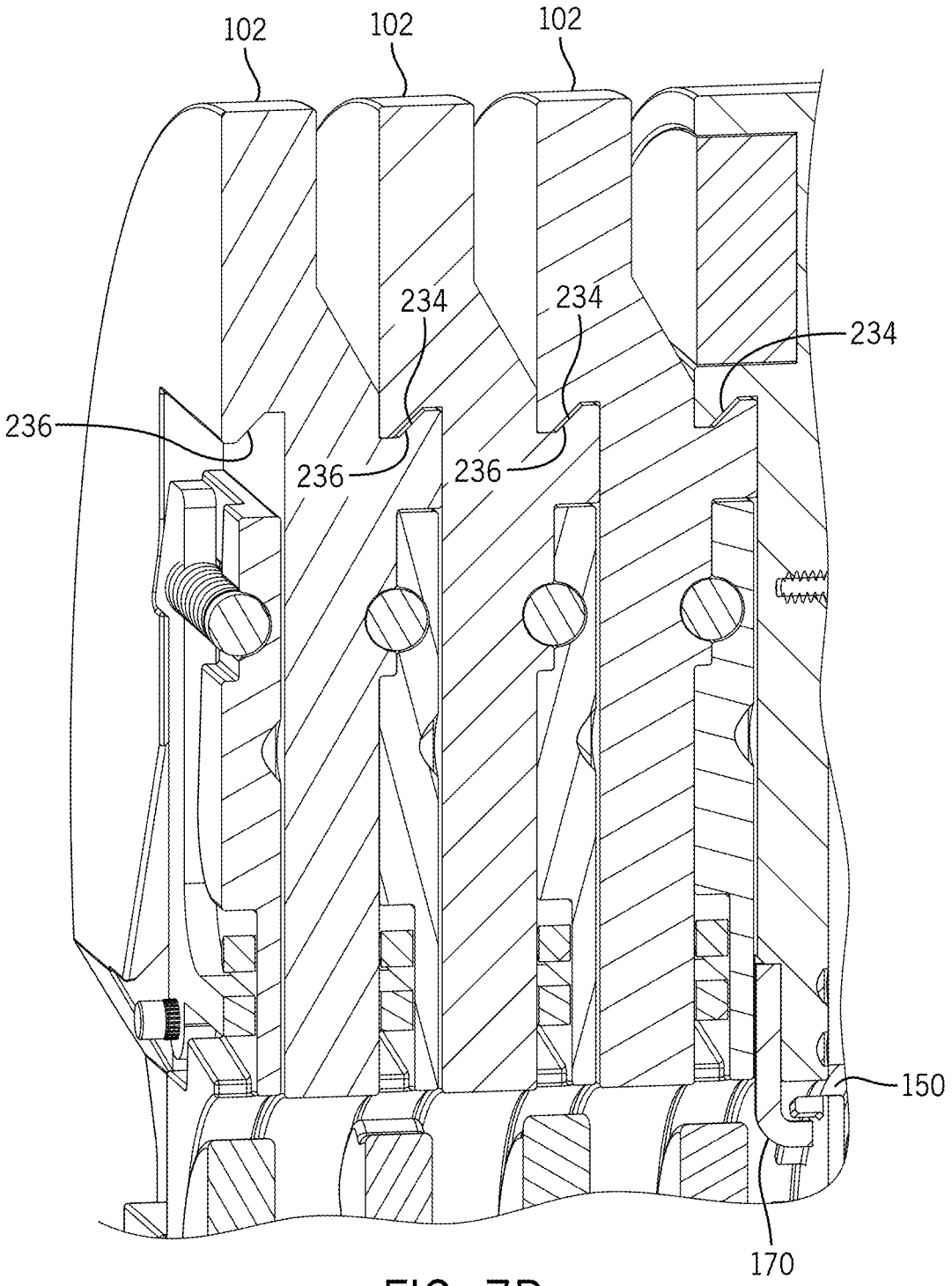
FIG. 7B is an isometric partial section view through a vertical plane centrally intersecting weights of the system of FIG. 1.

For example, as shown in FIG. 7B, a series of main weights 102 are shown in a partial section view showing the mechanical interlock between undercut surfaces 234 and 236. The laterally outward-ramped shape of the lower undercut surfaces 232, 235 also helps to keep the main weight 102 from axially rotating or rotating about a vertical axis while it is mounted to another weight 102, 105. This can beneficially reduce wobble or shaking of one weight relative to another while the user exercises. The ramped shape can also help guide the motion of the handle assembly 104 and weights 102 as they are reinserted onto the base assembly 110 and into position next to other weights 102 on the base assembly 110. A protrusion 228 on a weight 102 positioned on the base assembly 110 can have its top lateral side 230 guided by the slopes of the horizontal lateral sides (e.g., along 235) of the recess 226 until the top lateral side 230 reaches the top lateral side 238 of the recess 226.

FIG. 7A also shows in detail the interlocking interaction of the undercut surfaces 169, 232, and 235 across multiple weights 102, 105. The stacked or chained interaction of the weights 102, 105 can be seen, wherein each weight 102, 105 can provide axial retention of its immediately adjacent longitudinally outward-positioned main weight 102. The number of main weights 102 coupled together can determine the overall length of the dumbbell when it is lifted away from the base assembly 110, so the end-to-end length of the dumbbell may be variable based on the amount of load used.

Figure 6B:
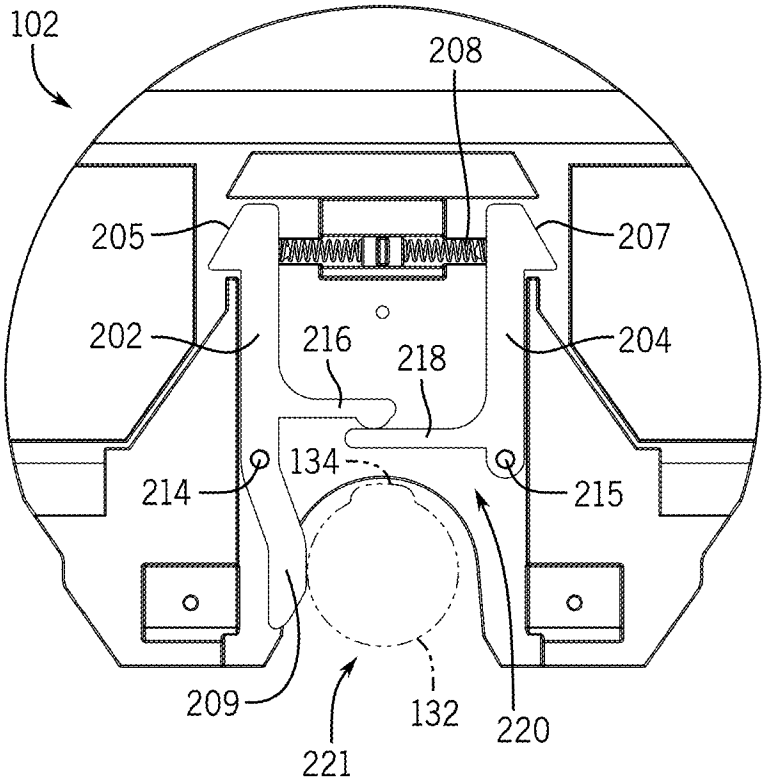
FIG. 6B is an end view of a main weight of the system of FIG. 1 in a first configuration.

FIGS. 6A-6C illustrate additional features of the coupling subassemblies or weight interconnection mechanisms of the main weights 102. Each weight interconnection mechanism may include a cover 210, a primary pawl 202, a secondary pawl 204, and at least one biasing member 208 (e.g., a compression spring, leaf spring, elastomeric material, similar structure, or combinations thereof) positioned in a compartment 220 in the inward-facing side of the main weight 102.

The cover 210 may keep the pawls 202, 204 and the at least one biasing member 208 protected and housed in the compartment 220. The cover 210 does not fully enclose all portions of the pawls 202, 204, and permits respective weight engagement portions 205, 207 (such as for example bird-beak-shaped portions or substantially triangular portions) of the pawls 202, 204 to protrude laterally from the compartment 220, as seen in at least FIGS. 5A and 6B. A cam engagement portion 209 of the first pawl 202 may also extend from the compartment 220 into the arch-shaped gap 221 at the base of the main weight 102. Each pawl 202, 204 may have a pivot point 223 aligned with and mounted to a respective pivot protrusion 214, 215 within the compartment 220, as shown in FIGS. 6A-6C. Each pawl 202, 204 may also have a rotation linkage portion 216, 218 configured to engage the other pawl within the compartment 220.

Figure 2A:
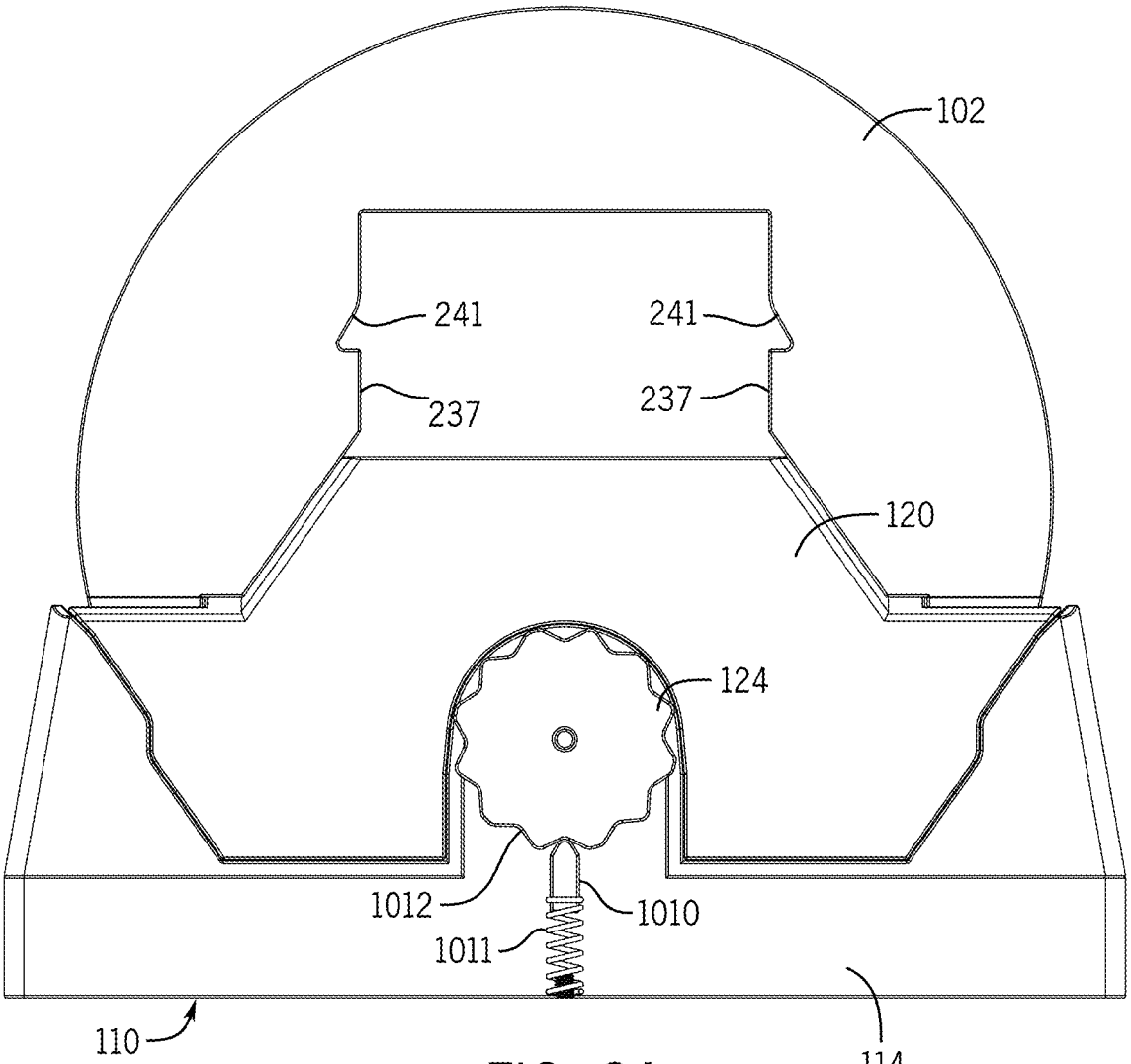
FIG. 2A is an end view of the system of FIG. 1.
Figure 6D:
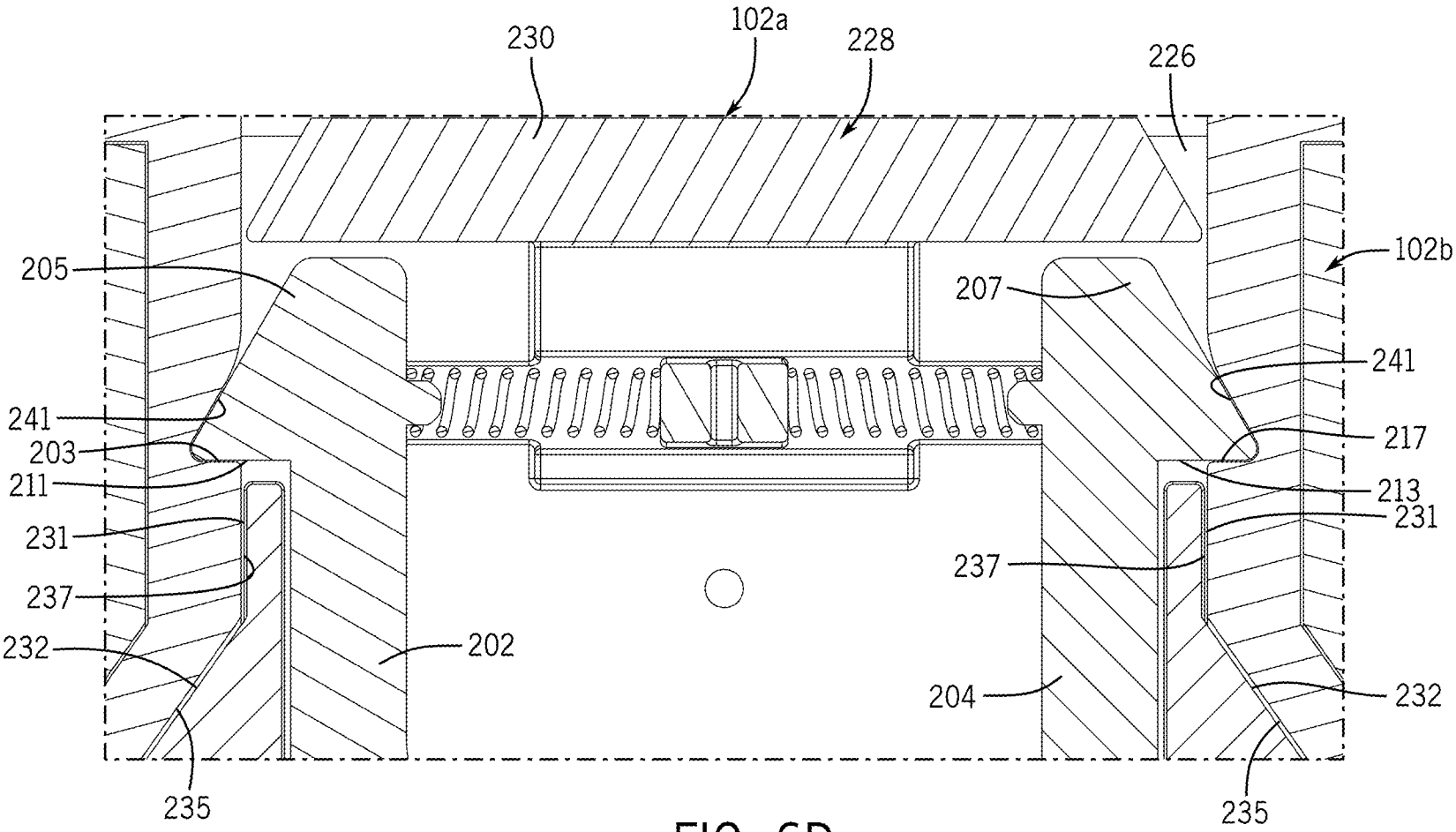
FIG. 6D is a detail section view of two main weights of the system of FIG. 1 interacting with each other, as taken through section lines 6D-6D in FIG. 1.

In a rest state, the main weight 102 may be configured as shown in FIG. 6B, wherein the pawls 202, 204 have their weight engagement portions 205, 207 extending laterally outward due to a biasing force applied by the at least one biasing member 208. The pawls 202, 204 rotate about the pivot protrusions 214, 215 until they contact the side surfaces of the compartment 220. In this configuration, the weight engagement portions 205, 207 extend from the compartment 220 and can be seated or nested in engagement recesses (e.g., 168 in handle weight 105 or recesses 241 in a recess 226 of a main weight 102, as shown in FIGS. 2A and 5B). FIG. 6D shows an end-facing section view of the pawls 202, 204 of one main weight 102*a* as they appear when they are positioned in an engaging position with recesses 241 (or 168) in an adjacent weight 102*b* (or 105). The weight engagement portions 205, 207 have substantially flat/horizontal bottom surfaces 211, 213 configured to contact and abut substantially flat/horizontal bottom surfaces 203, 217 of the engagement recesses 241 (or 168), thereby mechanically interlocking the main weight 102 to its neighboring weight 102/105 and preventing withdrawal of the protrusion 228 from the receiving recess 166/226, as shown in FIG. 6D. Accordingly, in this configuration, the pawls 202, 204 prevent lateral removal of the weight 102 from another weight 102/105 in the vertical direction. The undercut surfaces 169, 1015, 232, 234, 235, 236 prevent axial withdrawal and horizontal lateral movement of the weight 102 relative to its coupled neighboring weight 102/105. Accordingly, this configuration can be referred to as a coupled, locked, or engaged condition for the main weight 102 since it is coupled, locked, and engaged with the handle assembly 104.

The user may operate the weight selector assembly 112 to unlock, decouple, or disengage one or more main weight 102 from the other weights 102, 105. The input member 122 is turned, thereby axially rotating the cam shaft 130 and cams 132 until, at a predetermined rotational position of the cam 132 corresponding to a particular main weight 102, the protrusion 134 comes into contact with the cam engagement portion 209 of the first pawl 202. The protrusion 134 applies a horizontally outward force F (see FIG. 6C) to the cam engagement portion 209 that causes the first pawl 202 to rotate about pivot protrusion 214 from the configuration of FIG. 6B toward the configuration shown in FIG. 6C, thereby rotating the weight engagement portion 205 horizontally inward (such as for example into the compartment 220) as the rotating force overcomes the outward biasing force of the biasing member 208. Simultaneously, the rotation linkage portion 216 of the first pawl 202 rotates to apply a vertically downward force against the rotation linkage portion 218 of the second pawl 204, thereby causing rotation of the second pawl 204 about pivot protrusion 215. This rotation overcomes the outward biasing force of the at least one biasing member 208 to withdraw the weight engagement portion 207 into the compartment 220 in a horizontally inward direction, as shown in FIG. 6C. With the weight engagement portions 205, 207 withdrawn from the engagement recesses 168/241 of the neighboring weight 105/102, the main weight 102 is decoupled and will not be vertically lifted with the handle assembly 104 when the handle 160 is pulled up from the base assembly 110. Accordingly, the cams 132 and protrusions 134 can each be angularly positioned relative to the cam shaft 130 so that only a desired outermost one of the main weights 102 is decoupled from the rest of the main weights 102 that are further outwardly positioned from that desired outermost one. The handle assembly 104 will only be coupled to the desired outermost (and further inward) main weights 102, and the remaining main weights 102 will remain decoupled from the handle assembly 104 on the base 110 while the dumbbell is used.

In some embodiments, the cams 132 and protrusions 134 can be designed to keep all of the main weights 102 that are decoupled from the handle assembly 104 coupled to each other. This can be done by ensuring that only one protrusion 134 can engage one cam engagement portion 209 of a pawl on each side of the handle assembly 104 at any time. This can beneficially keep the decoupled main weights 102 secured together so that they are not lost or moved separately while resting on the base assembly 110.

If the weight selector assembly 112 is rotated while the handle assembly 104 is disconnected from the base assembly 110, the pawls 202, 204 can be configured to automatically re-couple with an adjacent weight 102/105 when the handle assembly 104 is replaced on the base assembly 110. This may be achieved because the top surfaces of the weight engagement portions 205, 207 have ramps/slopes that, when they engage the sides of a recess (e.g., 235 or 237), causes the pawls 202, 204 to automatically overcome the biasing force of the at least one biasing member 208 and to therefore horizontally retract until they reach an engagement recess (e.g., 241), and the biasing force drives them back horizontally outward.

Figure 8:
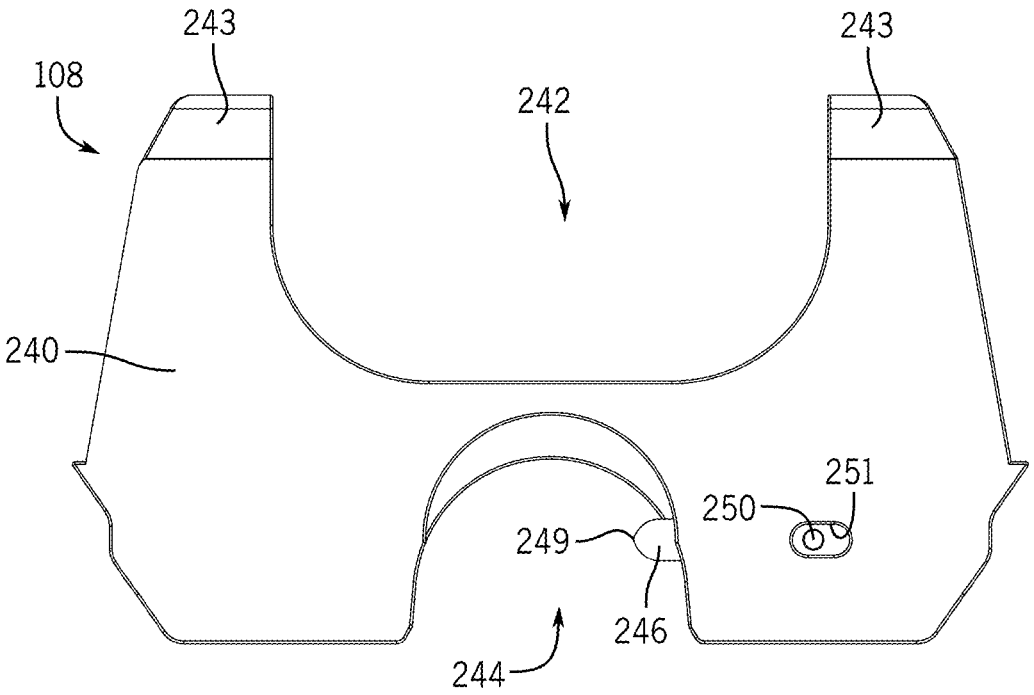
FIG. 8 is an end view of a weight of the system of FIG. 1.
Figure 9:
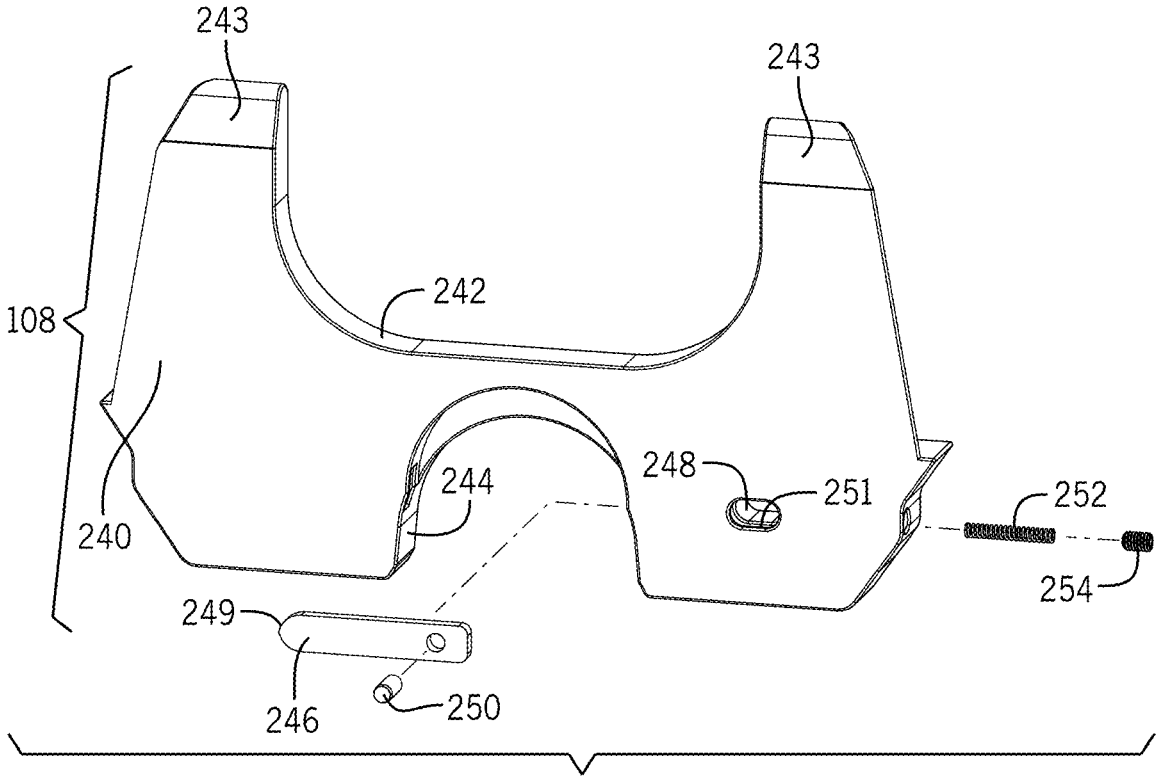
FIG. 9 is an exploded view of a weight of the system of FIG. 1.
Figure 10A:
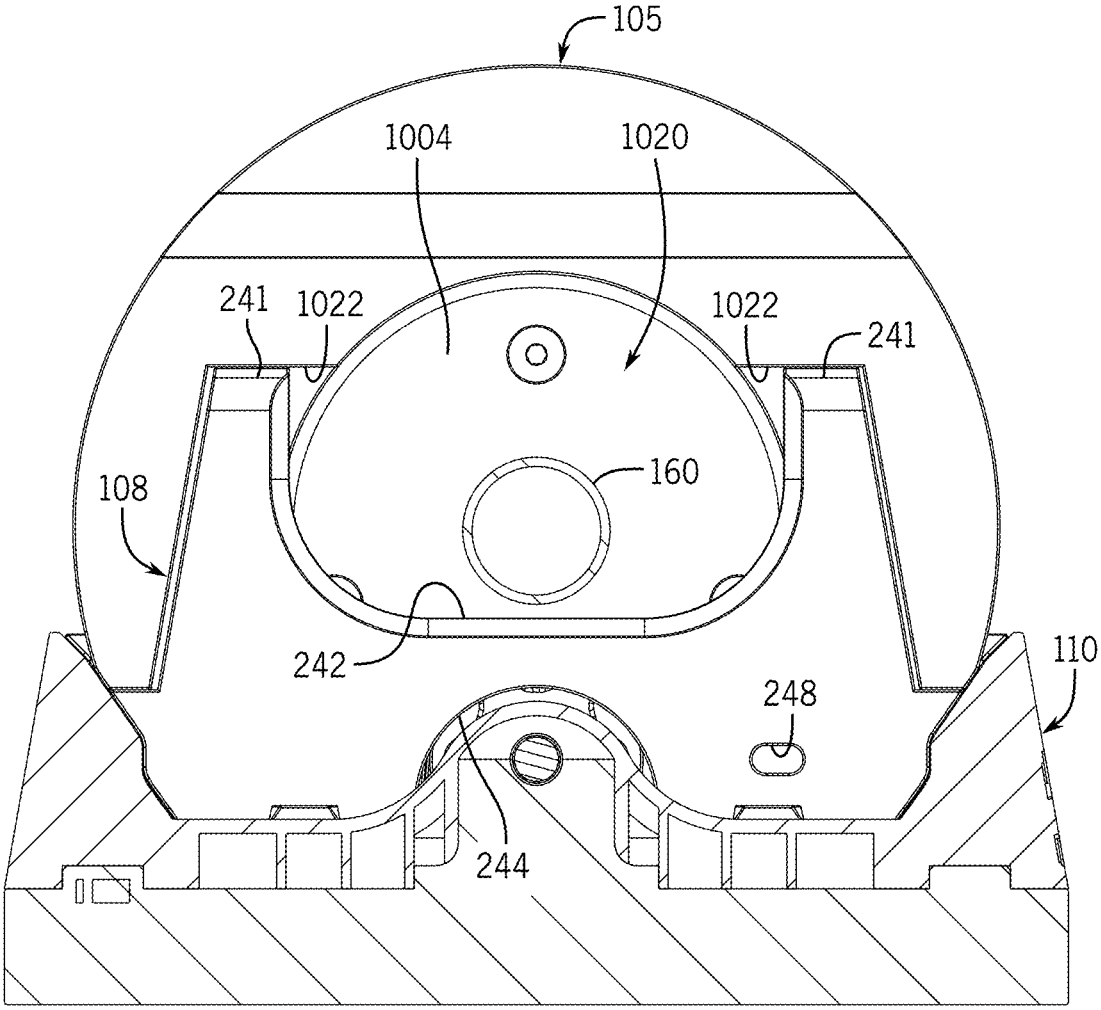
FIG. 10A is an end-facing section view of the system of FIG. 1 through a vertical plane in the handle.
Figure 10B:
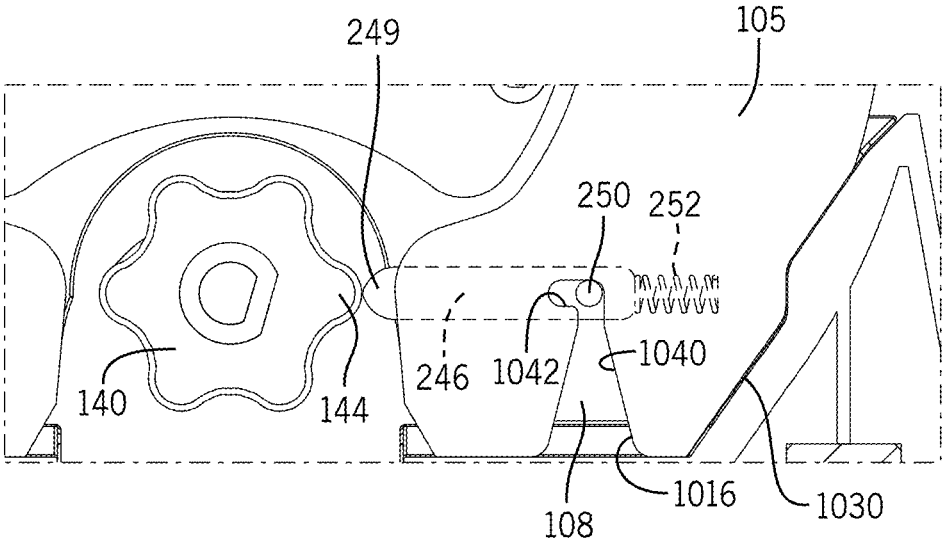
FIG. 10B is a partial section view of a weight engaging a cam of the weight selector assembly of the system of FIG. 1 in a first configuration.
Figure 10C:
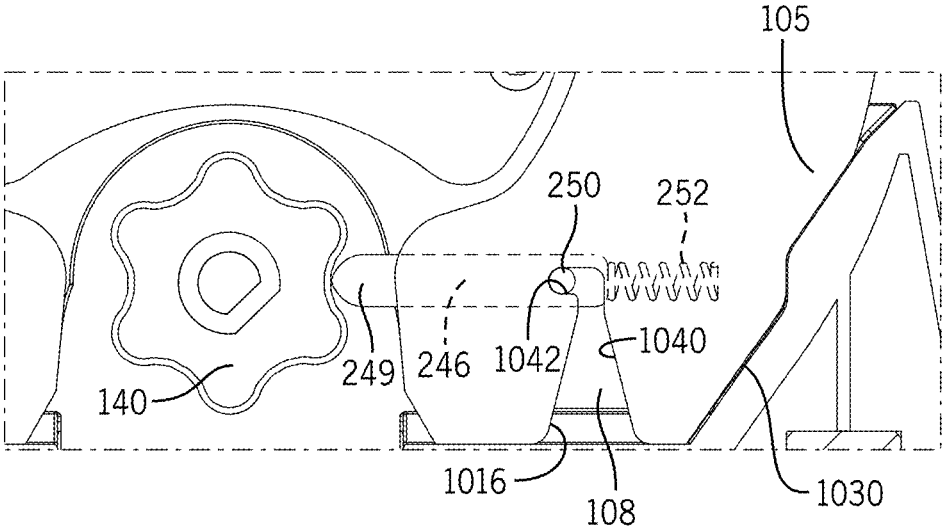
FIG. 10C is a partial section view of a weight engaging a cam of the weight selector assembly of the system of FIG. 1 in a second configuration.

Referring now to FIGS. 8-10C, embodiments of a supplemental weight 108 and an associated weight selector mechanism are illustrated. FIG. 8 shows the supplemental weight 108 in a perspective view, FIG. 9 shows an exploded view of the supplemental weight 108, FIG. 10A shows an end-oriented section view of the system 100 through the handle and facing the supplemental weight 108 and handle weight 105, and FIGS. 10B-10C show detail views of the mechanical interface between the handle weight 105, the supplemental weight 108, and the supplemental cam 140, as described in further detail below. The supplemental weight 108 may comprise multiple component parts, so the supplemental weight 108 can alternatively be referred to as a supplemental weight assembly or auxiliary weight assembly.

In some embodiments, the supplementary weight 108 may have a shape conforming to or accommodating a portion of the handle weight 105 or may be capable of nesting inside a portion of another weight. Some embodiments may have a shape that conforms to a portion of the handle assembly 104. For example, the supplemental weight 108 may have a top cutout 242 (such as for example a top recess or depression shape) configured to receive the handle 160. See FIGS. 8 and 10A. Additionally, as shown in FIGS. 4 and 10A, the handle assembly 104 may have an inner recess 1020 with a pair of top-end undercut surfaces 1022 configured to receive and engage end surfaces 243 at top ends of the supplemental weight 108, as shown in FIGS. 8-10C. The end surfaces 243 may be angled so that their tips fit underneath, and thereby mechanically interface with, the undercut surfaces 1022 of the inner recess 1020. In some embodiments, the recess 1020 may also include undercut horizontally lateral side surfaces that interface with and engage horizontally lateral sides of the supplemental weight 108.

A supplemental weight 108 may have a main body 240 with the top central cutout 242 and a bottom central cutout 244. See FIGS. 8-9. The cutouts 242, 244 can be formed with the main body 240 (e.g., molded with the rest of the main body 240) or can be removed from a structure (e.g., machined) to form the main body 240 during manufacturing. The cutouts 242 and 244 may allow the supplemental weight 108 to fit between the handle 160 and the weight selector assembly 112 in the base assembly 110. See FIG. 10A. For example, the lower cutout 244 may be configured to rest over the weight selector 112 and allow the supplemental cam 140 to rest within the cutout 244. Additionally, the cutouts 242, 244 may be used to accommodate other components or can have their sizes designed to reduce or control the load or mass of the supplemental weight 108.

As discussed in connection with FIG. 3, the weight selector assembly 112 may include supplemental cams 140 that include one or more engagement features 144 or radial protrusions exceeding a first radial size and one or more radial valleys or recesses between them that have or are below a second radial size. The supplemental cam 140 may be configured to couple or decouple the supplementary weight 108 from the handle assembly 104. To do so, the supplementary weight 108 may include a cam follower 246 positioned in a cavity 248 of the main body 240. The cam follower 246 may be biased laterally into the bottom cutout 244 (as seen in FIGS. 8, 10B, and 10C) with an end portion 249 (such as for example a tip portion or cam engagement end) protruding into the cutout 244. The cam follower 246 may have curved end surface and may be biased by a follower biasing member 252 positioned in or on the main body 240. See FIGS. 9, 10B, and 10C. A set screw 254 may be used to adjust the biasing force of the biasing member 252 by increasing or releasing pressure on the biasing member 252. Similar set screws can be implemented for other biasing members in other systems and embodiments disclosed herein. The cam follower 246 may also have a weight engagement portion 250 configured to protrude from an opening 251 in the main body 240. Thus, horizontal lateral movement of the end portion 249 can cause corresponding lateral movement of the weight engagement portion 250, and contact between the weight engagement portion 250 and the opening 251 can define limits of the range of motion of the cam follower 246.

The weight engagement portion 250 can extend from the supplemental weight 108 and into one of the segmented slots 1016 on each side of the handle weights 105. Due to the upside-down L-shape of the segmented slot 1016, the when the weight engagement portion 250 is in a laterally outward position (see FIG. 10B), it is aligned with the vertical slot segment 1040 of the segmented slot 1016, and the supplemental weight 108 is therefore decoupled from the handle weight 105. In other words, when the handle weight 105 is lifted vertically, the weight engagement portion 250 slips out of the segmented slot 1016 rather than engaging the slot 1016 and being carried up by the handle weight 105. Alternatively, when the weight engagement portion 250 is in a laterally inward position (see FIG. 10C), the weight engagement portion 250 is aligned with the short horizontal segment 1042 of the segmented slot 1016, and the engagement portion 250 therefore engages the bottom surface of the horizontal segment 1042 of the slot 1016 when the handle weight 105 is lifted vertically upward, thereby lifting the supplemental weight 108 with the handle weight 105. Thus, the engagement portion 250 being positioned laterally inward (FIG. 10C) can be referred to as an engaged or coupled configuration for the supplemental weight 108 since it is coupled with the handle weight 105.

As shown in FIGS. 10B and 10C, the cam follower 246 can be positioned on the main body 240 so that the end portion 249 is biased into engagement with the radial outer surface of the supplemental cam 140. The follower biasing member 252 may ensure the cam follower 246 remains in contact with the supplemental cam 140 as the supplemental cam 140 rotates. In certain rotated positions, such as FIG. 10B, the supplemental cam 140 has its engagement features 144 in contact with the end portion 249 of the cam follower 246, and the engagement features 144 apply a laterally outward-directed force to the cam follower 246 that compresses the follower biasing member 252 and moves the weight engagement portion 250 to the decoupled position. In other rotated positions, such as FIG. 10C, the engagement features 144 are not in contact with the end portion 249, and the end portion 249 is driven inward toward the central axis of the supplemental cam 140 (such as for example toward a portion of the supplemental cam 140 that has a second, smaller radius than the first, larger radius of one or more engagement features 144). Thus, the weight engagement portion 250 moves inward and into a coupling/engaging position relative to the handle weight 105. Accordingly, operation of the weight selector assembly 112 can rotate the supplemental cam 140 to control coupling and decoupling of the supplemental weight 108 relative to the handle weight 105.

Furthermore, there are multiple engagement features and multiple smaller-radius surfaces on the supplemental cam 140, so rotation of the supplemental cam 140 can alternate coupling and decoupling of the supplemental weight 108 multiple times throughout one full revolution of the cam shaft 130. In combination with the operation of the cams 132 and their interaction with the main weights 102, the supplemental cam 140 and supplemental weights 108 can thus be beneficially used to provide multiple load increments for the dumbbell system 100. For example, at a default or minimum weight angular position of the weight selector assembly 112, the supplemental weight 108 can be in a decoupled state (e.g., FIG. 10B) while at least the nearest main weight 102 to the handle weight 105 is also in a decoupled state (e.g., FIG. 6C). Thus, no extra load is added to the handle assembly 104. Incremental rotation of the weight selector assembly 112 (e.g., 30 degrees) may transition to a state where the supplemental weight is coupled (e.g., FIG. 10C) and the nearest main weight 102 is still decoupled (e.g., FIG. 6C), thereby adding only the load of the supplemental weight to the handle assembly 104. Further rotation of the weight selector assembly 112 (e.g., 30 more degrees) may then transition the supplemental weight to be decoupled (e.g., FIG. 10B) and the nearest main weight 102 is coupled (e.g., FIG. 6B/6D). Further rotation can then lead to additional states in this sequence, such as states where the second, third, fourth, and fifth main weights 102 are coupled/decoupled with or without the supplemental weights 108 being coupled as well. Each step-change in load caused by the state of rotation of the weight selector assembly 112 can correspond to an indicator 172 and/or a detent in the lateral surface 1012 of the end gear element 124. Thus, the user of the system 100 can visually determine the amount of weight selected without having to see the positioning of the cams 132, 140. Each state can correspond to an incrementally greater load for the handle assembly 104 to carry. In some embodiments, one or more of the main weights 102 may be heavier than other main weights 102, such as by including a denser material or by including heavy inserts into their weight bodies, so the step changes between each load state change may not be equal in magnitude. For example, some rotations may add 2.5 pounds to the handle assembly 104 (e.g., just by coupling a pair of 1.25-lb. supplemental weights 108), and some rotations may add 5 pounds or more (e.g., by coupling heavier main weights 102).

It should be fully understood that the dumbbell system and associated subassemblies illustrated above may be representative of an embodiment, rather than all possible embodiments. For example, as previously discussed, the main weights and supplemental weights may have any number of different sizes and configurations within the dumbbell system. Accordingly, the dumbbell system may have any number of configurations of main weights, supplemental weights, handle assemblies, etc.

Any of the features, components, and/or parts, including the arrangements and configurations thereof shown in FIGS. 1-10C, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 1-10C.

Figure 43:
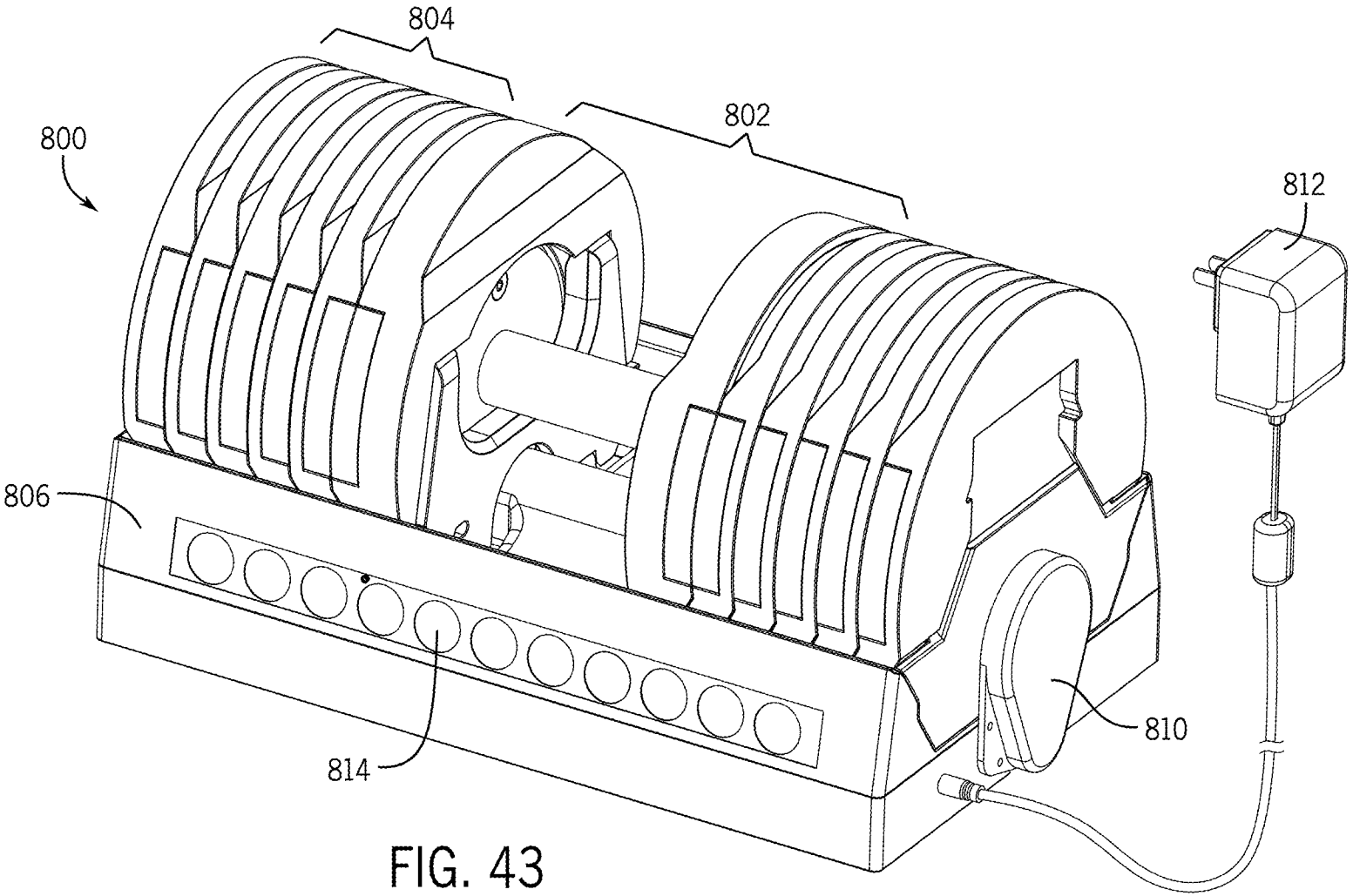
FIG. 43 is an isometric view of an adjustable dumbbell system.
Figure 44:
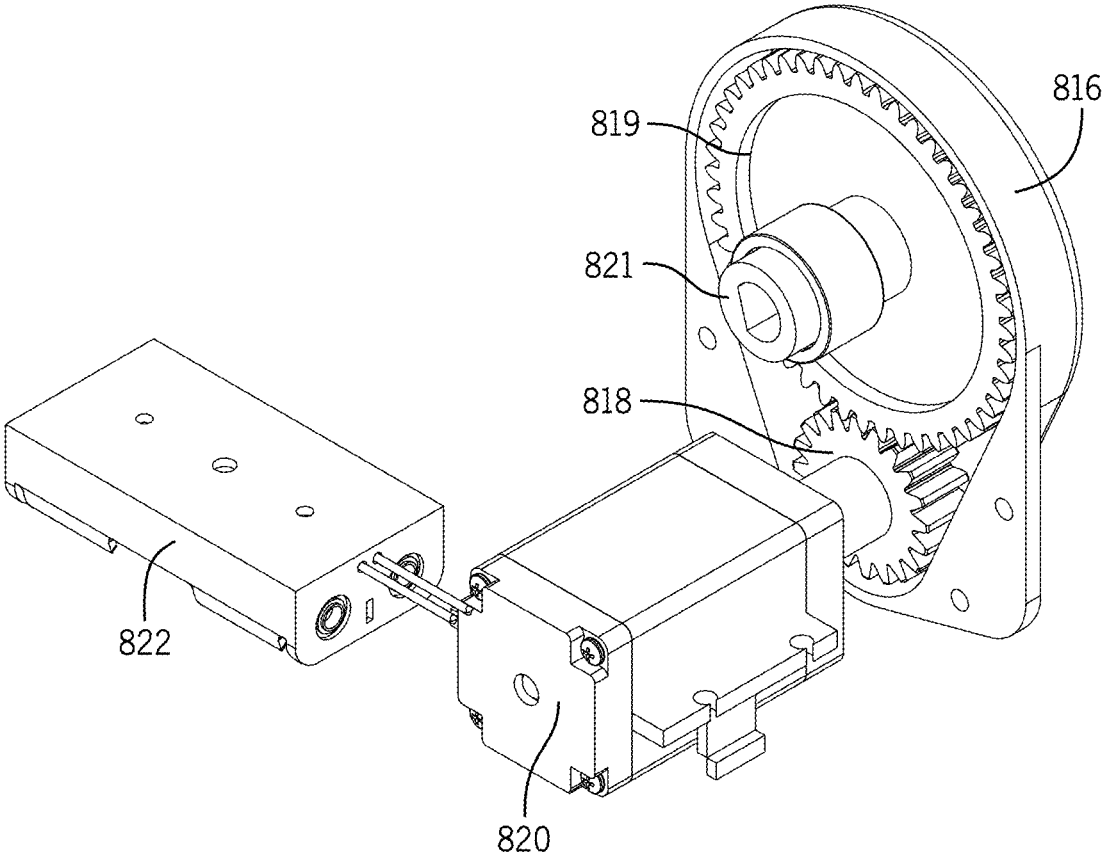
FIG. 44 is an isometric view of components of the system of FIG. 43.

Referring now to FIGS. 43-44, features of an adjustable dumbbell system 800 related to the dumbbell system 100 of FIGS. 1-10C. Although various embodiments are provided herein as having a manual form of weight selection, some embodiments of an adjustable load dumbbell may have an automated weight selection system. For example, FIGS. 43 and 44 illustrate aspects of an adjustable load dumbbell system 800 and various components of the weight selector assembly. The adjustable load dumbbell system 800 may include a handle assembly 802 that is engageable with a number of main weights 804 located on each end of the handle assembly 802. The handle assembly 802 and the main weights 804 may be positioned within or on a base assembly 806 that may provide support when the system is not in use. The weights 804 may be selected with any variety of weight selection components and methods illustrated herein, including elements of system 100 or embodiments described elsewhere herein. The selection of weights can be augmented or automated by way of a powered electronic weight selection system 810 that may be connected to the weight selector assembly (e.g., cam shaft 130). In some embodiments, the adjustable load dumbbell system 800 may be connected to a power supply 812 that may be a power cord or any other suitable form of providing power to the system. Additionally, some embodiments may include an external display element 814 (e.g., a lighted display screen or light array) that may illustrate to the user the value of the currently selected (and/or the overall possible) load or mass. The display element 814 may be any suitable display system.

Figure 11:
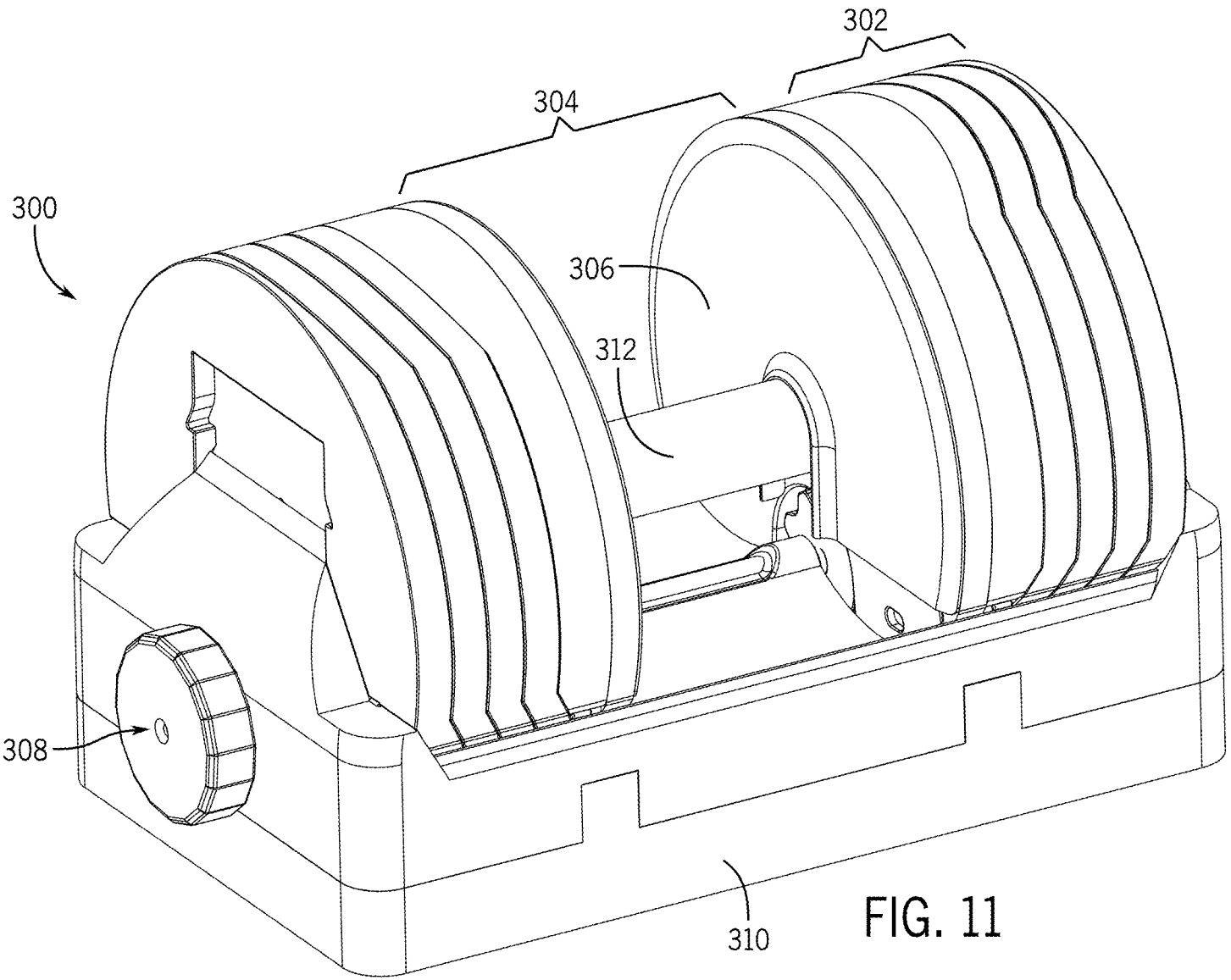
FIG. 11 is an isometric view of a weight system.

Referring now to FIG. 11, another related dumbbell system 300 is shown in perspective view. Similar to other embodiments, the dumbbell system 300 may have a number of different main weights 302 (or main weight assemblies) that are coupleable to a handle assembly 304. The dumbbell system 300 may sit within a base assembly 310 that supports the weights and handle. The base assembly 310 may have a weight selector assembly 308 disposed at least partially within the base assembly 310. The weight selector assembly 308 may be used to select a desired load to be lifted from the base assembly 310. This may be implemented by making rotational movement of the weight selector assembly 308, similar to weight selector assembly 112. The rotational movement may correspondingly select or deselect any configuration of weights and/or supplemental weights.

Figure 12A:
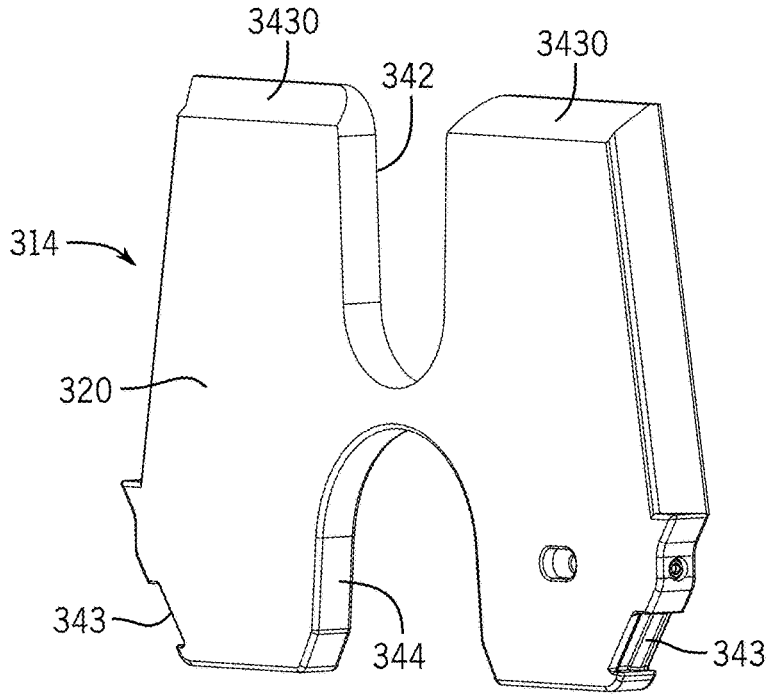
FIG. 12A is an isometric view of a weight of the system of FIG. 11.
Figure 12B:
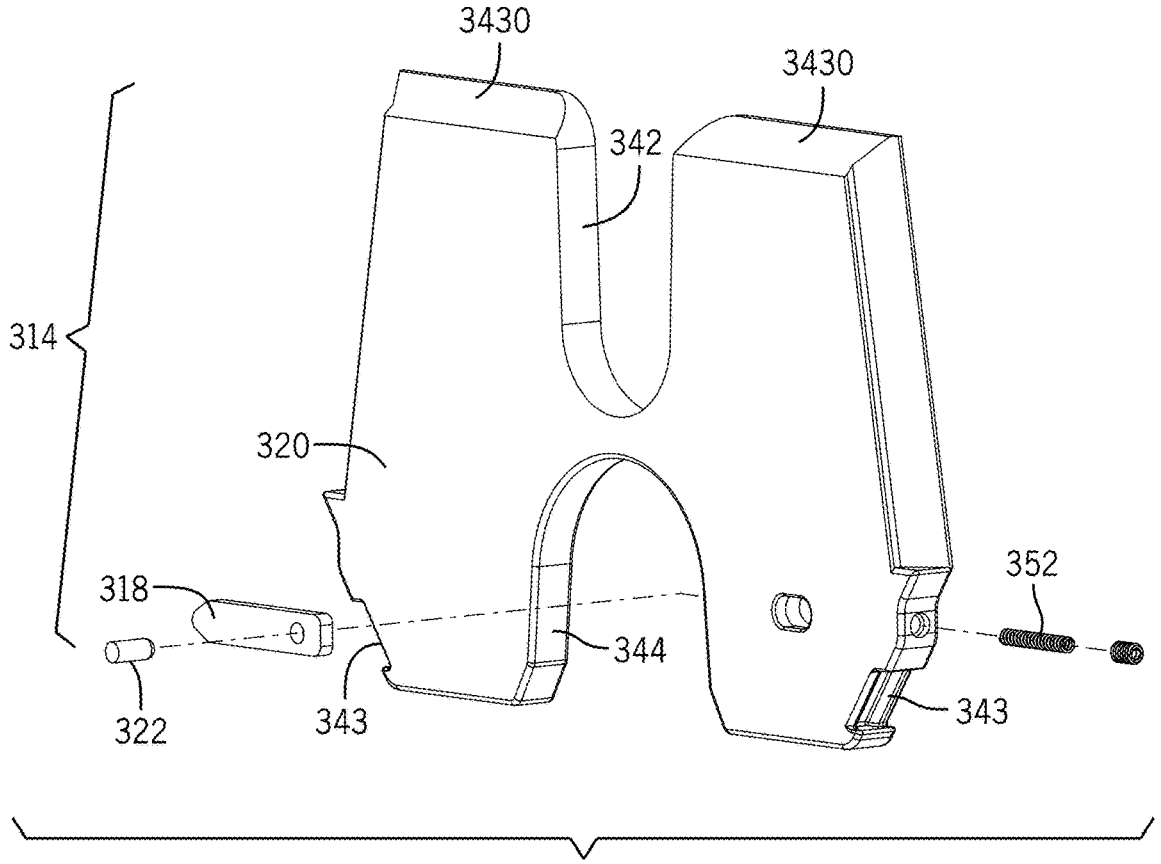
FIG. 12B is an exploded view of the weight of FIG. 12A.

In some embodiments, the handle assembly 304 may have a cap plate 306 that is connected to the handle 360 and may be configured to cover a number of different supplemental weights 314 and 316 which are illustrated in FIGS. 12A through 13B. FIGS. 12A and 12B, for example, respectively illustrate a perspective view and an exploded view of an embodiment of a larger supplemental weight 314. This larger supplemental weight 314 may take on any shape or configuration that is suitable for the overall system, including upper and lower cutouts 342, 344 and end surfaces 3430 similar to the cutouts 242, 244 and end surfaces 243 of supplemental weight 108 in form and in function. Similar to other embodiments of supplemental weights, the larger weight 314 may have a cam follower 318 that is positioned within the body 320 of the weight 314 and that has a weight engagement portion 322 and is engaged with a resilient member 352 to bias the cam follower 318 relative to the lower cutout 344 in the manner described in connection with cam follower 246.

Figure 13A:
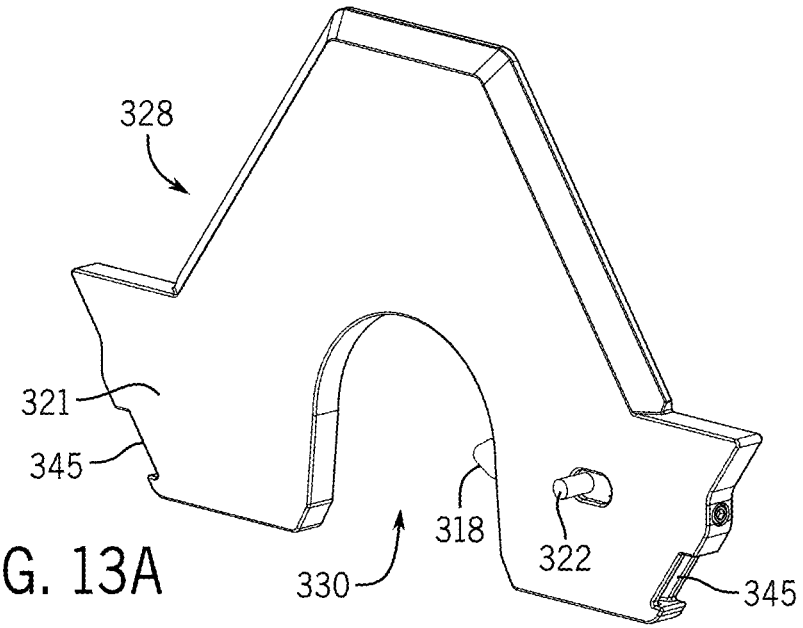
FIG. 13A is an isometric view of another weight of the system of FIG. 11.
Figure 13B:
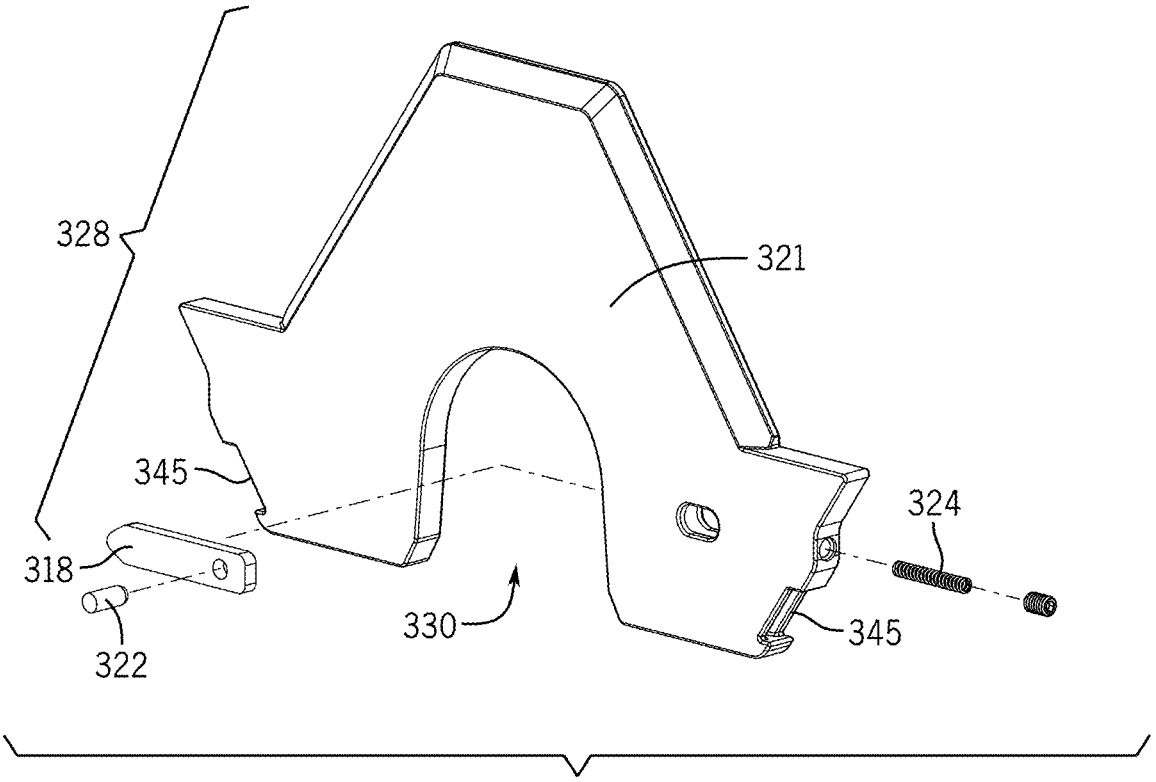
FIG. 13B is an exploded view of the weight of FIG. 13A.

In some embodiments, the dumbbell system 300 may include a set of secondary supplemental weights 328 as illustrated in FIGS. 13A and 13B, which respectively show a perspective view and an exploded view thereof. The secondary weights 328 may take on any suitable shape or configuration that is suitable for use in the overall system 300. For example, some embodiments of the secondary weight 328 may have a lower cutout 330 that is configured to receive and rest over a weight selector assembly that may be located within the base assembly 310, as shown in greater detail in connection with FIGS. 14A-16. Similar to the larger supplemental weights 314, the secondary supplemental weights 328 may have a cam follower 318 positioned in the body 321 with a biasing member 324. The cam followers 318 may function similar to cam followers 246 described in connection with supplemental weight 108 when in engagement with a supplemental cam of the weight selector assembly 308. Thus, the cam followers 318 may be used to engage with a supplemental cam that may be used to select or deselect the secondary supplemental weight 328.

Figure 14A:
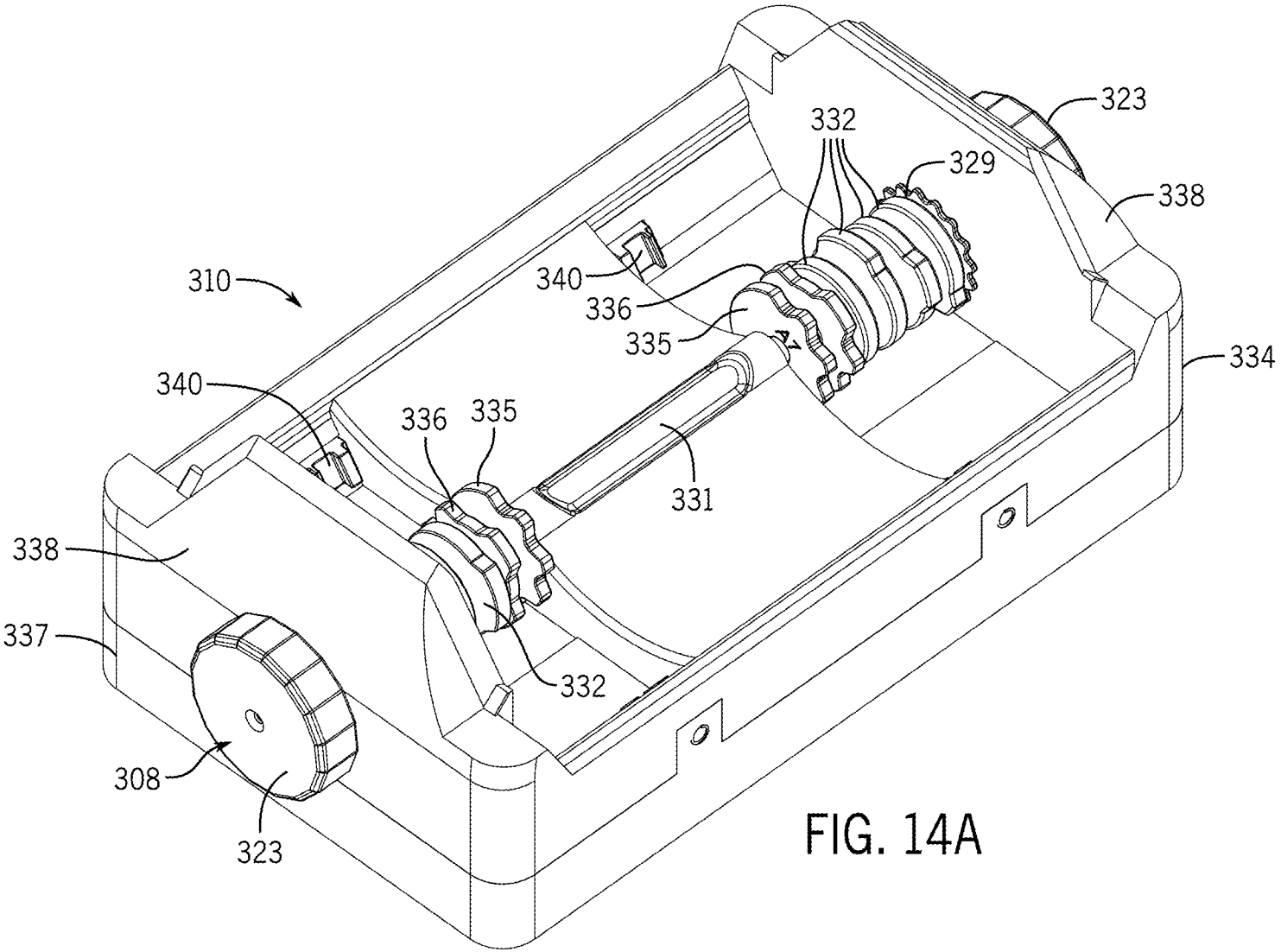
FIG. 14A is an isometric view of a base assembly of the system of FIG. 11.
Figure 15:
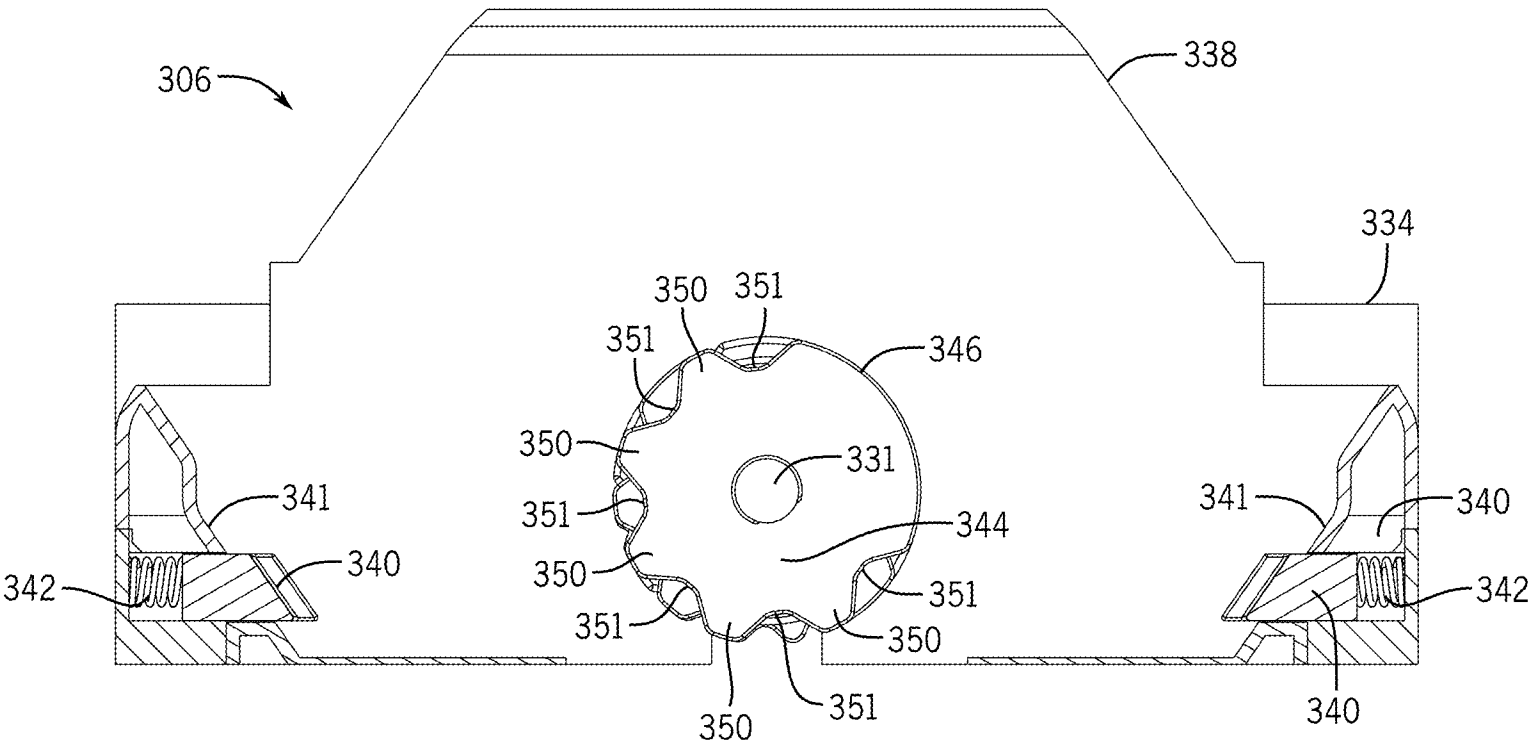
FIG. 15 is an end-facing section view of the base assembly of FIG. 14A through its supplemental weight interlocks.
Figure 16:
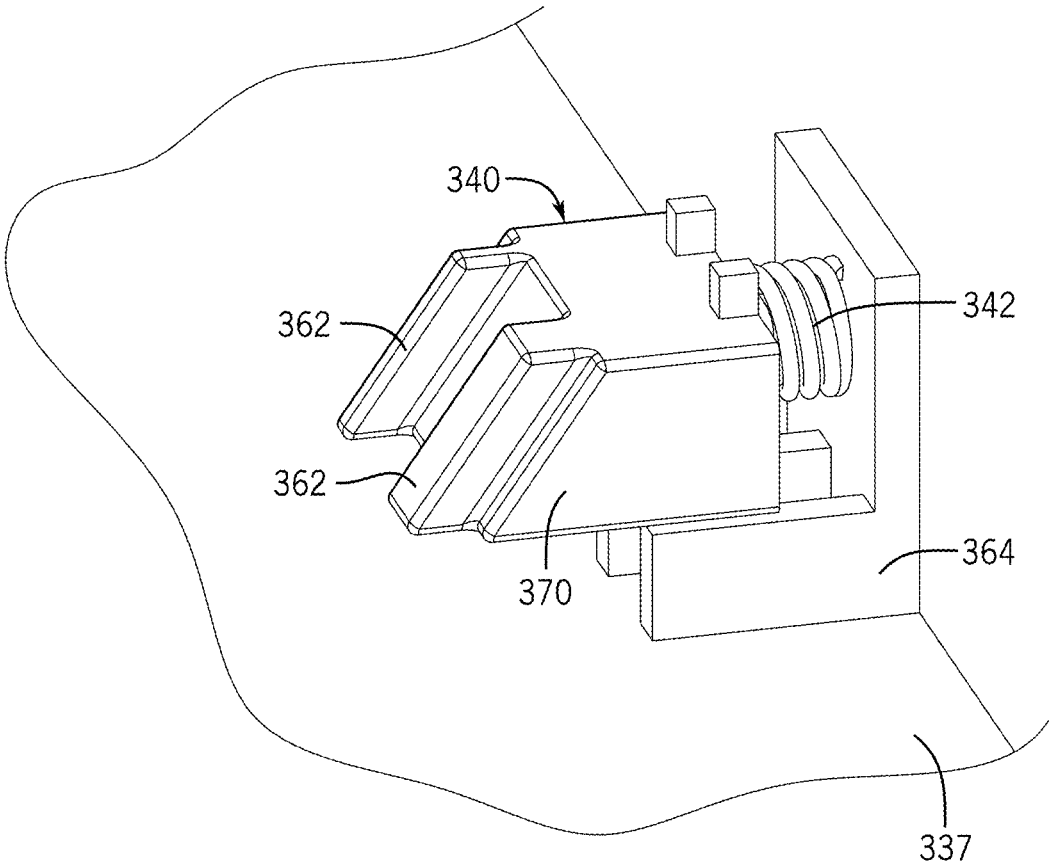
FIG. 16 is an isometric view of a supplemental weight interlock of the system of FIG. 11.

The axial position of the supplemental cam of each supplemental weight 314, 328 on the cam shaft 331 can correspond to the axial position of the supplemental weight 314, 328 in the system 300. Thus, as shown in FIG. 14A, which is a perspective view of the base assembly 310, the weight selector assembly 308 may have a set of main weight cams 332 axially aligned with main weights 302 and a set of supplemental cams 335, 336 axially aligned with supplemental weights 314, 328. A pair of supplemental cams 335, 336 on each end of the handle 312 enable coupling of a respective pair of supplemental weights 314, 328 on each side of the handle 312, thereby also enabling a plurality of incremental steps of load adjustability for the system 300 corresponding to each pair of supplemental weights 314, 328. The supplemental weights 314, 328 can be coupled as pairs or multiple pairs to the handle assembly 304 within the cap plate 306. In some embodiments, individual supplemental weights 314, 328 can be coupled, or a non-matching pair of supplemental weights (e.g., one weight 314 and one weight 328) can be coupled simultaneously, based on the shape characteristics of the supplemental cams 335, 336. As shown in FIG. 15, in some embodiments, a supplemental cam 335 may have a set of protrusions 350 between which a set of recesses 351 are positioned and which engage with a cam follower (e.g., 318) to engage or disengage a supplemental weight 328. The supplemental cam 335 may also have a larger protrusion 346 (such as for example a circumferentially extending surface portion) lacking recesses 351. Thus, at least a first range of angular positions of the supplemental cam 335 can correspond to alternating engagement and disengagement of the supplemental weight 328 (e.g., the range including the alternating protrusions 350 and recesses 351), and at least a second range of angular positions of the supplemental cam 335 may correspond to consistent disengagement of the supplemental weight 328 (such as for example the range including protrusion 346) due to a cam surface that keeps the cam follower 318 from moving into a coupling/engagement position (e.g., a position similar to the position shown in FIG. 10C).

FIG. 14A also shows that the base assembly 310 may include a cap plate 334 and a base plate 337 that house and support the weight selector assembly 308. The weight selector assembly 308 may include one or more handles 323 operable to rotate the cam shaft 331. Additionally, the weight selector assembly 308 may include one or more detent rings 329 configured to engage a biased protrusion (such as for example cam follower), similar in form and function to the protrusion 1010 and biasing member 1011 discussed in connection with system 100. See also FIG. 14B. Using multiple rings 329 and biased protrusions can increase the feedback and resistance to turning the cam shaft 331 and can ensure that substantially the same torque needs to be applied at each end of the cam shaft 331 for an equivalent amount of angular displacement. In some embodiments, the rings 329 may be integrated with or attached to one or more of the main weight cams 332.

Figure 14B:
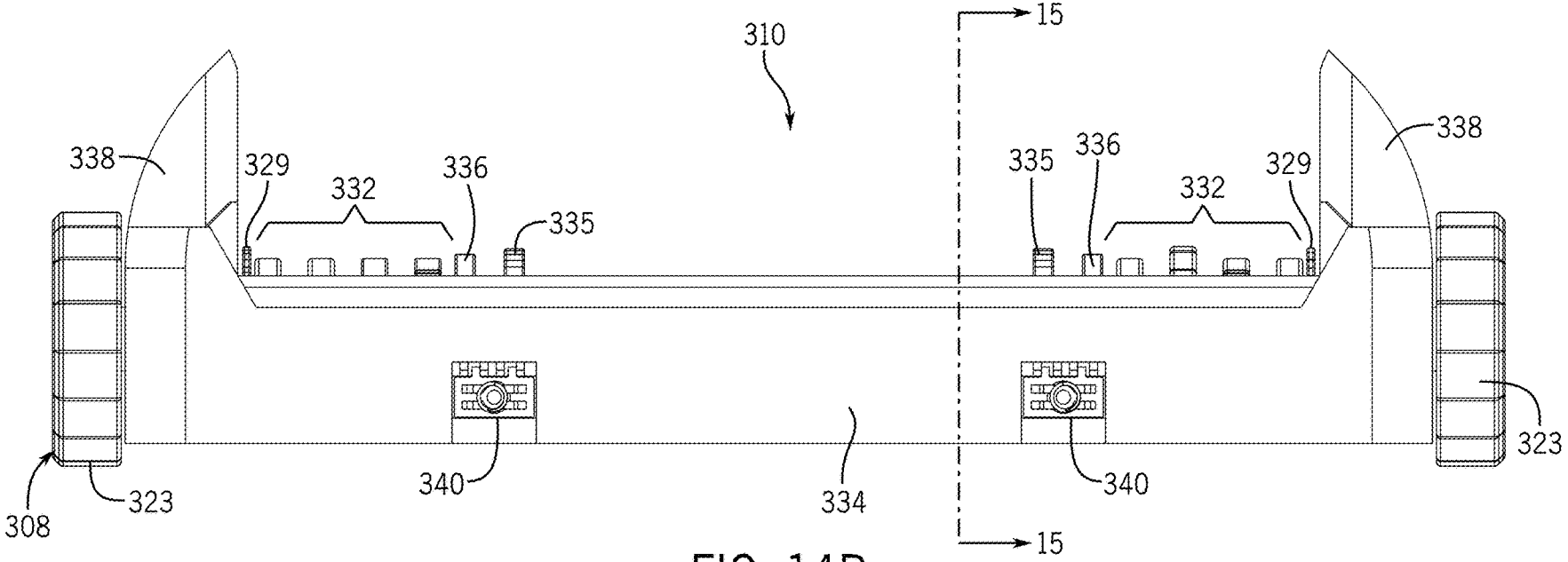
FIG. 14B is a side view of portions of the base assembly of the system of FIG. 11.

FIG. 14B is a side view of portions of the base assembly 310. Some elements, including the base plate 337, are not shown. The spaced-apart axial positions of the main weight cams 332, the supplemental cams 335, 336, and the detent rings 329. Side caps 338 cover the ends of the base assembly 310 and protect and guard the parts of the weight selector assembly 308. In some embodiments, the side caps 338 are integrally formed with the cap plate 334, and in some embodiments, the side caps 338 may be removable or separate from the cap plate 334.

The base assembly 310 may also include a set of supplemental weight interlocks 340 configured to prevent the supplemental weights 314, 328 from being unintentionally raised due to the biasing force on their respective cam followers 318. The supplemental weight interlocks 340 may also aid in pre-selection of the weights, allowing the cam to rotate with the handle out of the base assembly 310 but preventing the supplemental weights 314, 328 from moving relative to the base assembly 310. The supplemental weight interlocks 340 are also shown in the side section view of FIG. 15, wherein they are positioned in an angled, non-vertical surface 341 of the base assembly 310 that is configured to face and/or support the side of a supplemental weight 314, 328 when in the base assembly 310.

Supplemental weight interlocks 340 may be resiliently retained by a spring or other resilient element 342 that biases the interlock 340 inward and toward at least one interlock recess 343, 345 of a supplemental weight 314, 328. See FIGS. 12A and 13A. This may allow the supplemental weight interlock 340 to move within the base assembly 310 to engage with and disengage with the supplemental weights 314, 328 in a manner holding or releasing the supplemental weights from the base assembly 310.

FIGS. 16-18B illustrate views of a supplemental weight interlock 340. As shown in the perspective view of FIG. 16, the supplemental weight interlock 340 may have a body 370 with one or more engagement sections 362 that may be configured to engage with one or more supplemental weight interlock recesses 343, 345 of the supplemental weights 314, 328. In various embodiments, the supplemental weight interlock 340 may be movably positioned on a support structure 364 (that may be part of base plate 337) that may position the interlock 340 to engage with the supplemental weights 314, 328 or handle weight (e.g., 105). Additionally, the supplemental weight interlock 340 may be biased into the dumbbell-receiving top recess of the cap plate 334 of the base assembly 310 with a spring or other resilient element 342. The spring or resilient element 342 may bias the supplemental weight interlock 340 toward the supplemental weight interlock recesses 343, 345 when the supplemental weights are located within the base assembly 310, as explained in additional detail below.

Figure 17:
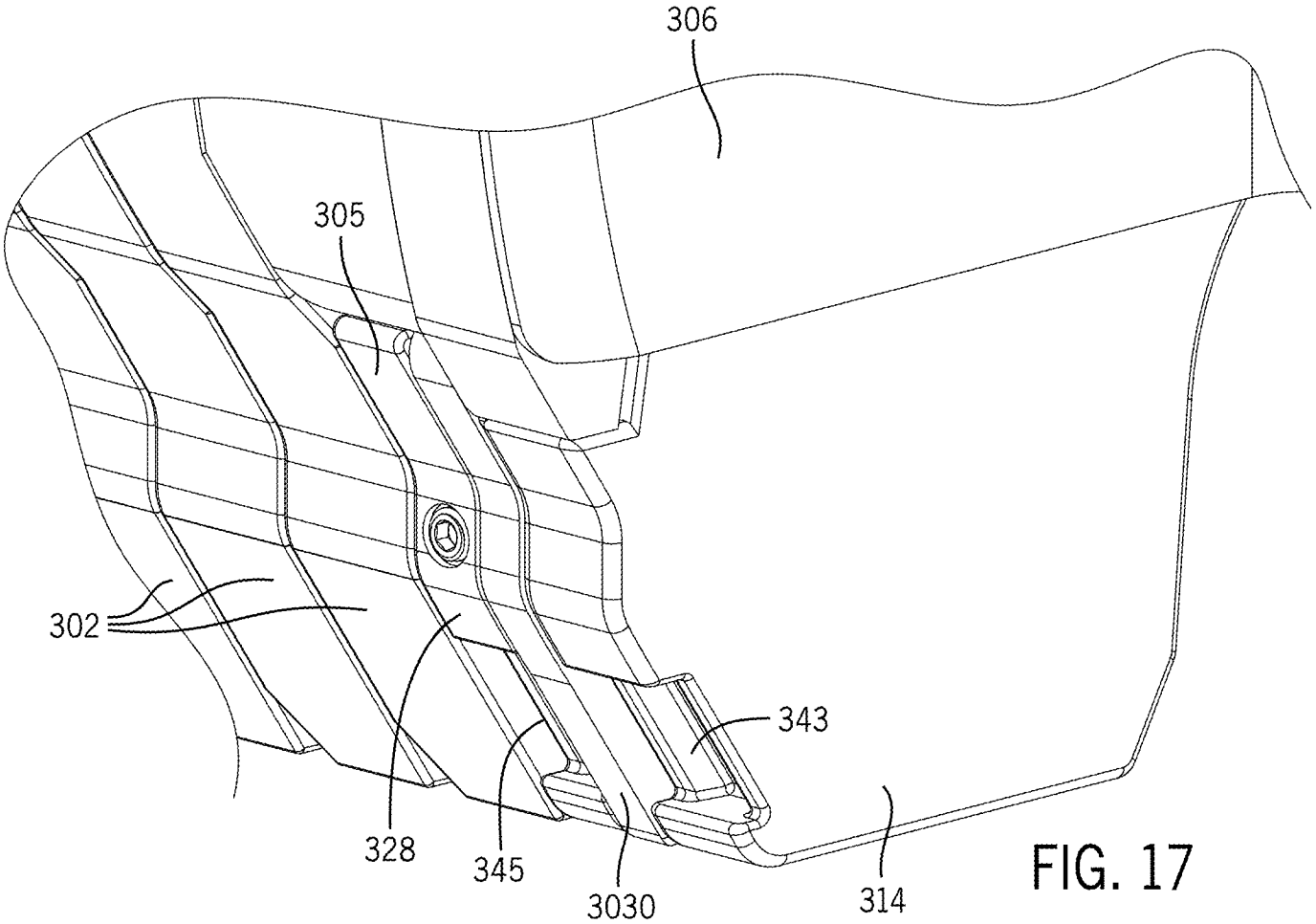
FIG. 17 is an isometric view of a portion of the handle assembly and the supplemental weights of the system of FIG. 11.
Figure 18A:
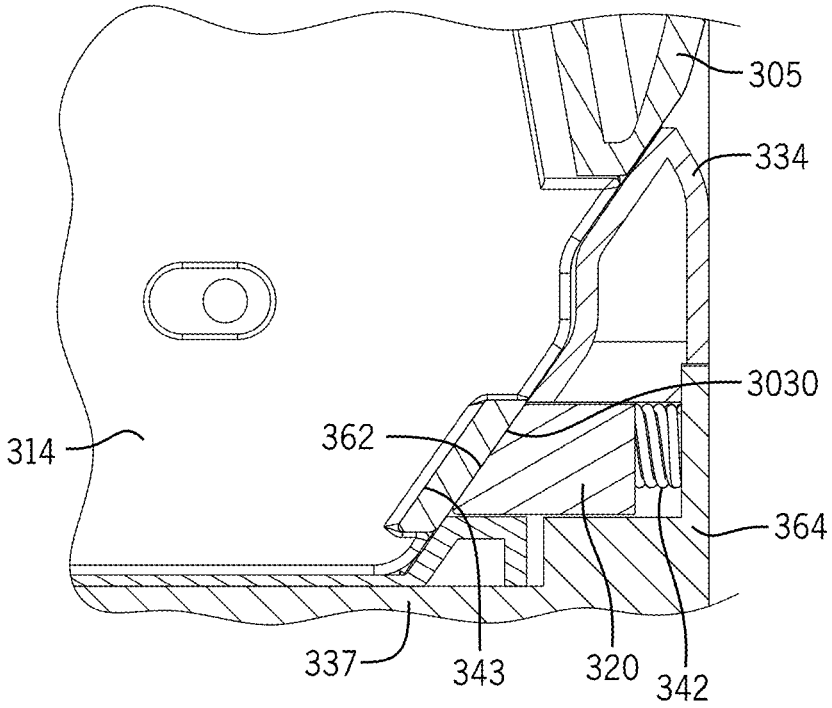
FIG. 18A is an end-facing section view of the system of FIG. 11 at a supplemental weight interlock with the supplemental weight interlock in a first configuration.
Figure 18B:
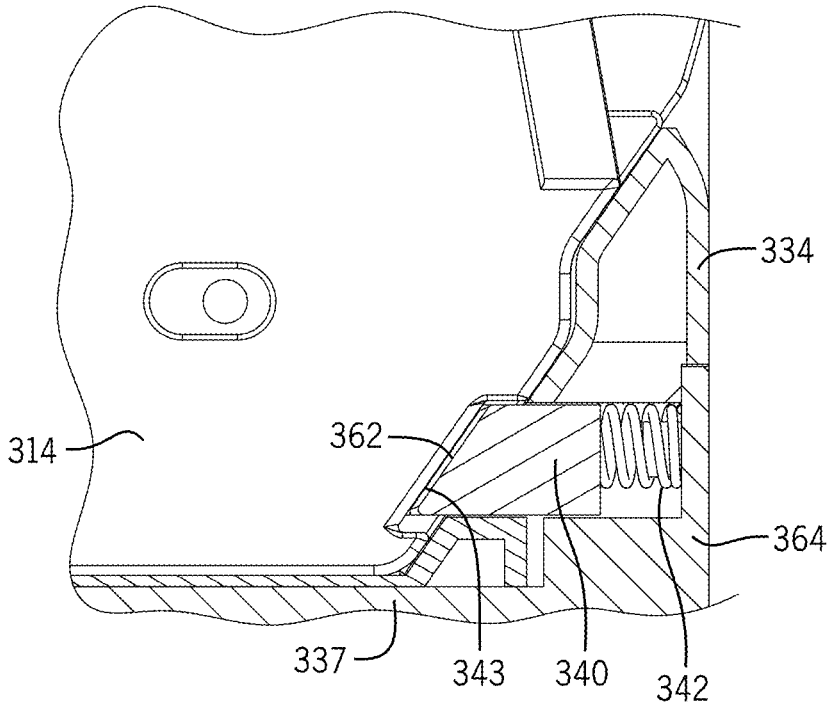
FIG. 18B is an end-facing section view of the system of FIG. 11 at a supplemental weight interlock with the supplemental weight interlock in a second configuration.
Figure 19:
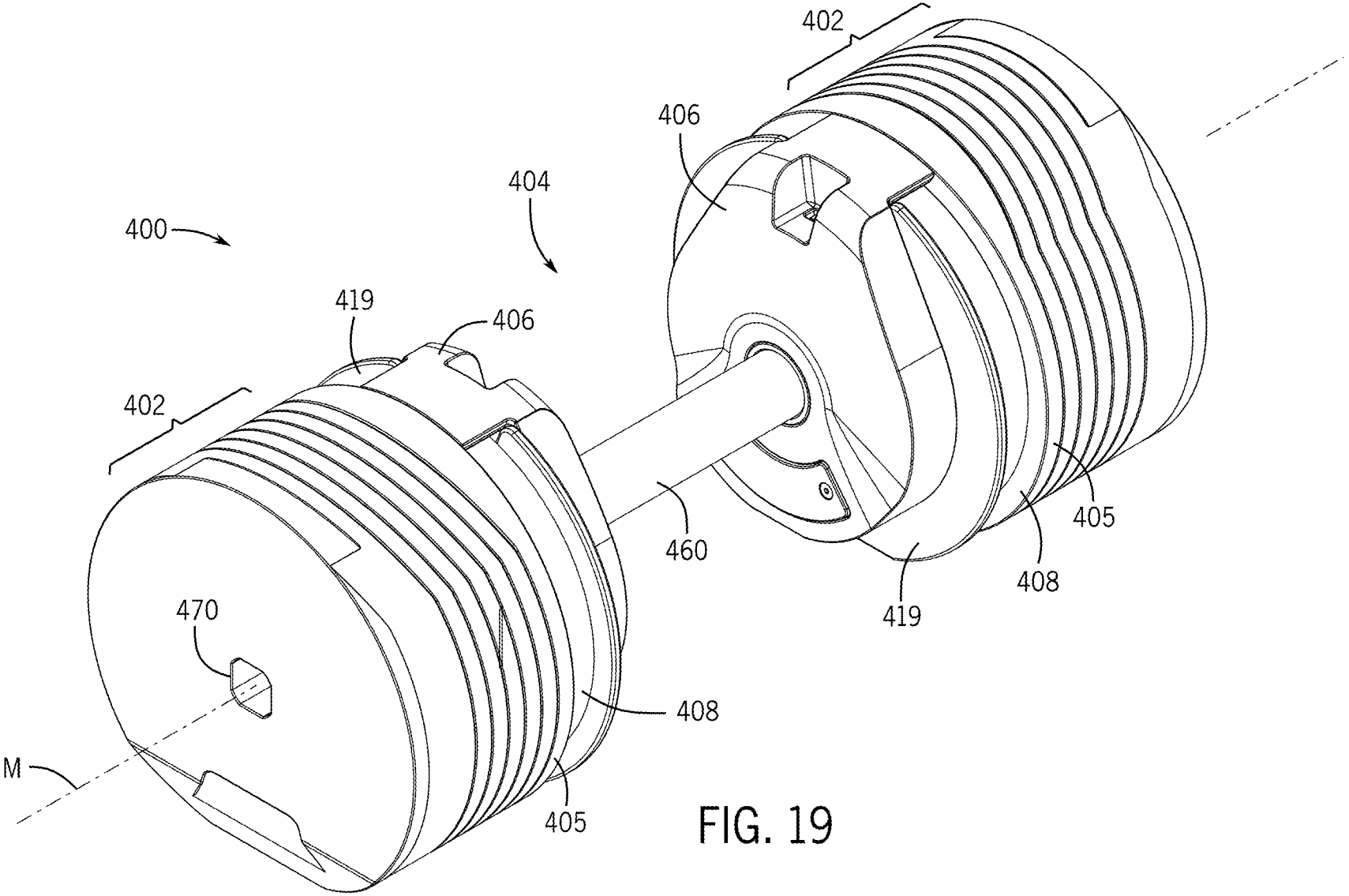
FIG. 19 is an isometric view of a dumbbell system.

FIGS. 17-18B further illustrate features related to the engagement of the supplemental weight interlock 340 with the supplemental weights 314, 328 and a handle weight 305. The handle weight 305 may include features in common with handle weight 105. When the handle weight 305 and the supplemental weights 314, 328 are coupled together (as shown in the detail perspective view of FIG. 17), or at least when all of them are positioned on the base assembly 310 (as shown in the end-facing section view of FIG. 18A), an interlock engagement surface 3030 of the handle weight 305 (e.g., positioned as shown by corresponding interlock engagement surfaces 1030 on weight 105 in FIGS. 4, 10B, and 10C) may be positioned axially adjacent to the supplemental weight interlock recesses 343, 345. Additionally, the interlock engagement surface 3030 may define an outer surface that extends further laterally away from a central vertical plane through the cam shaft 331 than the supplemental weight interlock recesses 343, 345. The interlock engagement surface 3030 may also be configured to contact the supplemental weight interlock 340 when the dumbbell is supported by the base assembly 310, as shown in FIG. 18A.

Thus, when the handle weight 305 is positioned on the base assembly 310, the interlock engagement surface 3030 can contact the supplemental weight interlock 340 and can push it laterally outward (overcoming the biasing force applied by the resilient element 342) to a position (as shown in FIG. 18A) where it is not seated within or engaging the supplemental weight interlock recess 343, 345 of either nearby supplemental weight 314, 328. Accordingly, in this position, the supplemental weights 314, 328 may be coupled and decoupled from the handle weight 305. As the handle weight 305 is lifted away from the base assembly 310, the interlock engagement surface 3030 may move upward and away from the supplemental weight interlock 340. The biasing force of the resilient element 342 may drive the interlock 340 laterally inward.

If a supplemental weight (e.g., 314) is coupled to the handle weight 305 as the handle assembly is lifted, the interlock 340 is prevented from engaging the supplemental weight interlock recess (e.g., 343) by the interlock engagement surface 3030 on the handle weight 305 contacting the engagement sections 362 (or another laterally-inward-facing surface of the interlock 340). If a supplemental weight is not coupled to the handle weight 305 as the handle assembly is lifted (e.g., as shown in FIG. 18B), the interlock 340 may slide laterally inward to a position engaging the supplemental weight interlock recess. Additionally, with an interlock 340 positioned on each lateral side of the supplemental weight, the supplemental weight is retained to the base assembly 310 by the interlocks 340 while the handle weight 305 is in use. This automatic retention of the supplemental weights 314, 328 can help prevent tampering with or incorrect repositioning of the supplemental weights while the dumbbell is being used.

Any of the features, components, and/or parts, including the arrangements and configurations thereof shown in FIGS. 11-18B, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 11-18B.

FIGS. 19-26 illustrate features of a dumbbell system 400 having some features and elements in common with the other dumbbell systems described herein (e.g., systems 100, 300). The adjustable dumbbell system 400 may include a handle assembly 404 that is centrally located in the system 400 with a handle 460 in its center and two sets of main weights 402 coupleable with the ends of the handle assembly 404 at a set of handle weights 405.

Figure 20:
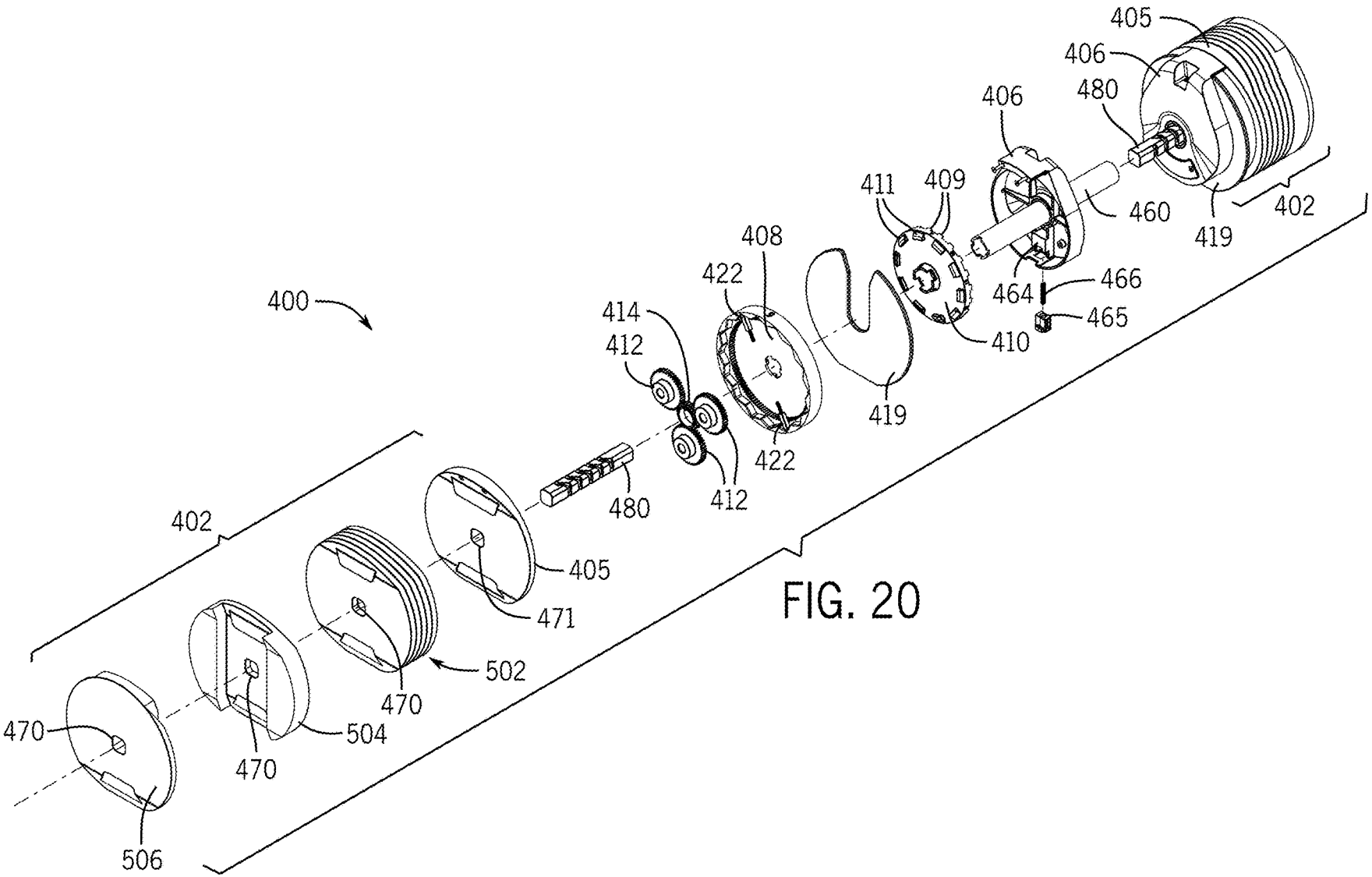
FIG. 20 is a partially exploded view of the system of FIG. 19.

A cover plate 406 and a gear housing 408 may be positioned axially inward from the handle weight 405 on each side of the handle assembly 404 and may collectively form an enclosure with a corresponding handle weight 405. FIG. 20 shows a partially exploded view of the system 400 that shows one end of the handle assembly 404 and its main weights 402 separated from the opposite end thereof (which remains assembled on the right end of FIG. 20).

The handle 460 may be a tubular member or tube having a central axis M. The main weights 402 and handle weight 405 may each have an aperture 470, 471 aligned with the central axis M and aligned with each other. On each end of the handle 460, within its internal tubular cavity, a rod 480 may be positioned. An outer surface of the rod 480 may define a helical path 435 (e.g., a helically extending groove or winding trench), as shown in at least FIG. 23A.

Figure 21A:
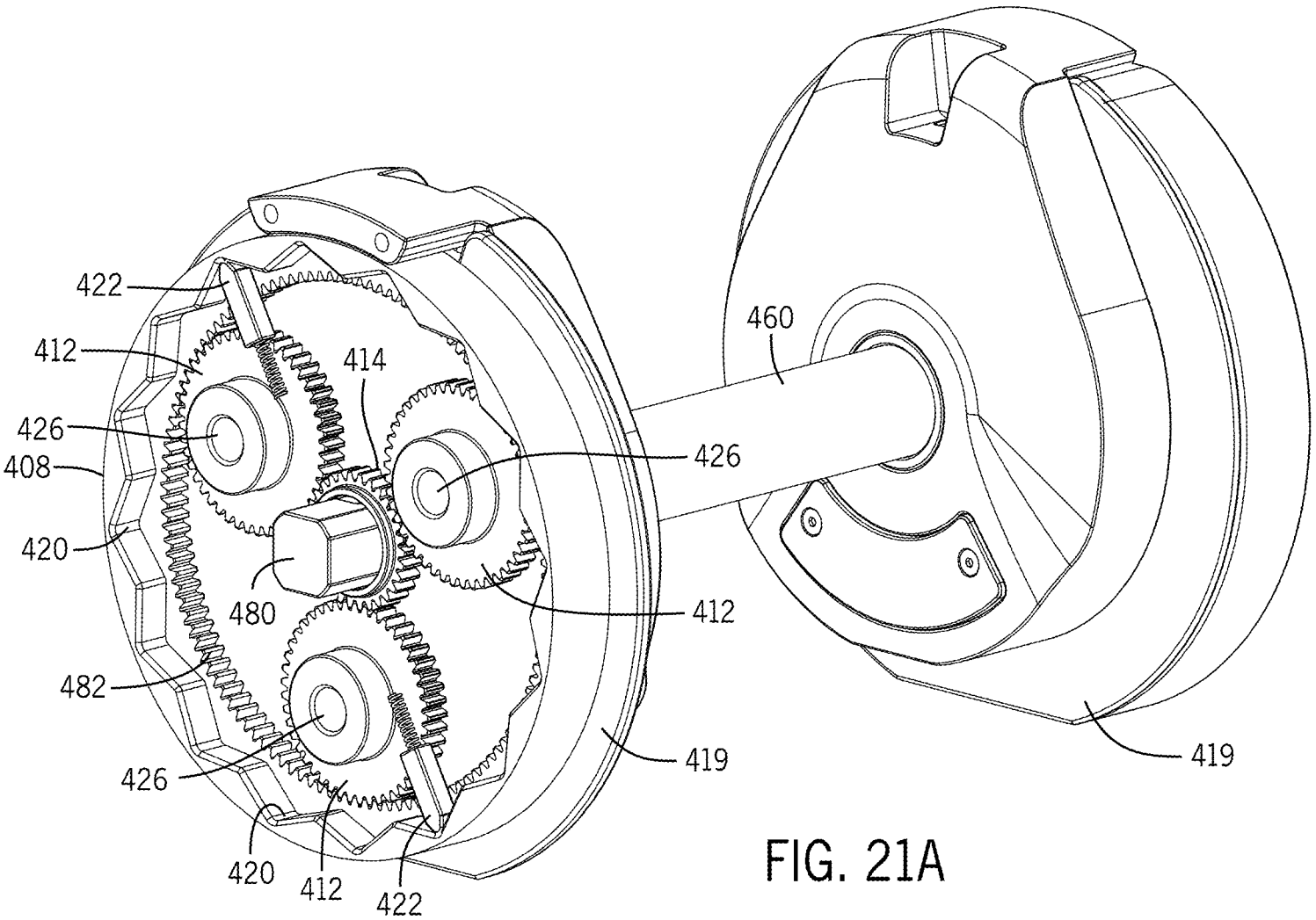
FIG. 21A is an isometric view of a partially disassembled handle assembly of the system of FIG. 19.
Figure 22A:
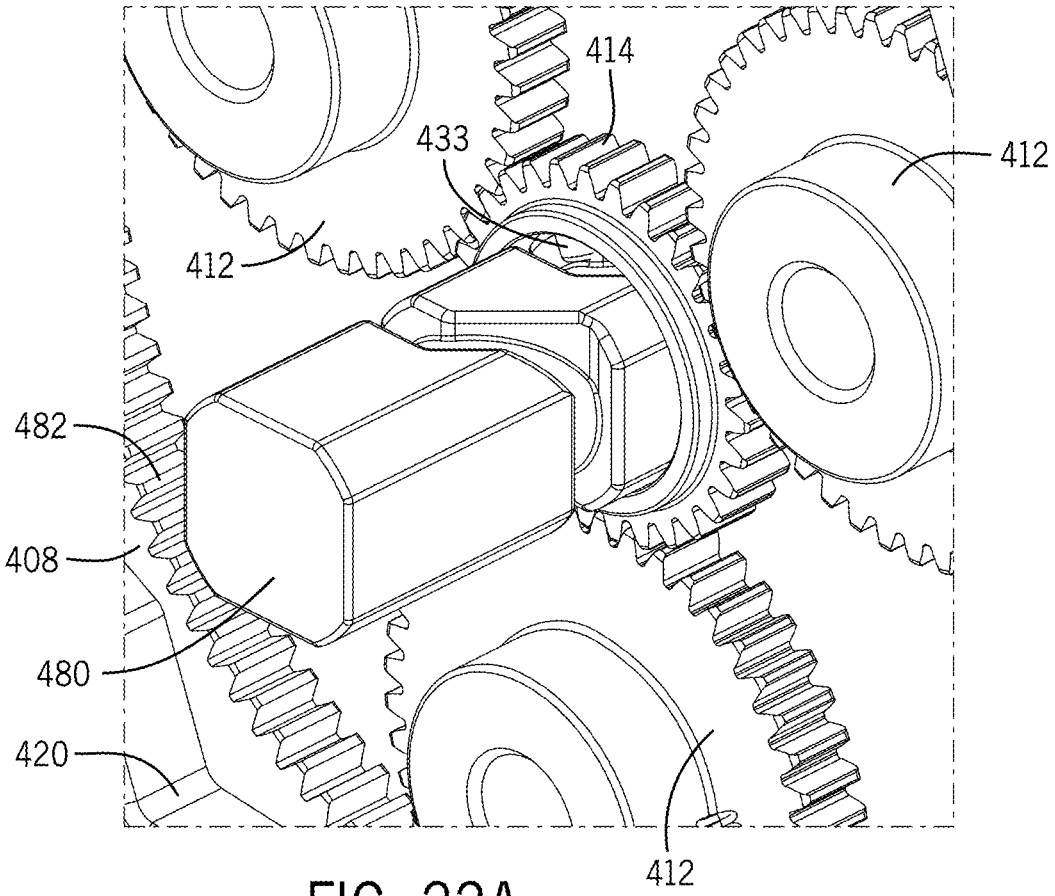
FIG. 22A is an isometric view of a weight selection assembly of the system of FIG. 19.
Figure 22B:
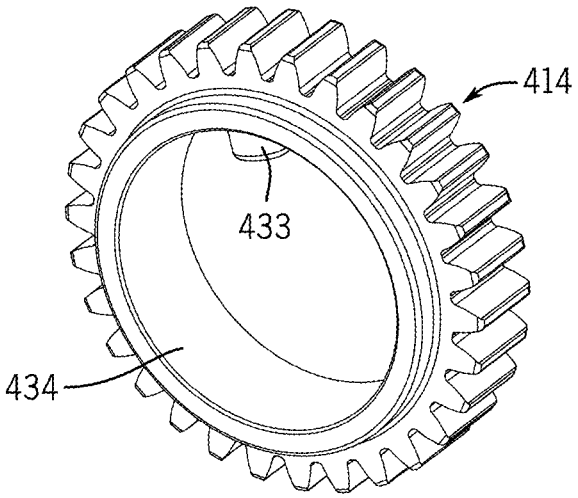
FIG. 22B is an isometric view of a sun gear of the system of FIG. 19.

The handle assembly 404 may contain a set of gears, including a gear housing 408 coupled with the handle 460, at least one planet gear 412, and a sun gear 414 arranged as shown in FIGS. 21A and 22A. Thus, the gear housing 408 may have an inner toothed surface 482 enmeshed with the planet gears 412, and the planet gears 412 may be enmeshed with the sun gear 414. The sun gear 414 may have a central opening 434 aligned with the rod 480 and through which the rod 480 is axially translatable. The central opening 434 may include a follower 433 (such as for example a radially-inward-projecting protrusion or rotation guide) configured to radially extend into the helical path 435 of the rod 480. In some embodiments, the follower 433 may be a radially extending recess in the central opening 434 configured to receive a helical path 435 that is radially projecting from the rod 480.

The follower 433 may be rotatably coupled with the handle 460 via the set of gears (such as for example via the gear teeth of housing 408, planet gears 412, sun gear 414), wherein axial rotation of the handle 460 induces axial rotation of the sun gear 414 and follower 433. Accordingly, due to the follower 433 being positioned in engagement with the helical path 435, the rotation of the handle 460 and sun gear 414 induces axial translation of the rod 480 as the follower 433 applies pressure to the sides of the helical path 435. The rod 480 therefore may move through a range of axial positions based on the amount of angular displacement of the follower 433. The rod 480 is guided by the helical path 435 in which the rod 480 is extended into, or withdrawn from, the apertures 470 of the main weights 402.

Figure 21B:
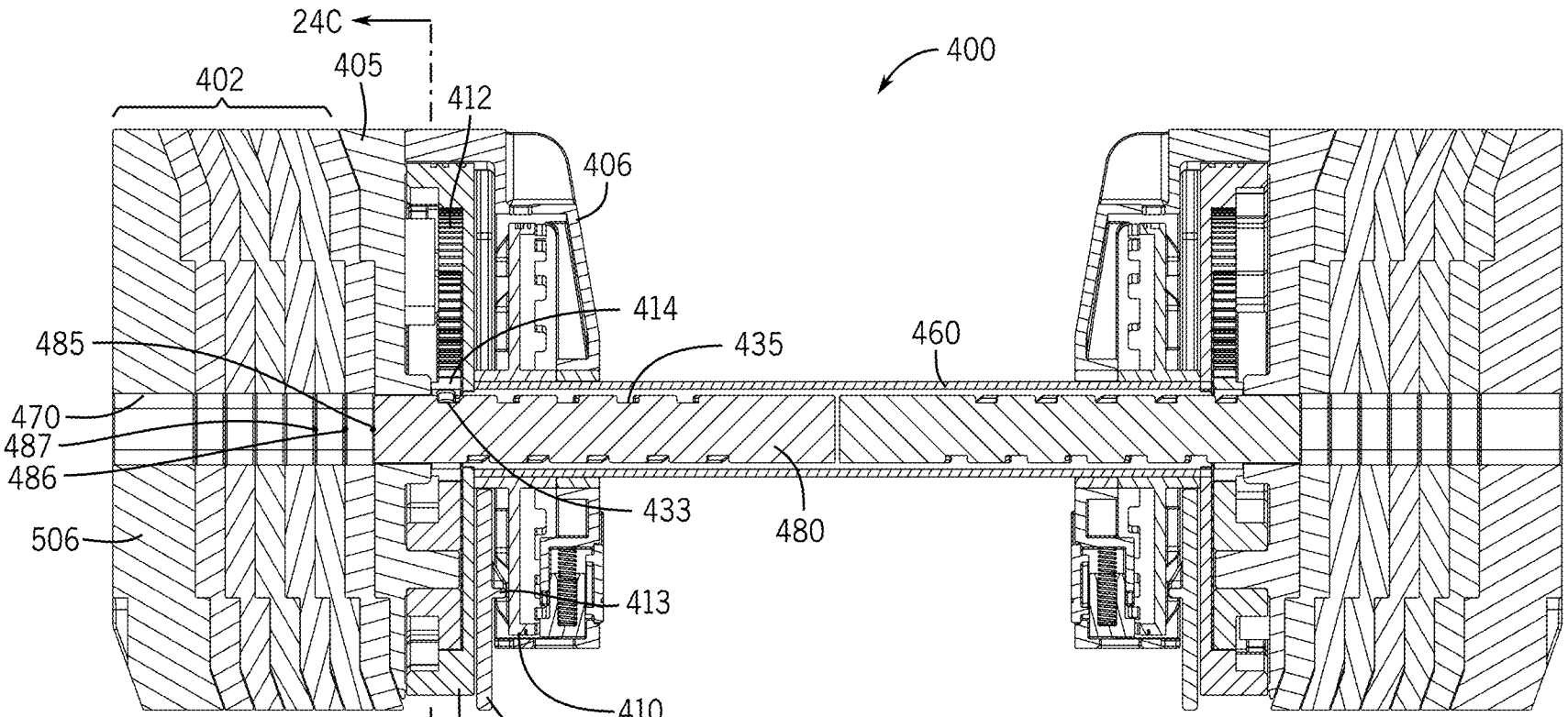
FIG. 21B is a central side section view of the system of FIG. 19 with a rod in a first position.
Figure 21C:
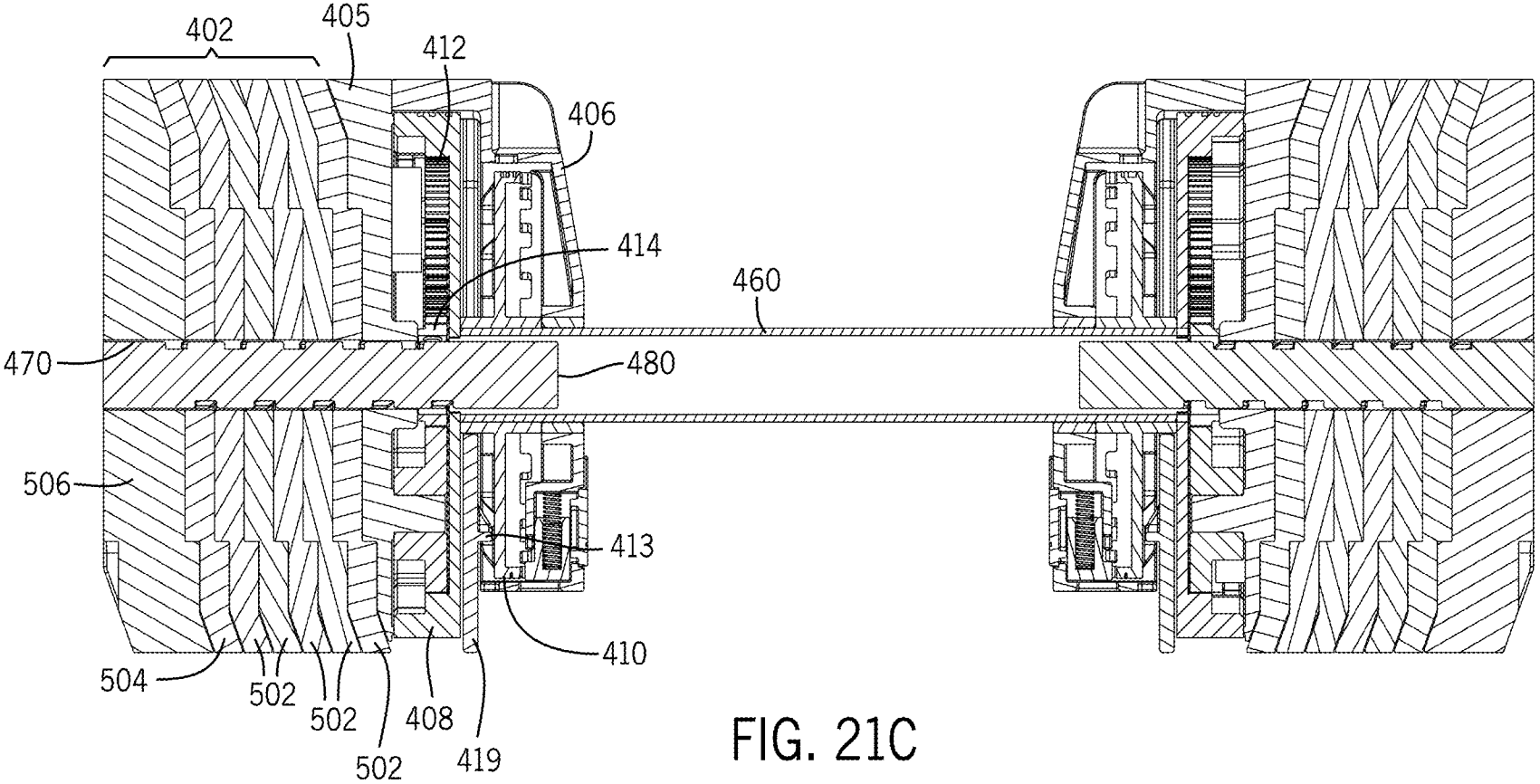
FIG. 21C is a central side section view of the system of FIG. 19 with the rod in a second position.

The position of the rod 480 shown in FIGS. 21A, 21B, and 22A is a fully withdrawn position, and the position of the rod 480 shown in FIG. 21C is a fully extended position. In the fully withdrawn position, the handle assembly 404 is decoupled from all of the main weights 402 and is liftable away from the main weights 402 since the rod 480 is not positioned in the apertures 470 of the main weights 402. In the fully extended position, the rod 480 extends through all of the apertures 470, so the main weights 402 are not laterally movable away from the rod 480 due to contact between the each aperture 470 and the outer surface of the rod 480. Furthermore, the partially squared, non-circular cross-sectional profile of the rod 480, as shown in at least FIG. 22A, when engaging the aperture 470, limits or prevents axial rotation of the main weight 402 about the central longitudinal axis M of the rod 480. Thus, the rod 480 retains the main weights 402 to the handle assembly 404 as the user lifts the handle 460.

The handle 460 and rod 480 may be operated to positions between the fully withdrawn and fully extended positions of FIGS. 21B and 21C. For instance, the outer tip of the rod 480 can be advanced to a plurality of different axial positions including at least one position corresponding to each of the main weights 402. For example, the outer tip portion of the rod 480 can be advanced from the fully withdrawn position at point 485 in FIG. 21B to a position coupling the nearest main weight 402 at point 486, coupling the two nearest main weights 402 at point 487, and so on, until eventually reaching the fully extended position of FIG. 21C.

Figure 24B:
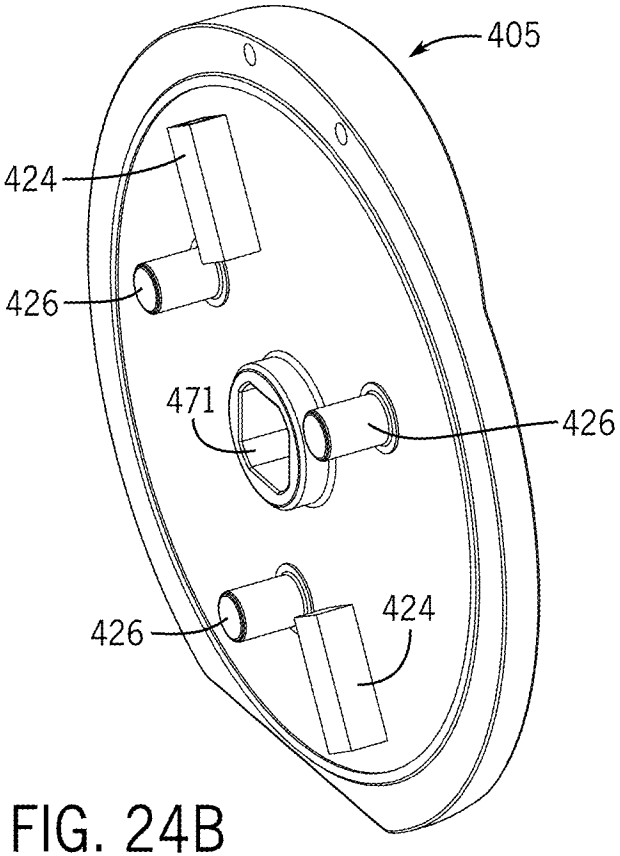
FIG. 24B is an isometric view of the weight of FIG. 24A.
Figure 24A:
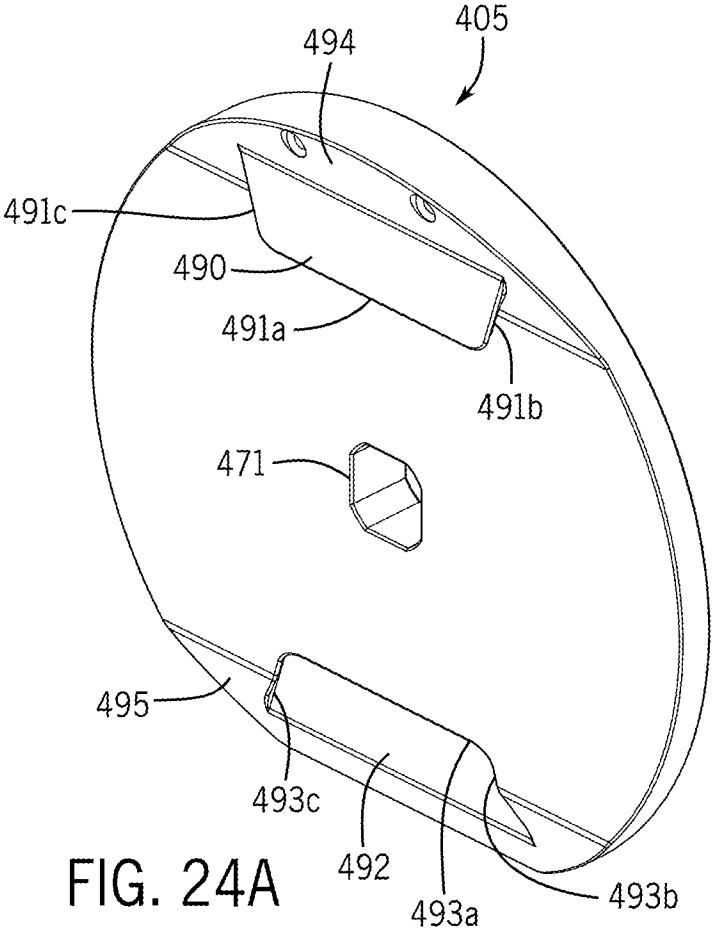
FIG. 24A is an isometric view of a handle weight of the system of FIG. 19.
Figure 24C:
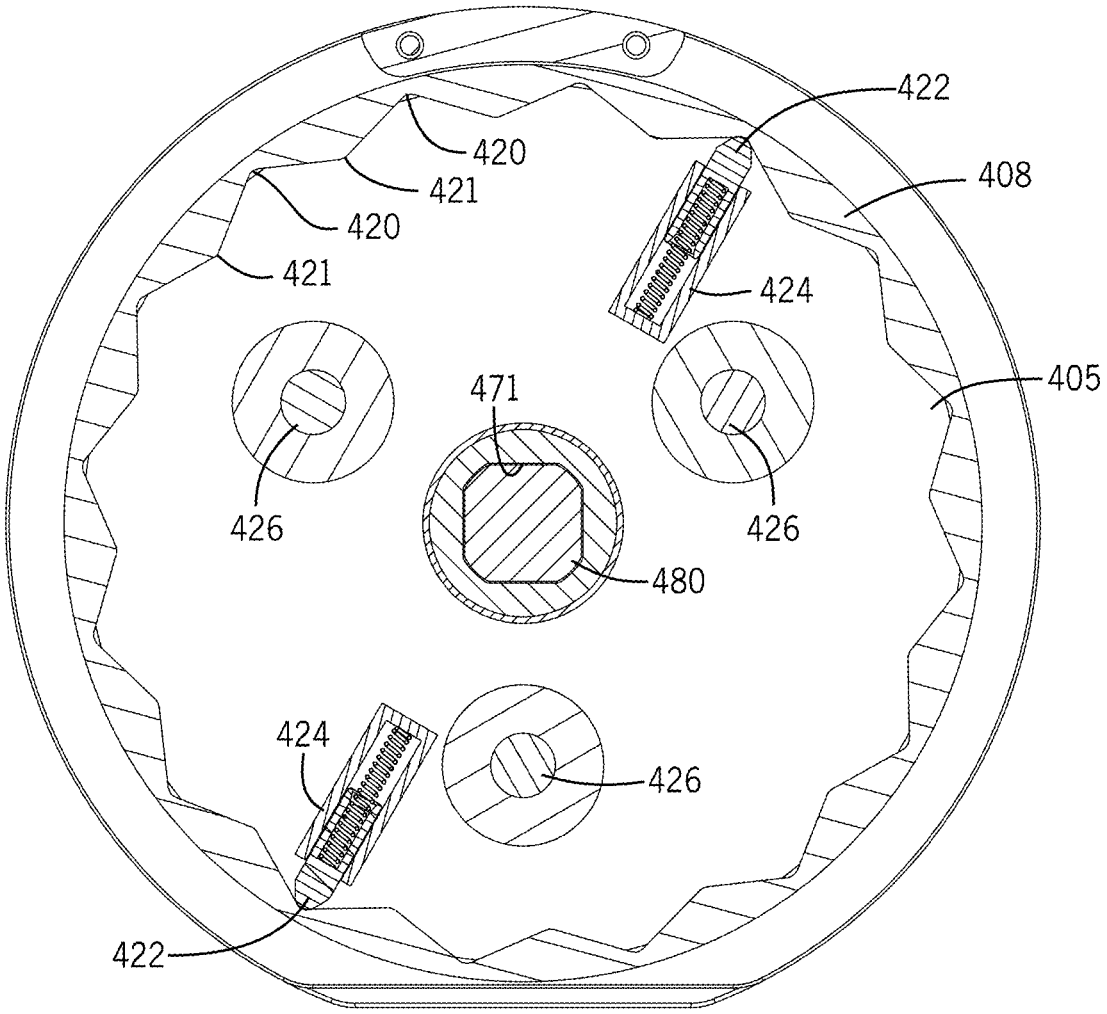
FIG. 24C is an end facing section view of a gear housing and biased followers of the system of FIG. 19.

In order to help ensure that the user does not adjust the rod 480 to a position where one of the main weights 402 is not securely or completely on the rod 480, the system 400 may include a detent mechanism, as illustrated in FIGS. 20, 21A, 24B, and 24C. The detent mechanism may include a set of alternating radial detents (e.g., 420) and protrusions (e.g., 421) circumferentially spaced around and within the gear housing 408, as shown in FIG. 21A. The handle weight 405 may support a set of biased followers 422 within enclosures 424 (see FIGS. 24B and 24C) on an axially inward side of the handle weight 405. The followers 422 may be biased radially outward and toward the gear housing 408 to engage the detents (e.g., 420) and protrusions (e.g., 421) thereof, as shown in FIG. 24C. FIG. 24C is a section view taken through section lines 24C-24C in FIG. 21B and which shows the main weight 402 behind an axially-outward-facing cross-section of the gear housing 408.

The handle weight 405 may be configured to be stationary as the gear housing 408 axially rotates in response to the rotation of the handle 460, so the followers 422 may be driven inward as the gear housing 408 moves a protrusion (e.g., 421) into contact with the end of the follower 422 and can be driven outward as the gear housing moves a detent (e.g., 420) into contact with an end of the follower 422 and a biasing member pushes the follower 422 radially outward into the detent. The followers 422 may have lower potential energy while in the detents and may therefore bias the rotation of the gear housing 408 (and other components rotationally coupled to it, including the handle 460) to discrete angular positions. Some of these angular positions can correspond to positions of the rod 480 where it would be suitable for supporting a discrete main weight 402 (e.g., at point 486, 487, etc.). Thus, if a user rotates the handle 460 to a position where the rod 480 would not be properly located to support a main weight 402, the detent mechanism can urge or bias the rotation of the handle 460 rotationally backward or forward until the rod 480 is at a proper location for main weight 402 engagement.

Additionally, the handle weight 405 may define a set of posts 426 configured to support the planet gears 412, as shown in FIGS. 21A, 24B, and 24C. Thus, the planet gears 412 may rotate about the posts 426 without revolving around the rod 480. Meanwhile, the gear housing 408 and the sun gear 414 rotate about the central axis M to adjust the axial position of the rod 480.

In some embodiments, the system 400 includes a discrete detent position for each of the main weights 402. In some embodiments, finer load adjustment may be performed by coupling or decoupling a supplemental weight 419 (or a pair thereof) relative to the handle assembly 404 at different rotational positions of the handle 460. For example, turning the handle 460 about the central axis M with a first amount of angular deflection can engage the supplemental weights 419, and turning the handle about the central axis M with a second amount of deflection can disengage the supplemental weights 419 and engage the first main weights 402. Turning to a third amount of deflection can engage the supplemental weights 419 and the first main weights 402, and turning to a fourth amount of deflection can engage the first and second main weights 402 while disengaging the supplemental weights 419. Additional rotation may, in an alternating fashion, engage a supplemental weight, additional main weight, or both, in succession. A detent (e.g., 420) in the gear housing 408 can correspond to discrete total load configuration of the system 400 enabled by the various combinations of supplemental weights 419, main weights 402, and handle weights 405.

Each end of the handle assembly 404 may include a supplemental weight selector 410 (see FIG. 20) to control whether a respective supplemental weight 419 is coupled to the handle assembly 404 or not. The supplemental weight selector 410 may include a plurality of circumferentially spaced apart protrusions (e.g., 411) facing toward the supplemental weight 419. The supplemental weight selector 410 and its protrusions may rotate with the handle 460 between positions in which (a) one of the protrusions engages an axially-extending protrusion 413 (see FIG. 21B) on the supplemental weight 419 that faces the supplemental weight selector 410 and (b) the axially-extending protrusion is positioned between two adjacent protrusions (e.g., 411) on the supplemental weight selector 410. When the protrusions on the supplemental weight 419 and selector 410 engage each other, the supplemental weight 419 is lifted with the handle assembly 404, and when the protrusion on the weight 419 is between protrusions on the selector 410, the weight 419 is decoupled from the handle assembly 404. As a result, some detents (e.g., 420) can correspond to positions in which the supplemental weight 419 is coupled to the handle assembly 404, and other detents can correspond to positions where the weight 419 is decoupled therefrom.

In some embodiments, the rod 480 may axially translate intermittently in response to consistent angular rotation of the handle 460. This may beneficially allow the rod 480 to move outward or inward to predetermined axial positions (e.g., 485, 486, and 487) and then to temporarily remain in those positions as the supplemental weights 419 are engaged or disengaged.

Figure 23A:
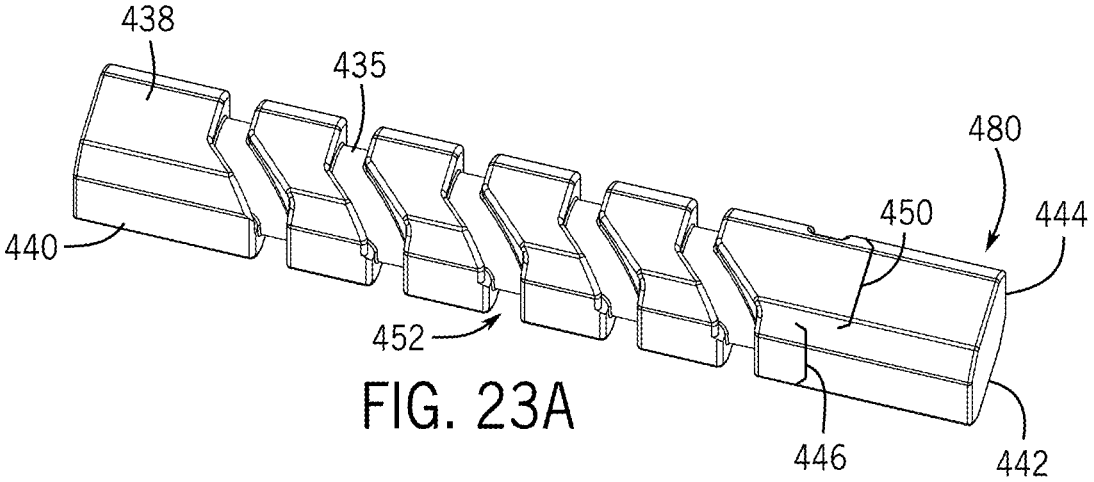
FIG. 23A is an isometric view of the rod of the system of FIG. 19.
Figure 23B:
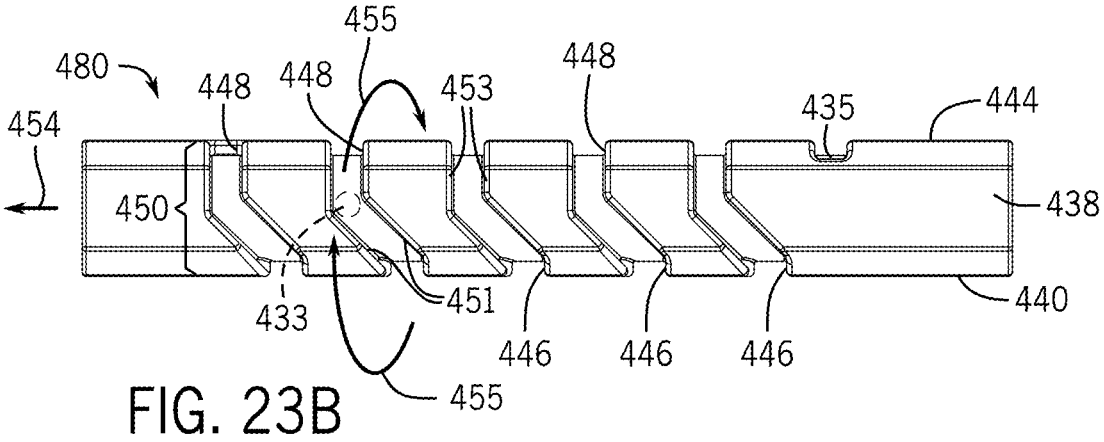
FIG. 23B is a side view of the rod of FIG. 23A.
Figure 23C:
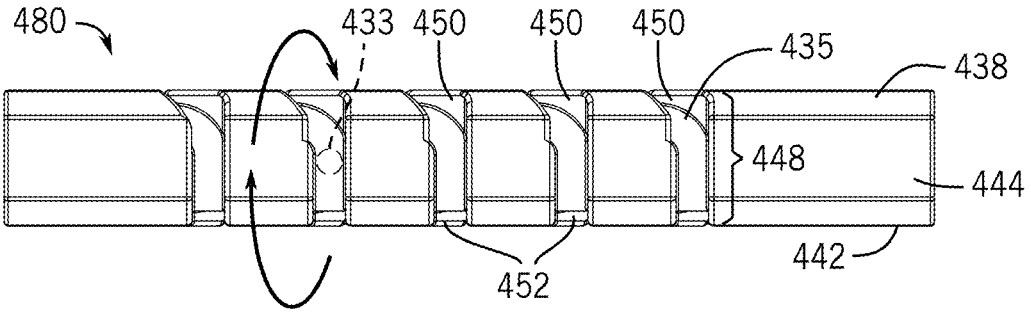
FIG. 23C is a side view of the rod of FIG. 23A.

The helical path 435 may have shape characteristics that enable the intermittent translation of the rod 480. As shown in FIGS. 23A-23C, the helical path 435 may continuously extend around the perimeter of the rod 480, such as for example around four side surfaces 438, 440, 442, 444 that form a substantially square cross-sectional profile of the rod 480. The helical path 435 can have straight path segments 446, 448 on opposite sides 440, 444 of the rod 480, and those segments 446, 448 may wrap around the rod 480 without moving longitudinally along the axis of the rod 480. Thus, while the follower 433 is positioned in those segments 446, 448 of the helical path 435, as schematically shown in FIG. 23C, the rod 480 may remain axially stationary because the follower 433 merely moves through the segment (e.g., 448) without moving axially along the rod 480.

The helical path 435 may also have angled path segments (e.g., 450, 452) extending along the other two sides 438, 442 of the rod 480. The angled path segments 452 may be a mirrored version of the segments 450 shown in FIG. 23B. While the follower 433 traverses those segments (e.g., 450), the rod 480 may be driven axially (such as for example in the direction of arrow 454 as the rod 480 rotates in the direction of arrows 455) due to the follower 433 engaging angled side surfaces (e.g., 451) of the path segment in which it is located, as shown schematically in FIG. 23B. Once reaching the end of an angled wall of the helical path 435, the follower 433 can move to a straight segment (e.g., 446/448), so the rod 480 stops axially advancing or retracting. In some embodiments, the angled path segments 450 may also include partially circumferentially straight walls (e.g., 453) in which the follower 433 does not longitudinally move the rod 480 and in which the follower 433 transitions to one of the straight path segments 446, 448.

In some embodiments, the rod 480 axially moves in response to the follower 433 moving through about 60 degrees to about 90 degrees of angular displacement around the central axis M (such as for example while contacting surfaces 451), then the rod 480 remains axially stationary for the next about 90 degrees to about 120 degrees of angular displacement of the follower 433 (such as for example while contacting surfaces 453 or the side surfaces of path segments 446, 448) before axially moving again.

Each transition from a straight segment 446, 448 to an angled segment (e.g., 450) may correspond to the rod 480 being at one of the engagement positions (e.g., 485, 486, and 487) for the main weights 402. One set of straight segments (e.g., 446) may correspond to the supplemental weights 419 being coupled to the handle assembly 404 while the follower 433 is in those segments, and the opposite set of straight segments (e.g., 448) may correspond to the supplemental weights 419 being decoupled from the handle assembly 404 while the follower 433 is in those segments. In some embodiments, the supplemental weights 419 may be coupled once and decoupled once within the range of motion of the follower 433 moving through just one straight segment (e.g., 446) rather than coupling on one side of the rod 480 and decoupling on the other side thereof. Similarly, in some embodiments, multiple different sets of supplemental weights can be coupled or decoupled along a straight segment. For example, two pairs may be decoupled for the first 15 degrees of angular displacement of the handle while the follower 433 is in the segment (e.g., 446), only a first pair may be coupled for the next 15 degrees, only the second pair may be coupled for the next 15 degrees, and both pairs may be coupled for the final 15 degrees before the follower 433 reaches an angled segment (e.g., 450). Detents (e.g., 420) may correspond to each load configuration as the handle 460 rotates.

Referring again to FIG. 20, in some embodiments, the supplemental weight selector 410 may comprise a set of inward-facing axial protrusions 409. These protrusions 409 may be spaced circumferentially around the circumference of the supplemental weight selector and may have a corresponding set of gaps circumferentially spacing them apart from each other. The cover plate 406 may comprise a latch 465 positioned within a cavity 464 defined by the cover plate 406, and the latch 465 may be biased radially outward by a latch biasing member 466 (e.g., spring or similar device). When the system 400 is lifted away from a base assembly (e.g., base assembly 608 described in connection with FIG. 27 herein), the latch 465 may be biased outward and thereby be positioned in a gap between two adjacent axial protrusions 409 of the supplemental weight selector 410. As a result, the protrusions 409 may contact the sides of the latch 465 and may therefore not rotate about the central axis M. Accordingly, the handle assembly 404 may be limited or prevented from rotating the handle 460 relative to the gear system (and thereby adjusting the coupling of the weights) while the handle assembly 404 is not placed on a base assembly.

When the system 400 is placed on a base assembly, a set of delatching hooks or delatching protrusions (e.g., 610 in FIG. 27) may come into contact with the latch 465, such as by being inserted into bottom openings in the cover plate 406 that are communication with the cavity 464. The delatching protrusions may then drive the latch 465 radially inward by overcoming the biasing force of the latch biasing member 466. With the latch 465 moved out of the gap between the axial protrusions 409, the supplemental weight selector 410, gear housing 408, handle 460, and sun gear 414 may be rotatable about the central axis M again. Thus, while the handle assembly 404 is on the base assembly, the load on the handle assembly 404 may be adjusted, as described elsewhere herein.

As described above, the rod 480 may help laterally retain the main weights 402 to the handle assembly 404. The main weights 402 may also be laterally and axially retained by interlockable undercut surfaces on the axially-facing sides of the weights 402 and 405. FIG. 24A shows that the handle weight 405 may include an axially-outward-extending upper protrusion 490 and an axially inward-extending lower recess 492 on the axially outward side of the weight 405. The upper protrusion 490 may have side surfaces 491*a*, 491*b*, 491*c*, and the recess 492 may have side surfaces 493*a*, 493*b*, 493*c*. Any or all of the side surfaces 491, 493 may be undercut. In the embodiment shown of system 400, only the side surfaces 491*b*, 491*c*, 493*b*, 493*c* are undercut, as shown in detail in FIGS. 21B, 21C, 25C, and 25D. The protrusion 490 may at least partially overlap an overhanging upper sloped surface 494, and the recess (within side surfaces 493) may at least partially overlap a lower sloped surface 495. Side undercut surfaces 491*b*/491*c* may have a tapering width toward the central axis M, and side undercut surfaces 493*b*/493*c* may have a tapering width toward the central axis M as well.

The main weights 402 may have inward-facing sides with corresponding upper recesses 496 at least partially formed on an upper upward-facing sloped surface and lower protrusions 497 at least partially formed on a lower upward-facing sloped surface. The recesses 496 and protrusions 497 may have respective pairs of undercut side surfaces that interlock with the protrusions 490/recesses 491 on a handle weight 405 or a protrusion 498 or recess 499 on another main weight 402 which have undercut surfaces, as indicated, for example, by surfaces 496*a*, 496*b*, 497*a*, 497*b*, 498*a*, 498*b*, 499*a*, and 499*b*. In some embodiments, a surface between a pair of the undercut surfaces 496*a*, 496*b*, 497*a*, 497*b*, 498*a*, 498*b*, 499*a*, and 499*b* can be undercut as well, similar to surfaces 493*a*/493*b*. A recess and a protrusion on the same side of a weight 402 may share line or plane of symmetry, such as a plane extending vertically through the weight 402 and intersecting the central axis M through the protrusion and recess.

Accordingly, as shown in FIGS. 25A, 25B, 25C, 25D, and 26 and as described in connection with main weights 102, the main weights 402 may interlock or dovetail with undercut surfaces on their axially-facing sides that retain the weights 402, 405 to each other and that only allow lateral movement relative to each other along a vertical direction (such as for example when the handle assembly 404 is vertically lifted from the base assembly). The sloped surfaces (e.g., 494, 495) may help funnel or guide axial movement of the handle assembly 404 and its related weights 402 into place in the stacked weights 402 on the base assembly. These funneling surfaces and slopes are shown in at least FIG. 21C. Notably, the upper ends of the weights have sloped surfaces that make a wider opening (between corresponding main weights 102 on each end of the handle 460) than an opening between the sloped surfaces at the lower ends or an opening between vertical faces of the main weights. Other embodiments disclosed herein may also include similar tapering sloped surfaces (e.g., 494, 495) to help guide main weights (e.g., 102, 302, 602, 702, 902, 1102) and their respective coupled handle assemblies into engagement with each other on their respective base assemblies. Similarly, the tapering of the protrusions (e.g., 490, 497) and recesses (e.g., 492, 496) may help guide or funnel horizontal, lateral movement of the handle assembly 404 as it is reinserted onto the base assembly.

Figure 25A:
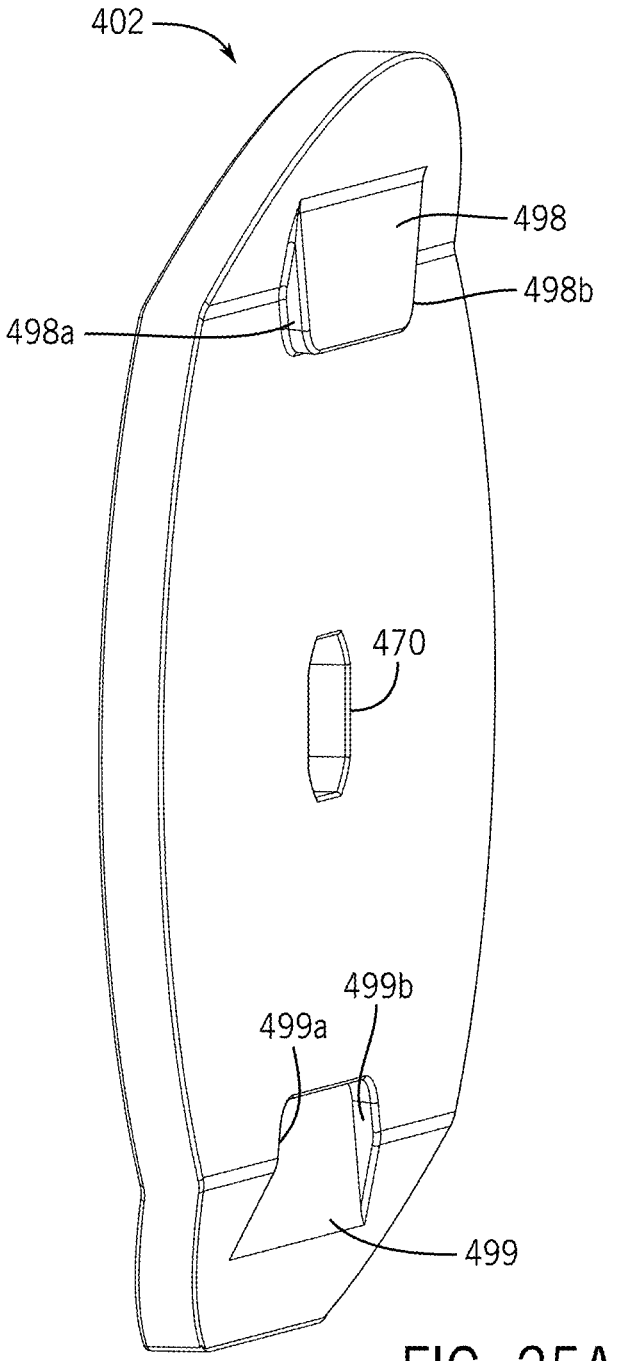
FIG. 25A is an isometric view of a main weight of the system of FIG. 19.
Figure 25B:
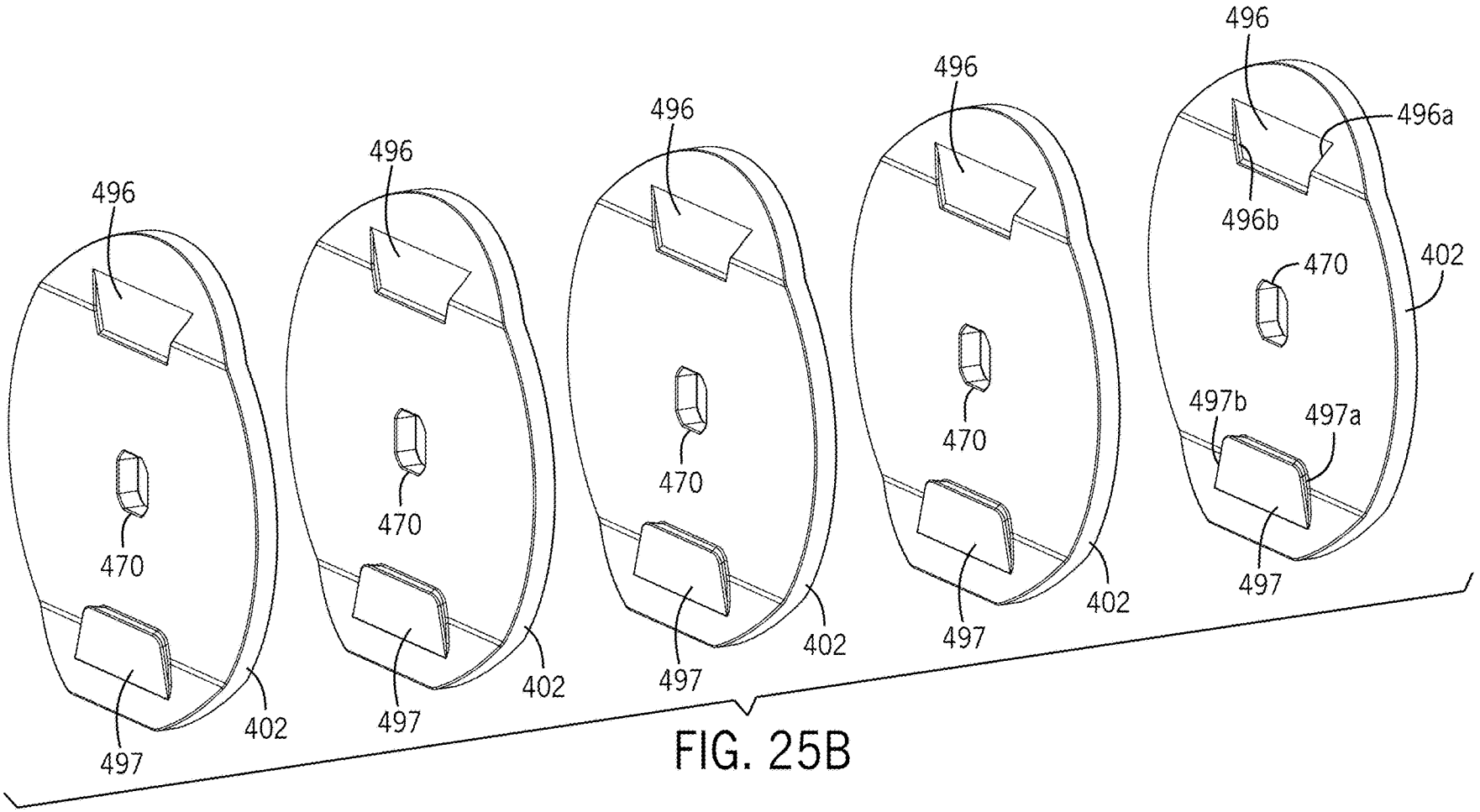
FIG. 25B is an isometric view of a set of main weights of the system of FIG. 19.
Figure 25C:
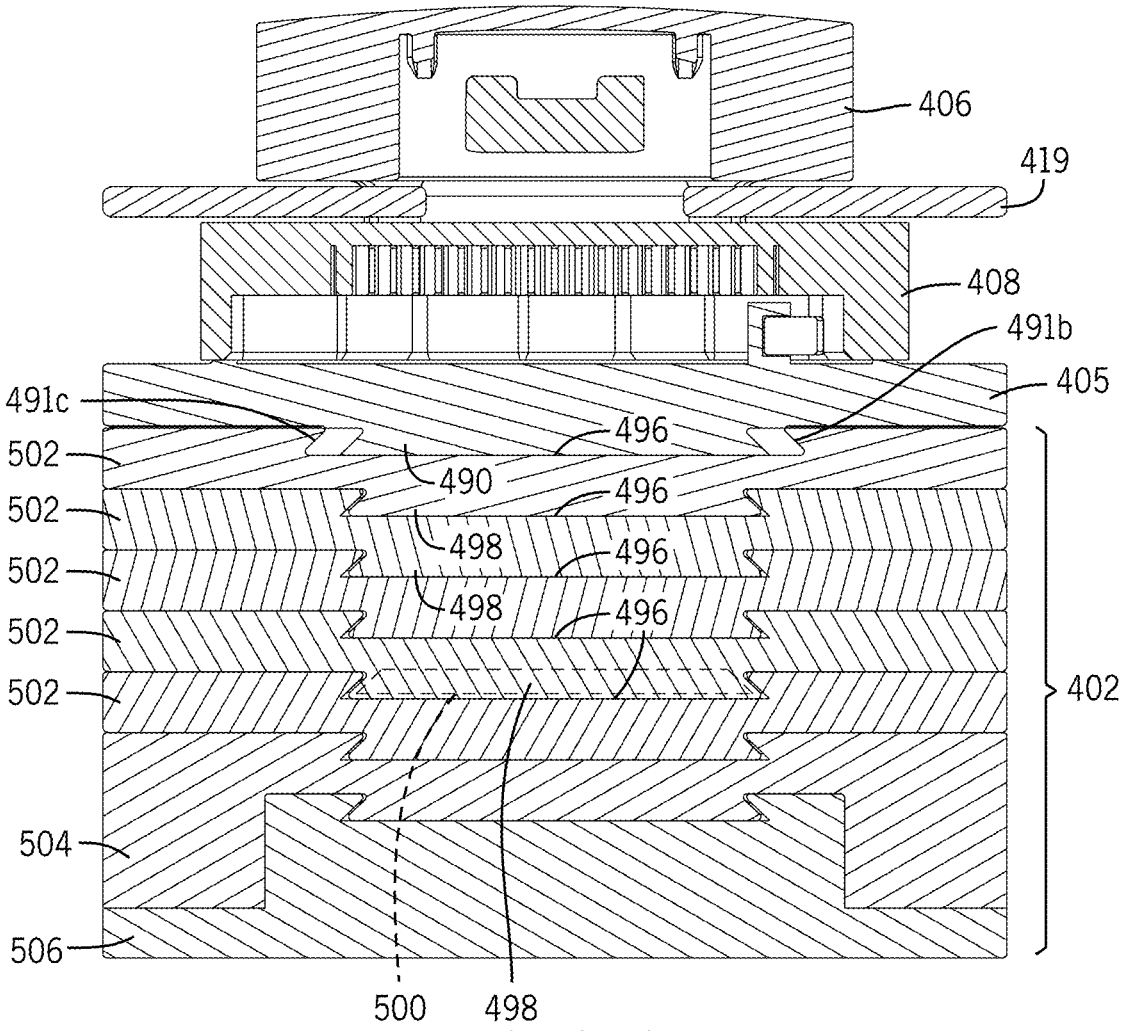
FIG. 25C is a top section view of the weights and handle assembly of the system of FIG. 19 as taken through section lines 25C-25C in FIG. 26.
Figure 25D:
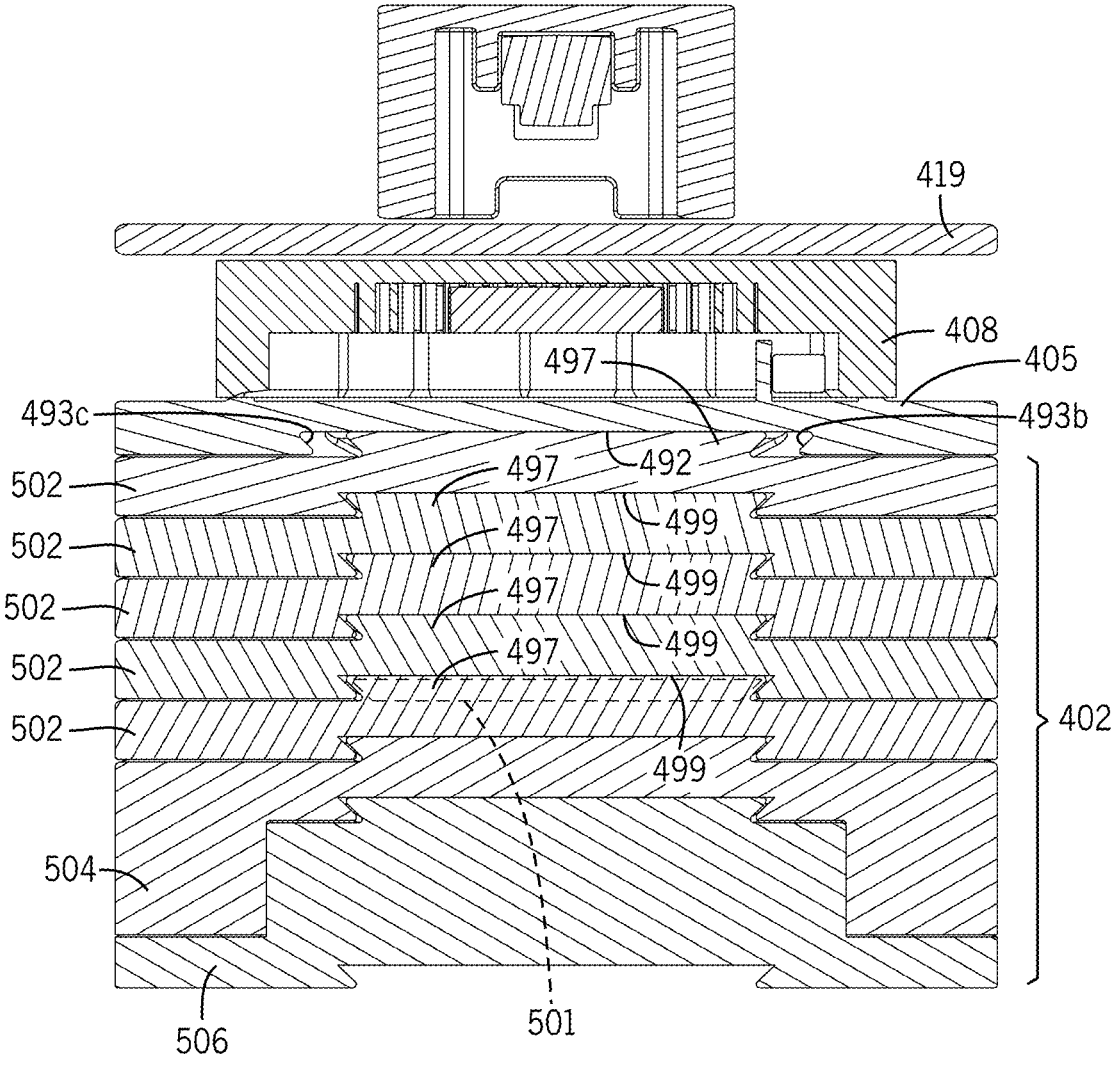
FIG. 25D is a top section view of the weights and handle assembly of the system of FIG. 19 as taken through section lines 25D-25D in FIG. 26.
Figure 26:
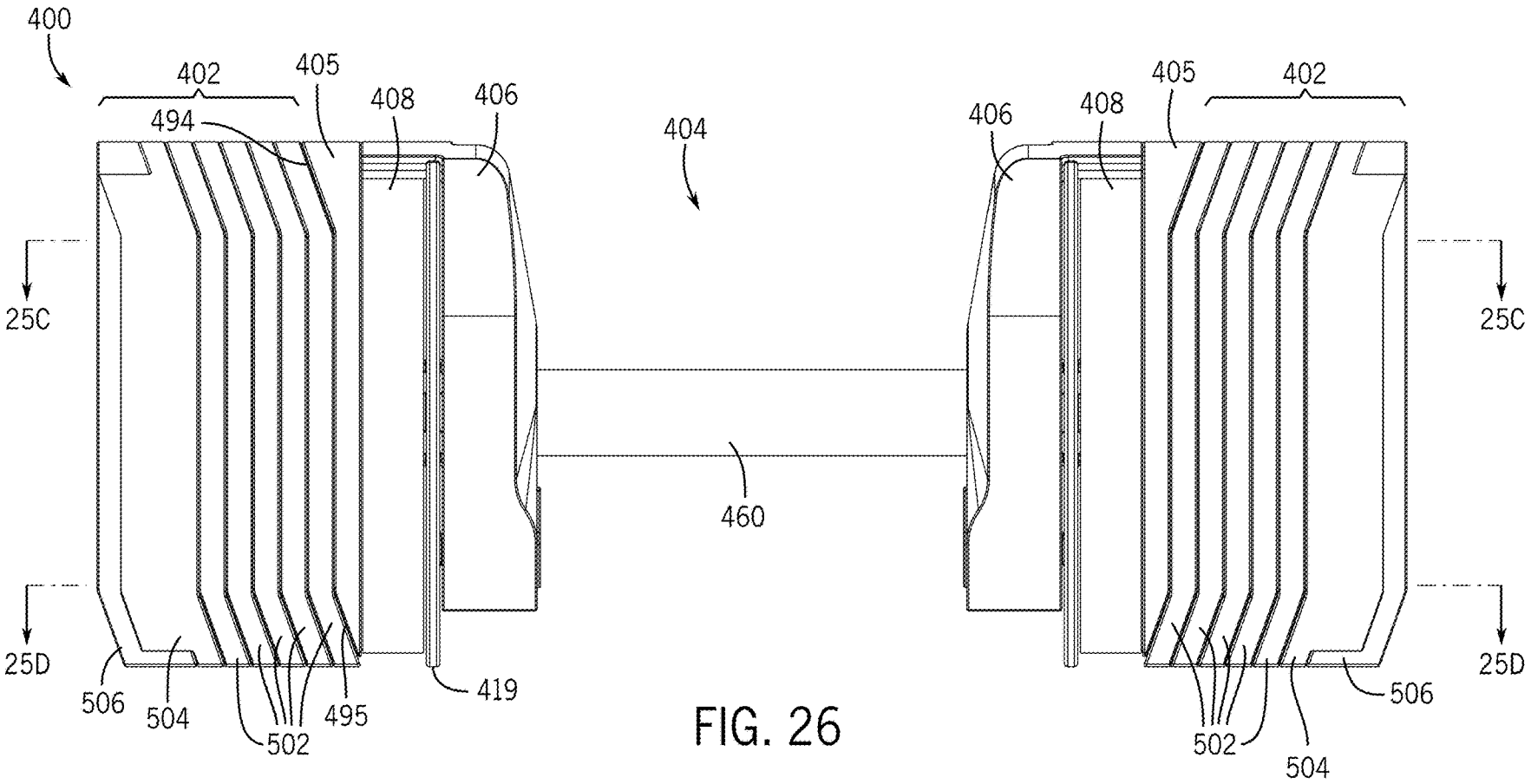
FIG. 26 is a side view of the system of FIG. 19.

As shown in FIGS. 25C and 25D, the main weights 402 can be axially secured to each other (or to main weight 405) in a chain-like manner, with one protrusion 490, 498 being received in a recess 496 of the next weight. Due to the undercut surfaces of the protrusions 490, 498 and recesses 496, in some embodiments, the protrusions or recesses may define trapezoidal-shaped cross-sections (e.g., 500, 501), wherein for a protrusion, one side of the trapezoidal-shaped cross-section is defined by the outward-facing surface, the opposite parallel side of the trapezoidal-shaped cross-section is defined by the plane at the base of the protrusion, and the non-parallel side surfaces are defined by the undercut surfaces of the protrusion. Similarly, for a recess, one side of the cross-section is defined by the outward-facing inner surface, the opposite parallel side is defined by the plane at the outer opening of the recess, and the non-parallel side surfaces are defined by the undercut surfaces of the recess.

Some of the main weights 402 may have different volumes or dimensions than others. For example, as shown in FIGS. 20, 21B, 21C, and 25A-26, the main weights 402 may include a set of thinner, s-profile main weights 502 with sloped upper and lower ends of the main axial faces. Other main weights 402 may include larger weights 504, 506 having protrusions and recesses configured to interlock with the thinner main weights 502. Coupling the larger weights 504, 506 to the handle assembly 404 via the thinner main weights 502 may incrementally increase the resistance of the dumbbell to a greater degree than the increase caused by the other weights 502.

Any of the features, components, and/or parts, including the arrangements and configurations thereof shown in FIGS. 19-26, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 19-26.

Figure 27:
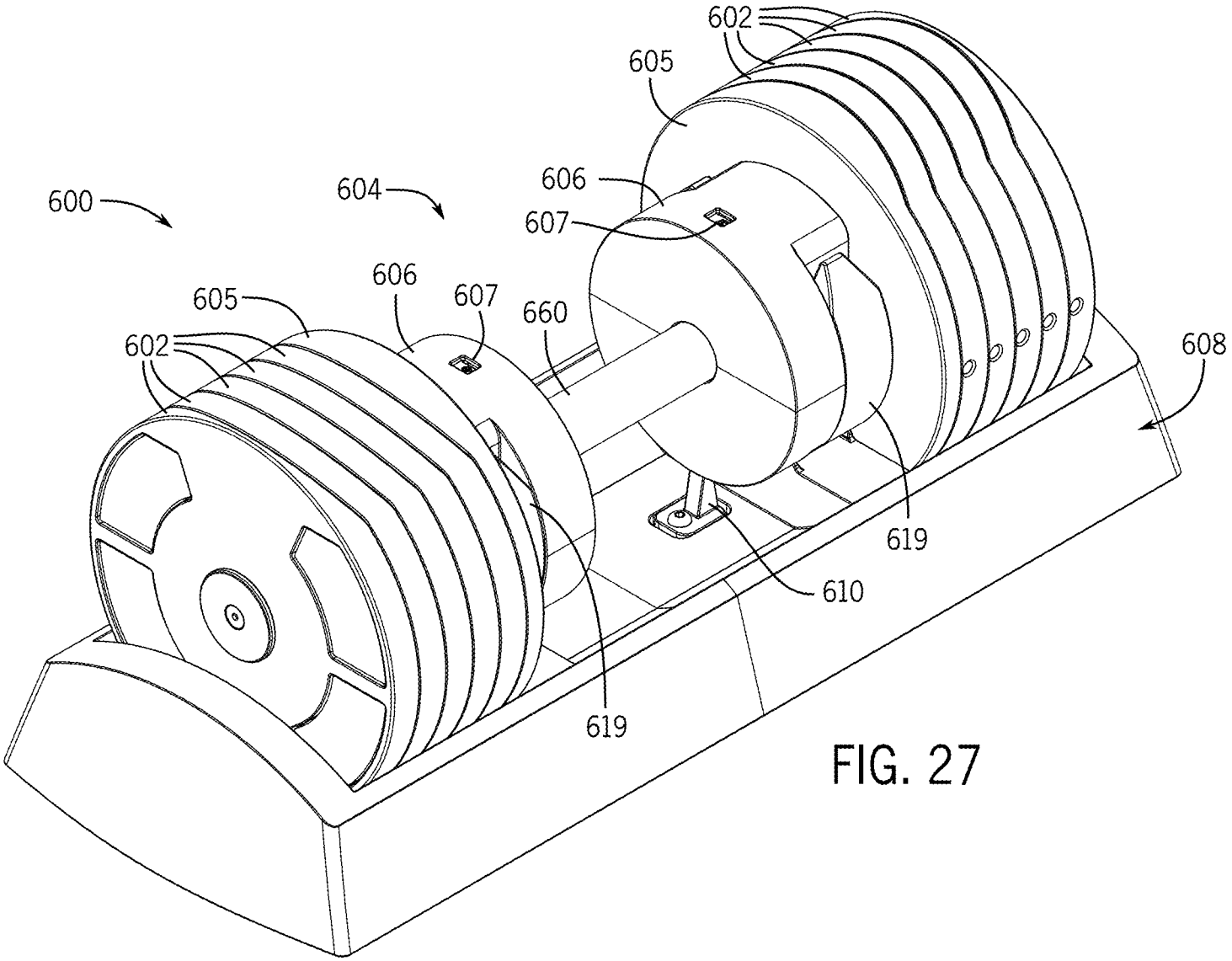
FIG. 27 is an isometric view of an adjustable dumbbell system.

FIGS. 27-33E show features of an adjustable dumbbell system 600. FIG. 27 shows an isometric view of the system 600. The system 600 may have a handle assembly 604 and a number of main weights 602 positioned at each end of the handle assembly 604. The handle assembly 604 may have a housing element 606 at each end that may be configured to house various weight selection elements. The housing elements 606 may include window openings 607 through which a user can determine the load setting for the handle assembly 604 on supplemental weight selectors 611 within the housing elements 606. Some embodiments of the adjustable dumbbell system 600 may have a base assembly 608 to support the main weights 602 and handle assembly 604.

Figure 28A:
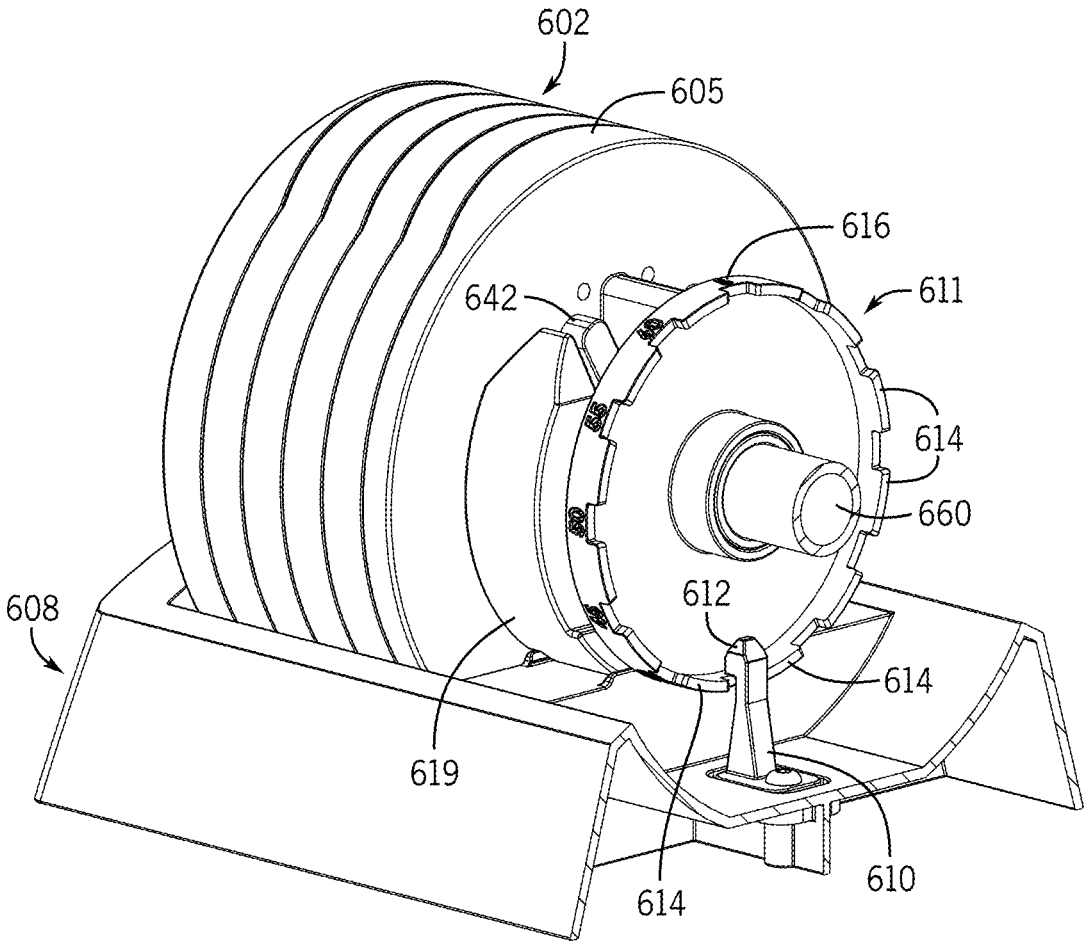
FIG. 28A is an isometric section view of the system of FIG. 27 in a partially disassembled state.

Some embodiments may have a weight interlock element 610 connected to the base assembly 608 and configured to unlock the main weights 602 from the handle assembly 604 when it is placed on the base assembly 608. FIG. 28A shows an isometric section view of one end of the system 600 and with the housing element 606 removed. The weight interlock element 610 may include a pawl shape with an axially extending overhang or hooked end configured to be inserted into one of plurality of gaps between axial protrusions (e.g., 614) spaced circumferentially around the supplemental weight selector 611. As described in greater detail below, the user of the system 600 may adjust the load of the handle assembly 604 by axially rotating the handle 660. The supplemental weight selector 611 may turn with the handle 660, and a protrusion (e.g., 614) may be positioned under the overhang of the weight interlock element 610 when the weight adjustment mechanisms in the system 600 are in an unstable or otherwise improper position. The handle assembly 604 can thereby be prevented or limited from removal from the base assembly 608 while in the improper position due to mechanical interference between the protrusion 614 and the weight interlock element 610. When the weight adjustment mechanisms are in a stable or proper position, the weight interlock element 610 is positioned in a gap between protrusions 614, so there is clearance for the handle assembly 604 to be lifted vertically away from the base assembly 608. A detent mechanism in the handle assembly 604 may bias the rotation of the handle 660 and selector 611 to guide the angular position of the handle 660 to a stable or proper position, similar to other embodiments described herein, such as the mechanisms having followers 422, 652, 656, 730, 1174, and 1184.

The supplemental weight selector 611 may also include a series of glyphs or other visual indicators (e.g., 616) on a radially outer surface thereof, and the glyphs may be visible to a user through the window openings 607 of the housing elements 606.

Figure 28B:
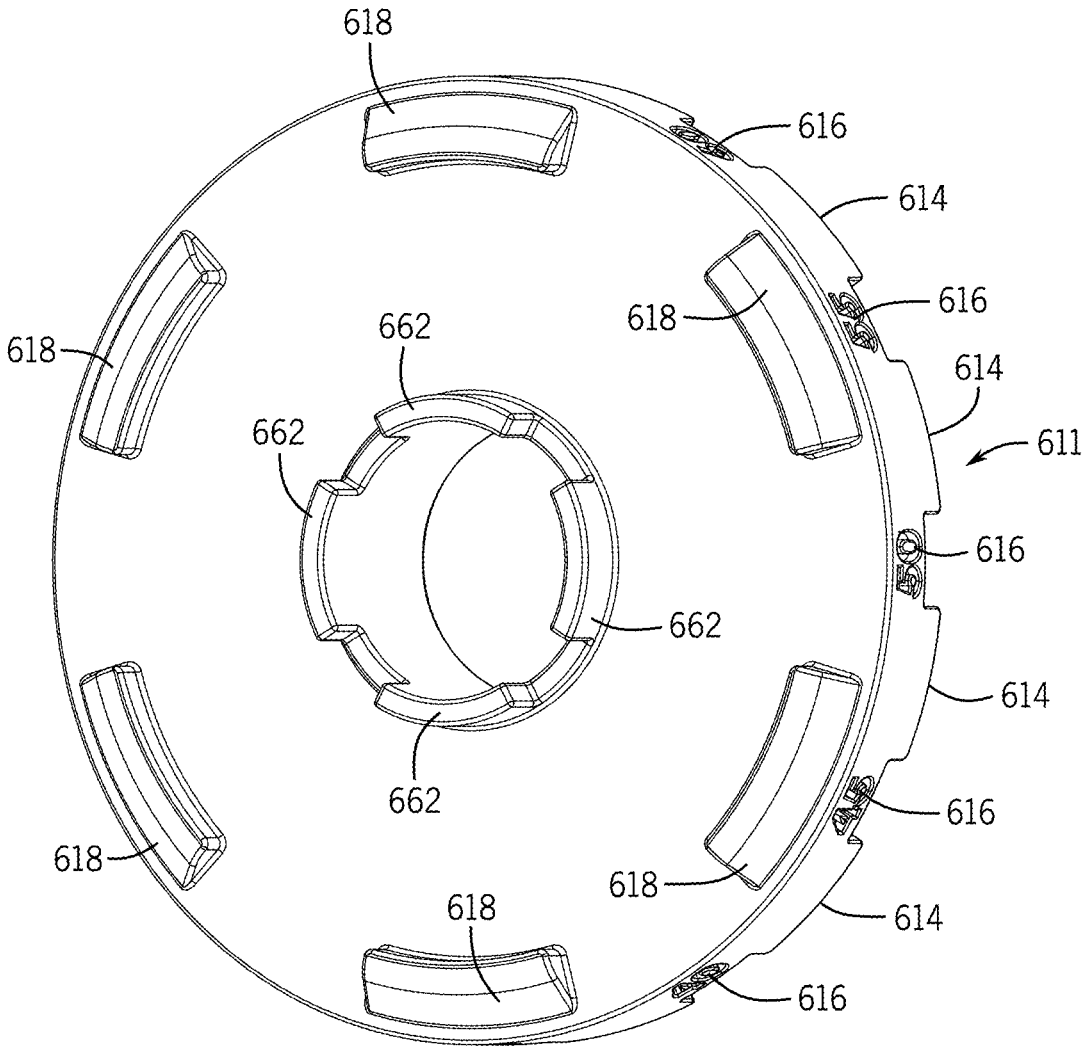
FIG. 28B is an isometric view of a supplemental weight selector of the system of FIG. 27.
Figure 29A:
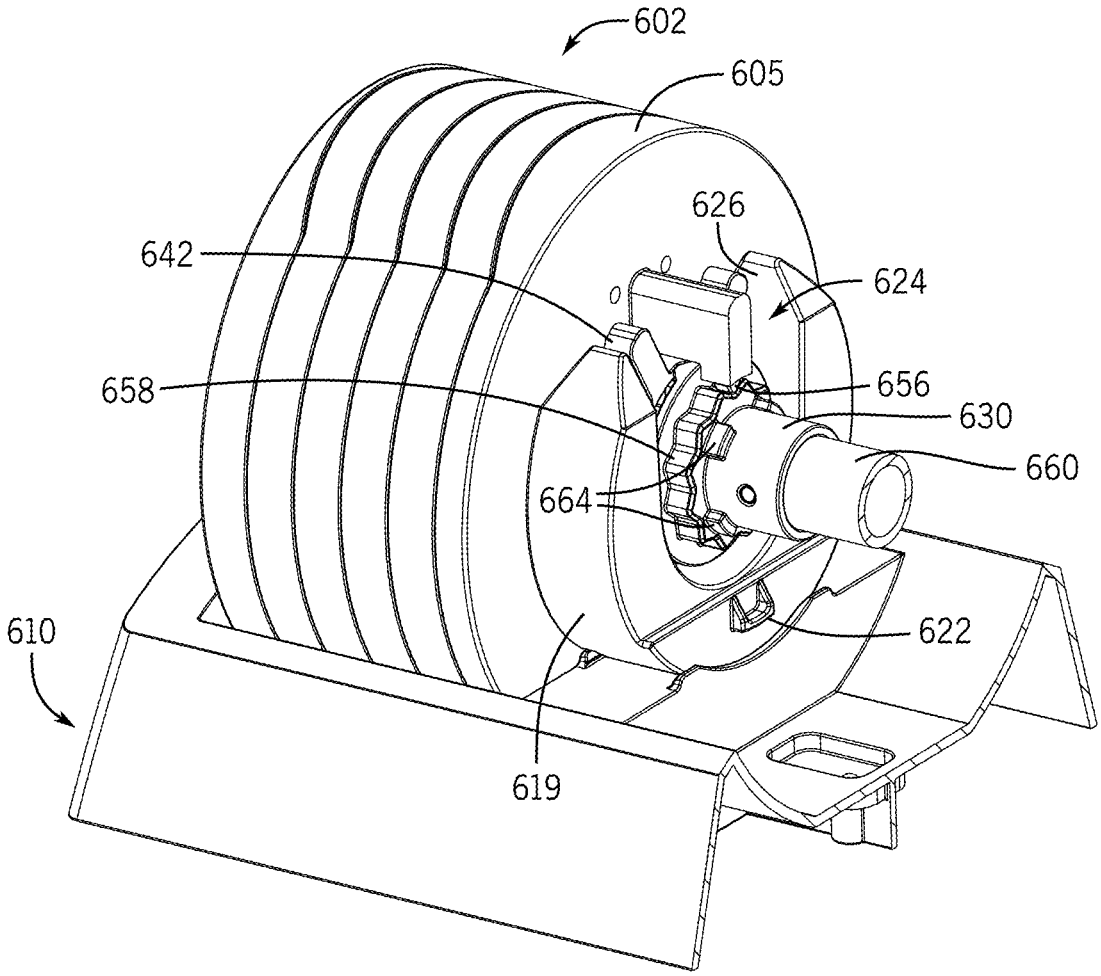
FIG. 29A is an isometric section view of the system of FIG. 27 in a partially disassembled state.
Figure 29B:
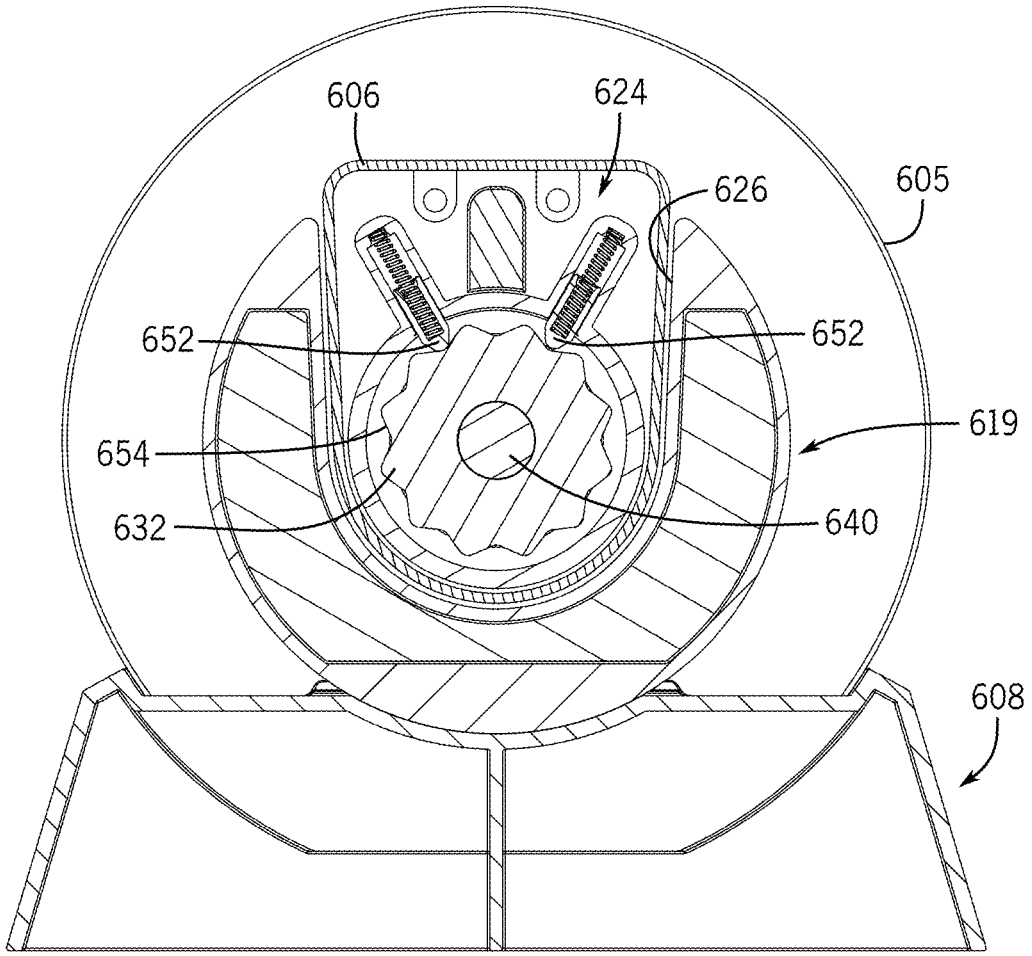
FIG. 29B is an end-facing section view of the system of FIG. 27 taken through the second rotor.

FIG. 28B shows an isometric view of an axially-outward-facing side 620 of the supplemental weight selector 611. A set of circumferentially spaced apart protrusions 618 extend from the side 620 and are configured to rotate with the supplemental weight selector 611 between at least one position in which a protrusion 618 engages a corresponding lifting tab 622 (such as for example lifting protrusion or supplemental weight engagement protrusion); see FIG. 29A) on the supplemental weight 619 and at least one position in which the lifting tab 622 is positioned in a gap between two adjacent protrusions 618. When the lifting tab 622 is engaged with a protrusion 618, the supplemental weight 619 is lifted with the handle assembly 604, and when the tab 622 is not engaged, the supplemental weight 619 is left on the base assembly 608 as the handle assembly 604 is lifted away from the base assembly 608. FIG. 29A shows a partial section view similar to FIG. 28A, but with the supplemental weight selector 611 and weight interlock element 610 removed to better show the supplemental weight 619 and other nearby parts. FIG. 29B shows an axially-outward-facing section view through the supplemental weight 619. The supplemental weight 619 may have a substantially crescent- or U-shaped profile defining an upper opening 626 in which elements of a main load adjustment system 624 are positioned. When the supplemental weight 619 is not coupled to the handle assembly 604, the main load adjustment system 624 may be lifted from the supplemental weight 619 through the top end of the supplemental weight 619, and the supplemental weight 619 may remain supported by the base assembly 608.

Figure 30A:
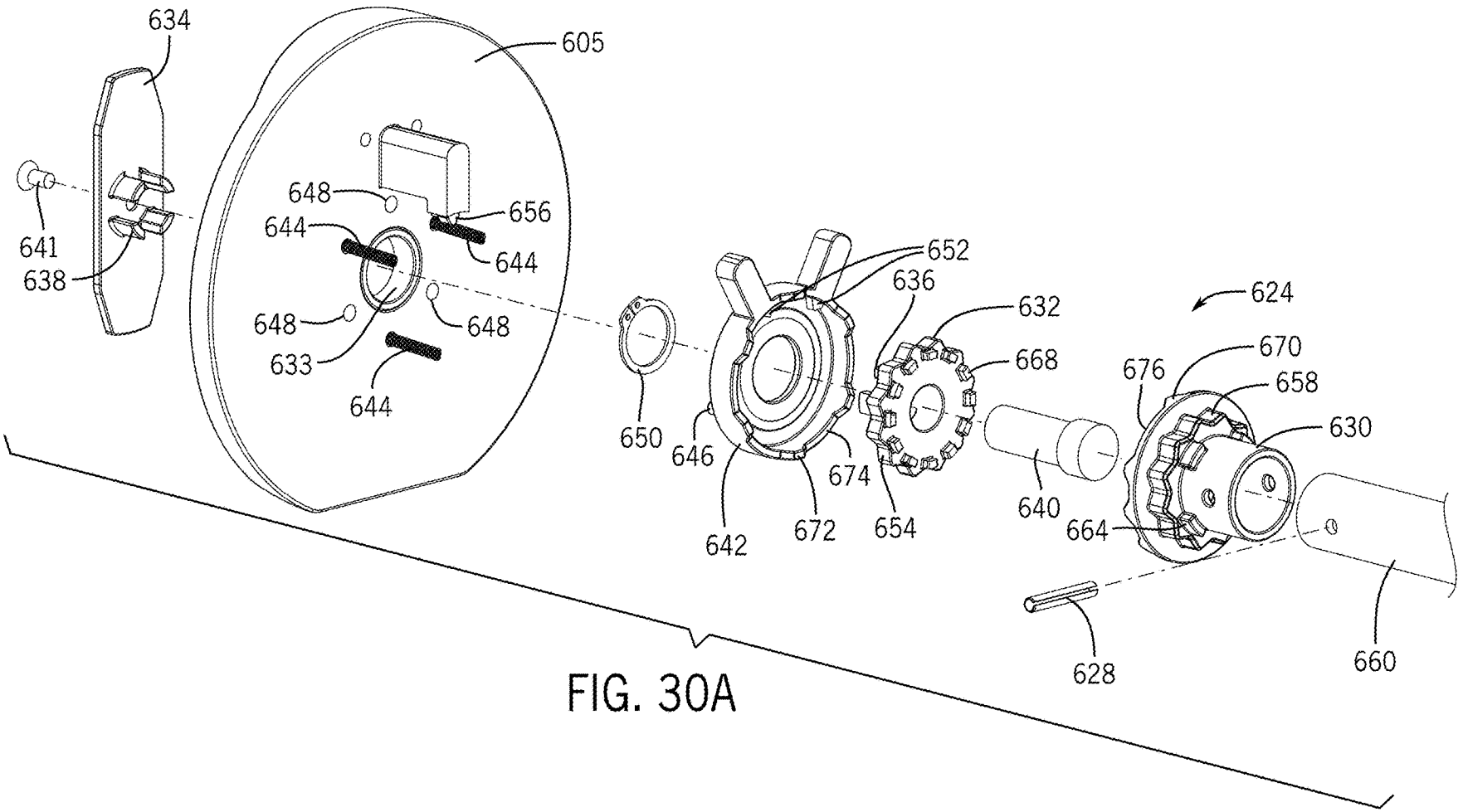
FIG. 30A is an exploded view of the handle assembly of the system of FIG. 27.
Figure 30B:
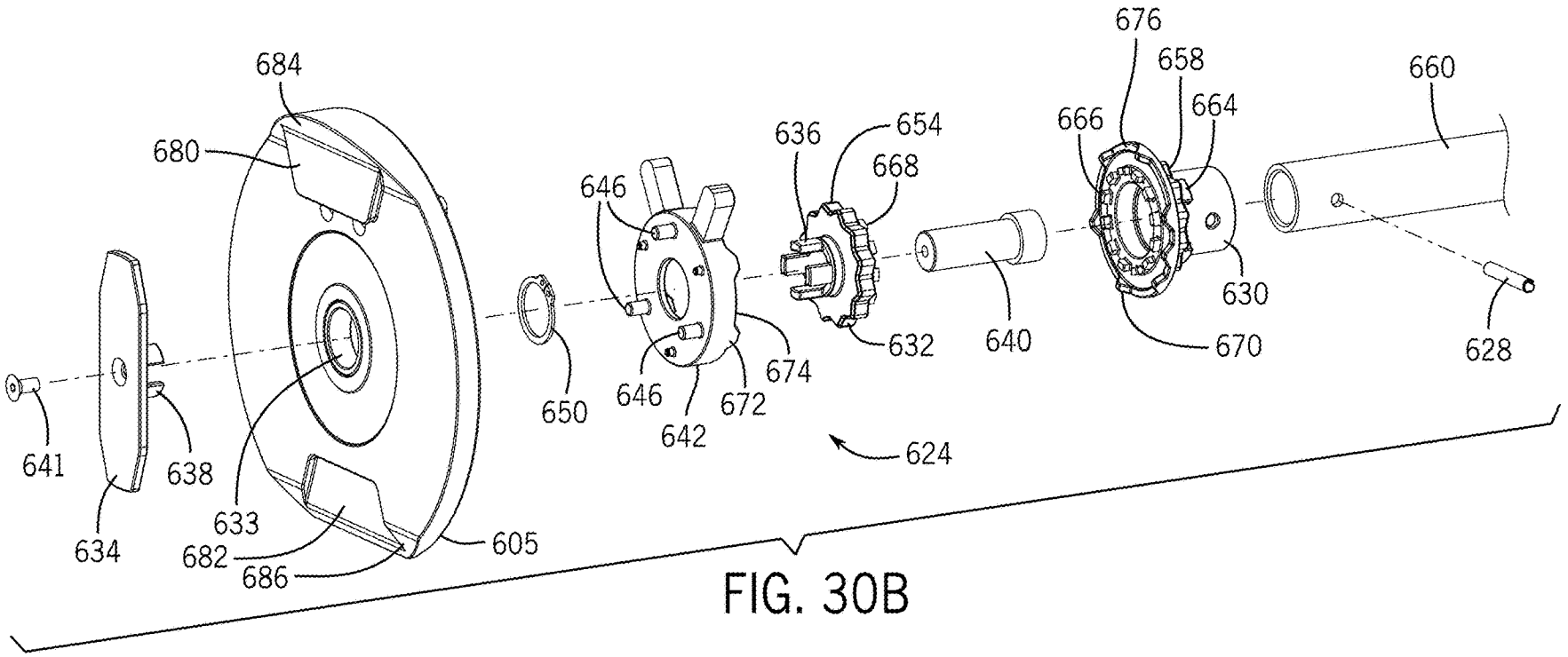
FIG. 30B is an exploded view of the handle assembly of the system of FIG. 27.
Figure 31B:
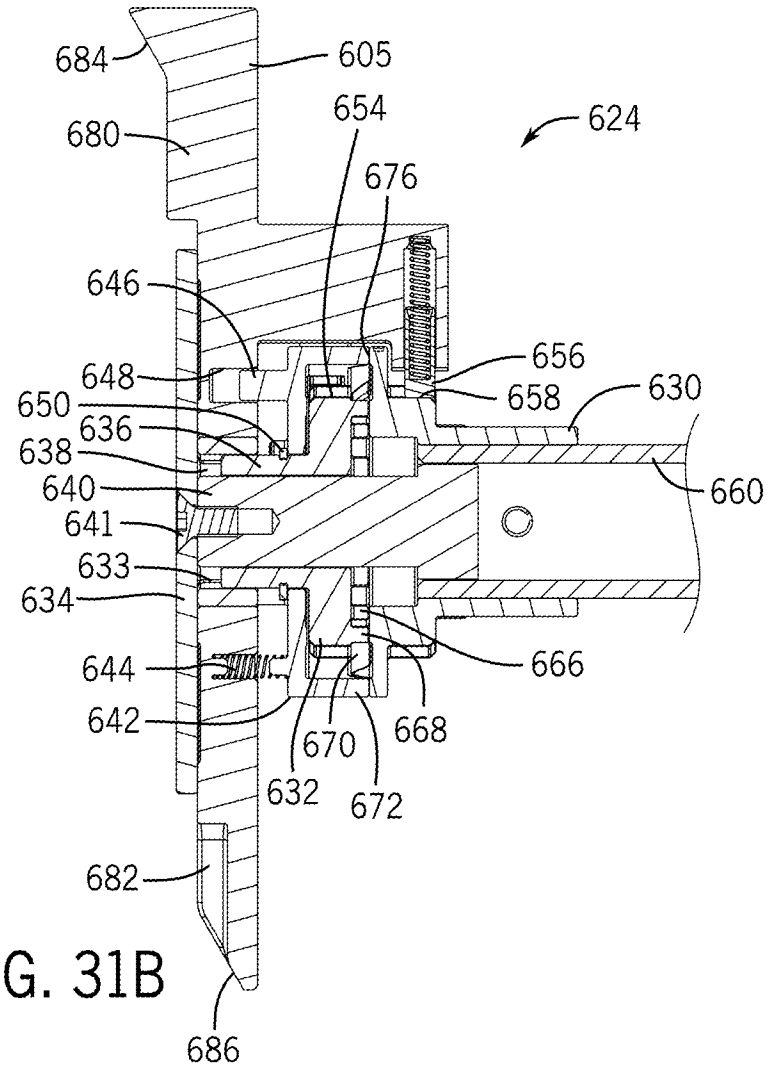
FIG. 31B is a central side section view of the handle assembly of FIG. 31A.
Figure 31A:
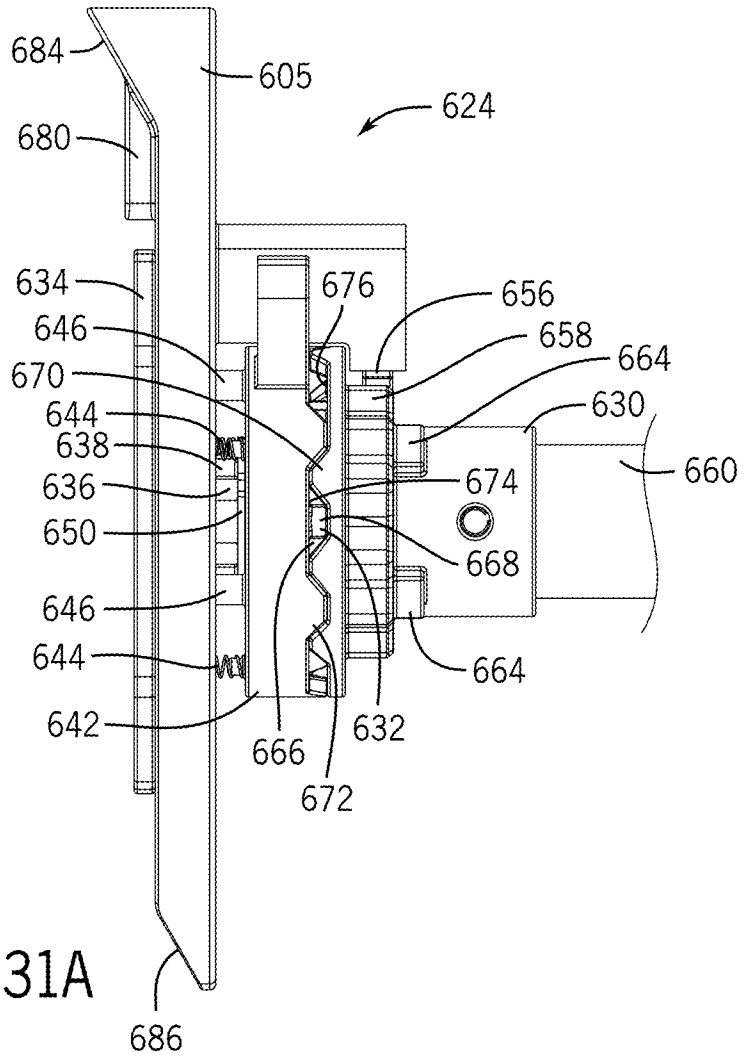
FIG. 31A is a side view of the handle assembly of the system of FIG. 27 with the first and second rotors enmeshed.
Figure 32B:
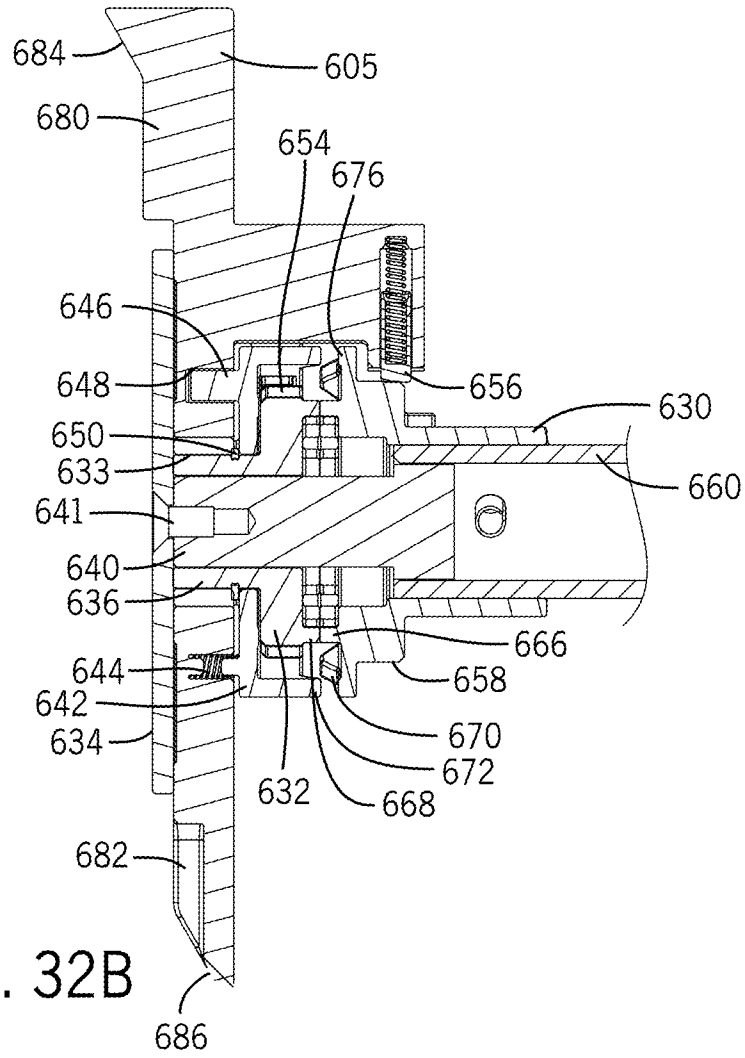
FIG. 32B is a central side section view of the handle assembly of FIG. 32A.
Figure 32A:
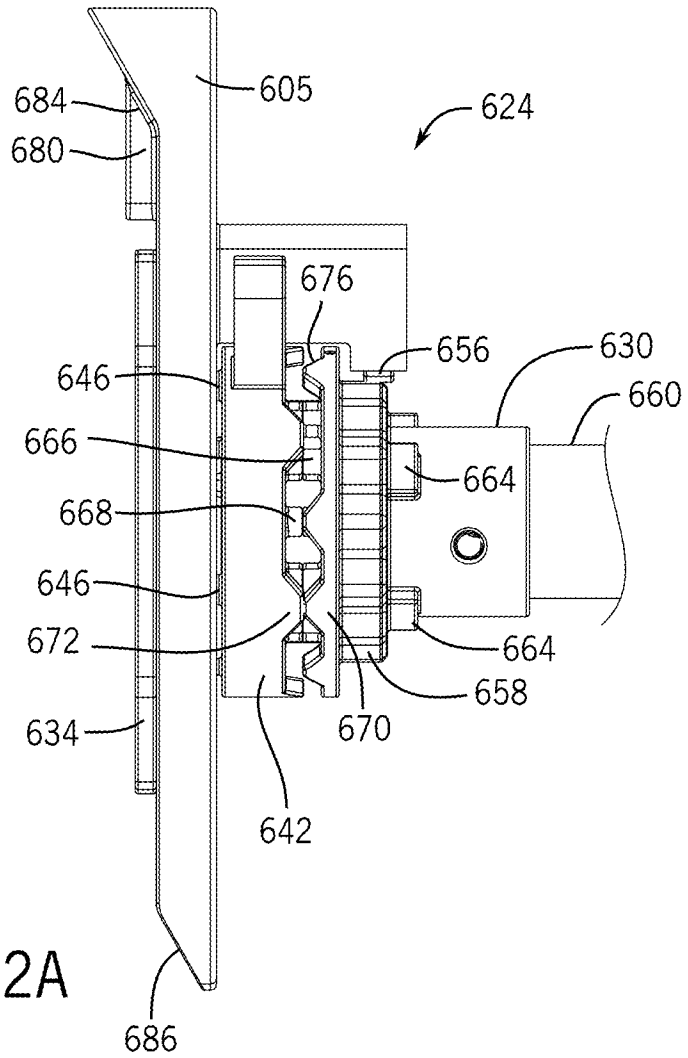
FIG. 32A is a side view of the handle assembly of the system of FIG. 27 with the first and second rotors decoupled.

FIGS. 30A-30B show outward- and inward-directed exploded views of the main load adjustment system 624 of the system 600. FIGS. 31A-31B and 32A-32B show assembled side views of (and assembled side section views through) the system 624. FIGS. 31A-31B show the system 624 in a drive configuration, and FIGS. 32A-32B show the system 624 in a slip configuration, as described in further detail below.

The main load adjustment system 624 may include the handle 660 (such as for example handle bar) rotationally coupled to a first rotor 630 (e.g., via a pin 628, adhesive, welding, similar attachment technique, or combinations thereof). The main load adjustment system 624 may also include a second rotor 632 rotationally coupled to a selector key 634 through a central opening 633 (and, optionally, a bearing or bushing in the opening 633) in handle weight 605. A guide rod 640 may extend through the second rotor 632 and central opening 633 to attach to the selector key 634 (e.g., using a fastener 641). The second rotor 632 may be displaced along the central axis of the system 624 (such as for example along the guide rod 640) without displacing the selector key 634 due to interlocking teeth 636, 638 that are axially slidable relative to each other while they are enmeshed with each other. A ramp ring 642 may be positioned between the second rotor 632 and the handle weight 605 and may be axially-inwardly biased along the longitudinal axis of the handle 660 by a set of biasing members 644 (e.g., springs). Thus, the ramp ring 642 may be biased away from the handle weight 605 toward the first rotor 630. The ramp ring 642 may also comprise a set of guide posts 646 positioned in corresponding guide openings 648 in the handle weight 605 and configured to guide axial movement of the ramp ring 642 and to prevent rotation of the ramp ring 642 relative to the handle weight 605. A retaining ring 650 may be positioned around the teeth 636 of the second rotor 632 next to the axially-outer-facing surface of the ramp ring 642 to prevent axial movement of the second rotor 632 relative to the ramp ring 642 but while also permitting axial rotation of the second rotor 632 relative to the ramp ring 642. A pair of biased followers 652 may be positioned in the ramp ring 642 and may be biased into contact an outer detent surface 654 of the second rotor 632. A biased follower 656 may be positioned in a projecting portion of the handle weight 605 and may be biased into contact with an outer detent surface 658 of the first rotor 630. See FIGS. 29B, 30A, 30B, 31A, 31B, 32A, and 32B.

In system 600, the handle 660 may be axially rotated to adjust the load carried by the handle assembly 604. The main load adjustment system 624 may operate to control how much load is coupled and decoupled with the handle assembly 604 according to the user's selection. In some embodiments, the main load adjustment system 624 may also include the supplemental weight selectors 611 to select/deselect the supplemental weights 619. As shown in FIGS. 28B and 29A, the first rotor 630 and the supplemental weight selector 611 may include engageable teeth 662, 664 so that their axial rotation is synchronized. In some embodiments, the first rotor 630 and the supplemental weight selector 611 may be a single integral piece or can be permanently affixed to each other to act as a single part. In such cases, the first rotor 630 and supplemental weight selector 611 may be collectively referred to as a first rotor. When the handle 660 is axially rotated, the coupling of the handle 660 to the first rotor 630 and supplemental weight selector 611 causes all three of them to have synchronous rotation. The first rotor 630 may include a first set of axial drive teeth 666 (FIG. 30B) enmeshed with a second set of axial drive teeth 668 (FIGS. 30A-30B) on the second rotor 632. FIGS. 31A-31B show the rotors 630, 632 enmeshed with each other. Thus, the rotation of the first rotor 630 drives rotation of the second rotor 632 via the axial drive teeth 666, 668, and rotation of the second rotor 632 drives rotation of the selector key 634 via interlocking teeth 636 and 638. As explained below, rotation of the selector key 634 controls coupling or decoupling of main weights 602 to the handle weight 605. Thus, rotation of the handle 660 can couple or decouple one or more main weights 602 from the handle weight 605.

As shown in FIGS. 30A-32B, the first rotor 630 may also include a first set of ramped protrusions 670 circumferentially spaced around its periphery, and a second set of ramped protrusions 672 may be circumferentially spaced around the ramp ring 642. The first set of ramped protrusions 670 is positioned between the second set of ramped protrusions 672 in FIGS. 31A-31B, wherein the first set of protrusions 670 engages an axial face 674 between the second ramped protrusions 672 (such as for example from which the second ramped protrusions 672 project). Simultaneously (or alternatively), the second set of protrusions 672 may engage an axial face 676 of the first rotor 630 from which the first ramped protrusions 670 extend.

However, as the first rotor 630 axially rotates, the first set of ramped protrusions 670 also axially rotates relative to the ramp ring 642 and is corresponding second set of ramped protrusions 672. When a side surface (such as for example a sloped or ramped engagement surface) of a first ramped protrusion 670 engages a side surface (such as for example a sloped or ramped engagement surface) of a second ramped protrusion, the first rotor 630 applies an axial force to the ramp ring 642 that drives the ramp ring 642 more and more axially outward (such as for example away from the handle 660 and toward the handle weight 605) as the ramped protrusions 670, 672 become more and more aligned. The ramp ring 642 does not rotate along with the first rotor 630.

At a certain amount of axial displacement of the ramp ring 642, the ramped protrusions 670, 672 are face-to-face aligned, as shown in FIGS. 32A-32B. Thus, the ramp ring 642 has been maximally axially displaced away from the first rotor 630. The second rotor 632 axially moves simultaneously with the ramp ring 642 due to the retaining ring 650 linking the second rotor 632 to the ramp ring 642. By the time the ramped protrusions 670, 672 are face-to-face aligned, the sets of axial drive teeth 666, 668 are no longer enmeshed due to axial displacement of the second set of axial drive teeth 668 away from the first set of axial drive teeth 666, as also shown in FIGS. 32A-32B. While the sets of axial drive teeth 666, 668 are not enmeshed, rotation of the handle 660 does not rotate the selector key 634.

Further rotation of the handle 660 from the position of FIGS. 32A-32B may move the ramped protrusions 670 back to a position where none of the ramped protrusions 670 are in face-to-face alignment with one of the second set of ramped protrusions 672. The ramp ring 642 is biased back axially inward to the axial position shown in FIGS. 31A-32B, and the sets of axial drive teeth 666, 668 reengage to drive rotation of the selector key 634 via the handle 660. The spacing and positioning of the first and second sets of ramped protrusions 670, 672 may correspond to various angular displacement positions of the handle 660, wherein a set of angular displacement positions of the handle 660 corresponds to a set of load settings for the system 600. For example, as explained above, the angular position of the handle 660 may correspond to angular positions where the supplemental weight selector 611 couples or does not couple the supplemental weight 619 to the handle assembly 604. Likewise, rotation of the selector key 634 may couple one or more main weights 602 to the handle assembly 604 in response to various rotated positions of the handle 660, but, due to the interaction between the ramp ring 642 and rotors 630, 632 as described above, the selector key 634 may not rotate synchronously with the handle 660 and may intermittently (or at predetermined intervals or ranges of angular rotation of the handle) stop rotating with the handle 660. The main load adjustment system 624 may therefore be referred to as a clutch system or intermittent rotor engagement system for the dumbbell system 600.

The biased followers and outer detent surfaces 652, 654, 656, 658 may function as described using comparable followers and detent surfaces in connection with other embodiments herein. Thus, the biased followers and outer detent surfaces 652, 654, 656, 658 may provide the main load adjustment system 624 with a bias toward preferred angular rotation positions of the handle 660 in order to limit or prevent unstable or partial engagement of main weights 602 or supplemental weights 619. See, e.g., protrusions/followers and lateral surfaces/detents at elements 124, 1010, 1012, 420, and 422.

Figure 33B:
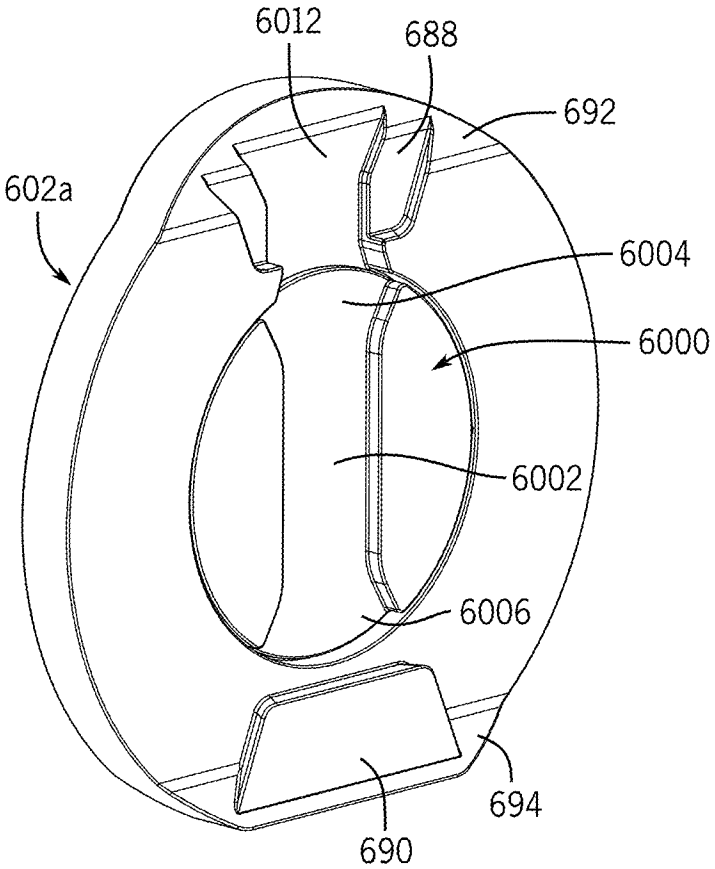
FIG. 33B is an isometric view of a main weight of the system of FIG. 27.
Figure 33A:
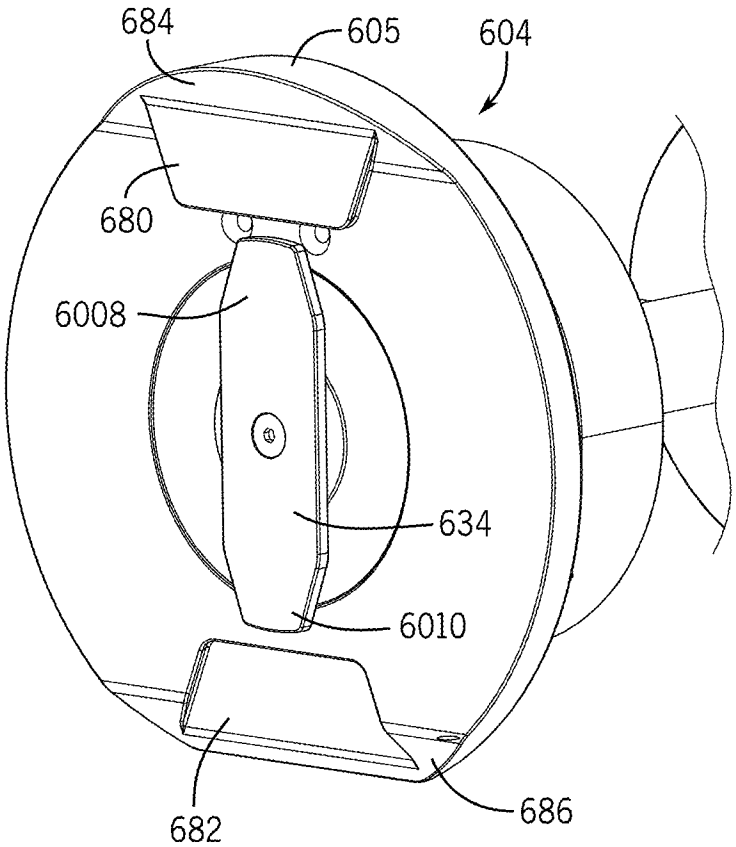
FIG. 33A is an isometric view of a handle assembly of the system of FIG. 27.

FIGS. 30B and 33A show an axially outward-facing side of the handle weight 605. Similar to handle weight 405, the handle weight 605 may include an upper protrusion 680 and a lower recess 682 respectively positioned at least partially on a sloped upper surface 684 and a sloped lower surface 686. The protrusion 680 and recess 682 may each comprise two or three side walls with undercut surfaces, as described in connection with handle weight 405. FIG. 33B shows an axially inward side of an example main weight 602*a* having an upper recess 688 and a lower protrusion 690 positioned on respective upper and lower sloped surfaces 692, 694. Similar to system 400, these features 688, 690, 692, 694 may interface, interlock, and axially and laterally couple the handle weight 605 to the main weight 602*a*. Thus, the handle weight 605 is only insertable into coupling engagement with the main weight 602*a* by vertically laterally lowering the handle weight 605 so that the lower protrusion 690 inserts into the lower recess 682 and the upper protrusion 680 inserts into the upper recess 688. The handle weight 605 is removable from the main weight 602*a* by moving it vertically upward and decoupling the interlocking undercut surfaces.

Figure 33D:
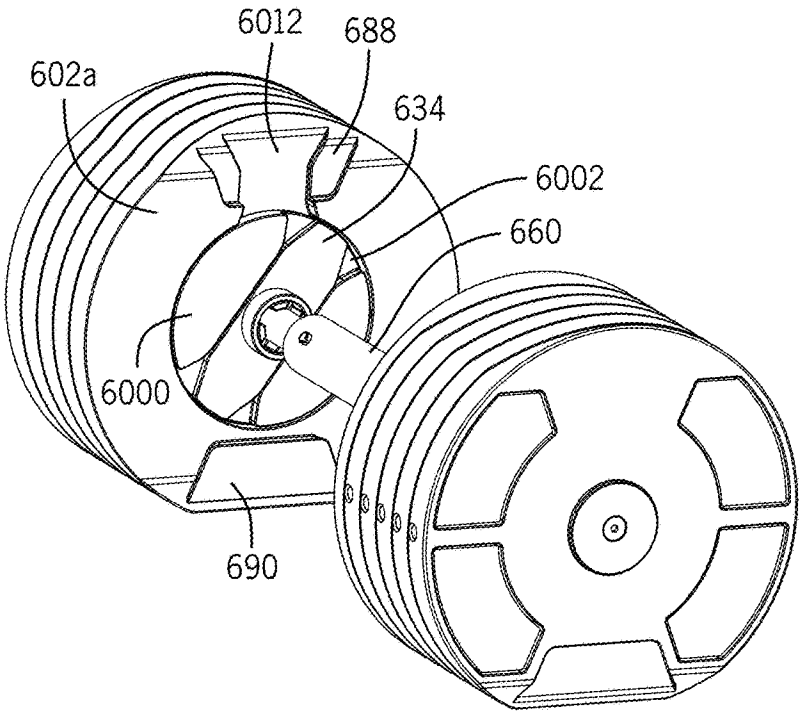
FIG. 33D is an isometric view of the system of FIG. 33C with the selector key in a position captured within the main weight.
Figure 33C:
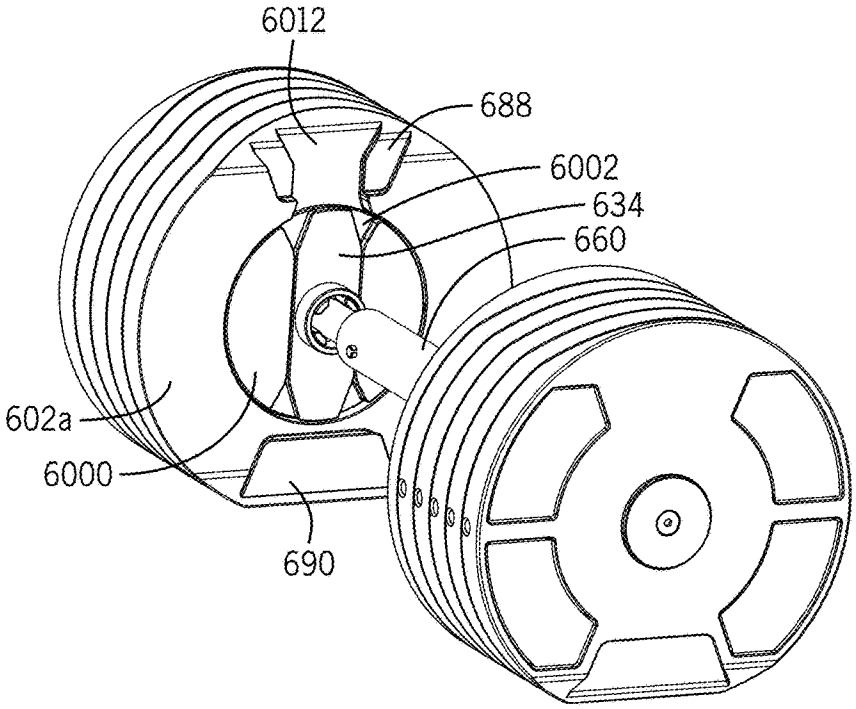
FIG. 33C is an isometric view of the system of FIG. 27 with portions of the handle assembly omitted and with a selector key in a position vertically removable from a main weight.

The main weight 602*a* may include a retainer 6000 (such as for example a rotor) configured to face axially inward and toward the handle weight 605. The retainer 6000 may define a slot 6002 having a first terminal end 6004 and a second terminal end 6006. The first and second terminal ends 6004, 6006 may have flared widths. The selector key 634 of the handle weight 605 may have corresponding first and second terminal ends 6008, 6010. Those first and second terminal ends 6008, 6010 may have tapered widths. The handle weight 605 may be coupled with the main weight 602*a* when the selector key 634 and the slot 6002 are aligned. A bottom terminal end (e.g., 6010) of the selector key 634 may be vertically inserted into an upper terminal end (e.g., 6004) of the retainer 6000 until the position shown in FIG. 33C is reached. For illustration purposes, the main load adjustment system 624, including the handle weight 605, is omitted from FIG. 33C. In some embodiments, an upper insertion slot 6012 may be included on the main weight 602*a* to provide a path for insertion of the selector key 634 into the retainer 6000.

As explained above, rotation of the handle 660 may cause rotation of the selector key 634 via the main load adjustment system 624. Once the selector key 634 is completely within the slot 6002, the rotation of the selector key 634 may cause rotation of the retainer 6000 relative to the main weight 602*a*, as shown in FIG. 33D. When the slot 6002 is rotated, it is rotationally offset from the upper insertion slot 6012, and the selector key 634 is therefore not removable from the slot 6002 by sliding through the upper insertion slot 6012. Additionally, the protrusion and recess retention features 688, 690, 692, 694 may prevent axial withdrawal (or lateral movement) of the main weight 602*a* from the handle weight 605. Accordingly, the selector key 634, retainer 6000, and retention features 688, 690, 692, 694 couple the main weight 602*a* to the handle weight 605, and the handle assembly 604 lifts the main weight 602*a* when the handle 660 is pulled upward away from the base assembly 608. The main weight 602*a* may return to a releasable condition by rotating the selector key 634 and retainer 6000 back to the position shown in FIG. 33C, where the selector key 634 can again be withdrawn through the upper insertion slot 6012. Accordingly, the user can select or deselect a main weight 602 for the load of the handle assembly 604 by rotating the handle 660 and, in turn, rotating the selector key 634 of the handle weight 605.

Figure 33E:
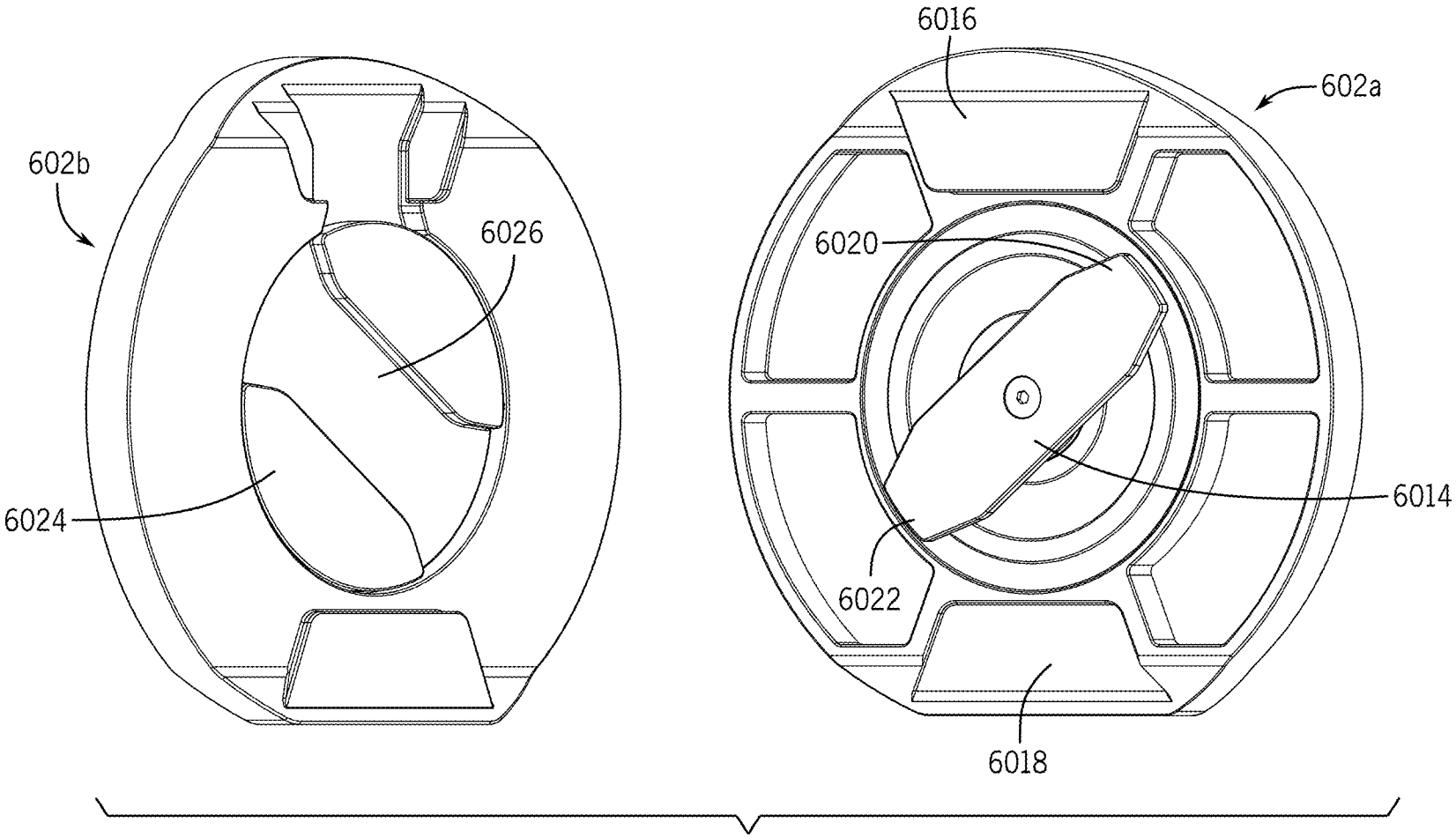
FIG. 33E is an isometric view of facing sides of two main weights of the system of FIG. 27.

FIG. 33E shows an axially outward-facing side of the example main weight 602*a* and an axially inward-facing side of another example main weight 602*b*. Similar to the handle weight 605, the main weight 602*a* may have a selector key 6014, an upper protrusion 6016, and a lower recess 6018. The selector key 6014 is rotationally coupled with the retainer 6000, so the axial rotation of the retainer 6000 causes equivalent rotation of the selector key 6014 on the opposite side of the main weight 602*a*. When the slot 6002 is vertically oriented (as shown in FIGS. 33B and 33C), the selector key 6014 may have its longitudinal axis (through its terminal ends 6020, 6022) angularly offset from the vertical axis through the terminal ends 6004, 6006 of the slot 6002. For example, the selector key 6014 may be offset by about 30 degrees relative to the slot 6002, as suggested in FIG. 33E. The handle weight 605 may be pulled up through the upper insertion slot 6012, and the main weight 602*a* may remain on the base assembly 608. The selector key 6014 may be received by the slot of a retainer 6024 of an adjacent main weight 602*b*, so while the handle assembly 604 is separated from the example main weight 602*a* and the adjacent main weight 602*b*, the main weight 602*a* and its adjacent main weight 602*b* are coupled to each other. Similarly, selector keys and retainers/slots in the rest of the main weights 602 couple them to each other in a chain-like manner extending axially outward and away from the center of the base assembly 608.

The selector key 6014 of the main weight 602*a* may be turned, via selector key 634 in retainer 6000, to a position where it is removable from the slot of the retainer 6024 of the adjacent main weight 602*b*. In order for the selector key 6014 to be removed from the adjacent retainer 6024 on another main weight 602*b*, the selector key 6014 may be oriented vertically, and the adjacent retainer 6024 may have its slot 6026 oriented vertically as well. Accordingly, in order to couple the main weight 602*a* to the next adjacent main weight 602*b*, the retainer 6000 may be rotated by the amount of angular offset of the selector key 6014 (e.g., by about 30 degrees, as shown in FIG. 33D). In other words, the selector key 6014 and its receiving slot may be vertically aligned when the selector key 634 and its slot 6002 are angularly offset from vertical alignment. Thus, when the handle assembly 604 is lifted, the handle weight 605 is coupled with the main weight 602*a*, but the remaining outer main weights (e.g., 602*b*) are not coupled to the main weight 602*a*.

The angular offsets of selector keys of various other main weights 602 may be different from the angular offset of the example main weight 602*a*, such as an offset of about 60 degrees for the next main weight, an offset of about 90 degrees for the next main weight after that, and an offset of about 120 degrees and 150 degrees for the following two main weights. An offset of 180 degrees would allow the selector key to exit the retainer of its neighboring main weight (e.g., slot 6002 on that weight would be inverted with end 6006 on top and aligned with that weight's upper insertion slot 6012), so the angular offset position of each selector key may be within the range of greater than 0 degrees to less than 180 degrees to prevent unwanted or unintentional decoupling of main weights 602 from each other while they are on the base assembly 608.

The amount of spacing between the angular offsets of the selector keys of the main weights 602 may be a limit on the number of main weights 602 usable with the handle assembly 604. For a given angular offset interval, there is a related maximum number of main weights 602 that can be used before the selector key of one of the main weights is undesirably made removable from a retainer slot as the handle 660 turns. Simultaneously, it may be desirable to allow the handle 660 to turn through a large range of rotational motion in order for a large number of incremental loads to be selected (e.g., by using the supplemental load selector 611). Thus, the main load adjustment system 624 may be configured to rotate the selector key 634 (and, accordingly, the successive selector keys (e.g., 6014) of the main weights 602) during certain ranges of rotation of the handle 660 and to prevent rotation of the selector key 634 during certain other ranges of rotation of the handle 660, as also explained above. Therefore, in some embodiments, rotation of the handle 660 may cause changes in load coupled to the handle assembly as follows: (1) a range of rotation in which only the handle weight is engaged, (2) a range of rotation in which only the supplemental weight 619 is engaged to the handle assembly 604, (3) a range of rotation in which only a main weight 602*a* is engaged to the handle assembly 604, (4) a range of rotation in which the supplemental weight 619 and one main weight 602*a* are engaged to the handle assembly 604, (5) a range of rotation in which two main weights 602*a*, 602*b* are engaged and no supplemental weight 519 is engaged, (6) a range of rotation in which two main weights 602*a*, 602*b* and the supplemental weight 519 are engaged, etc. The rotation of the handle 660 can sequentially move up or down through these load settings until the user reaches a desired load setting.

Any of the features, components, and/or parts, including the arrangements and configurations thereof shown in FIGS. 27-33E, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 27-33E.

Other features that may be implemented in an adjustable weight system are depicted in FIGS. 34 through 42F. These figures show an example dumbbell system 700 having some features and attributes similar to or carried over from system 600. The system 700 may include a handle assembly 704 coupleable to a set of main weights 702 and a set of supplemental weights 706. The supplemental weights 706 may be positioned internal to the main weights 702 and may be partially enclosed within portions of the handle assembly 704. In some embodiments, the handle assembly 704 may include a set of weight selector components usable to systematically select the weights (702 and/or 706) to achieve a desired exercise load.

Many embodiments of the dumbbell system 700 may also include a base assembly 708 that may serve as a support for the weights that are not currently being used. Additionally, the base assembly 708 may include a safety interlock 710 that engages with the handle assembly 704 to allow for the rotation of the handle 712 when the dumbbell system 700 is positioned in the base assembly 708. In contrast, once when a user removes the system 700 from the base, the safety interlock 710 may disengage with the handle assembly 704 and may prevent the rotation of the handle 712, similar to the operation of weight interlock element 610.

Figure 35:
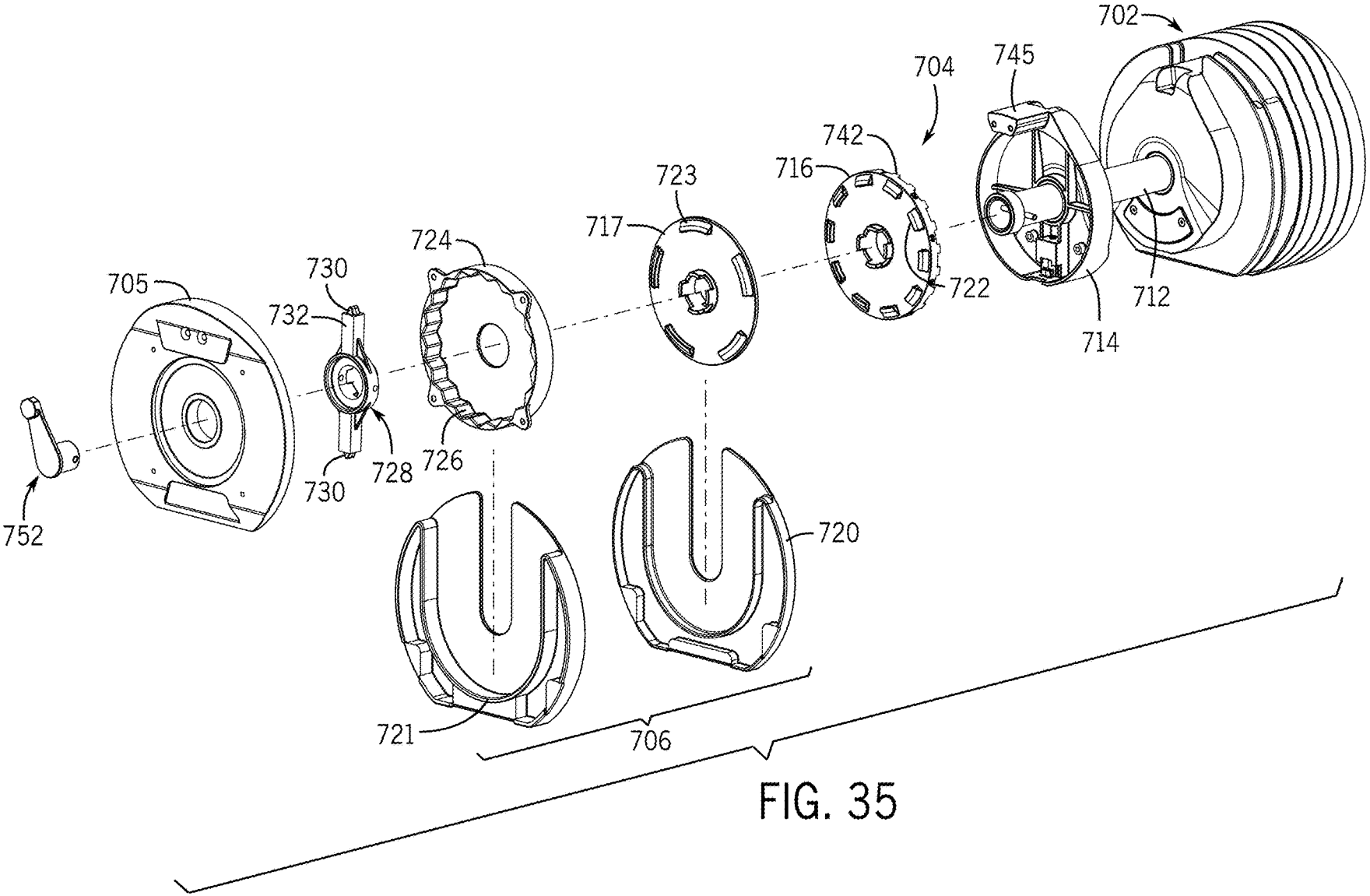
FIG. 35 is a partial exploded view of the system of FIG. 34 with some parts omitted.
Figure 36:
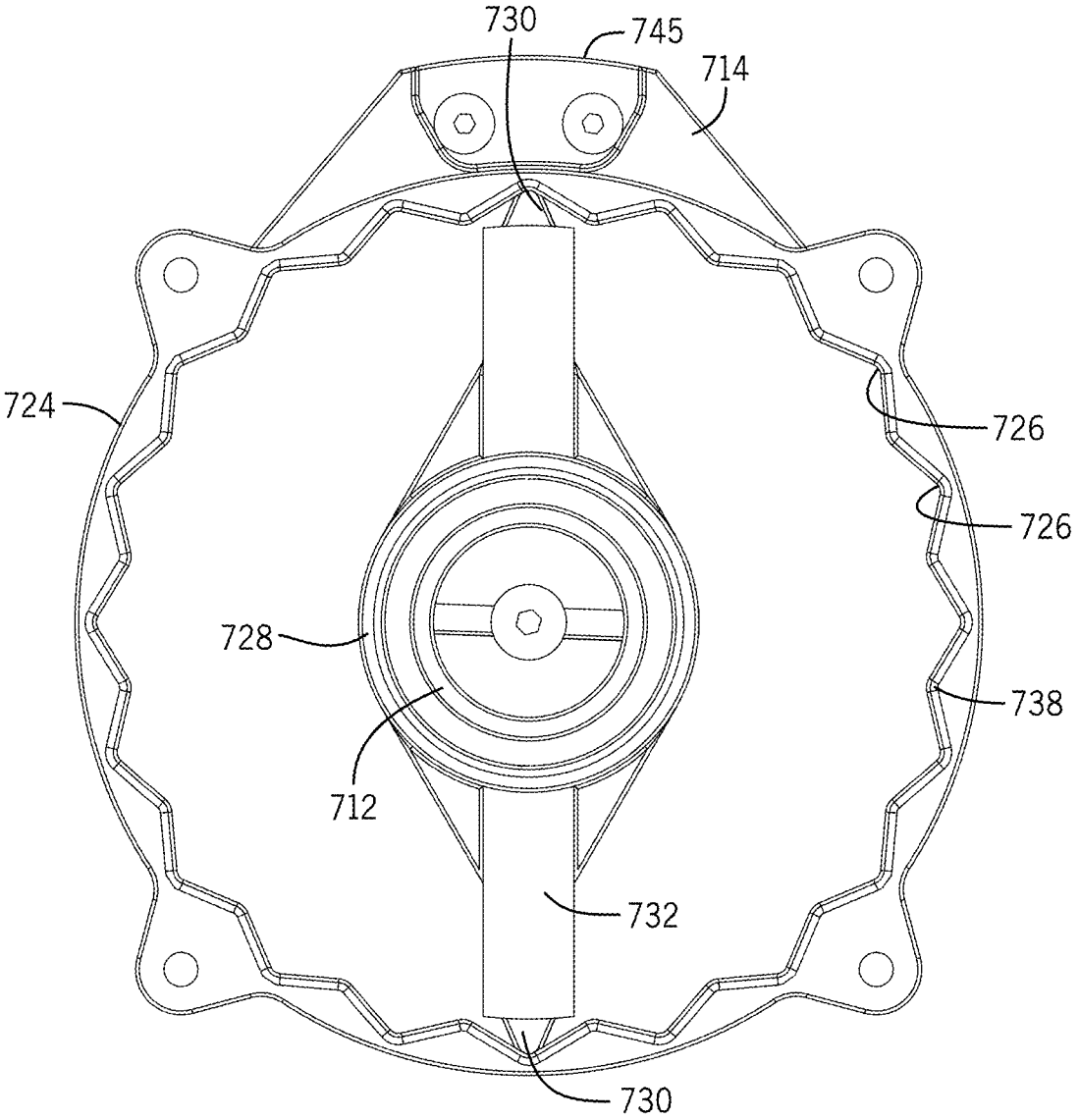
FIG. 36 is an end view of a detent ring and follower subassembly of the system of FIG. 34.

In some embodiments, the handle assembly 704 may have a housing 714 that encloses or covers a number of different weight selector components. FIG. 35 illustrates an exploded view of one side of the handle assembly 704. Within the housing 714, the handle assembly 704 may have one or more supplemental selectors, such as an inner supplemental weight selector 716 and an outer supplemental weight selector 717. The inner and outer supplemental weight selectors 716, 717 may be operated to enable or disable coupling of the inner and outer supplemental weights 720, 721, respectively. The supplemental weights 720, 721 may be of any desired weight that may allow the adjustable dumbbell system 700 to incrementally increase the load or resistance of the handle assembly 704. For example, some supplemental weights may be 1 pound, 1.25 pounds, 2 pounds, 2.5 pounds, etc. The supplemental weight selectors 716, 717 may be connected to the handle 712 and may synchronously rotate with the rotation of the handle 712. Additionally, each of the supplemental weight selectors 716, 717 may have multiple tabs 722, 723 (e.g., axial protrusions) that extend axially outward from the axially outward-facing side of the disc and that may be configured to engage with lifting tabs 718 (similar to tab 622; see FIG. 39) on each of the supplemental weights 720, 721.

The tabs 722, 723 may be circumferentially spaced apart so that the supplemental weights 720, 721 are only coupled for lifting with the handle assembly 704 at certain increments in the rotation of the selectors 716, 717. In some embodiments, tabs (e.g., 722) on one selector (e.g., 716) may have a smaller circumferential width (such as for example arc length) than tabs (e.g., 723) on another selector (e.g., 717). In this manner, the tabs 722, 723 do not necessarily couple both supplemental weights 720, 721 at the same time. In some rotational positions of the handle 712 and tabs 722, 723, only a first supplemental weight may be selected. In another position, only the other/second supplemental weight may be selected. In another position, both supplemental weights may be selected, and in some cases, neither may be selected. Thus, using multiple supplemental weights 720, 721 and differently-spaced and -sized tabs 723, 722 on their respective selectors 716, 717 may allow for a greater number of incremental load selection options for the user of the dumbbell system 700.

The handle assembly 704 may have a detent ring 724 that is positioned within the housing 714 and connected thereto. The detent ring 724 may include a set of circumferentially positioned detents 726 on a radially internally facing surface. See the axially-facing end view of FIG. 36. The detents 726 may be configure to interact with a spring actuated follower subassembly 728. The follower subassembly 728 may have one or more biased pawls or deflectable biased followers 730 located in a housing 732. The followers 730 may be resiliently engaged with the radially internally facing surface and its detents 726 on the detent ring 724. The follower subassembly 728 may be connected to the handle 712 and may rotate with the rotation of the handle 712 while the detent ring 724 does not rotate and is instead mounted to a handle weight 705. As the follower subassembly 728 rotates, the followers 730 may move between the detents 726 and may create a positive haptic and/or audio feedback for the user, indicating the selection or deselection of various weights, similar to other follower and detent mechanisms described in detail elsewhere in the present disclosure.

Additionally, the follower subassembly 728 and the detent ring 724 may serve as an additional safety device to ensure that that the handle is not partially rotated between load selections. The shape of the detents 726 may be configured with a sloped surface on either side of a peak (e.g., 738). Thus, the followers 730 may be biased radially outward by a biasing member (e.g., a spring; see FIG. 39) within the housing 732, and the biasing force may urge the followers 730 to a stable, low-potential-energy position where they are seated in the radially outermost points of the nearest detents 726. Accordingly, the handle 712 may be biased to rotate with the housing 732 into corresponding stable positions with the followers 730 as deep as possible in the detents 726. The depth of the detents 726 and the slopes on each side of the peaks (e.g., 738) may also help to prevent the follower 730 from undesired rotational movement because a threshold minimum moment or torque may need to be applied to the handle to overcome the biasing force on the followers 730 that keeps them urged toward their radially outermost, stable positions.

Figure 38:
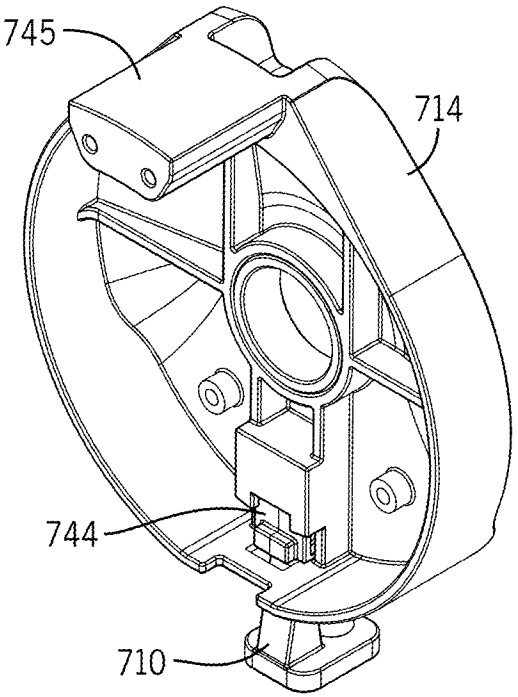
FIG. 38 is an isometric view of the system of FIG. 34 with some parts omitted.

The prevention of unwanted movement may be desirable for the user so that that the handle 712 does not accidentally rotate and allow any of the selected weights to be disengaged during use. Accordingly, in some embodiments, the weight selector 716 may be configured with a set of axially extending, circumferentially spaced apart safety tabs 742 on the opposite side of the selector 716 from the weight selector tabs 722. See FIGS. 35 and 37. The safety tabs 742 may be engaged or disengaged with a lock button 744 positioned in a portion of the housing 714 and biased radially outward by a biasing member 746 (e.g., spring), as shown in FIGS. 37 and 38.

The lock button 744 may be configured to contact the safety interlock 710 of the base assembly 708. When the dumbbell system 700 is placed in the base assembly 708, the safety interlock 710 may radially internally depress the lock button 744 and thereby disengage the lock button 744 from between adjacent tabs 742 of the weight selector 716. In that lock-disengaged state, the user may rotate the handle 712 (including rotating the weight selector 716) to select a desired exercise load on the handle assembly 704 and then remove the handle assembly 704 from the base assembly 708. As described above, the detent ring 724 may assist in biasing the handle 712 to certain rotational positions associated with different incremental loads. Those detent positions may correspond to gaps between the tabs 742, so if the followers 730 are fully seated in the detents 726, the lock button 744 and interlock 710 may both be radially aligned with a corresponding gap between two tabs 742. Accordingly, the handle assembly 704 (including the weight selector 716) may be lifted away from the interlock 710 as the interlock 710 is radially withdrawn through that gap. At the same time, the biasing member 746 may drive the lock button 744 into the gap, thereby preventing further rotation of the weight selector 716 (and therefore further adjustment of the main weight or supplemental weight selection assemblies of the system 700) while the handle assembly 704 is displaced away from the base assembly 708 and the interlock 710. Thus, once the lock button 744 is disengaged with the safety interlock 710, the biasing member 746 may push the lock button 744 into a position between two safety tabs 742 and prevent the rotation of the supplemental weight selector 716 and the handle 712 relative to the handle weight 705 and other weights 702, 720, 721 coupled to the handle assembly 704.

Figure 34:
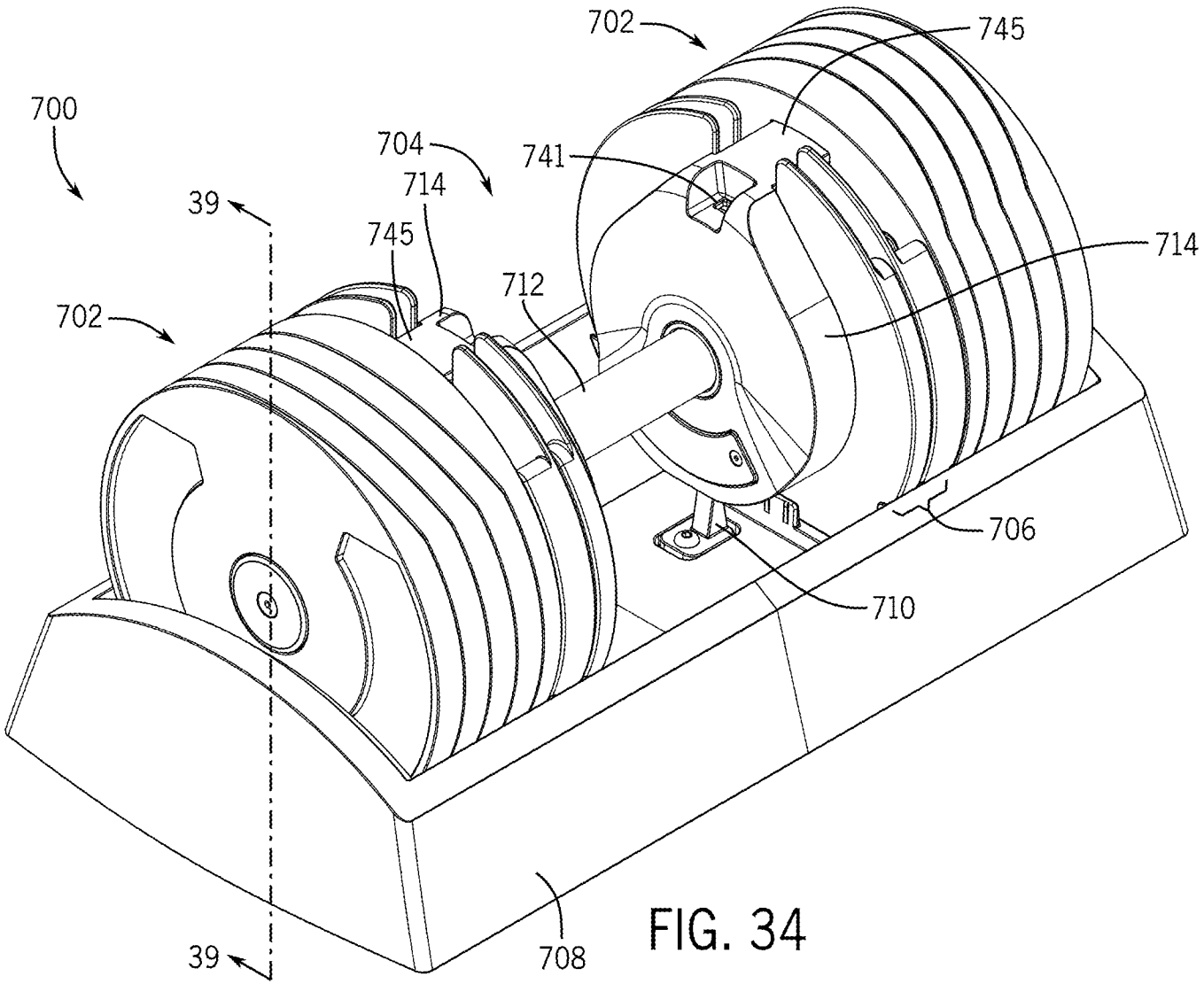
FIG. 34 is an isometric view of an adjustable dumbbell system.
Figure 37:
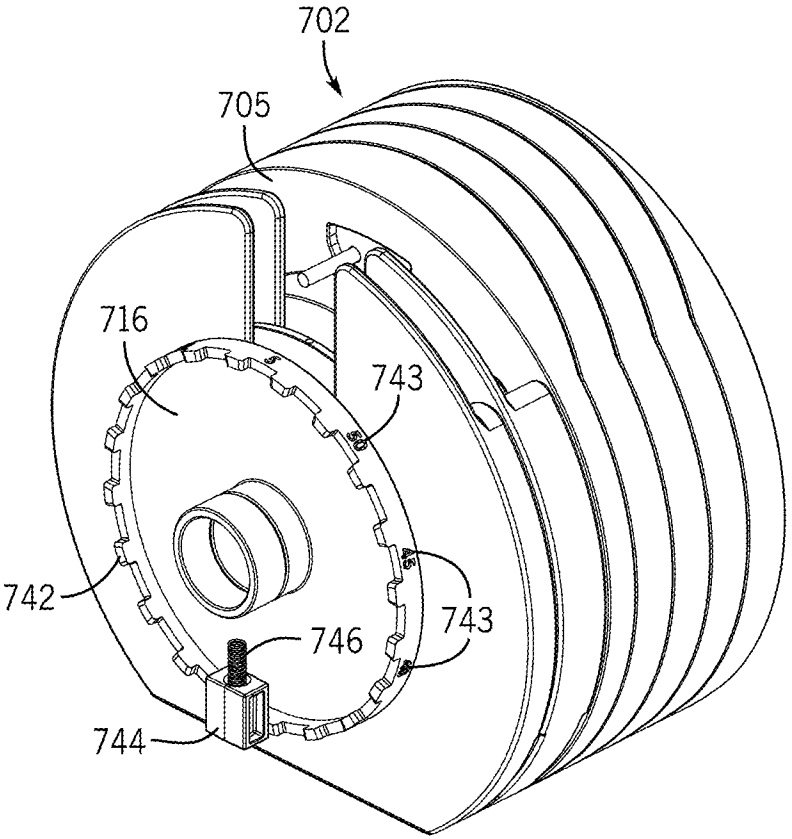
FIG. 37 is an isometric view of the system of FIG. 34 with some parts omitted.

In some embodiments, the supplemental weight selector 716 may comprise a set of indicators or glyphs 743, as shown in FIG. 37, that may indicate the selected load to the user. The glyphs 743 may be visible through an opening or window 741 in the housing 714, as indicated in FIG. 34. The housing 714 may include a connecting portion 745 mounted to the handle weight 705. Accordingly, while on the base assembly 708, the handle 712 may rotate with the supplemental weight selectors 716, 717, and the follower subassembly 728 while the housing 714, detent ring 724, handle weight 705, and supplemental weights 720, 721 remain rotationally stationary. While detached from the base assembly 708, the handle 712 and its connected features (716, 717, 728) may be prevented from rotating relative to the other elements 714, 724, 705, 720, 721) in the handle assembly 704.

While supported by the base assembly 708, the handle 712 may also rotate a selector key 752 that extends through the handle weight 705. See FIGS. 35 and 40. The selector key 752 of the handle weight 705 may function in a manner similar to selector key 634 by being at least partially insertable into a slot 758*a* of an axially rotatable retainer 756*a* (such as for example a rotor) of an adjacent main weight 702*a*. See FIG. 40. The selector key 752 may include a central axial shaft 751, a radial arm 753, and an outer axial shaft 755. The central axial shaft 751 and radial arm 753 may be positioned flush with, or axially internal to, an axially-outward-facing surface 757 of the handle weight 705. Accordingly, in some embodiments, only the outer axial shaft 755 may protrude outward from the axially-outward-facing surface 757 and into the retainer 756*a* at the slot 758*a*.

The slot 758*a* may be significantly smaller than the slot 6002 of retainer 6000 and may extend only partially radially into the retainer 756*a* rather than extending entirely across its diameter. In some embodiments, the slot 758*a* may be referred to as an outer radial notch, radial indent, or retainer recess in an outer edge of the retainer 756*a*. The slot 758*a* may have a shape profile of a radial inner part 763*a* that is configured to at least partially receive and match side surfaces of a substantially squared or octagonal outer axial shaft 755. See FIG. 42A. The slot 758*a* may also have a flared radially outer portion 761*a* configured to horizontally and laterally funnel or guide the outer axial shaft 755 toward the radial inner part 763*a* of the slot 758*a* as the handle weight 705 vertically approaches the main weight 702*a* (e.g., when the handle assembly 704 is being placed on the base assembly 708).

The retainer 756*a* may be rotatable to a position wherein the slot 758*a* opens upward (as in FIG. 40) and also radially opening toward an upper recess 760 of the main weight 702*a*. The upper recess 760 may receive a protrusion 763 of the handle weight 705 and may axially and at least partially laterally interlock (e.g., with pairs of undercut surfaces) the weights 702*a*, 705, similar to the interlocking features described in connection with the other systems herein (e.g., 100, 300, 600). Similarly, the main weight 702 may have a lower protrusion 765 insertable into and axially (and at least partially laterally) interlockable with a recess 767 on the handle weight 705. The main weight 702 and handle weight 705 are illustrated in this configuration in FIGS. 34 and 39.

Figure 42A:
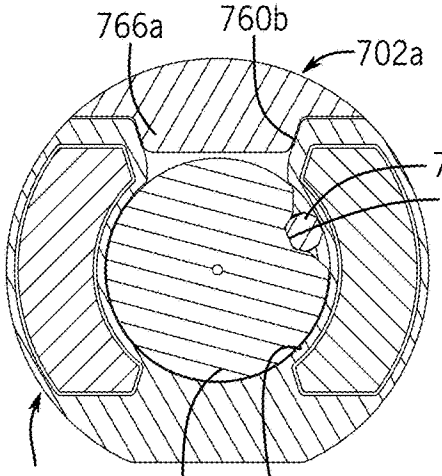
FIGS. 42A-42F are end-facing section views as taken through an interface between two main weights of the system of FIG. 34 with an outer axial shaft and retainer in various rotated positions.
Figure 42B:
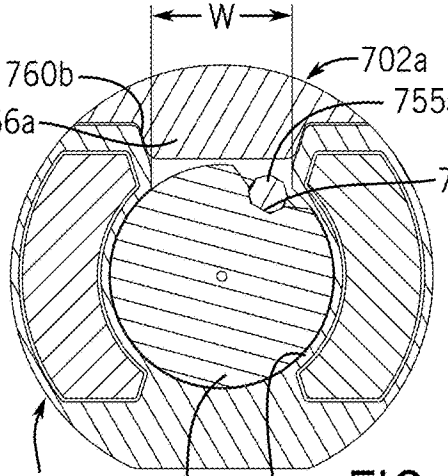
Figure 42C:
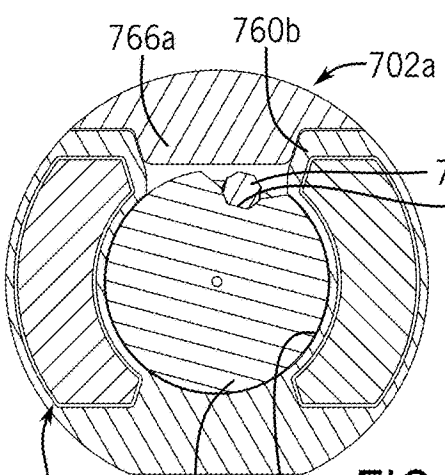

As the handle weight 705 descends into the interlocked configurations of the recesses 760, 767 and respective protrusions 763, 765, the selector key 752 may be configured with the outer axial shaft 755 positioned within a slot-receiving opening width W of the upper recess 760 (see width W in cross-section of FIG. 42B). The slot 758*a* may also be rotated/positioned so that the outer axial shaft 755 vertically moves through the upper recess 760 and into the slot 758*a*, as shown in FIG. 42B, 42C, 42D, or 42E. Rotation of the selector key 752 (e.g., via rotation of the handle 712) may rotate the retainer 756 (similar to key 634 rotating retainer 6000). At certain rotated positions of the selector key 752 and retainer 756 relative to the main weight 702, the selector key 752 may be prevented from radial withdrawal from the slot 758 due to engagement with a recess sidewall 769 surrounding the retainer 756, as described in further detail below. Accordingly, the handle weight 705 and main weight 702 may be axially and laterally coupled to each other while the outer axial shaft 755 is positioned between the sidewall 769 and the slot 758. In this configuration, the handle assembly 704 may be used for exercise with the main weight 702 securely held to the handle weight 705. In order to remove the main weight 702 from the handle weight 705, the handle assembly 704 may be positioned on the base assembly 708 (thereby unlocking weight selector 716 via lock button 744), and the handle 712 may be rotated to a position corresponding to the outer axial shaft 755 being radially aligned with the upper recess 760 of the main weight 702, thereby allowing the outer axial shaft 755 (and the rest of the handle weight 705) to be separated from the main weight 702 by vertical movement of the axial shaft 755 through the top of the upper recess 760.

Figure 40:
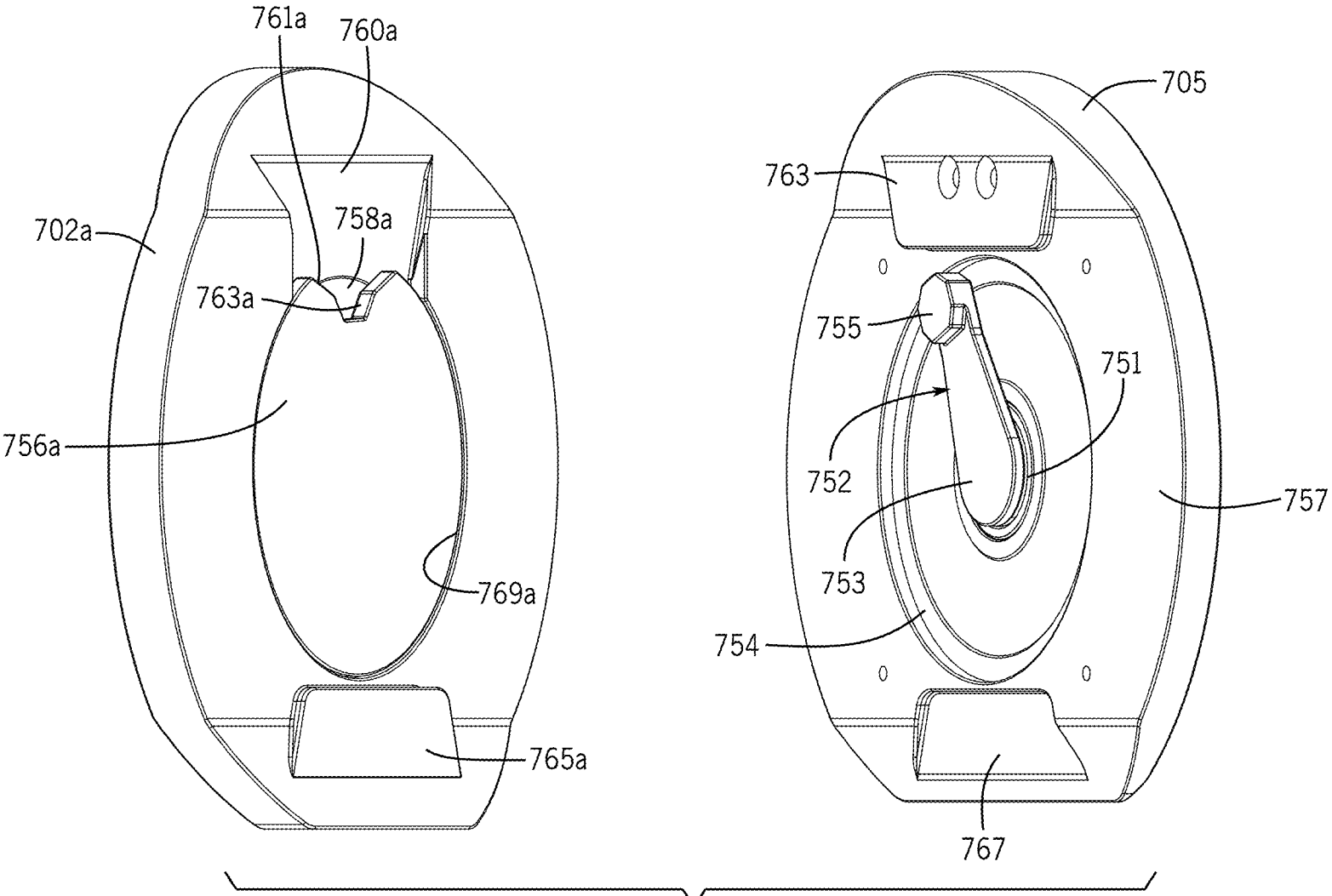
FIG. 40 is an isometric view of a handle weight and main weight of the system of FIG. 34.
Figure 41B:
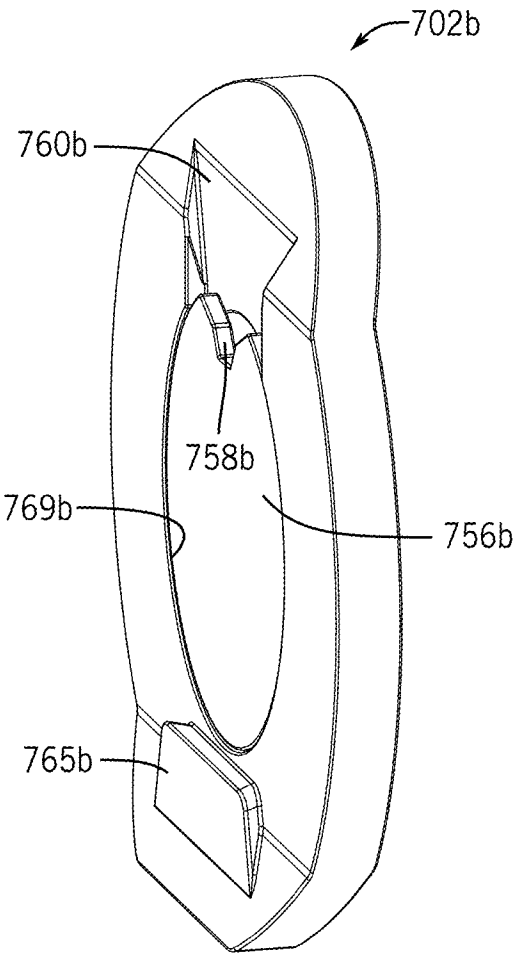
FIG. 41B is an isometric view of a main weight of the system of FIG. 34.
Figure 41A:
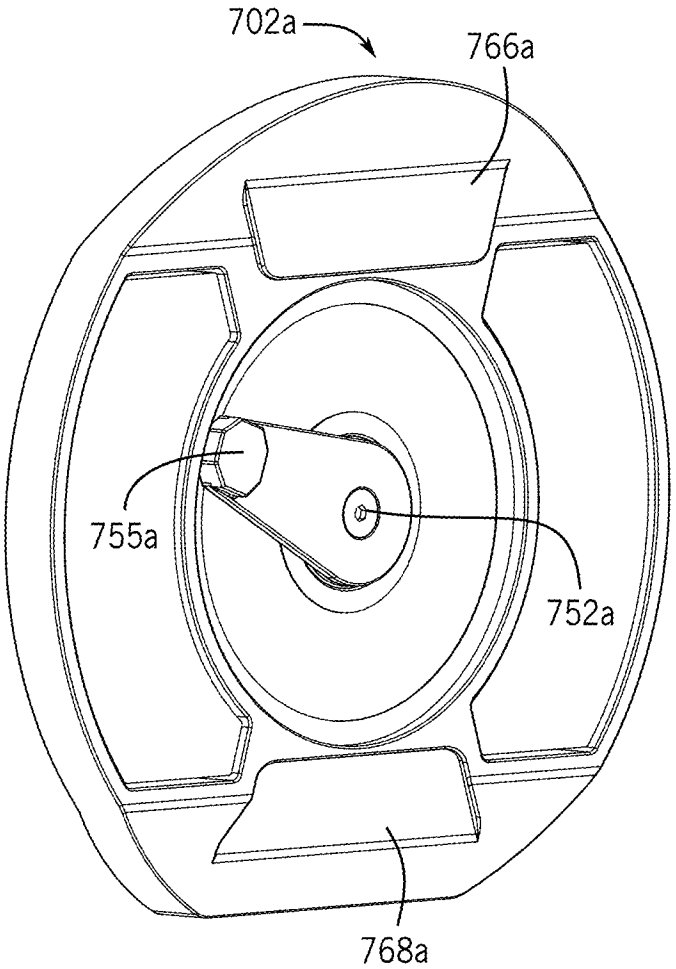
FIG. 41A is an isometric view of a main weight of the system of FIG. 34.

FIGS. 41A-42F show how similar features and mechanisms operate to allow a first main weight (e.g., 702*a*) to interlock with a second main weight (e.g., 702*b*). FIG. 41A shows an isometric view of a first main weight 702*a* (which may be the same main weight 702 shown in FIG. 40) with its axially outward-facing side visible. FIG. 41B shows an isometric view of a second main weight 702*b* with its axially-inward-facing side visible. The upper protrusion 766*a* and lower recess 768*a* of the first main weight 702*a* may interlock (e.g., dovetail) with a respective recess 760*b* and protrusion 765*b* of the second main weight 702*b*. The first main weight 702*a* may have a selector key 752*a* and an outer axial shaft 755*a* that is insertable into the slot 758*b* of the rotatable retainer 756*b* of the second main weight 702*b*. Thus, the selector key 752*a* and retainer 756*b* may interface to lock the main weights 702*a*, 702*b* together, particularly when the outer axial shaft 755*a* is positioned between a sidewall 769*b* and the slot 758*b* of the second main weight 702*b*.

As explained in connection with selector key 634, retainer 6000, and selector key 6014, the retainer (e.g., 756*a*) and selector key (e.g., 752*a*) on each main weight (e.g., 702*a*) may rotate together. In some embodiments, the slot (e.g., 758*a*) on the retainer (e.g., 756*a*) and the outer axial shaft (e.g., 755*a*) of the selector key (e.g., 752*a*) on the same main weight (e.g., 702*a*) may not be axially aligned with each other. For example, when the slot 758*a* of the retainer 756*a* is positioned at the top position, as shown in FIG. 40, the outer axial shaft 755*a* may be positioned angularly offset from the top position, as shown in FIG. 41A. The angular offset of the shaft 755*a* relative to the slot 758*a* may be within a range of about 15 degrees to about 60 degrees. In some embodiments, the angular offset may be within a range of about 30 degrees to about 50 degrees. Thus, as with system 600, the system 700 may have main weights 702 that are locked to each other while only one of the weight pairs (e.g., 702*a*/705, 702*a*/702*b*, or other pairs of main weights 702) is unlocked from each other due to the rotated positions of the retainers and outer axial shafts in each of the main weights 702 in the system 700.

Figure 39:
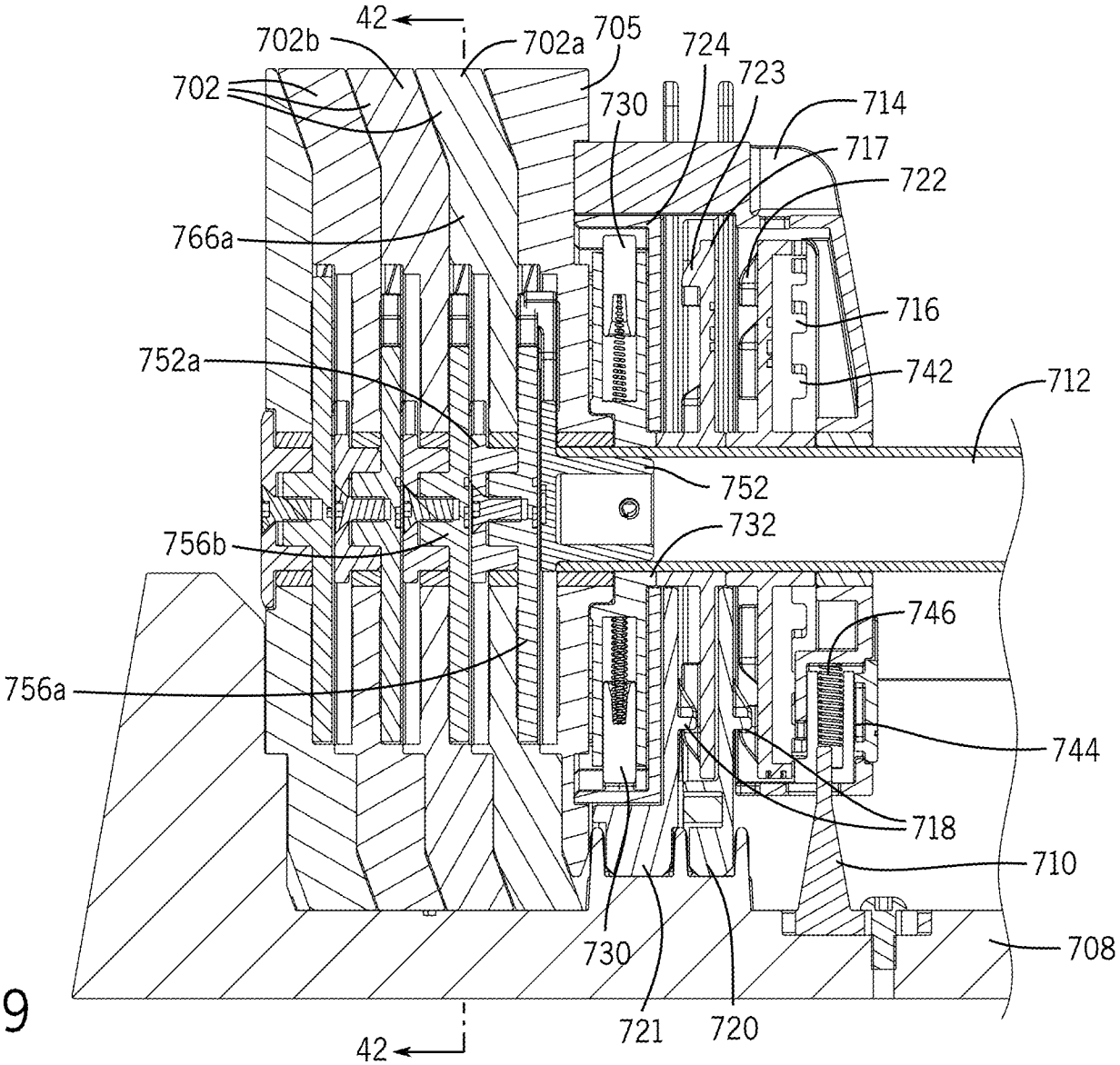
FIG. 39 is a central side section view of the system of FIG. 34.

FIGS. 42A-42F show axially-outward-facing section views of the interface between the first main weight 702*a* and the second main weight 702*b*, as taken through section lines 42-42 in FIG. 39. In FIG. 42A, the outer axial shaft 755*a* of the first main weight 702*a* is retained between the slot 758*b* of the retainer 756*b* and the sidewall 769*b* of the second main weight 702*b*, so the first and second main weights 702*a*, 702*b* are locked together. Rotation of the retainer 756*b* to one of the positions shown in FIGS. 42B-42E, wherein the outer axial shaft 755*a* is positioned within the width W of the recess 760*b*, would allow the outer axial shaft 755*a* to be vertically withdrawn out of the slot 758*b* and through the recess 750*b*, so the main weights 702*a*, 702*b* may be referred to as being unlocked or decoupled from each other for load-transferring purposes.

Figure 42D:
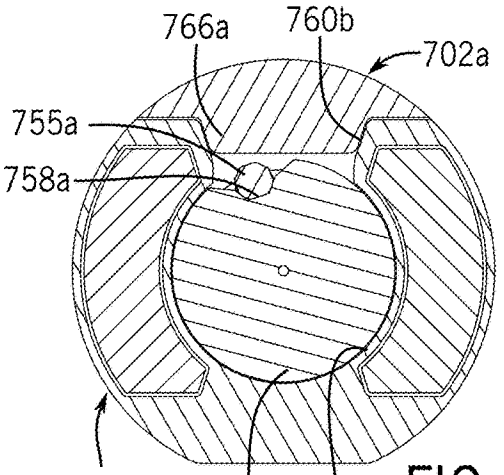
Figure 42E:
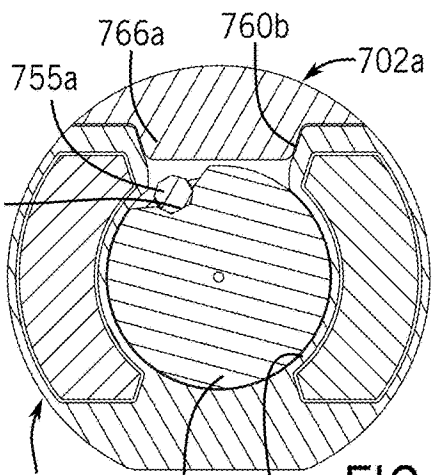
Figure 42F:
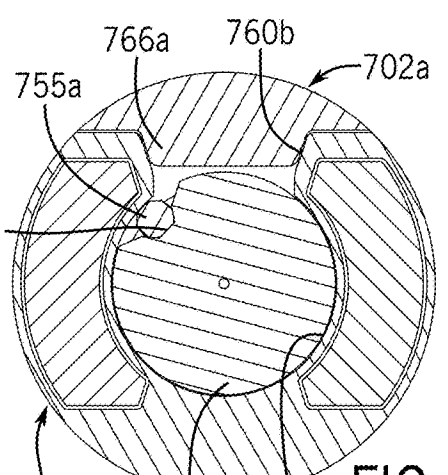

The weight selectors 716, 717 may rotate as the selector key 752*a* rotates, thereby engaging and disengaging one or both supplemental weights 720, 721 depending on the rotated positions of the tabs 722, 723, as explained in detail above. The arc lengths of the tabs 722, 723 and the gaps between the tabs 722, 723 may define ranges of handle 712 rotation (and selector key 752*a* rotation) wherein none, one, or both of the supplemental weights 720, 721 are engaged with the handle assembly 704. The width W of the recess 750*b* of a main weight (e.g., 702*b*) may therefore correspond to a range of rotated handle/selector key positions so that the load coupled to the handle assembly 704 is incrementally increased across several intervals of handle 712 rotation. For example, in the position shown in FIG. 42B, the main weight 702*b* may be disengaged/decoupled, and the supplemental weights 720, 721 may also be disengaged/decoupled. For example, only the handle weight 705 and one pair of main weights (e.g., 702*a* and its corresponding main weight on the other side of the handle 712) may be lifted together. In the position shown in FIG. 42C, the retainer 756*b* may be rotated (along with the weight selectors 716, 717) so that one pair of supplemental weights 720 is engaged/coupled, a second pair of supplemental weights 721 is disengaged/decoupled, and the main weight 702*b* is disengaged/decoupled. In FIG. 42D, the retainer 756*b* is in a position where the first pair of supplemental weights 720 is disengaged/decoupled, the second pair 721 is engaged/coupled, and the main weight 702*b* remains disengaged/decoupled. As shown in FIG. 42E, both pairs of supplemental weights 720, 721 may be engaged/coupled, and the main weight 702*b* may be disengaged/decoupled. Once the retainer 756*b* reaches the position of FIG. 42F, the pair of main weights on each side of the handle 712 that correspond to main weight 702*b* may be added to the load, and the supplemental weights 720, 721 may be disengaged again. Thus, the main weight 702*b* may be decoupled through a range of angular positions of the handle 712 (FIGS. 42B-E) and may be coupled through a range of angular positions of the handle 712 (e.g., from the position of FIG. 42F to just after the position of FIG. 42A, traveling counterclockwise.

Furthermore, with the outer axial shafts 755 on each main weight 702 being angularly offset from the slot 758 on the opposite side of the main weight 702, some main weights 702 may be coupled to each other with outer axial shafts 755 not at the top of the retainer 756 and aligned with the upper recess width W of their neighbor. At least one main weight 702 may be in the top of retainer position, thereby allowing the handle assembly 704 to be lifted without also lifting any further-axially-outward main weight 702 in the system 700. Multiple angles allow a selector key 752 to clear a neighboring main weight 702, so more valid handle positions can be used to control the selection of the supplemental weights.

The foregoing has many advantages. For instance, as described, the dumbbell system may provide a single dumbbell that accommodates lighter weight workouts with relatively small weight increments between weight selections and heavier weight workouts without disassembling the handle assembly. The dumbbell system may include multiple types of weight selection methods. One weight selection method may involve rotating a handle about an axis of rotation to join one or more weights to a handle assembly of the dumbbell via rotation of indexing and/or selector discs. Such as selection method may be useful on a lighter weight dumbbell and/or may allow for relatively small incremental weight selections, such as two and one-half pound increments, between lower and upper weight limits for the adjustable dumbbell. The other weight selection method may involve rotating a selector to linearly move a selection member to couple a weight to a handle assembly of the dumbbell. This selection method may be useful to join relatively large weights to the dumbbell to significantly increase the upper weight limit of an existing adjustable dumbbell that uses another selection method to join its other weights to the handle assembly.

Any of the features, components, and/or parts, including the arrangements and configurations thereof shown in FIGS. 34-42F, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 34-42F.

Referring now to FIG. 44, the weight selection system 810 may have a cover or end housing 816 that may enclose and cover a set of enmeshed gears 818, 819. A drive motor 820 positioned in the base assembly 806 may be powered by the power supply 812 and may drive a lower gear 818. An upper gear 819 may be coupled with or integrated with a shaft 821 coupled to the end of the cam shaft 130. The movement of the lower gear 818 may cause the upper gear 819 to rotate. Thus, in various embodiments, the upper gear 819 may be connected to one or more weight selection components, and the rotation thereof may result in the selection of one or more weights, as described in connection with system 100. In some embodiments, the weight selection system 810 may also include a controller 822 that may include a computer system and software controls that may be programmed to operate the motor 820 as well as provide and output signal to the display 814. The controller 822 may also be connected to any number external controllers to send and/or receive signals. In some embodiments, the display 814 may function as an input device, wherein the user can provide input indicating a desired load, and the controller 822 can then receive the input and control the motor 820 to turn the necessary amount to implement the user instruction. The controller may also utilize any suitable signal transmission protocol such as wired or wireless communications. For instance, some embodiments may utilize BLUETOOTH® or WI-FI® wireless connectivity to connect to the external controller another external device, such as a computing device.

Any of the features, components, and/or parts, including the arrangements and configurations thereof shown in FIGS. 43-44, can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 43-44.

Figure 45:
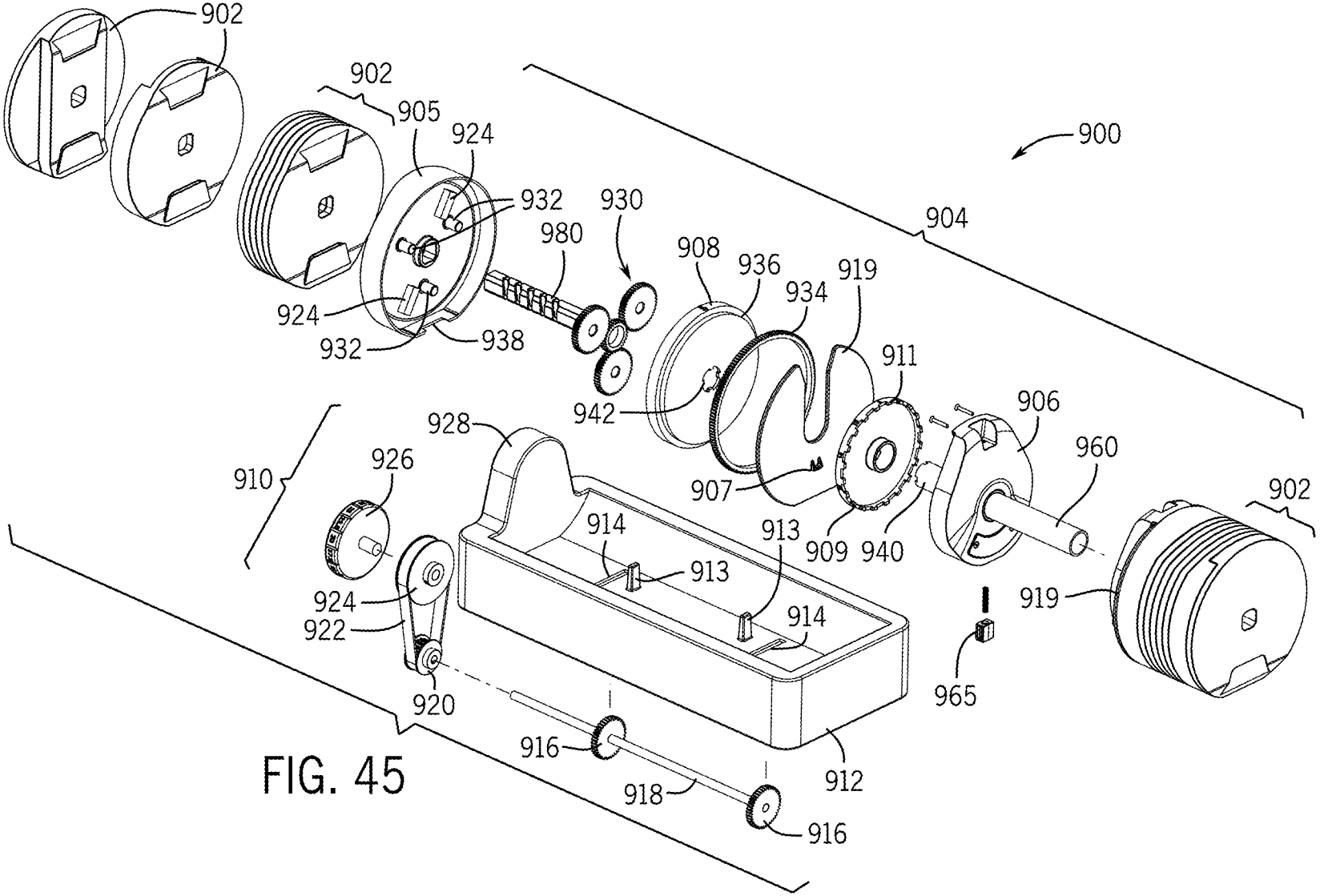
FIG. 45 is an isometric partially exploded view of an adjustable dumbbell system.
Figure 46:
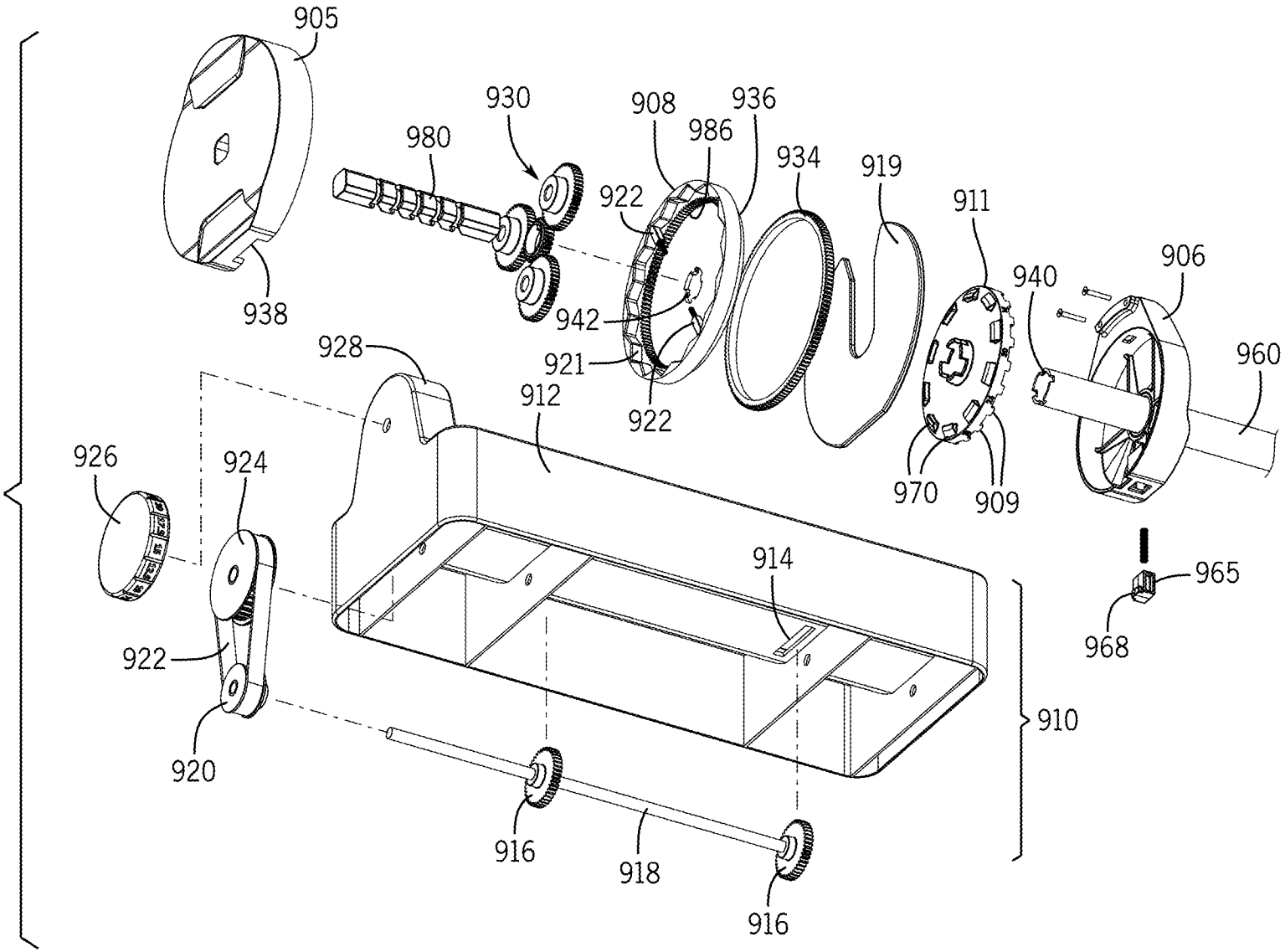
FIG. 46 is an isometric partially exploded view of the system of FIG. 45.
Figure 47:
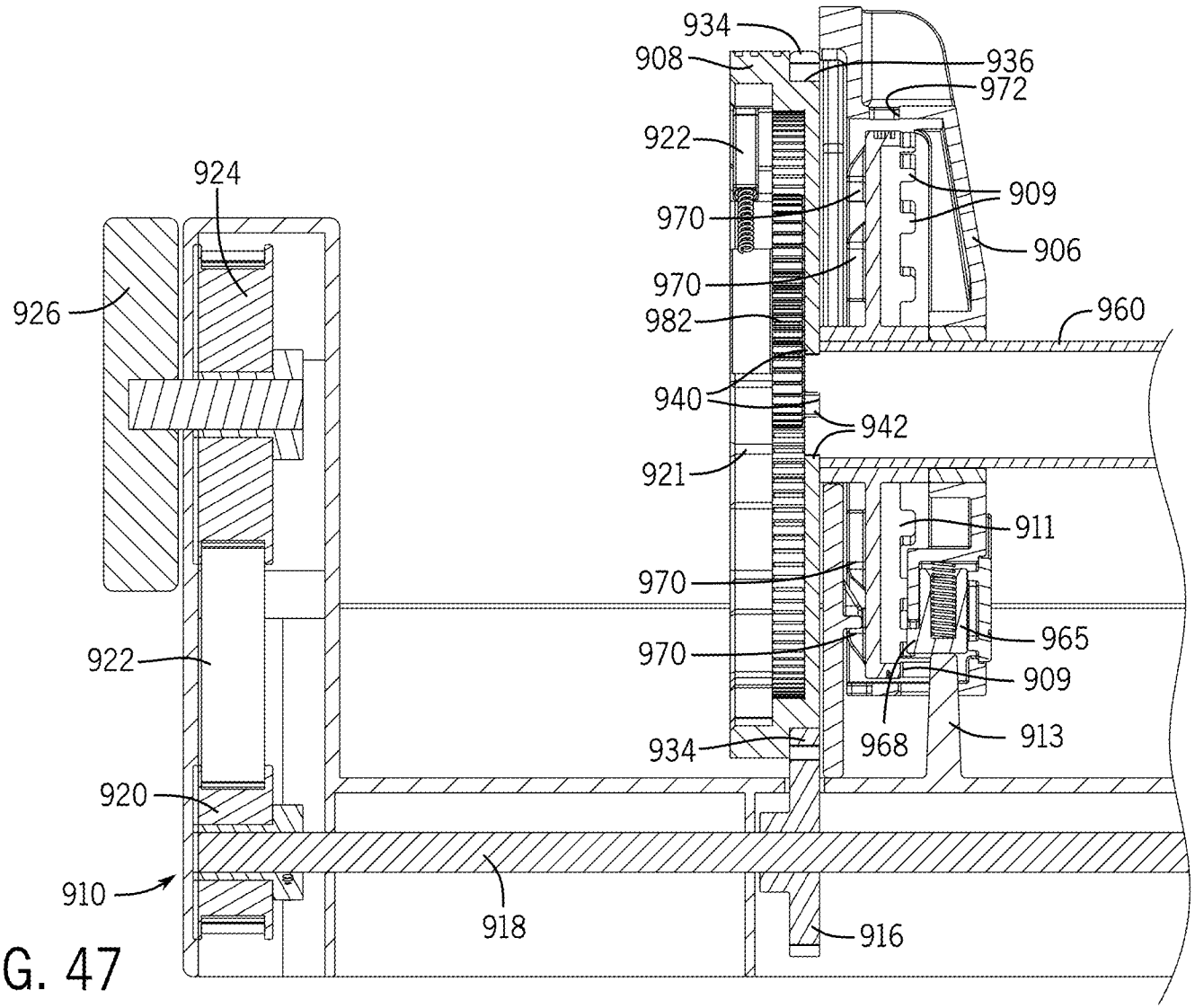
FIG. 47 is a central side cross-section view of some components of the system of FIG. 45.

FIGS. 45-47 illustrate aspects of a dumbbell system 900 with a handle assembly 904 configured to engage with and be supported by a base assembly 910 with controls for adjusting the load carried by the handle assembly 904 via movement of an extendable selector rod 980 without having to rotate the handle 960. The system 900 may therefore have components in common with dumbbell system 400, and those components may share the same function and features as corresponding components of system 400, such as the main weights 902 having features and functions in common with main weights 402. FIG. 45 shows an isometric view of the system 900 with one end of the handle assembly 902 and with the base assembly 910 exploded to show individual components. FIG. 46 shows an isometric exploded view of the system 900 with one end of the handle assembly 904 and some of the main weights 902 omitted. FIG. 47 shows a central side section view of one end of the base assembly 910 with parts of the handle assembly 904 positioned on the base assembly 910.

The base assembly 910 may be configured with portions of a load adjustment mechanism 908 configured to engage with portions of the handle assembly 904 to adjust load via engagement or disengagement of the main weights 902 and/or a set of supplemental weights 919. The base assembly 910 may include a base platform 912 having a set of openings 914 through which a set of selector gears 916 may be positioned. The selector gears 916 may be rigidly connected to an axle or drive shaft 918 engaging an end roller 920 (or sprocket/gear) which is driven by an upper roller 924 (or sprocket/gear) via a belt 922 (or chain). A load adjustment handle 926 may be coupled with the upper roller 924 and may extend from an upper housing portion 928 of the base platform 912 in order to be manipulated by a user when selecting a load for the dumbbell. Accordingly, rotation of the load adjustment handle 926 may drive the upper roller 924, which may drive the lower roller 922, which may drive the drive shaft 918, which may drive the selector gears 916.

The handle assembly 904 may comprise a gear housing 908 configured to contain a set of gears 930 (e.g., sun gear and planet gears similar to gears 412, 414) and to engage/mesh with the planet gears thereof at an inner toothed surface 982 (see FIG. 46). The planet gears may have axes of rotation defined by bearings and/or guide rods 932 extending from a handle weight 905. Thus, rotation of the gear housing 908 relative to the handle weight 905 can cause rotation of the central/sun gear of the set of gears 930 via the planet gears. Rotation of the sun gear can drive longitudinal/axial movement of the rod 980 via a helical path on the rod 980, similar to elements 414 and 480 of system 400.

A toothed ring 934 may be positioned around an outer surface 936 of the gear housing 908. In some embodiments, the toothed ring 934 may be integrated into the outer surface 936, wherein the outer surface 936 includes the teeth. In some embodiments, the toothed ring 934 may be affixed (e.g., adhered, welded, interlocked, press-fit, or held by similar methods) to the outer surface 936 so that the ring 934 and housing 908 operate as a single piece and do not rotate relative to each other. The toothed ring 934 may engage/mesh with one of the selector gears 916 when the handle assembly 904 is positioned on the base assembly 910, as shown in FIG. 47. A slot or other opening 938 on the main weight 905 may receive a respective selector gear 916 so that the rest of the handle weight 905 may protect the toothed ring 934 from exposure. Accordingly, rotation of the load adjustment handle 926 drives rotation of the gear housing 908. In this manner, the handle 960 does not need to rotate to adjust load on the handle assembly 904 (such as for example to adjust the axial position of the selector rod 980) because the selector handle 926 can be used for that purpose. In some embodiments, the lifting handle 960 and the selector handle 926 can each individually be operated to adjust load on the handle assembly 904. For example, the lifting handle 960 may have its outer ends interlocked with or affixed to the gear housing 908. The lifting handle 960 may comprise a set of circumferentially spaced-apart slots (e.g., 940) configured to receive circumferentially spaced-apart teeth (e.g., 942) of the gear housing 908.

The tubular lifting handle 960 may extend through a cover 906 and through a supplemental weight selector 911. The supplemental weight selector 911 may rotate with the lifting handle 960 (e.g., may be rotated by the rotation of the handle 960 caused by operation of the selector handle 926). A latch 965 similar to latch 465 may be biased downward within the cover 906 and may have a longitudinal tab 968 positioned within a gap between protrusions (e.g., 909) on the supplemental weight selector 911 to lock rotation of the handle 960 and/or gear housing 908 while the handle assembly 904 is lifted away from tabs 913 in the base assembly 910. See also latch 465, supplemental weight selector 411, and their related descriptions herein. When the latch 965 is pressed radially inward by the tabs 913, the supplemental weight selector 911 (and handle 960 and gear housing 908) may rotate due to the latch 965 being moved out of the radial position between protrusions 909. Thus, load adjustment is possible while the handle assembly 904 is on the base assembly 910. Supplemental weight selectors 911 on each end of the lifting handle 960 may be unlocked in this state, so load at each end of the handle assembly 904 may be changed simultaneously.

Removal of the handle assembly 904 from the base assembly 910 allows the latch 965 to be biased outward to a position where the tab 968 is between protrusions (e.g., 909) of the supplemental weight selector 911. The supplemental weight selector 911, gear housing 908, and lifting handle 960 are therefore locked relative to the handle weight 905, thereby preventing load adjustment during movement of the handle assembly 904 and usage by the user.

The handle weight 905 may also comprise a set of enclosures 924 to receive followers 922 and biasing members similar to enclosures 424 and followers 422 of system 400. See FIG. 24C. The followers 922 may engage a detent surface 921 of the gear housing 908 to bias the rotation of the gear housing 908 to predetermined positions of stability and security for the main weights 902 and supplemental weights 919.

The supplemental weights 919 may be engaged or disengaged by interaction between the supplemental weight selector 911 at engagement protrusions 970, similar to protrusions 411, and a supplemental weight protrusion 907, similar to axially-extending protrusion 413. The load selection chosen by the user may be indicated by indicators positioned on the radially outer-facing surface of the supplemental weight selector 911 through a window 972 on the cover 906.

Any of the features, components, and/or parts, including the arrangements and configurations thereof shown in FIGS. 45-47, may be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 45-47.

Figure 48:
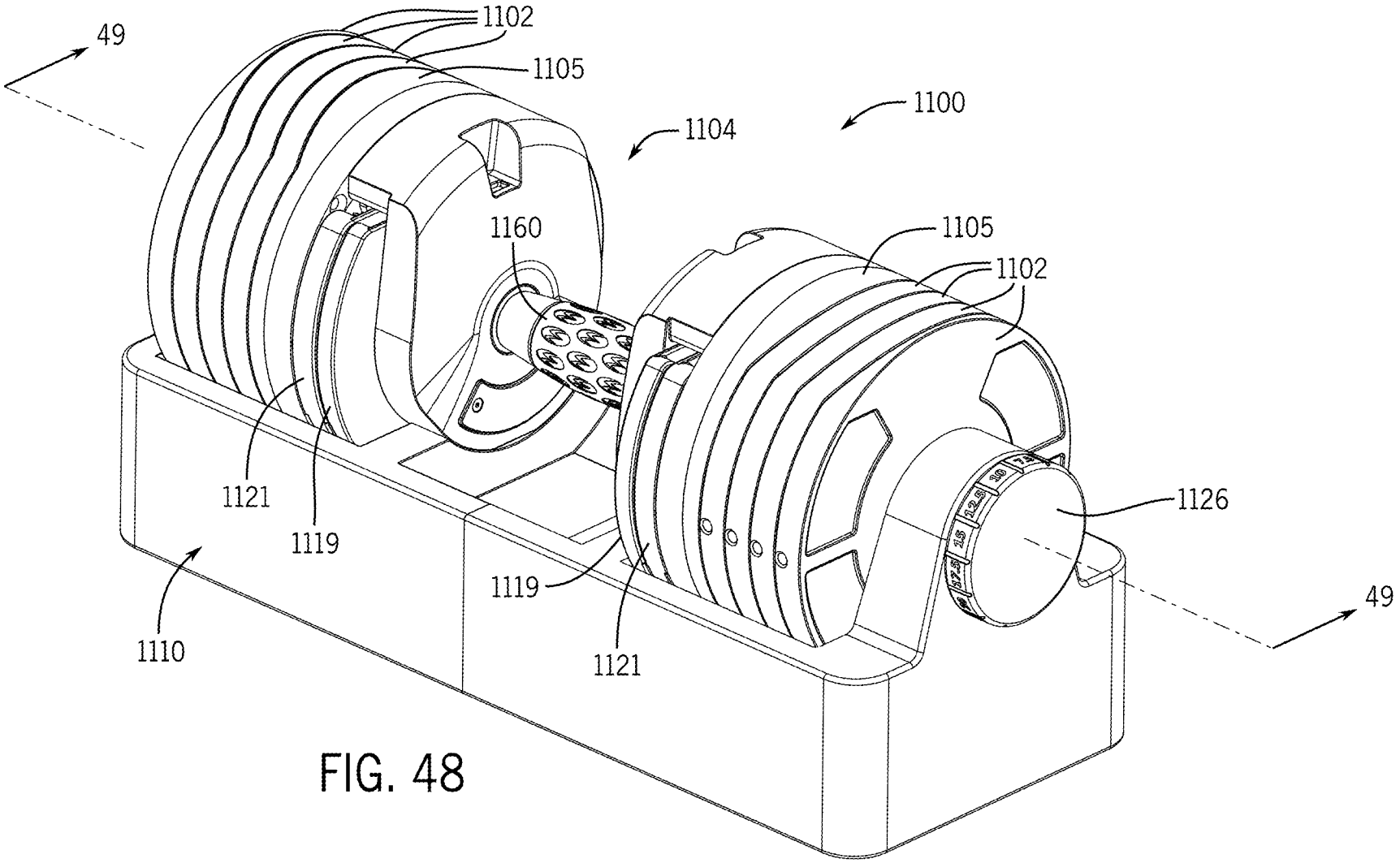
FIG. 48 is an isometric view of an adjustable dumbbell system.

FIG. 48 shows an isometric view of an adjustable dumbbell system 1100 having a load selector system partially positioned in its base assembly 1110. The system 1100 may have features and elements in common with systems 600 and 700 described herein. The system 1100 may include a handle assembly 1104 configured to engage or disengage pairs of supplemental weights 1119, 1121 and groups of main weights 1102 to change the load.

Figure 49:
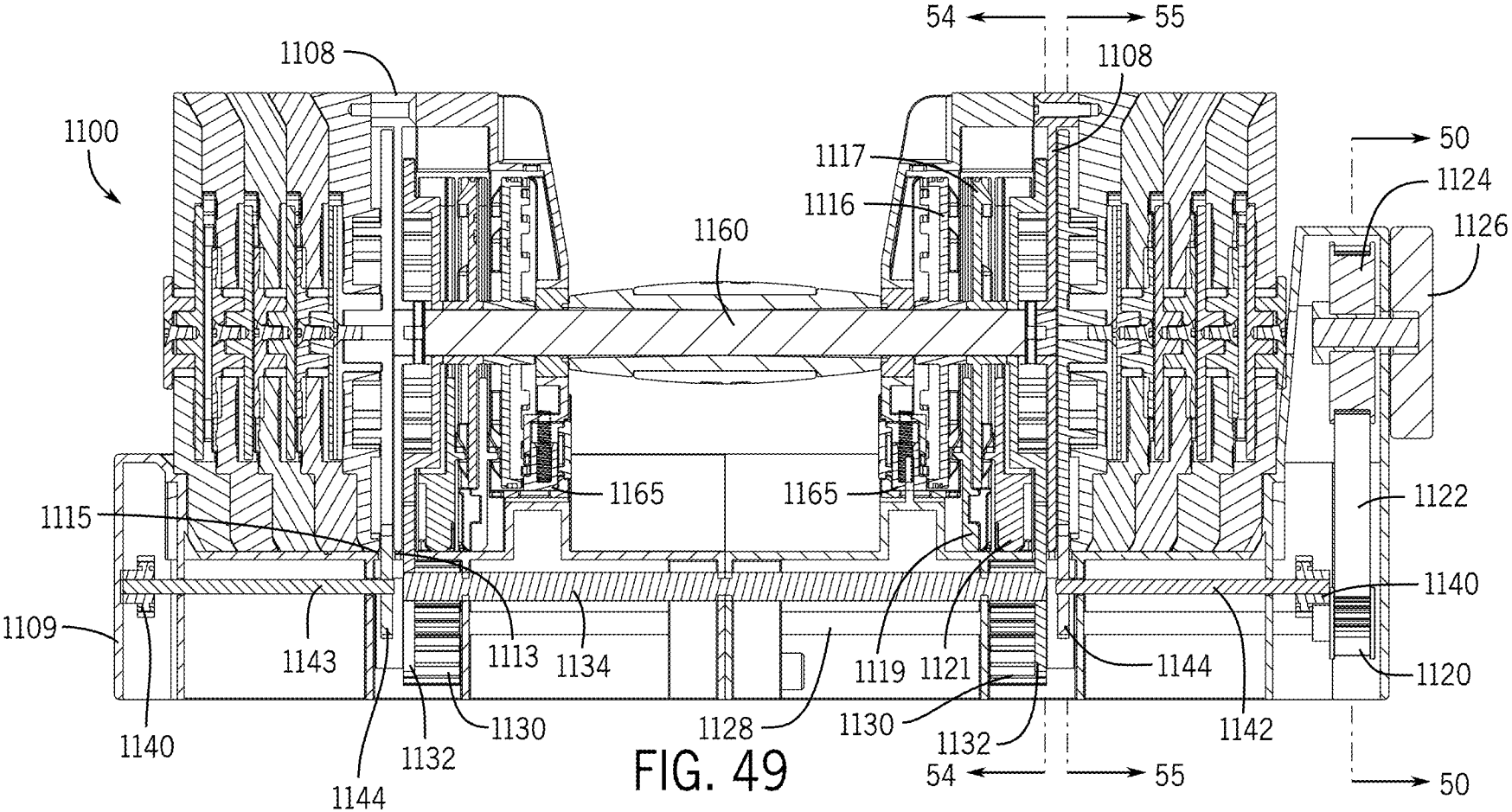
FIG. 49 is a central side cross-section view as taken through section lines 49-49 in FIG. 48.
Figure 50:
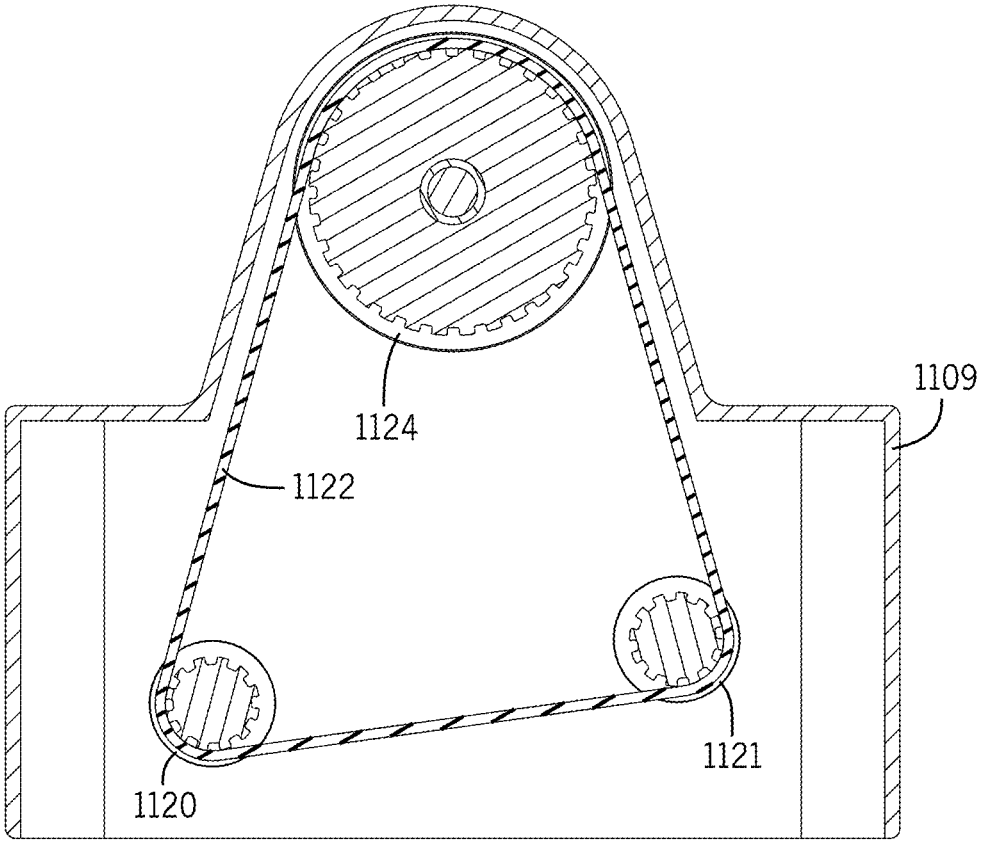
FIG. 50 is a side cross-section view as taken through section lines 50-50 in FIG. 48.
Figure 51:
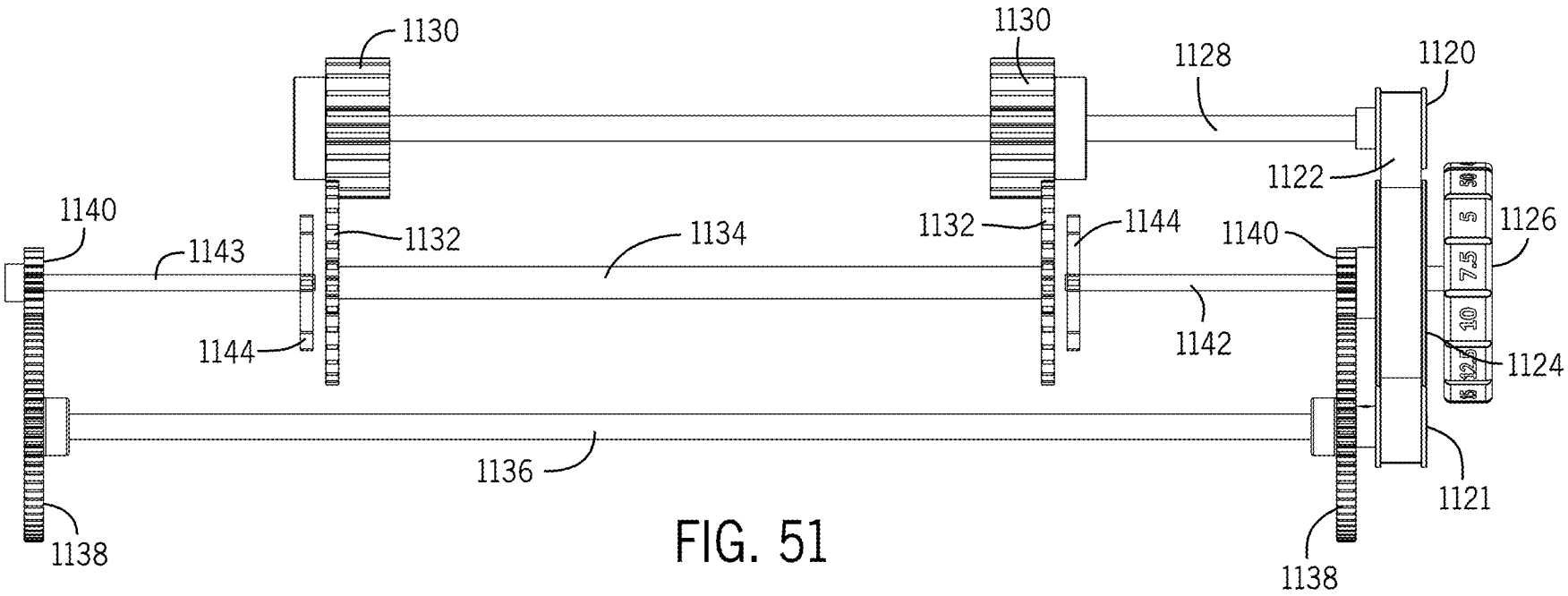
FIG. 51 is a top view of a base selector mechanism of the system of FIG. 48.

FIG. 49 is a central side section view of the system 1100 as taken through section lines 49-49 in FIG. 48. FIG. 50 is an end section view as taken through section lines 53-53 in FIG. 49. FIG. 51 is a top view of the base selector mechanism 1108 of the base assembly 1110.

As shown in FIGS. 49, 50, and 51, the base assembly 1110 may comprise a handle 1126 on a housing 1109 and coupled with an upper roller 1124 (or sprocket or gear) that is rotatable to drive a belt 1122 (or chain) linked to a first lower roller 1120 (or sprocket or gear) and a second lower roller 1121 (or sprocket or gear). In some embodiments, the rollers and belt/chain may be replaced with enmeshed gears or similar linkages. The base selector mechanism 1108 may include a first drive shaft 1128 linking rotation of the first lower roller 1120 to a first pair of intermediate gears 1130. The first pair of intermediate gears 1130 may each have teeth respectively engaged with teeth of a first pair of selector gears 1132. The first pair of selector gears 1132 may have their rotation linked via a second drive shaft 1134 and may extend through a pair of upward-opening slots 1113 (see FIGS. 49 and 55) in the base housing 1109, similar to slots 914. The base selector mechanism 1108 may also include a third drive shaft 1136 driven by the second lower roller 1121 and which is configured to rotate a second pair of intermediate gears 1138. The second pair of intermediate gears 1138 may drive rotation of a third pair of intermediate gears 1140 positioned on two separate drive shafts 1142, 1143. The drive shafts 1142, 1143 may be driven by the third pair of intermediate gears 1140 to also drive a second pair of selector gears 1144. The second pair of selector gears 1144 may extend through upward-opening slots 1115 (see FIGS. 49 and 54) in the base housing 1109. As explained in further detail below, the first pair of selector gears 1132 and the second pair of selector gears 1144 may be rotated (via operation of the selector handle 1126) to adjust the load on the handle assembly 1104 while the handle assembly is positioned on the base assembly 1110.

Figure 52:
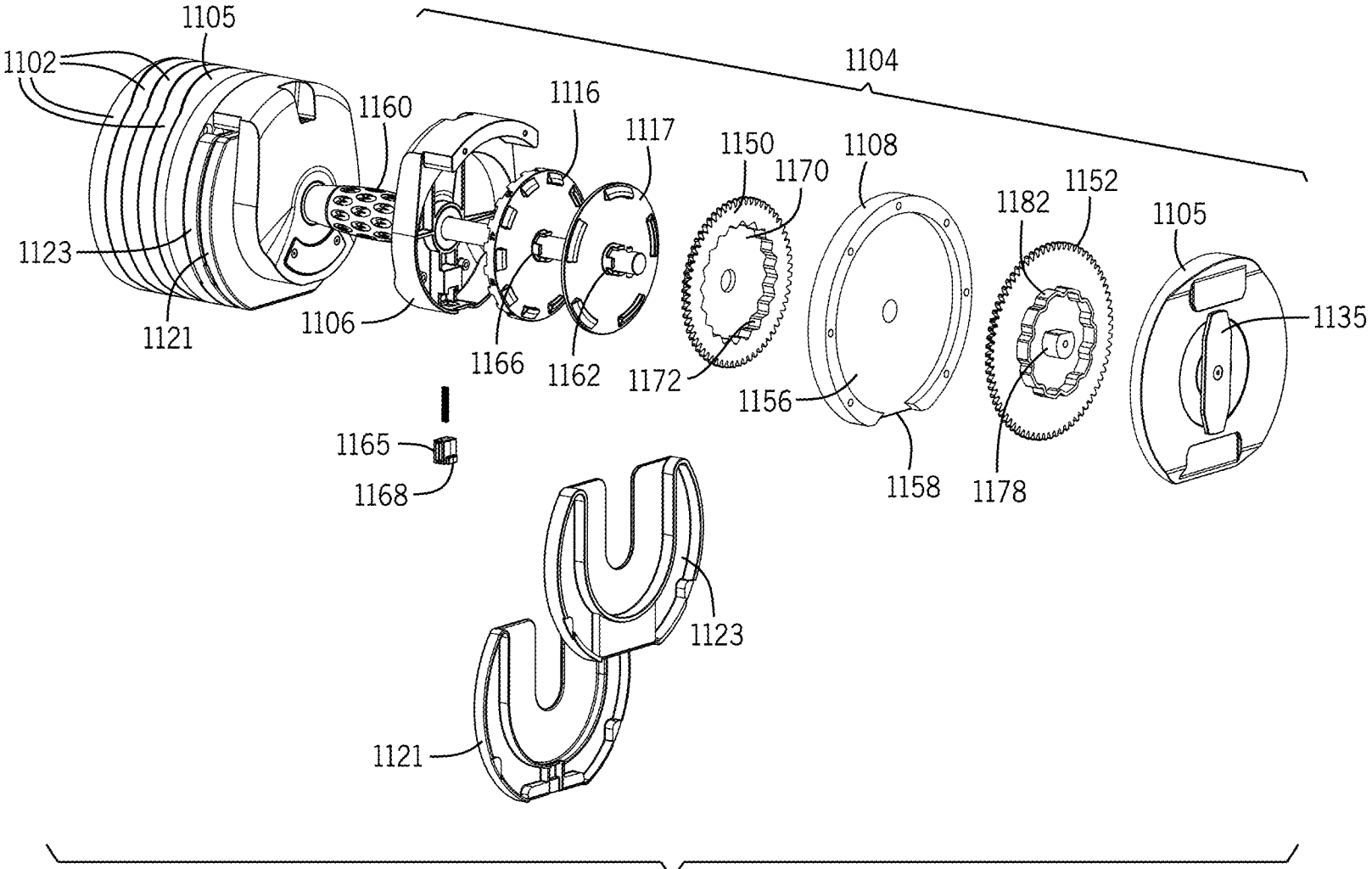
FIG. 52 is a partially exploded view of the handle assembly and weights of the system of FIG. 48.
Figure 53:
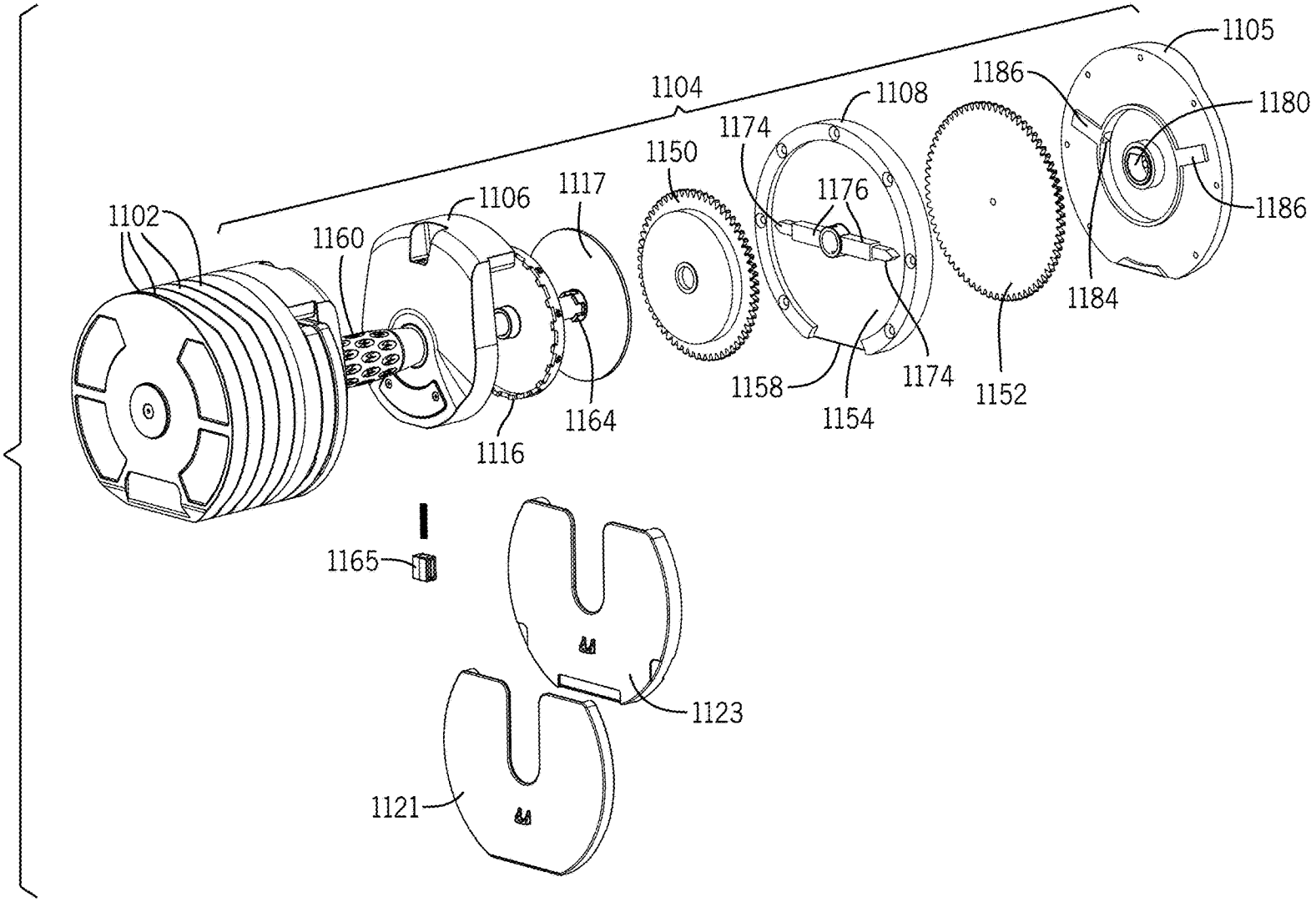
FIG. 53 is a partially exploded view of the handle assembly and weights of the system of FIG. 48.

FIGS. 52-53 show a partially exploded isometric view of the handle assembly 1104 and main weights 1102 of the system 1100. Components and features of the system 1100 may be similar to or copied from systems 600 and 700 and may therefore not all be described in connection with system 1100 in particular to avoid unnecessary repetition. For example, the handle assembly 1104 may include handle weights 1105 similar to handle weights 605, supplemental weights 1121, 1123 similar to supplemental weights 720, 721, and supplemental weight selectors 1116, 1117 similar to supplemental weight selectors 716, 717. The handle assembly 1104 may also include covers 1106 configured to hold biased latches 1165 with tabs 1168 operable relative to supplemental weight selectors 1116 to permit or prevent load adjustment via rotation of the selector handle 1126, similar to latches 465 and tabs 409. The covers 1106 may also include windows for viewing load indicators on a selector (e.g., 1116). Rotation of the selector handle 1126 may induce rotation of selector keys 1135 of the handle assembly 1104 similar to keys 634. In some embodiments, the lifting handle 1160 may not be used to adjust the load on the handle assembly 1104.

A pair of first base engagement gears 1150 and a pair of second base engagement gears 1152 may be carried in the handle assembly 1104. Each first base engagement gear 1150 may engage with a respective one of the first pair of selector gears 1132, and each second base engagement gear 1152 may engage with a respective one of the second pair of selector gears 1144. As shown in FIGS. 52-55, a selector gear housing 1108 may be positioned between the first base engagement gear 1150 and the second base engagement gear 1152. The first base engagement gear 1150 may be positioned in a first longitudinally-inward-facing recess 1154 on the selector gear housing 1108, and the second base engagement gear 1152 may be positioned in a second longitudinally-outward-facing recess 1156 on the selector gear housing 1108. The selector gear housing 1108 may define bottom slots 1158 or openings in those recesses 1154, 1156 into which the selector gears 1132, 1144 may extend to mesh with the radially outward-facing teeth of the base engagement gears 1150, 1152. The selector gear housing 1108 may be affixed to the handle weight 1105 (e.g., via fasteners, adhesives, interlocking parts, etc.). The central shaft of the handle 1160 may extend through central openings in the first base engagement gears 1150 and the selector gear housings 1108. The end of the central shaft may be interlocked with or affixed to the selector gear housing 1108, as shown in FIG. 49. Thus, the handle 1160 may have its movement synchronized with the selector gear housing 1108.

The first base engagement gear 1150 may be driven by selector gear 1132, and the first base engagement gear 1150 may be interlocked with and synchronously rotatable with supplemental weight selectors 1117 and 1116. For example, the first base engagement gear 1150 may be affixed to or interlocked with the outer supplemental weight selector 1117 (e.g., via longitudinally-extending tabs, such as tabs 1162), and the outer supplemental weight selector 1117 may be affixed to or interlocked with the inner supplemental weight selector 1116 (e.g., via additional longitudinally-extending tabs, such as tabs 1164, 1166). Accordingly, the first base engagement gear 1150, outer supplemental weight selector 1117, and inner supplemental weight selector 1116 may rotate together and independent from the handle 1160 and selector gear housing 1108. Rotation of the first base engagement gear 1150 may therefore be used to engage or disengage/select or deselect/couple or decouple one or both supplemental weights 1121, 1123 via rotation of the supplemental weight selectors 1116, 1117, similar to operation of supplemental weight selectors 717, 716 and supplemental weights 721, 720. However, rather than rotating the lifting handle 1160, the selector handle 1126 (and the other parts of the selector mechanism, including the rollers, belt, gears, and drive shafts 1120, 1122, 1124, 1126, 1128, 1130, 1132, 1134, 1136, 1138, 1140, 1142, 1143, and 1144) may be used to make the load adjustment.

The first base engagement gears 1150 may include a recess 1170 having a set of inward-facing detents 1172 configured to contact followers 1174 extending radially from enclosures 1176 in the selector gear housing 1108. See FIGS. 52 and 55. As with other embodiments herein, the followers 1172 and detents 1172 may assist in biasing the rotation of the first base engagement gear 1150 to discrete secure and stable positions in which the supplemental weights 1121, 1123 are fully selected or fully deselected.

Figure 54:
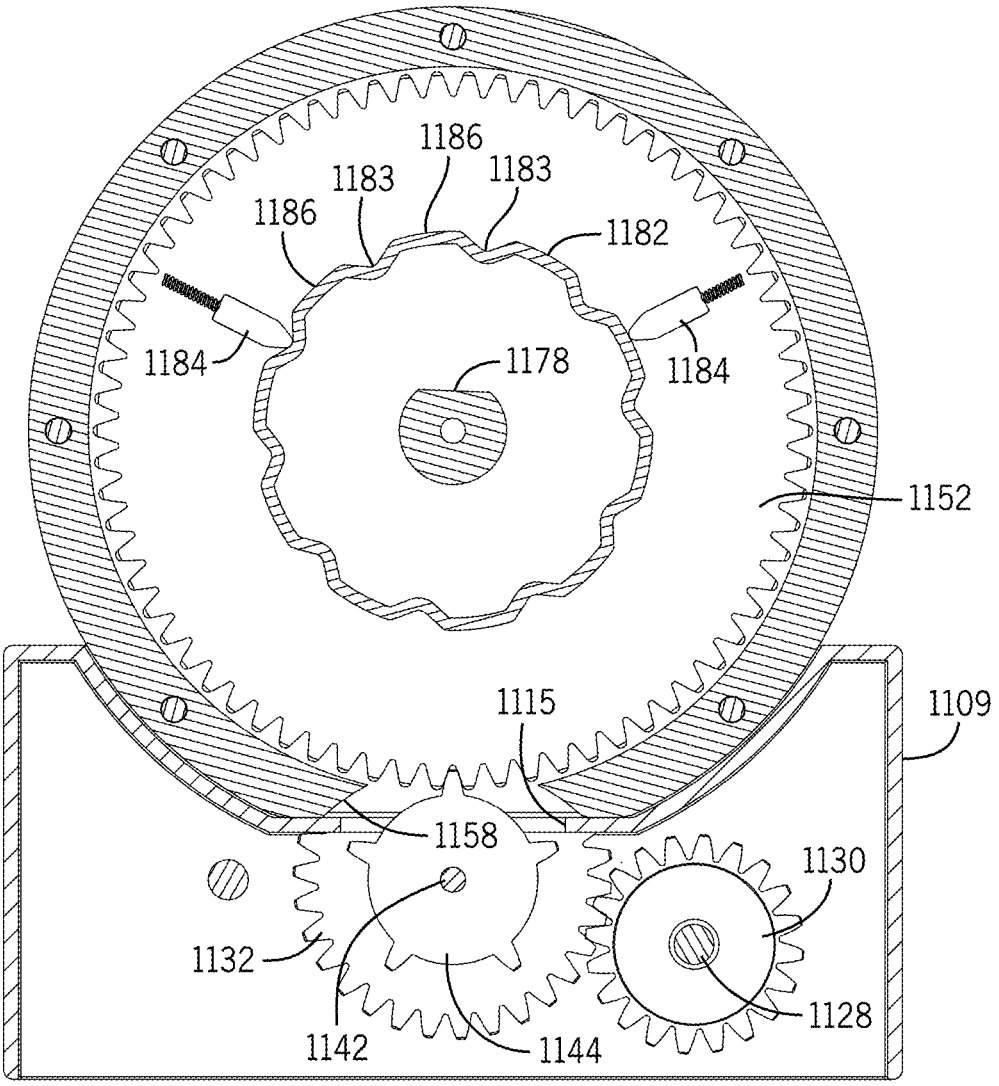
FIG. 54 is a side cross-section view as taken through section lines 54-54 in FIG. 48.

The second base engagement gears 1152 may each include a central keyed Keyed-shaft 1178 configured to interlock with a central keyed opening 1180 on an inward side of a selector key 1135 on the handle weight 1105, as shown in FIGS. 52-54. The keyed nature of the shaft 1178 and opening 1180 can ensure that the selector key 1135 has its rotation synchronized with the second base engagement gear 1152. Accordingly, rotation of the second base engagement gear 1152 adjusts the positioning of selector key 1135. In turn, the selector key 1135 may control engagement and disengagement/coupling and decoupling of the main weights 1102, similar to the key 634 of system 600, as described in connection with at least FIGS. 30B-33E. In some embodiments, the selector key 1135 may be shaped and configured to operate similar to key 752 of system 700 (e.g., with an outer axial shaft 755), as described in connection with at least FIGS. 40-42F.

The second base engagement gears 1152 may also each comprise a detent flange 1182 surrounding the central keyed Keyed-shaft 1178. The detent flange 1182 may be contacted by a pair of biased followers 1184 positioned in enclosures 1186 defined by the handle weight 1105, as shown in FIG. 53 and as schematically shown in FIG. 54. The detent flange 1182 may define a series of circumferentially-spaced-apart V-shaped radial detents (e.g., 1183) separated from each other by radially extended flange portions (e.g., 1186). Thus, the second base engagement gears 1152 may be biased into a set of rotationally-spaced-apart stable positions with the followers 1184 positioned in the detents 1183. Those positions may correspond to stable or secure positions for the selector key 1135 (or selector keys of the main weights 1102).

Figure 55:
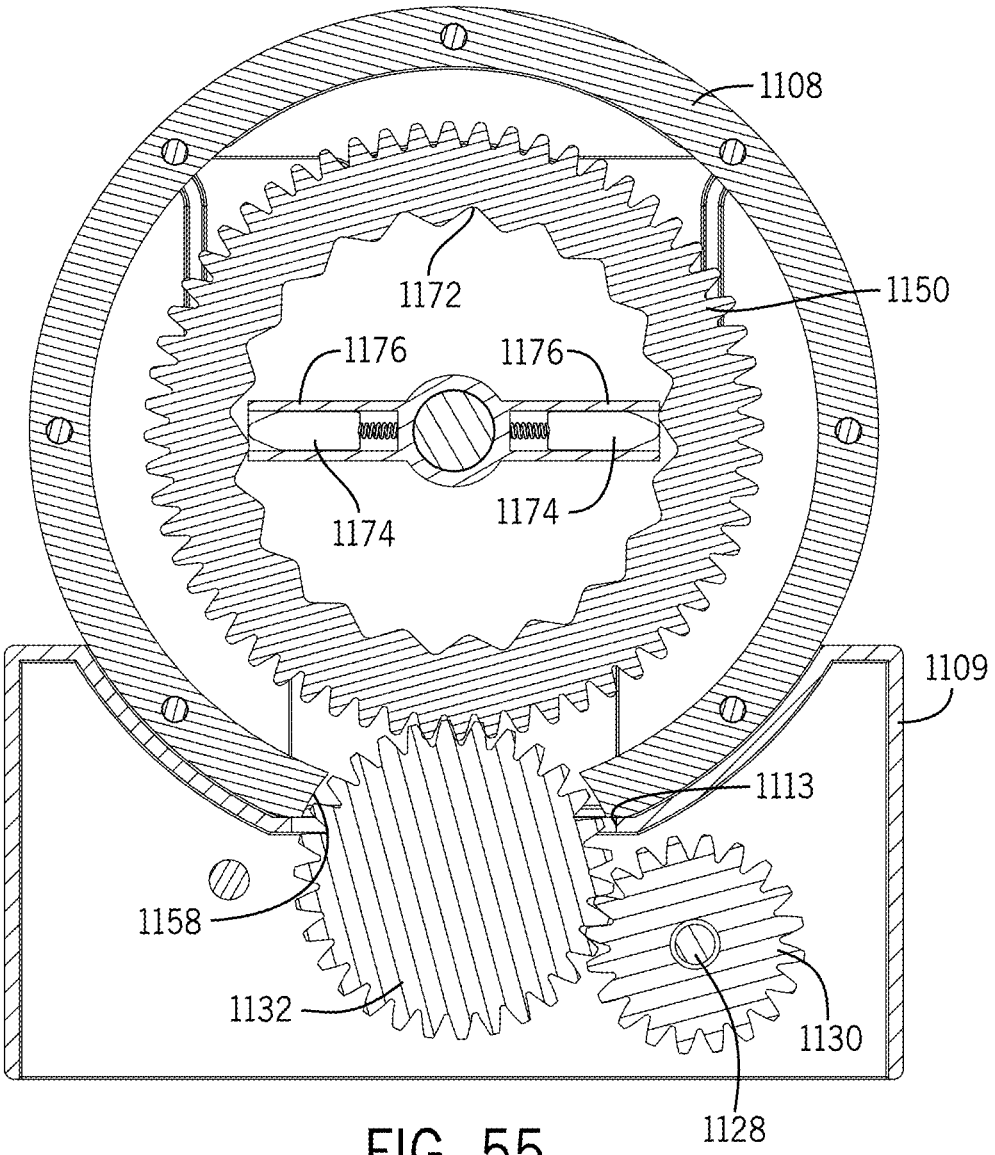
FIG. 55 is a side cross-section view as taken through section lines 55-55 in FIG. 48.

The second base engagement gears 1152 and their respective selector gears 1144 may have different gear ratios (e.g., gear sizes and gear teeth numbers) as compared to the first base engagement gears 1150 and their respective selector gears 1132, as seen in FIGS. 54-55. In some embodiments, the second pair of selector gears 1144 may have intermittent teeth, such as the five teeth shown in FIG. 54. Thus, each full rotation of the selector gear 1144 may advance the second base engagement gear 1152 by five positions. The size and positioning of the intermittent teeth can therefore give a predetermined intermittent clock-like movement to the second base engagement gears 1152 rather than moving the second base engagement gears 1152 at a constant velocity. The second base engagement gears 1152 may move at a first velocity relative to the handle weight 1105 while being driven by one of the intermittent teeth of the selector gear 1144 and may be stationary relative to the handle weight 1105 while none of the intermittent teeth of the selector gear 1144 are contacting the second base engagement gear 1152, even while the selector gear 1144 moves at a constant angular velocity. By comparison, the first base engagement gears 1150 may be in constant contact with the teeth of their respective selector gears 1132 and may therefore move at an angular velocity constantly proportional to the angular velocity of the selector gear 1132.

In this manner, and due to the gear ratios of the selector gears and base engagement gears, rotation of the selector handle 1126 may rotate the base engagement gears at different rates that allow selective engagement/disengagement of the supplemental weights at intervals different from the main weights, similar to the selector mechanisms of systems 600 and 700. Accordingly, the load selection mechanisms of the system 1100 may enable loads to change at smaller increments as compared to simply engaging or disengaging main weights 1102 by one pair (such as for example one weight on each end of the handle 1160) at a time. In some embodiments, between the engagement of each main weight 1102, the supplemental weights 1121, 1123 may transition between being both disengaged, one engaged (e.g., 1121), the other engaged (e.g., 1123), and both engaged (e.g., 1121 and 1123). Thus, the load may transition at smaller, smoother increments while minimizing the number and size of the main weights 1102 needed to reach a desired maximum load possible on the handle assembly 1104. Additionally, the user may adjust the load carried by the handle assembly 1104 without needing to grasp the lifting handle 1160 by turning the selector handle 1126 of the base assembly 1110. In some embodiments, the gearing of the base assembly 1110 may enable load adjustment with less effort (torque) provided by the user as compared to adjustment via twisting the lifting handle.

Any of the features, components, and/or parts, including the arrangements and configurations thereof shown in FIGS. 48-55, may be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the examples of the devices, features, components, and parts shown in FIGS. 48-55. For instance, in some embodiments, the system 1100 may include fewer supplemental weights 1121, 1123 and supplemental weight selectors 1116, 1117, such as only one pair of supplemental weights and their pair of corresponding selectors instead of two pairs. Additionally, the key 1135 may be modified or replaced to implement features of selector key 752 for interacting with main weights with corresponding retainers and slots (e.g., 702).

FIGS. 56-68 illustrate aspects of a dumbbell system 6400 including an adjustable dumbbell 6401 having a handle assembly 6404 and a plurality of weights 6402 (e.g., weight assemblies, weight plates, etc.) selectively coupled to the handle assembly 6404 to adjust the mass of the dumbbell 6401, such as when lifted away from a base 6410. The dumbbell system 6400 may therefore have components or assemblies in common with dumbbell system 600, 700, or 1100, among other systems described above, and such components or assemblies may share the same function and features as described above. For example, the adjustable dumbbell 6401 may have various components that cooperatively engage to allow a sequential selection of weights 6402 to adjust the mass of the dumbbell 6401 while limiting or controlling the size of the dumbbell 6401 due to only being as long as the necessary number of weights 6402 required to attain a particular load or weight. Components and features similar to dumbbell system 600, 700, or 1100 (or other systems described herein) may not be described in connection with dumbbell system 6400 to avoid unnecessary repetition.

Figure 56:
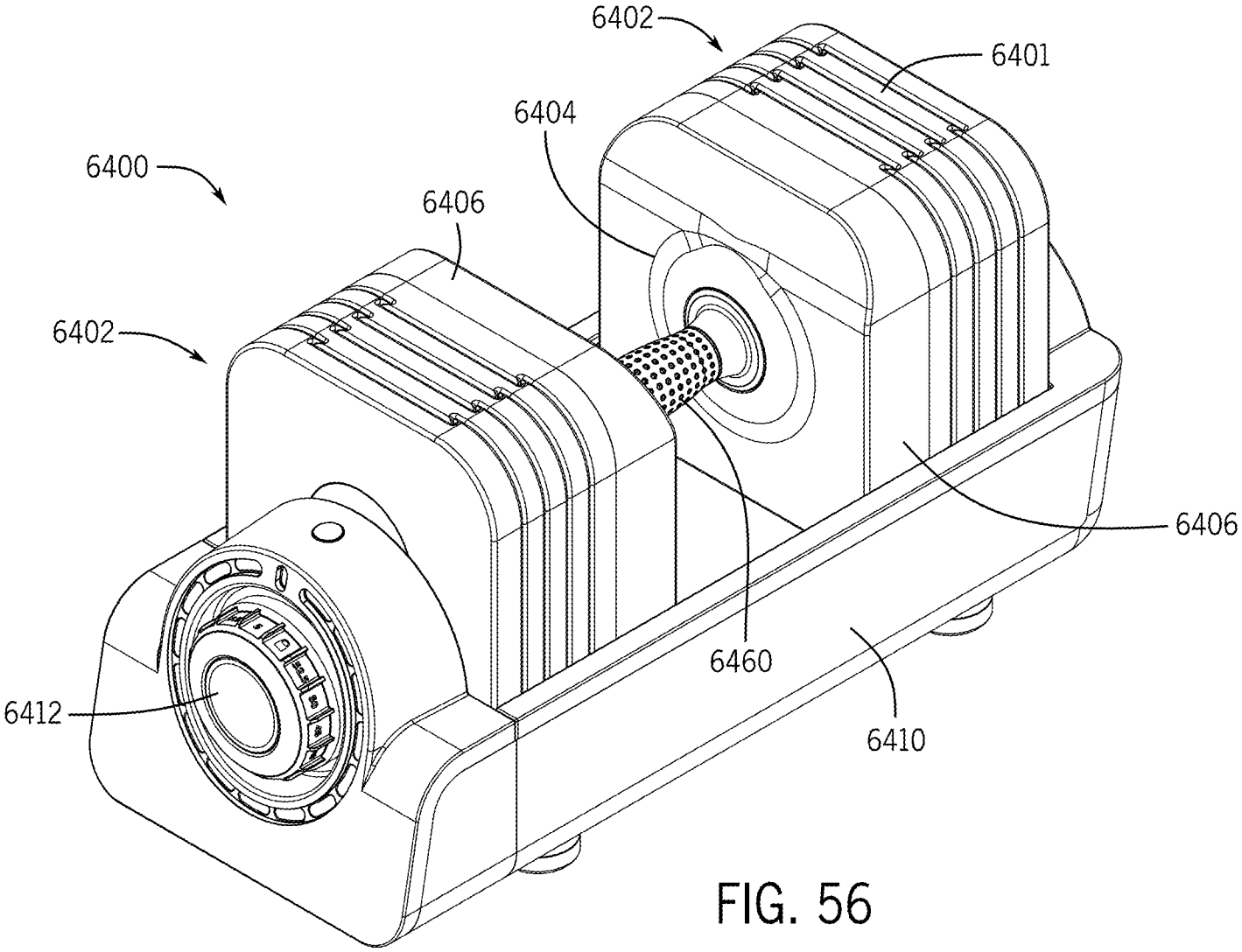
FIG. 56 is an isometric view of an adjustable dumbbell system.

Referring to FIG. 56, one or more (e.g., a number of) weights 6402 may be positioned at each end of the handle assembly 6404. In one example, the handle assembly 6404 may include a housing element 6406 at each end of a grip 6460, each housing element 6406 configured to house one or more add-on or supplemental weights 6406 (see FIG. 57). In such embodiments, each end of the handle assembly 6404 may include a respective housing element 6406, such that the housing elements 6406 are considered part of the handle assembly 6404. The base 6410 may receive the dumbbell 6401 and serve as a support for the dumbbell 6401 when not in use. Additionally, or alternatively, the base 6410 may support the weights 6402 and/or supplemental weights 6406 when not in use. In one example, the base 6410 may include a weight selector assembly 6412 operable to selectively couple one or more weights to the handle assembly 6404, as described above and below. For example, the weight selector assembly 6412 may operate to cause a sequential engagement of weights 6402 to each end of the handle assembly 6404 via interlocking features between adjacent weights 6402, as detailed below.

Figure 57:
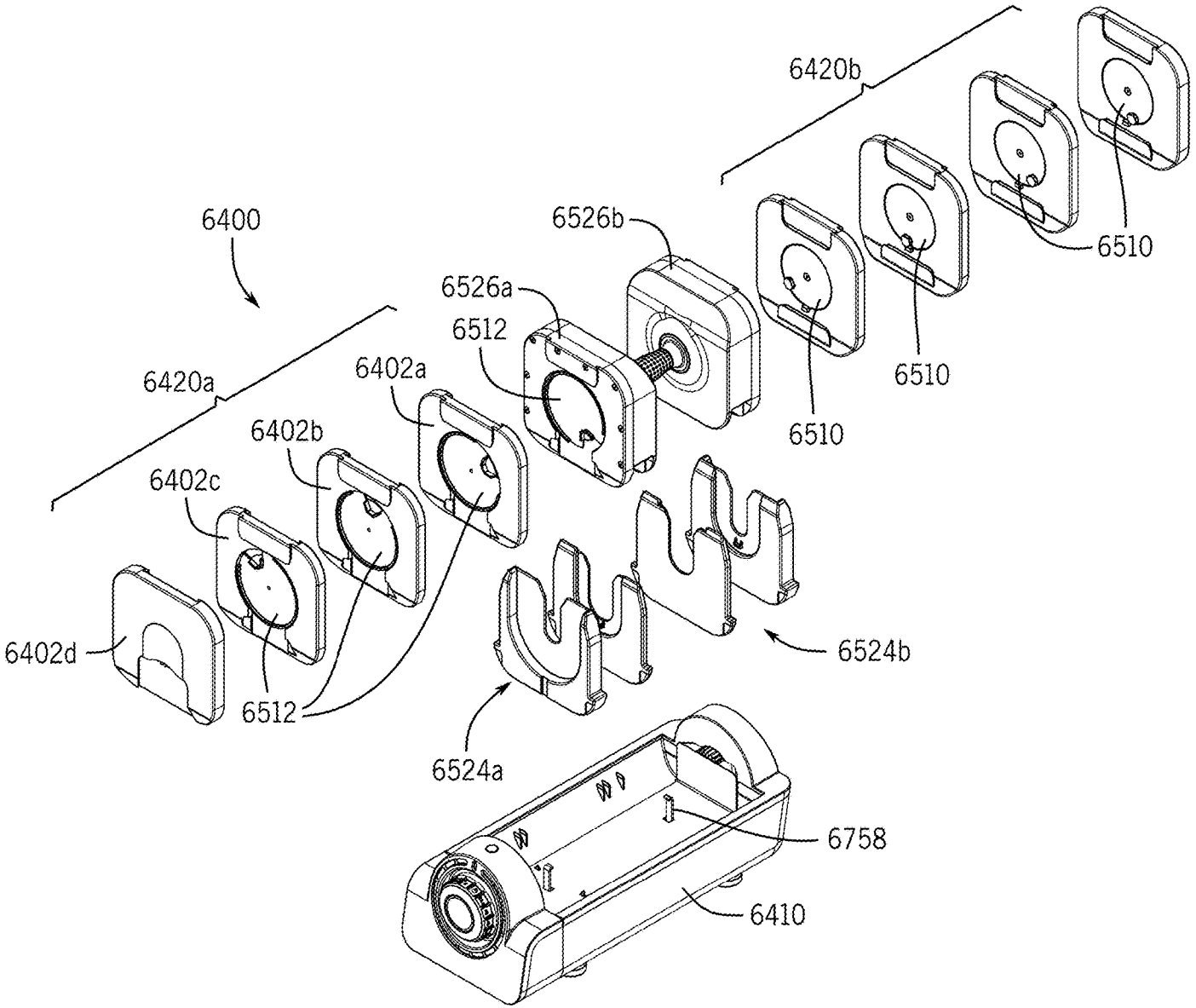
FIG. 57 is an exploded view of the dumbbell system of FIG. 56.

FIG. 57 is an exploded view of the dumbbell system 6400. As shown, the dumbbell 6401 may include a first weight stack 6420*a* at a first end of the handle assembly 6404, and a second weight stack 6420*b* at an opposite second end of the handle assembly 6404. Each weight stack 6420*a* and 6420*b* may include one or multiple weights 6402 (e.g., one weight 6402, two weights 6402, three weights 6402, four weights 6402, or more than four weights 6402) coupled together. In one example, each of the first weight stack 6420*a* and the second weight stack 6420*b* may include a first weight 6402*a*, a second weight 6402*b*, a third weight 6402*c*, and a fourth weight 6402*d*, although other configurations are contemplated, including less than four weights 6402 or more than four weights 6402. In some examples, the outermost weight 6402 of each weight stack 6420*a* and 6420*b* may be considered an end plate.

The size of the weight stacks 6420*a*, 6420*b* may be adjusted to set a load or mass/weight of the dumbbell 6401. For instance, a single weight 6402 may be coupled to each end of the handle assembly 6404 to set a first load of the dumbbell 6401, two weights 6402 may be coupled to each end of the handle assembly 6404 to set a second load greater than the first load, and so on. In one example, the entireties of the weight stack 6420*a*, 6420*b* may be coupled to the handle assembly 6404 (e.g., such that none of the weights 6402 remain in the base 6410 when the handle assembly 6404 is lifted off the base 6410) to set a max or near-max load of the dumbbell 6401. In another example, none of the weights 6402 may be coupled to the handle assembly 6404 (e.g., such that the entireties of the weight stack 6420*a*, 6420*b* remain in the base 6410 when the handle assembly 6404 is lifted off the base 6410) to set a minimum or baseline load of the dumbbell 6401. In another example, any number of the first weight 6402*a*, second weight 6402*b*, third weight 6402*c*, and fourth weight 6402*d* may be coupled to the handle assembly 6404 to set a desired load of the dumbbell 6401 in combination.

As provided more fully below, the size of each weight stack 6420*a* and 6420*b* may be set by selectively adding the weights 6402 to the handle assembly 6404, and in one example this selective addition of weights 6402 is done sequentially. In one example, weights 6402 may be added to the ends of the handle assembly 6404 in a sequentially stacked or positioned manner. For example, the first weight 6402*a* may be selectively coupled to the handle assembly 6404 (e.g., to a respective end of the handle assembly 6404), the second weight 6402*b* may be selectively coupled to the first weight 6402*a*, the third weight 6402*c* may be selectively coupled to the second weight 6402*b*, the fourth weight 6402*d* may be selectively coupled to the third weight 6402*c*, and so on. In this manner, the selective addition of weights 6402 to the handle assembly 6404 may be done sequentially from an inner location (e.g., near or adjacent the grip 6460) to outer location (e.g., distal from grip 6460).

In one example, the coupling of a weight 6402 to the handle assembly 6404 or to another weight 6402 (e.g., to an inner adjacent weight) may be operated by an adjacent weight (e.g., by the neighboring outer adjacent weight), as detailed below and similar to other embodiments described herein. For instance, the second weight 6402*b* may control the selective engagement of the first weight 6402*a* to the handle assembly 6404. Similarly, the third weight 6402*c* may control the selective engagement of the second weight 6402*b* to the first weight 6402*a*, the fourth weight 6402*d* may control the selective engagement of the third weight 6402*c* to the second weight 6402*b*, and so on, as detailed below.

One or more weights 6402 may include opposing mechanisms 6510 and 6512 to control the selective (e.g., in this example sequential) engagement of the weights 6402 to the handle assembly 6404. In one example, the mechanisms 6510, 6512 may be on opposing sides of the weight 6402, and in such examples, the mechanisms 6510 and 6512 may be inner and outer mechanisms, respectively. As shown in FIG. 57, each weight 6402 may include an inner mechanism 6510. At least the handle assembly 6404, first weight 6402*a*, second weight 6402*b*, and third weight 6402*c* may include an outer mechanism 6512. The inner mechanism 6510 of the first weight 6402*a* may engage the outer mechanism 6512 of the handle assembly 6404 to control the selective engagement of the first weight 6402*a* to the handle assembly 6404. Similarly, the inner mechanism 6510 of the second weight 6402*b* may engage the outer mechanism 6512 of the first weight 6402*a* to control the selective engagement of the second weight 6402*b* to the first weight 6402*a*. Engagement of the third weight 6402*c* to the second weight 6402*b*, and engagement of the fourth weight 6402*d* to the third weight 6402*c* may be controlled in a similar manner. Examples of the inner mechanism 6510 and outer mechanism 6512 are provided below with reference to FIGS. 61A-64.

In one example, the dumbbell 6401 may include a first set 6524*a* of supplemental weights 6406 and a second set 6524*b* of supplemental weights 6406, such as to fine tune the load of the dumbbell 6401, as provided herein. The first set 6524*a* may be selectively coupled to the handle assembly 6404 within a first housing 6526*a* at the first end of the handle assembly 6404. For example, at least one supplemental weight 6406 of the first set 6524*a* may be coupled to the handle assembly 6404 within the first housing 6526*a*, as detailed below. The second set 6524*b* may be selectively coupled to the handle assembly 6404 within a second housing 6526*b* at the second end of the handle assembly 6404 in a similar manner. The coupling of the supplemental weights 6406 to the handle assembly 6404 may occur independent from the coupling of the first and second weight stacks 6420*a*, 6420*b* to the handle assembly 6404, and vice-versa. In this manner, various combinations of weights 6402 and supplemental weights 6406 may be coupled to the handle assembly 6404 to provide a desired load of the dumbbell 6401, such as to incrementally load the dumbbell 6401 as desired (e.g., by 2.5 lb, by 5 lb, by 10 lb, etc.).

Figure 58:
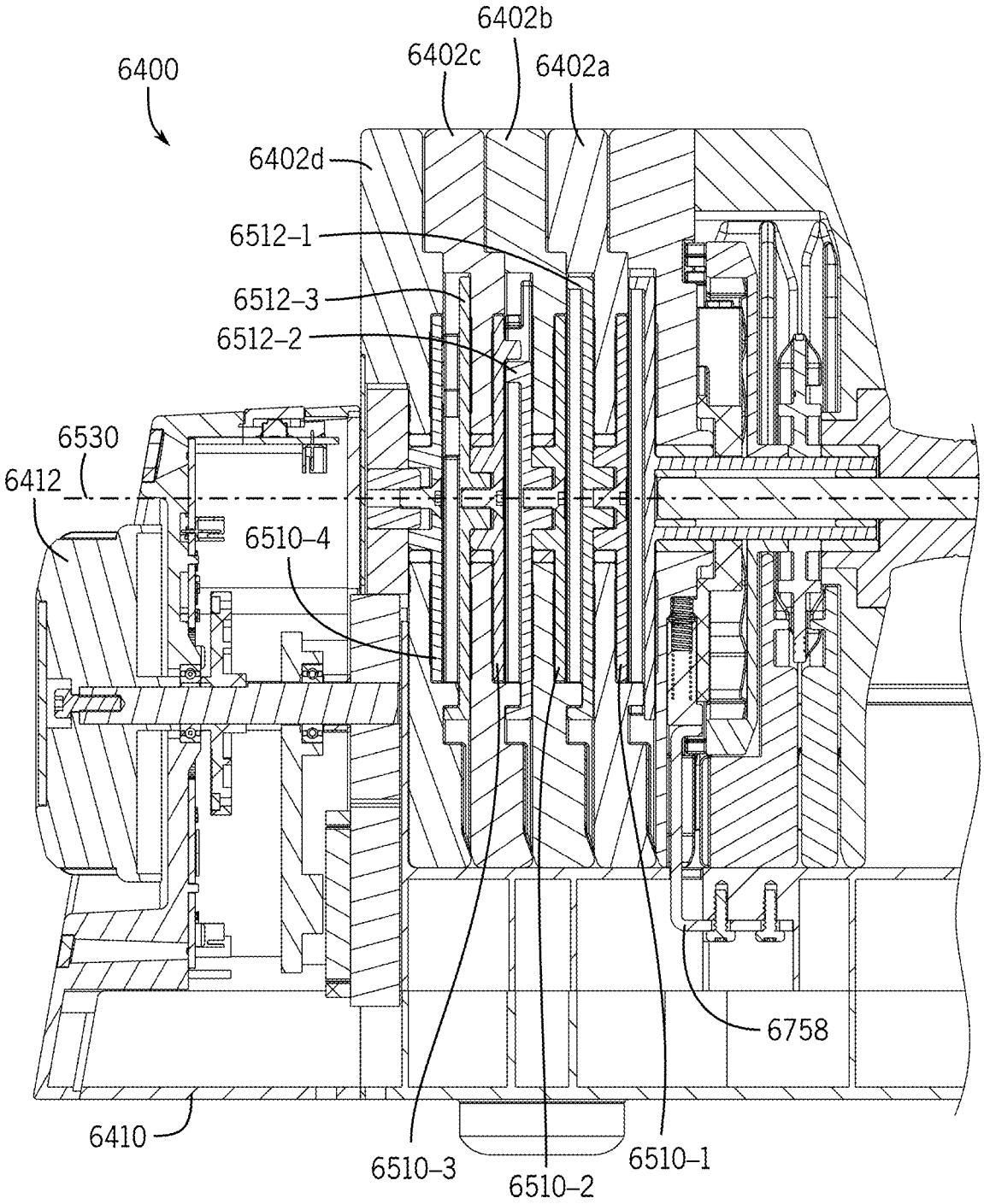
FIG. 58 is a sectional view of the dumbbell system of FIG. 56.

FIG. 58 is a partial sectional view of the dumbbell system 6400. In one example, the inner mechanism 6510 and outer mechanism 6512 of each weight 6402 are releasably fixed together so as to move correspondingly with each other, such that, for example, the operation of the outer mechanism 6512 operates the inner mechanism 6510 of each respective weight 6402. For example, the inner mechanism 6510 may be coupled to rotate with the outer mechanism 6512 (e.g., about a central axis 6530 of the handle assembly 6404 when the dumbbell 6401 is placed on the base 6410). For clarity in numbering, the first weight 6402*a* includes inner mechanism 6510-1 and outer mechanism 6512-1. Similarly, the second weight 6402*b* includes inner mechanism 6510-2 and outer mechanism 6512-2, the third weight 6402*c* includes inner mechanism 6510-3 and outer mechanism 6512-3, and the fourth weight 6402*d* includes inner mechanism 6510-4.

In one example, rotation of the inner mechanism 6510-4 of the fourth weight 6402*d* (e.g., via the weight selector assembly 6412) rotates the outer mechanism 6512-3 of the third weight 6402*c*, which causes corresponding rotation of the inner mechanism 6510-3 of the third weight 6402*c*. Rotation of the inner mechanism 6510-3 of the third weight 6402*c* then rotates the outer mechanism 6512-2 of the second weight 6402*b*, which causes corresponding rotation of the inner mechanism 6510-2 of the second weight 6402*b*. Rotation of the inner mechanism 6510-2 of the second weight 6402*b* then rotates the outer mechanism 6512-1 of the first weight 6402*a*, which causes corresponding rotation of the inner mechanism 6510-1 of the first weight 6402*a*. Rotation of the inner mechanism 6510-1 of the first weight 6402*a* then rotates the outer mechanism 6512 of the handle assembly 6404.

Any of the features, components, and/or parts, including the arrangements and configurations thereof shown in FIGS. 56-58, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 56-58.

Figure 59A:
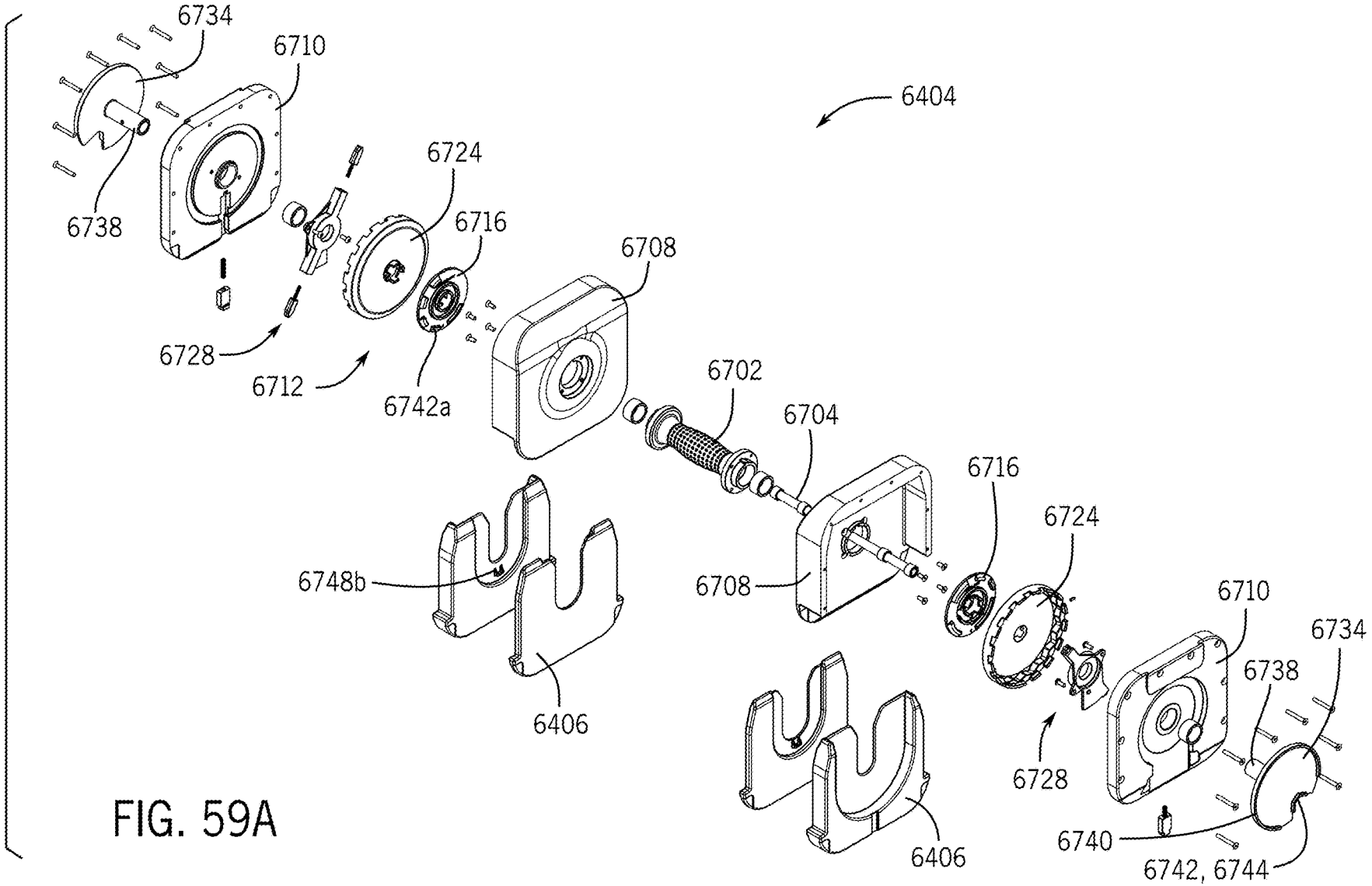
FIG. 59A is an exploded view of a handle assembly of the dumbbell system of FIG. 56.
Figure 59B:
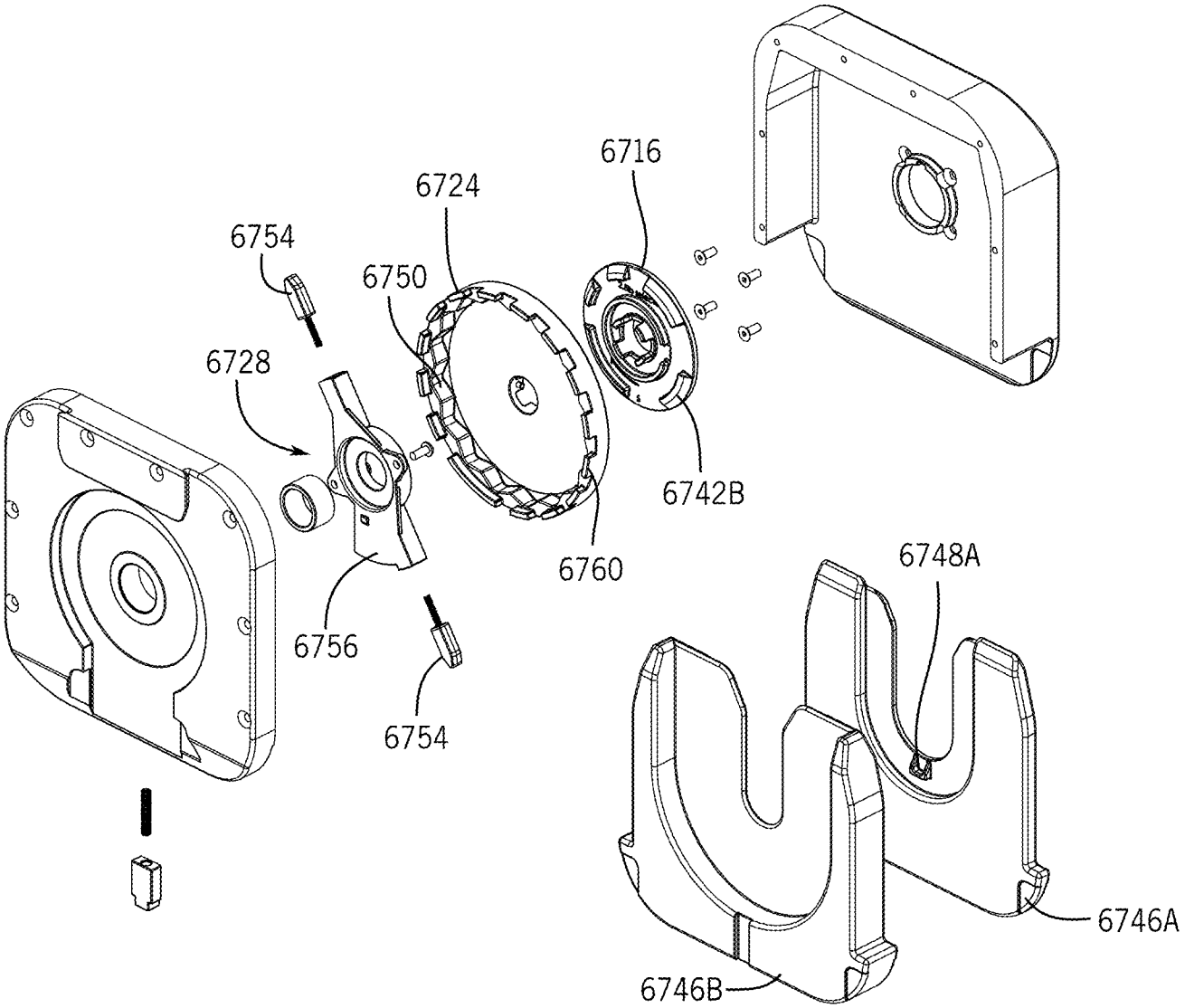
FIG. 59B is a partial exploded view of the handle assembly of FIG. 59A.

FIGS. 59A-59B are exploded views of the handle assembly 6404. The handle assembly 6404 may include a grip 6702 and the first and second housings 6526*a*, 6526*b* coupled to the grip 6702. In one example, the handle assembly 6404 includes a central shaft 6704, such as defining the central axis 6530 of the handle assembly 6404. Each of the first housing 6526*a* and the second housing 6526*b* may be a two-piece assembly, including an inner piece 6708 coupled to the grip 6702, and an outer piece 6710 coupled to the inner piece 6708 to define a weight compartment 6712 to receive one or more supplemental weights 6406 therein.

As shown, the handle assembly 6404 may include a supplemental weight selector 6716, a detent ring 6724, and a follower subassembly 6728 within the weight compartment 6712 of each housing. Except as otherwise detailed below, the supplemental weight selector 6716, detent ring 6724, and follower subassembly 6728 may be similar to those described above with reference to other embodiments. In one example, the handle assembly 6404 may include a handle disc 6734 at each end of the handle assembly 6404, wherein each are coupled to the shaft 6704. Depending on the application, the handle disc 6734 may be coupled to rotate about the shaft 6704, or the handle disc 6734 may be fixed to the shaft 6704. The handle disc 6734 may include a disc shaft 6738 that extends through the outer piece 6710 and into the weight compartment 6712. In such examples, the supplemental weight selector 6716 and detent ring 6724 may be coupled (e.g., fixed) to the disc shaft 6738, such that supplemental weight selector 6716 and detent ring 6724 rotate with the handle disc 6734 (e.g., the handle disc 6734, supplemental weight selector 6716, and detent ring 6724 rotate in unison). In one example, the handle disc 6734 may include a first flange 6740 and a second flange 6742. The first flange 6740 may extend at least partially around (e.g., circumferentially along a perimeter of) the handle disc 6734, such as less than a full circumference of the handle disc 6734. The second flange 6742 may define a pocket 6744.

Except as otherwise detailed below, the supplemental weight selector 6716, detent ring 6724, and follower subassembly 6728 may be similar to those described above with reference to other embodiments. For example, the supplemental weight selector 6716, which may be referred to as a selector disc, may include a first set of tabs 6742*a* on a first side/face, and a second set of tabs 6742*b* on a second side/face, to selectively engage first and second supplemental weights 6746*a*, 6746*b*, such as in a manner as detailed above. For instance, the supplemental weight selector 6716 may engage and disengage the first supplemental weight 6746*a* based on the rotated position of the first tabs 6742*a*, such as by selectively engaging the first tabs 6742*a* with a first protrusion 6748*a* of the first supplemental weight 6746*a*. Similarly, the supplemental weight selector 6716 may engage and disengage the second supplemental weight 6746*b* based on the rotated position of the second tabs 6742*b*, such as by selectively engaging the second tabs 6742*b* with a second protrusion 6748*b* of the second supplemental weight 6746*b*. In this manner, the supplemental weight selector 6716 may include a plurality of tabs that selectively engage at least one supplemental weight based on a rotational position of the supplemental weight selector 6716 relative to the supplemental weight(s).

Figure 60A:
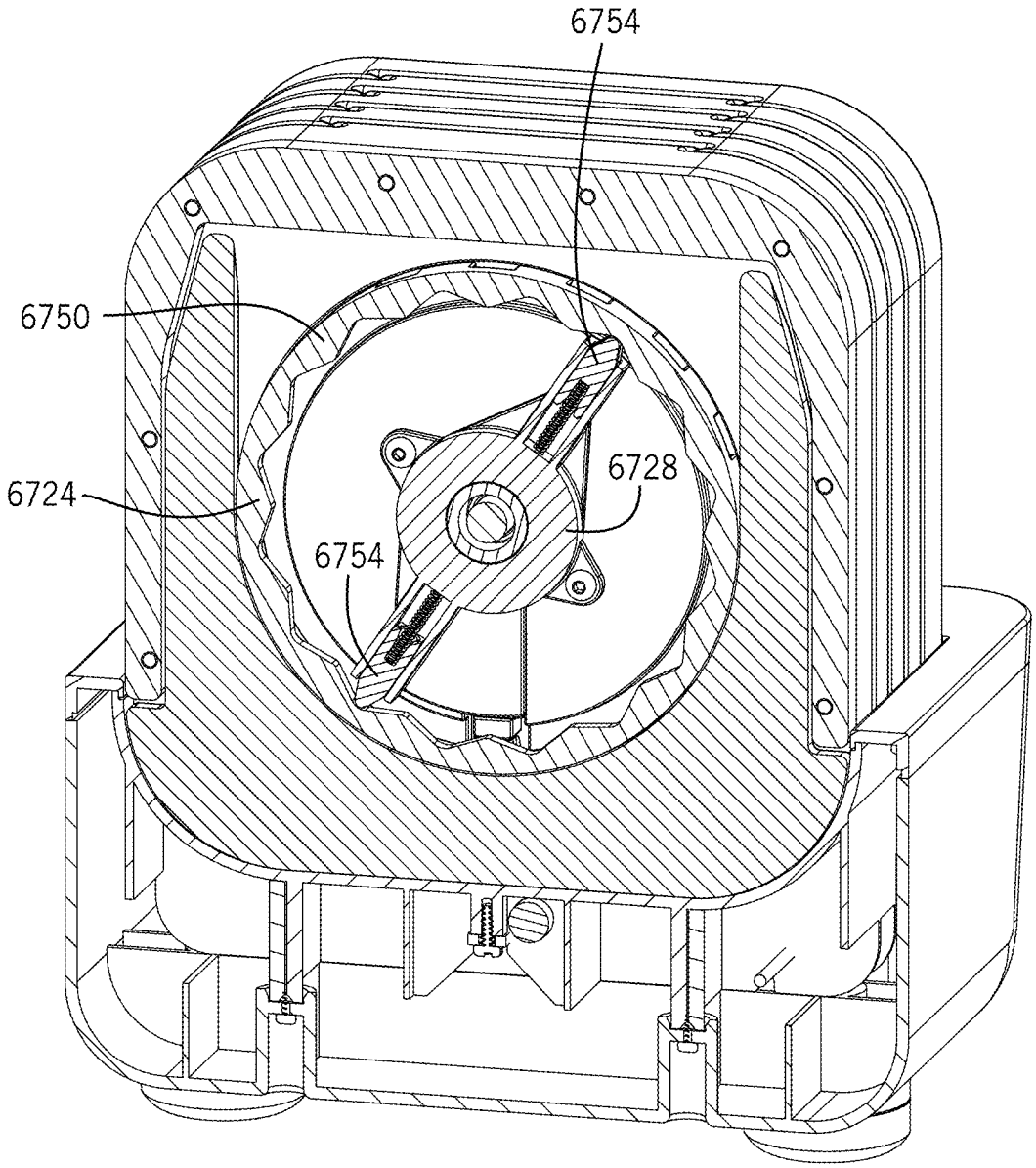
FIG. 60A is a sectional view of a detent ring of the handle assembly of FIG. 59A.

FIG. 60A is a sectional view of the detent ring 6724. Referring to FIGS. 59B and 60A, the detent ring 6724 may include a set of circumferentially positioned detents 6750 on a radially internally facing surface and configured to interact with the follower subassembly 6728, such as in a manner as described above. For example, the follower subassembly 6728 may include one or more biased pawls or deflectable biased followers 6754 located in a housing 6756. The followers 6754 may be resiliently engaged with the radially internally facing surface and its detents 6750 on the detent ring 6724. The follower subassembly 6728 may be fixed against rotation relative to the detent ring 6724. As the detent ring 6724 rotates, the followers 6754 may move between the detents 6750 and may create a positive haptic and/or audio feedback for the user, indicating the selection or deselection of various weights, similar to the follower and detent mechanisms described above. Additionally, the biasing force applied to the followers 6754 may urge the followers 6754 to a seated position within the detents 6750, such as in a manner as described above.

Figure 60B:
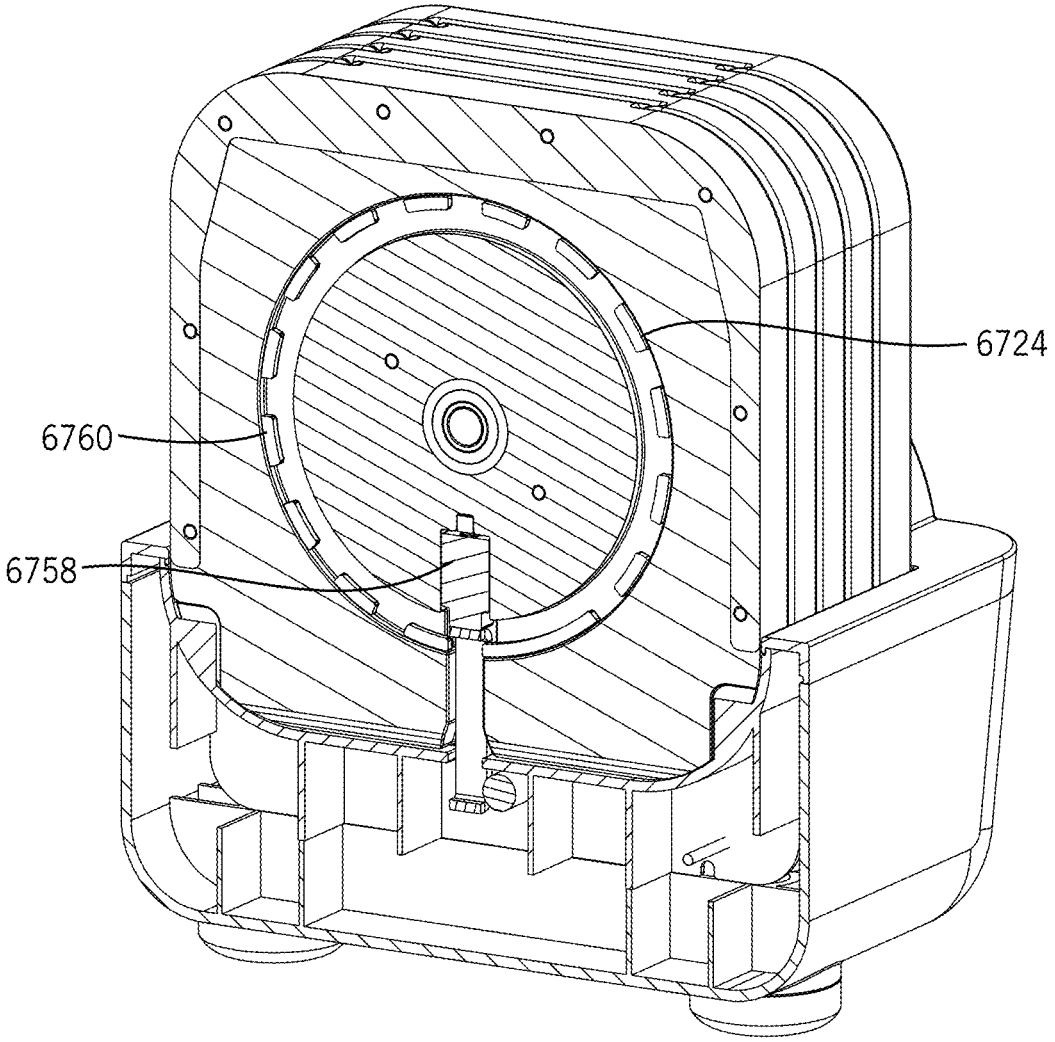
FIG. 60B is another sectional view of the detent ring of FIG. 60A.

FIG. 60B is another sectional view of the detent ring 6724. Referring to FIGS. 57, 58, and 60B, the detent ring 6724 may be configured to selectively engage an interlock element 6758 of the base 6410, such as in a similar manner as described herein in reference to other embodiments (e.g., weight interlock element 610). For instance, the detent ring 6724 may include a plurality of circumferentially spaced protrusions 6760, similar to protrusions 614. The interlock element 6758 may include a pawl shape with an axially extending overhang or hooked end configured to be inserted into one of a plurality of gaps between the protrusions 6760. The user may adjust the load of the handle assembly 6404, which may cause the detent ring 6724 to rotate. In such embodiments, a protrusion (e.g., 6760) may engage the interlock element 6758 when the weight adjustment mechanism of the dumbbell 6401 is in an unstable or otherwise improper position. The handle assembly 6404 may thereby be prevented or limited from removal from the base 6410 while in the improper position due to mechanical interference between the protrusion and the interlock element 6758, such as in a manner as described above. When the weight adjustment mechanism is in a stable or otherwise proper position, the interlock element 6758 is positioned in a gap between protrusions 6760, so there is clearance for the handle assembly 6404 to be lifted vertically away from the base 6410. The detents 6750 and followers 6754 may bias the rotation of the detent ring 6724 to a stable or proper position, similar to other embodiments described herein.

Any of the features, components, and/or parts, including the arrangements and configurations thereof shown in FIGS. 59A-60B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 59A-60B.

Figure 61A:
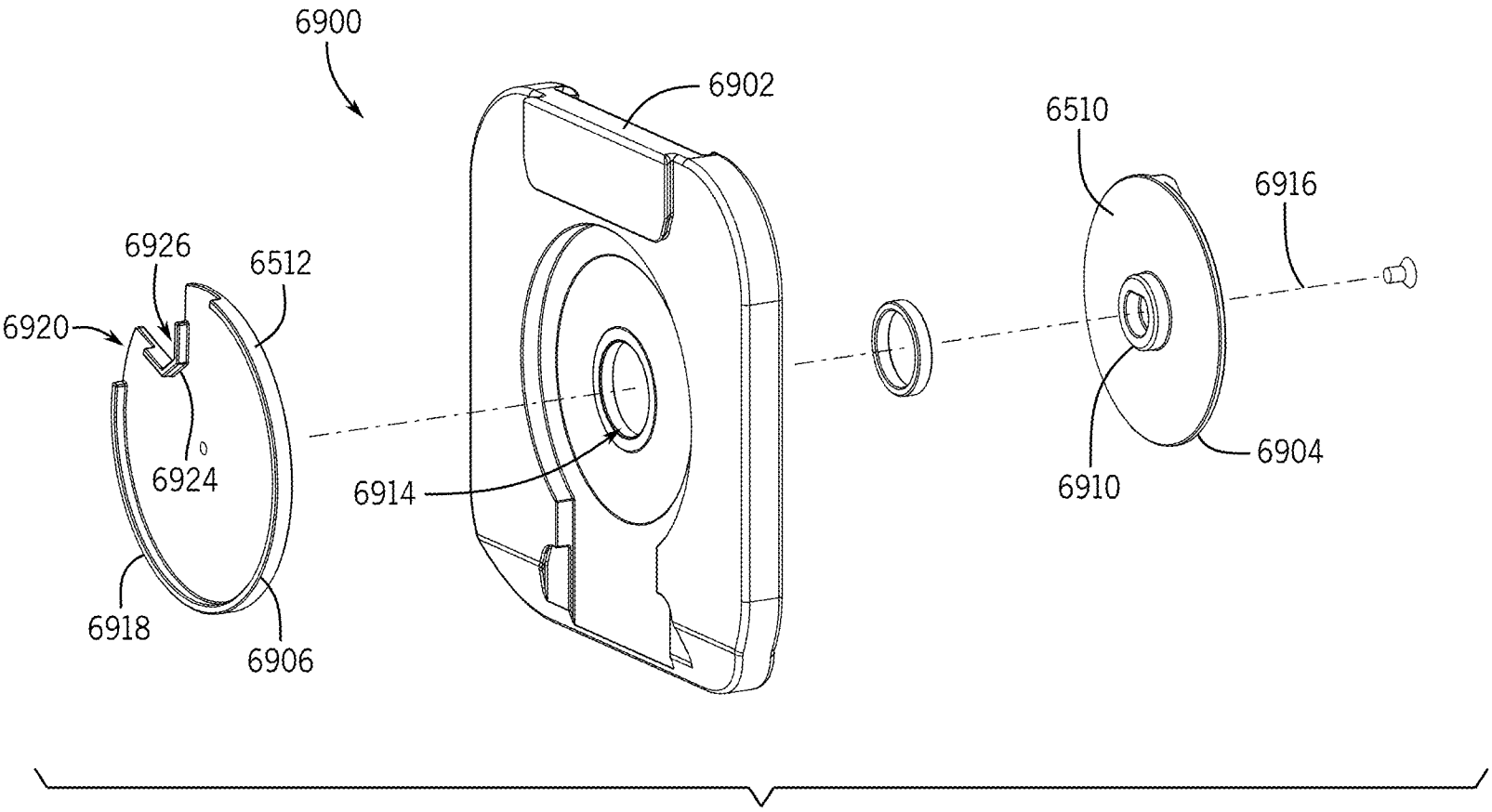
FIG. 61A is an exploded view of a weight of the dumbbell system of FIG. 56.
Figure 61B:
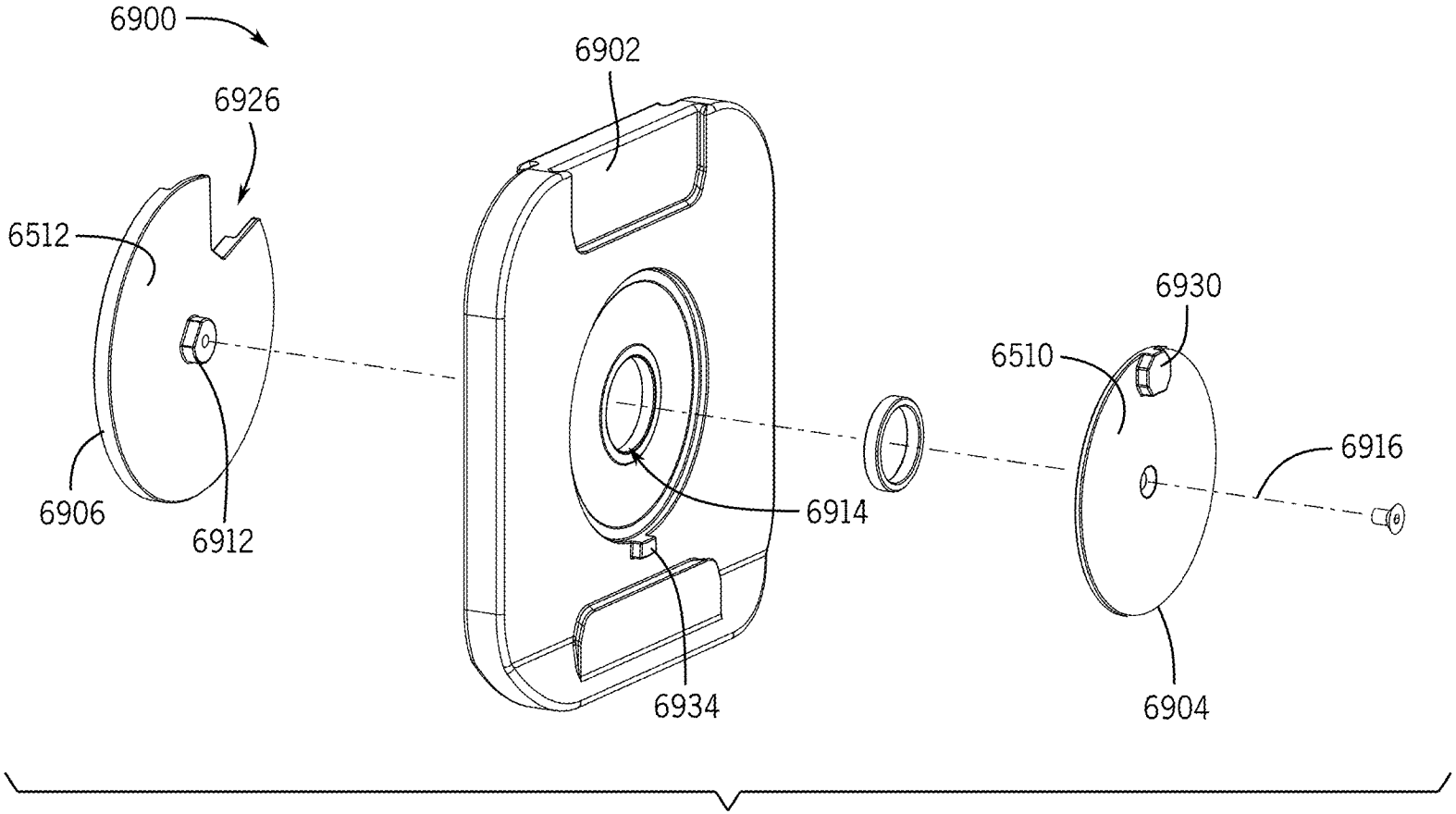
FIG. 61B is another exploded view of the weight of FIG. 61A.

FIGS. 61A-61B are exploded views of a weight 6900 for use in an adjustable dumbbell system. The weight 6900 may embody any of weight 6402, first weight 6402*a*, second weight 6402*b*, or third weight 6402*c*, described above with reference to FIGS. 56-58. Thus, weight 6900 may be used in connection with the dumbbell system 6400 and/or handle assembly 6404 as described elsewhere herein.

As shown, the weight 6900 may include a body 6902 and a first disc 6904 rotatably coupled to the body 6902. The weight 6900 may also include a second disc 6906 rotatably coupled to the body 6902. The first and second discs 6904, 6906 may be coupled to opposing sides of the body 6902, such as to inner and outer sides of the body 6902, respectively. The second disc 6906 may be coupled to the first disc 6904, such that the first and second discs 6904, 6906 rotate together, and move together relative to the body 6902. For example, one of the first disc 6904 or the second disc 6906 may include a keyed bore 6910 that receives a corresponding keyed shaft 6912 of the other one of the first disc 6904 or the second disc 6906 such that the first and second discs 6904, 6906 rotate together in unison. In this manner, the first and second discs 6904, 6906 may be fixed disc pairs, such that rotating one disc on one side of the weight 6900 rotates the corresponding disc on the opposite side of the weight 6900. In one example, the weight 6900 includes an aperture 6914 through the body 6902 and through which the first and second discs 6904, 6906 are coupled. As shown, the aperture 6914 may define an axis 6916 about which the first and second discs 6904, 6906 rotate. In such examples, the axis 6916 may extend collinearly with the central axis 6530 of the handle assembly 6404 when the weight 6900 is coupled thereto.

The first disc 6904 may embody the inner mechanism 6510 described above, and the second disc 6906 may embody the outer mechanism 6512 described above, both with respect to FIGS. 57 and 58. For example, the illustrated first disc 6904 may engage the second disc of an adjacent weight (e.g., of an inner adjacent weight), such that rotation of the illustrated first disc 6904 rotates the adjacent weight's second disc. Similarly, the illustrated second disc 6906 may engage the first disc of an adjacent weight (e.g., of an outer adjacent weight), such that rotation of the adjacent weight's first disc rotates the illustrated second disc 6906. In such examples, the first disc 6904 may be considered an inner disc, and the second disc 6906 may be considered an outer disc.

Referring to FIG. 61A, the second disc 6906 may include a first flange 6918 extending along at least a portion of the second disc 6906. In some examples, the first flange 6918 may extend at least partially along a profile of the second disc 6906. The profile of the extension of the first flange 6918 may be at or near a perimeter of the second disc 6906. The profile of the extension of the first flange 6918 may, in other examples, be in an arcuate shape, such as in one example a circumferential along the edge of the second disc 6906. In some examples, the first flange 6918 may extend substantially all of but less than a full circumference of the second disc 6906, to define an opening or gap in the first flange 6918 forming a lateral opening 6920 to an interior of the second disc 6906. In one example, the lateral opening 6920 may define a window (e.g., less than a 90-degree window) along the lateral side of the second disc 6906, although other configurations are contemplated.

As shown, the second disc 6906 may include a second flange 6924 at least partially defining a pocket 6926. In one example, the pocket 6926 may also be defined by a notch in the peripheral edge of the second disc 6906. In such embodiments, the notch may have a truncated wedge shape with three sides, although other shapes may be used. The second flange 6924 may extend along at least a portion of the notch, and in one example, along the periphery of the notch. The pocket 6926 may be aligned with the lateral opening 6920 and positioned interiorly from a peripheral edge of the second disc 6906. In one example, the first flange 6918 and the second flange 6924 may extend away from the body 6902, such as outwardly towards an adjacent weight along a direction parallel to the central axis 6530. In one example, the second disc 6906 may be recessed within the body 6902, such that at least an outer surface of the second disc 6906 is flush or substantially flush with an adjacent surface of the body 6902 in which it is recessed.

Referring to FIG. 61B, which is a reverse perspective view of FIG. 61A, the first disc 6904 may include a key 6930 for positioning (e.g., positionable) within the pocket 6926 of an adjacent weight. The key 6930 may be offset laterally from the central axis 6530, such that the key 6930 is rotatable about the central axis 6530. As described more fully below, the key 6930 may engage the second flange 6924 of an adjacent weight to operate the adjacent weight with rotation of the key 6930. For example, as the key 6930 is rotated about the central axis 6530, the key 6930 may engage the second flange 6924 of an adjacent weight to rotate the second disc 6906 of the adjacent weight. In one example, the key 6930 may have a matching outer shape of the second flange 6924 and notch, such as to provide a solid engagement between the key 6930 and second flange 6924.

In one example, the weight 6900 may include a tab 6934 extending from the body 6902 adjacent the first disc 6904. As shown, the tab 6934 may be positioned below the first disc 6904, such as positioned between the first disc 6904 and the bottom of the weight 6900. As described more fully below, the tab 6934 may engage the first flange 6918 of an adjacent weight to provide an engagement for retention and/or for lifting (e.g., for retention, for lifting, or for both retention and lifting) the weight 6900 with the adjacent weight. For example, as the adjacent weight is lifted, the first flange 6918 of the adjacent weight may engage the tab 6934 to lift the weight 6900 with the adjacent weight. In one example, engagement of the first flange 6918 with the tab 6934 may retain the adjacent weight with the weight 6900, such as providing a coupling of the adjacent weight with the weight 6900. In one example, the first disc 6904 may be recessed within the body 6902, such that at least a body of the first disc 6904 is flush or substantially flush with a neighboring surface of the body 6902.

Any of the features, components, and/or parts, including the arrangements and configurations thereof shown in FIGS. 61A-61B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 61A-61B.

Figure 62A:
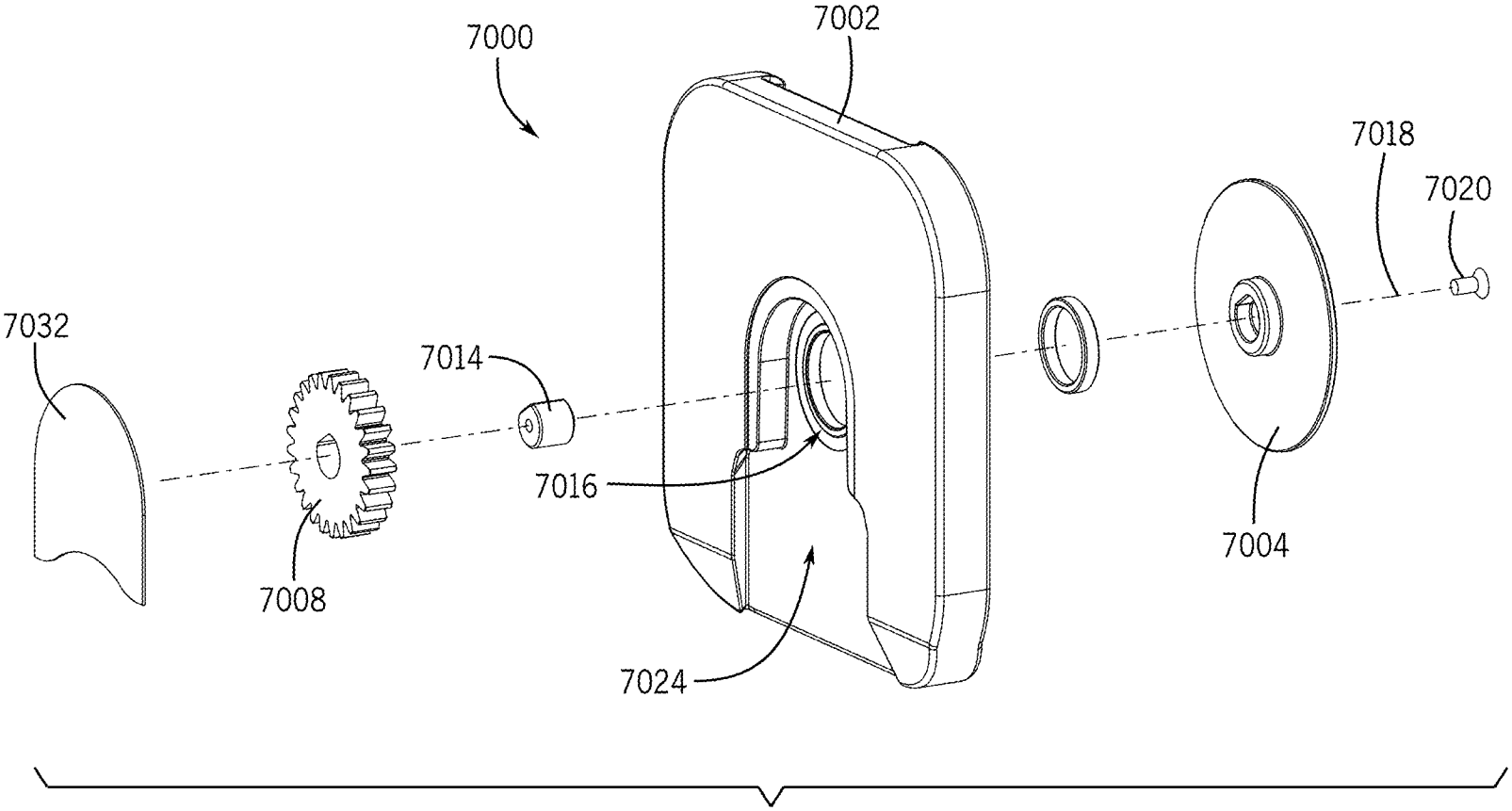
FIG. 62A is an exploded view of another weight of the dumbbell system of FIG. 56.
Figure 62B:
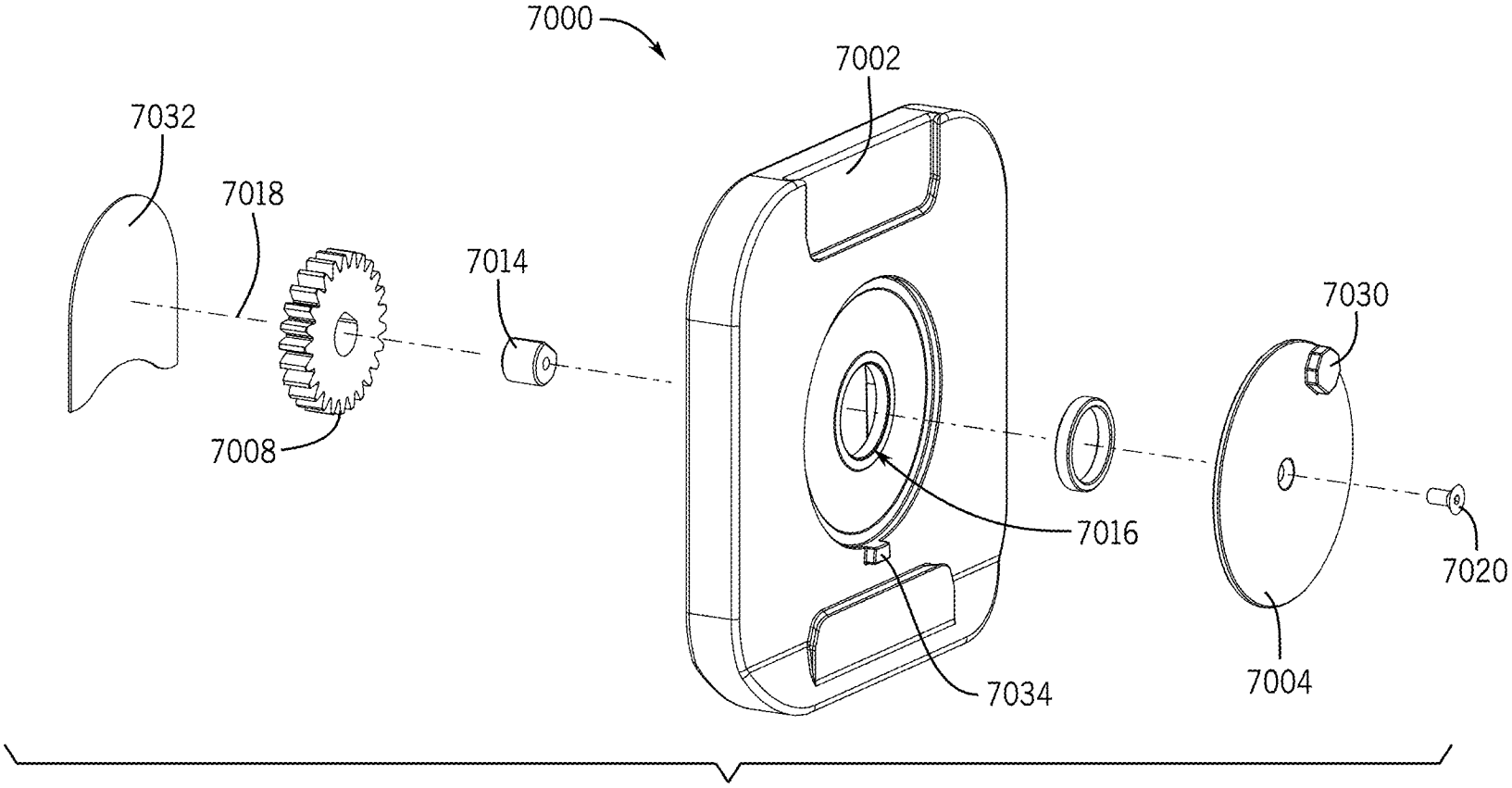
FIG. 62B is another exploded view of the weight of FIG. 62A.

FIGS. 62A-62B are exploded views of another weight 7000 for use in an adjustable dumbbell system. The weight 7000 may embody any of weight 6402 or fourth weight 6402*d*, described above with reference to FIGS. 56-58. Thus, the weight 7000 may be used in connection with the dumbbell system 6400 and/or handle assembly 6404. The weight 7000 may include a body 7002 and a first disc 7004 rotatably coupled to the body 7002 (e.g., to an inner side of the body 7002). As shown, the first disc 7004 may be similar to the first disc 6904 described above, such as including a key 7030 for positioning (e.g., positionable) within the pocket 6926 of a neighboring weight (e.g., the third weight 6402*c*). In one example, the weight 7000 may include a tab 7034 extending from the body 7002 adjacent the first disc 7004 (e.g., between the first disc 7004 and the bottom of the weight 7000). The tab 7034 may be similar to tab 6934 to provide an engagement for retention and/or for lifting (e.g., for retention, for lifting, or for both retention and lifting) the weight 7000 with an adjacent weight. For instance, like tab 6934, the tab 7034 may engage the first flange 6918 of an adjacent weight to lift the weight 7000 with the adjacent weight.

In one example, the weight 7000 may include a gear 7008 coupled to the first disc 7004 and positioned on a side opposite the first disc 7004 (e.g., on an outer side of the body 7002). In one example, a keyed coupling, such as a keyed-shaft 7014, may extend through the body 7002 (e.g., through an aperture 7016 defined through the body 7002) to couple the gear 7008 to the first disc 7004. In such examples, both the gear 7008 and the first disc 7004 may receive the keyed-shaft 7014 in a keyed recess or bore having a corresponding shape to limit rotation relative to the keyed-shaft 7014 (e.g., such that the gear 7008 and the first disc 7004 rotate together in unison). In one example, the gear 7008 and/or first disc 7004 may be press-fit onto the keyed-shaft 7014. In one example, the aperture 7016 may define an axis 7018 about which the first disc 7004 and gear 7008 rotate, and in such examples, the axis 7018 may extend collinearly with the central axis 6530 of the handle assembly 6404 when the weight 7000 is coupled thereto. As shown, the first disc 7004 may be secured to the keyed-shaft 7014 via a fastener 7020.

Referring to FIG. 62A, the gear 7008 may be positioned at least partially in a gear compartment 7024 on the outer-facing side of the weight 7000. In such examples, the gear compartment 7024 may be defined by a recess formed in the outer surface of the weight 7000, which may be partially closed by a cover 7032 secured to the body 7002. In one example, the cover 7032 may be flush or substantially flush with the outer-facing side of the weight 7000. In one example, the cover 7032 may not fully enclose the gear 7008 in the gear compartment 7024, such that the gear 7008 may selectively engage the weight selector assembly 6412, as detailed below. For example, an opening may be defined at the bottom of the gear compartment 7024 to allow the gear 7008 to engage a gear assembly of the weight selector assembly 6412 when the weight 7000 is positioned in the base 6410, as provided below. In one example, the gear compartment 7024 may be sized to expose a portion of the periphery of the gear 7008 to allow engagement with circumferential gear teeth of the weight selector assembly 6412.

Any of the features, components, and/or parts, including the arrangements and configurations thereof shown in FIGS. 62A-62B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 62A-62B.

Figure 63:
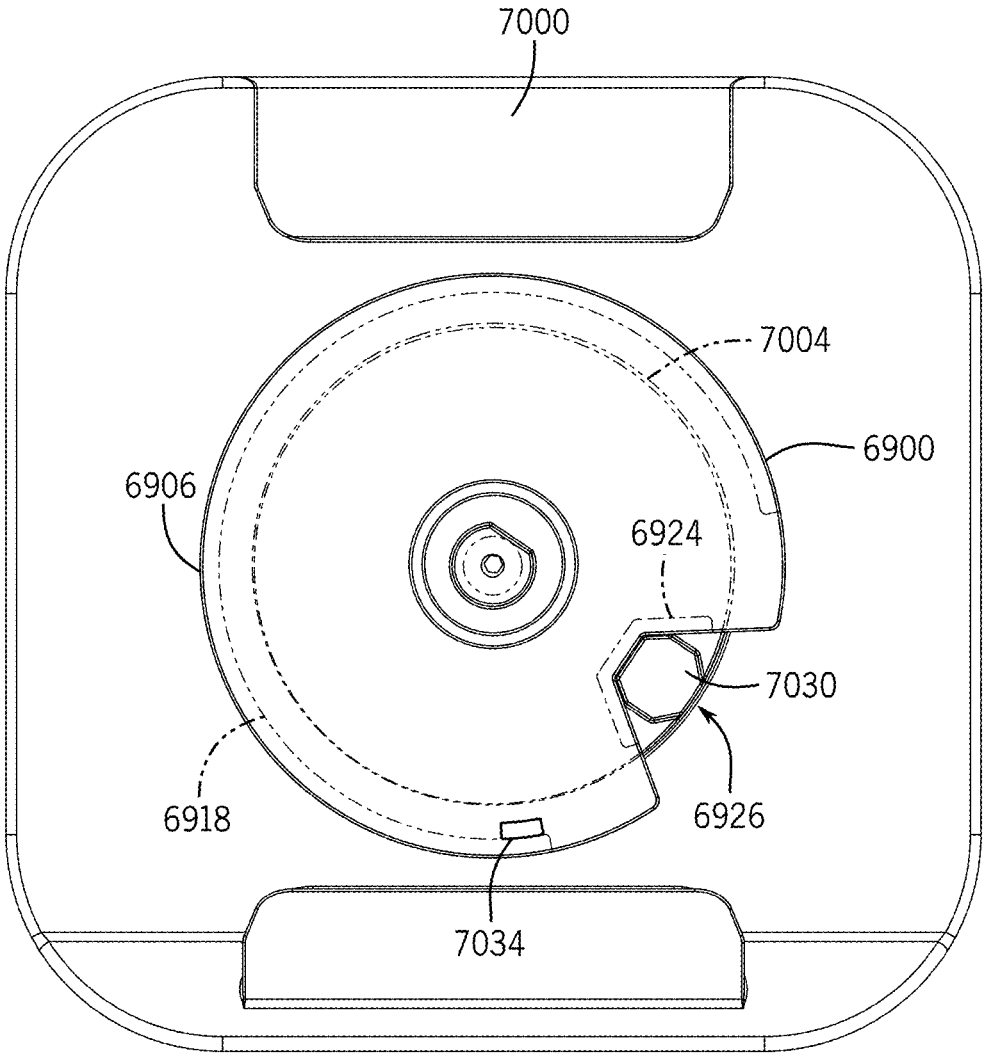
FIG. 63 is a schematic view of a sequential key system for selectively engaging a weight or weight assembly.

FIG. 63 is a schematic view of a sequential key system for selectively coupling a weight (e.g., weight 6402, weight 6900, and/or weight 7000) to the handle assembly 6404 as described herein, specifically in FIGS. 56-62B. For illustration purposes, FIG. 63 shows the weight 7000 coupled to the weight 6900, with the first disc 7004 of weight 7000 coupled to the second disc 6906 of weight 6900, and with all other portions of weight 6900 removed to illustrate the sequential key system described herein. However, the configuration illustrated in FIG. 63 may apply equally to one weight 6900 coupled to another weight 6900 (e.g., first weight 6402*a* coupled to second weight 6402*b*, second weight 6402*b* coupled to third weight 6402*c*, third weight 6402*c* coupled to fourth weight 6402*d*, etc.), with the first disc 6904 of one weight 6900 coupled to the second disc 6906 of another weight 6900, such as within weight stack 6420*a* or 6420*b*. Thus, FIG. 63 illustrates a method of coupling adjacent weights together.

Continuing with FIG. 63, as shown, the key 7030 may be positioned in the pocket 6926, such as engaging the second flange 6924. When the key 7030 is positioned in the pocket 6926, the key 7030 may rotate about the central axis 6530 to rotate the second disc 6906 between a retaining position (e.g., as illustrated) and a releasing position. For instance, when the key 7030 is positioned in the pocket 6926, the key 7030 may engage the second flange 6924 to rotate the second disc 6906 between the retaining position and a releasing position. In embodiments, with the key 7030 in the pocket 6926 or notch of the adjacent disc, when the disc pair of weight 7000 rotates, it causes the disc pair of the adjacent weight to rotate. This rotation of the central discs may occur in the various weights positioned in weight stack 6420*a* or 6420*b*. For instance, rotation of the disc pair of first weight 6402*a* may rotate the disc pair of the adjacent second weight 6402*b*, with rotation of the disc pair of second weight 6402*c* rotating the disc pair of the adjacent third weight 6402*c*, and so on, or vice-versa. In this manner, the disc pairs throughout the weight stack 6420*a* or 6420*b* may rotate together in unison.

Figure 64B:
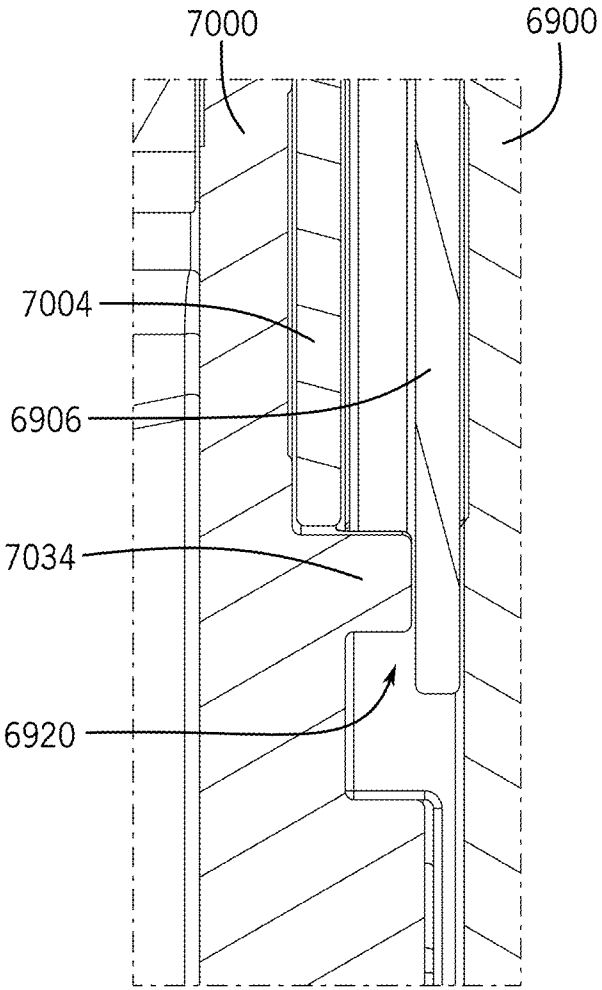
FIG. 64B is a sectional view of the sequential key system of FIG. 63 in a releasing position.
Figure 64A:
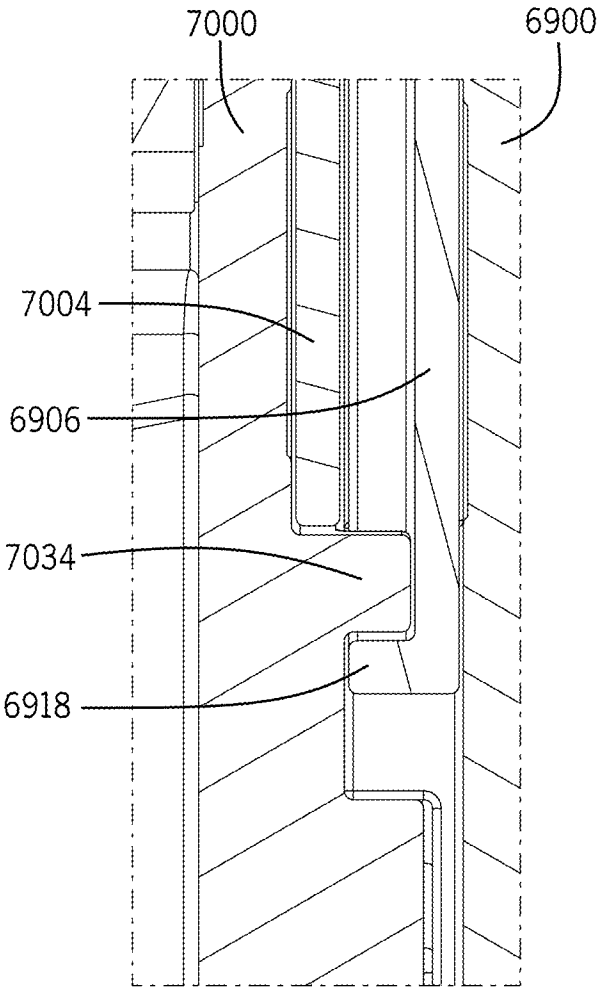
FIG. 64A is a sectional view of the sequential key system of FIG. 63 in a retaining position.

In the retaining position, the first flange 6918 may engage the tab 7034 to provide an engagement for retention and/or for lifting the weight 7000 with the weight 6900. For example, as shown in FIG. 64A, when the second disc 6906 is in the retaining position, vertical lifting of the weight 6900 may cause the first flange 6918 to engage and lift against the tab 7034, thereby lifting the weight 7000 with the weight 6900. In one example, the engagement for lifting the weight 7000 with the weight 6900 may be provided solely by the engagement of the first flange 6918 with the tab 7034. In such examples, engagement of the key 7030 with the second flange 6924 defining the pocket 6926 may be for purposes of rotating the second disc 6906 with the first disc 7004 only. Thus, receipt of the key 7030 in the pocket 6926 may be for one or more purposes separate from vertical lifting of the weight 7000 with the weight 6900.

In the releasing position, the tab 7034 may be aligned with the gap in the first flange 6918 (e.g., with the lateral opening 6920) to decouple the weight 7000 from the weight 6900. For instance, as shown in FIG. 64B, when the second disc 6906 is rotated to the releasing position, the tab 7034 may clear the first flange 6918 and move through the lateral opening 6920 to allow vertical lifting of the weight 6900 without the weight 7000. For example, the lateral opening 6920 may define a window or gap (e.g., less than a 90-degree window) through which the tab 7034 may exit the flange profile of the first flange 6918 when the weight 6900 is lifted away from the weight 7000. In one example, the pocket 6926 is also aligned with the lateral opening 6920 to receive the key 7030 through the lateral opening 6920. For instance, the key 7030 may move through the lateral opening 6920 and into the pocket 6926 as the weight 6900 is lowered into the base 6410 and next to the weight 7000.

Figure 65A:
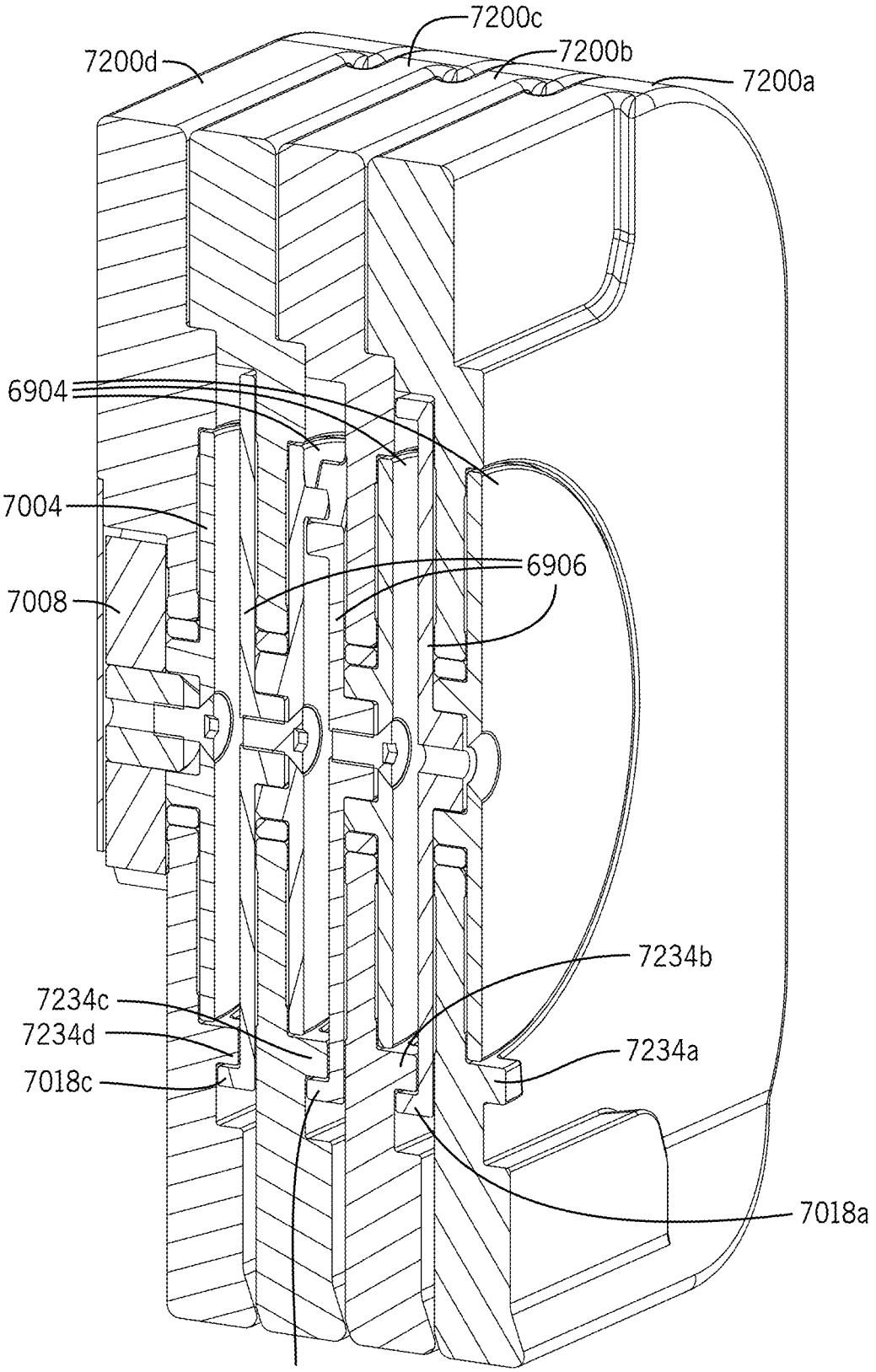
FIGS. 65A-65D are sectional views of multiple weights positioned together in a weight stack.
Figure 65B:
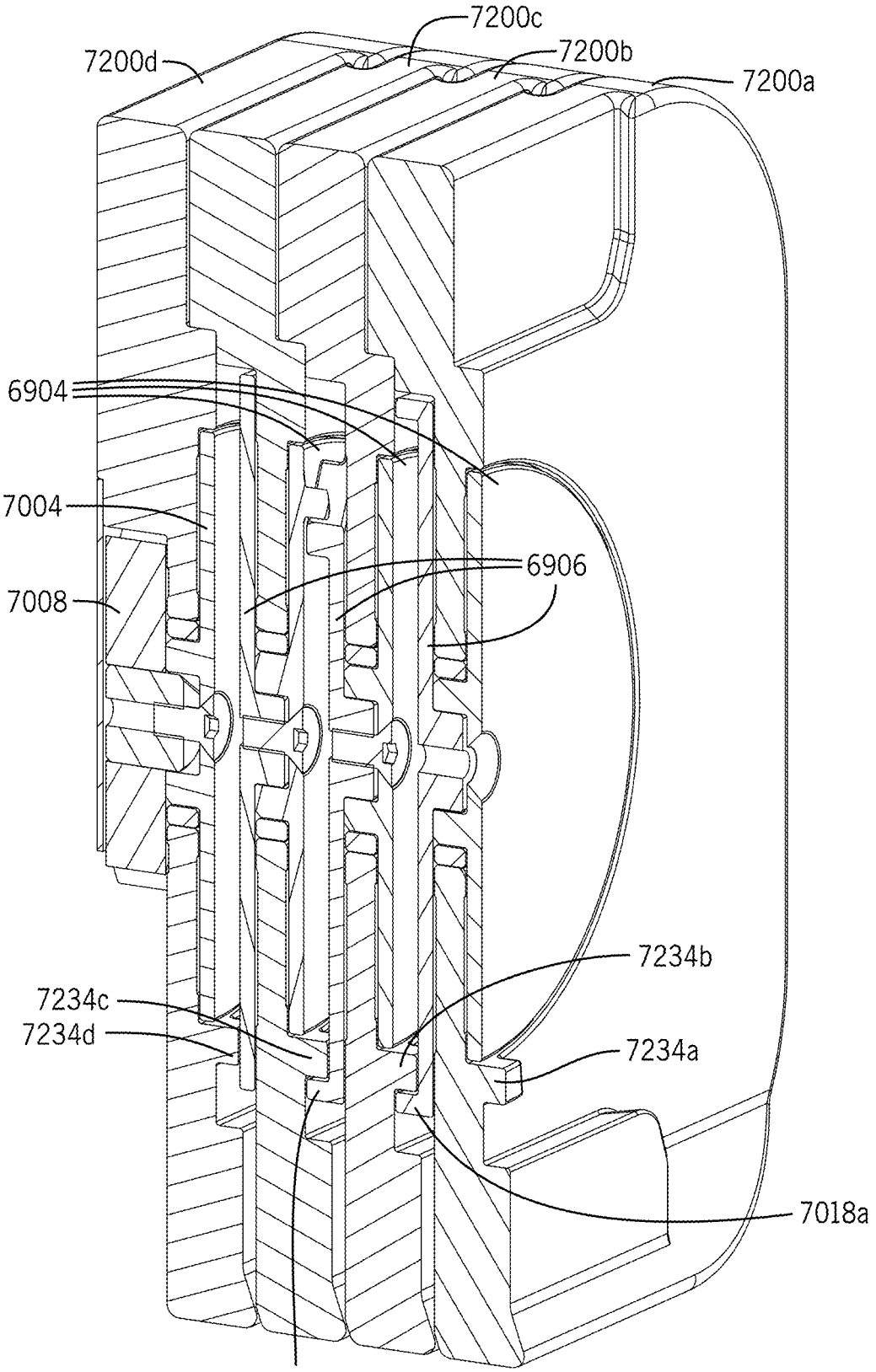
Figure 65C:
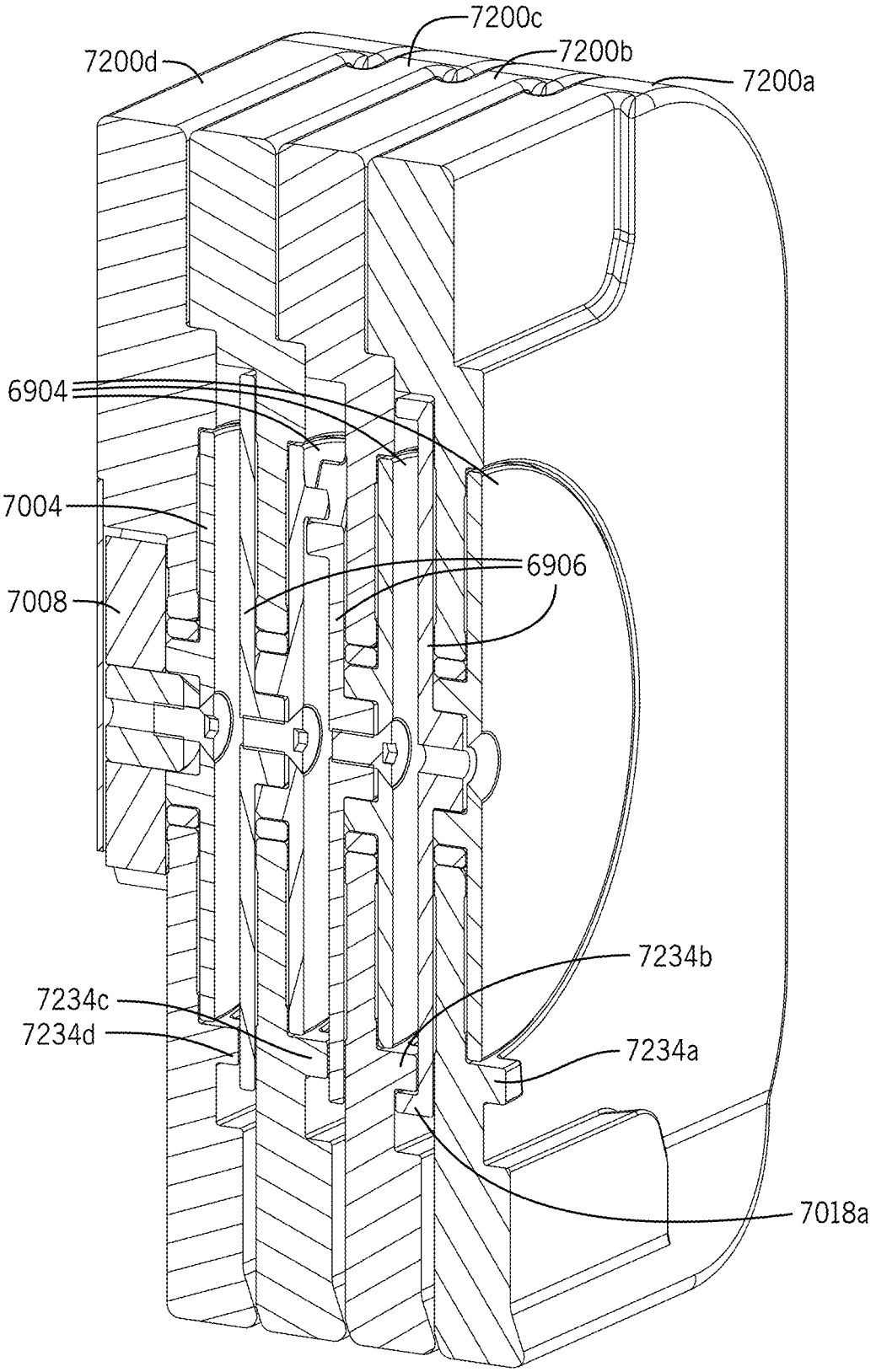
Figure 65D:
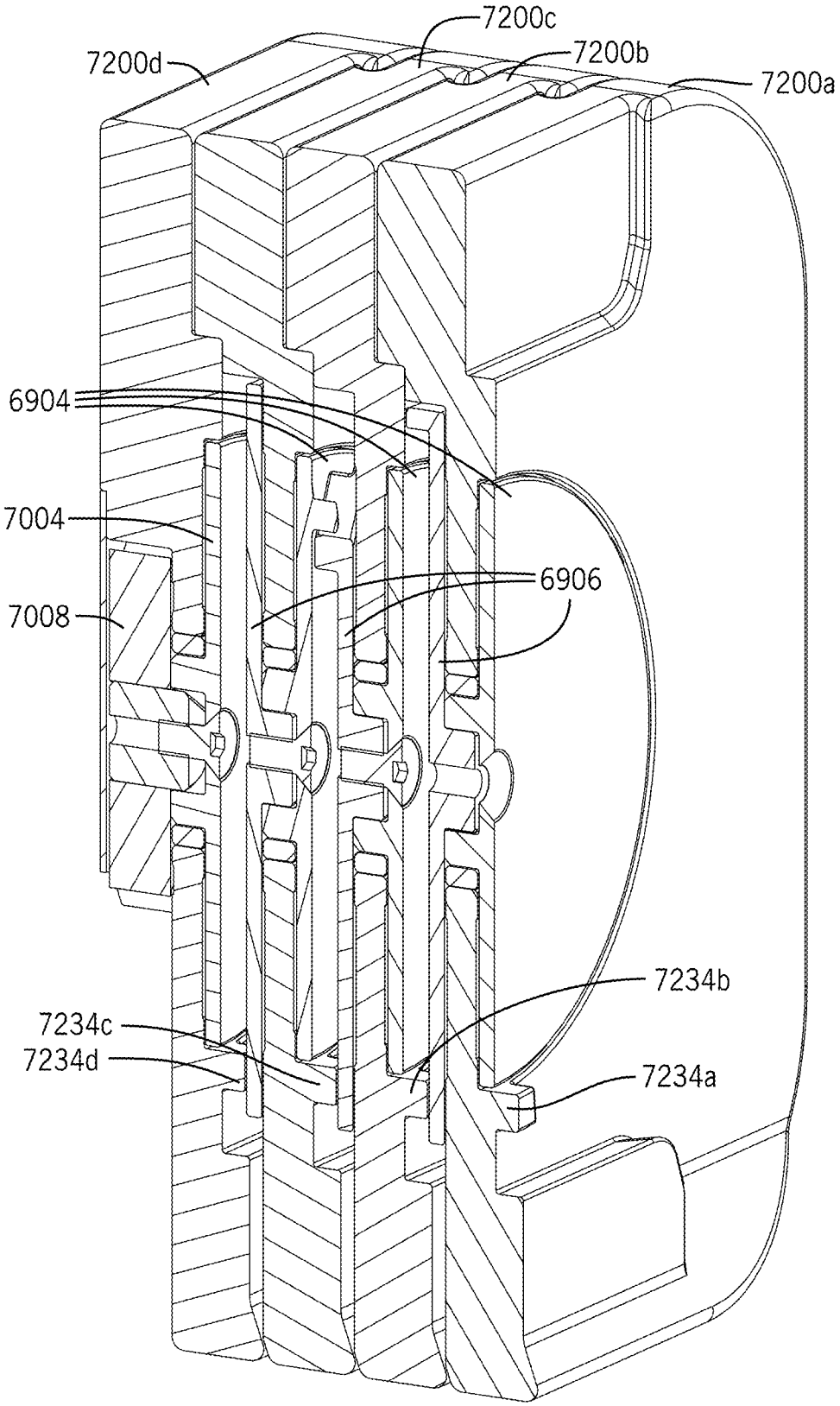

FIGS. 65A-65C is a sectional view of multiple weights positioned together (e.g., in a weight stack) and illustrate a first weight 7200*a* nearest the handle, a second weight 7200*b* adjacent the first weight 7200*a*, a third weight 7200*c* adjacent the second weight 7200*b*, and a fourth weight 7200*d* adjacent the third weight 7200*c*. In such embodiments, the first weight 7200*a* may selectively engage the second weight

7200*b* to provide an engagement for retention and/or for lifting the second weight 7200*b* with the first weight 7200*a*, such as in a manner as described above. For example, the second weight 7200*b* may include a key (e.g., key 6930) for positioning (e.g., positionable) within a pocket (e.g., pocket 6926) of the first weight 7200*a* to rotate a disc (e.g., second disc 6906) of the first weight 7200*a* between retaining and releasing positions. In the retaining position, a flange 7018*a* of the first weight 7200*a* (e.g., first flange 6918) may engage a tab 7234*b* of the second weight 7200*b* (e.g., tab 6934) to provide an engagement for retention and/or for lifting the second weight 7200*b* with the first weight 7200*a* when the first weight 7200*a* is lifted from the base 6410, such as described above. In the releasing position, the tab 7234*b* may disengage the flange 7018*a* to decouple the second weight 7200*b* from the first weight 7200*a*, such as described above. In this manner, the first weight 7200*a* may selectively engage the second weight 7200*b* by rotational position of the key of the second weight 7200*b*, which rotationally positions the second disc 6906 of the first weight 7200*a* such that the gap in the flange 7018*a* is positioned in alignment with the tab 7234*b*, which allows the tab 7234*b* to not engage the flange 7018*a* to not lift the second weight 7200*b* when the first weight 7200*a* is lifted from the base 6410. As shown, the first weight 7200*a* may also include a tab 7234*a* (e.g., tab 6934), such as for selectively engaging the handle assembly 6404, as described herein.

Similarly, the second weight 7200*b* may selectively engage the third weight 7200*c* to provide an engagement for retention and/or for lifting the third weight 7200*c* with the second weight 7200*b*, such as in a manner as described above. For example, the third weight 7200*c* may include a key (e.g., key 6930) for positioning (e.g., positionable) with a pocket (e.g., pocket 6926) of the second weight 7200*b* to rotate a disc (e.g., second disc 6906) of the second weight 7200*b* between retaining and releasing positions. In the retaining position, a flange 7018*b* of the second weight 7200*b* (e.g., first flange 6918) may engage a tab 7234*c* of the third weight 7200*c* (e.g., tab 6934) to provide an engagement for retention and/or for lifting the third weight 7200*c* with the second weight 7200*b*, such as described above. In the releasing position, the tab 7234*b* may disengage the flange 7018*b* to decouple the third weight 7200*c* from the second weight 7200*b*, such as described above. In this manner, the second weight 7200*b* may selectively engage the third weight 7200*c* by rotational position of the key of the third weight 7200*c*, which rotationally positions the second disc 6906 of the second weight 7200*b* such that the gap in the flange 7018*b* is positioned in alignment with the tab 7234*c*, which allows the tab 7234*c* to not engage the flange 7018*b* to not lift the third weight 7200*c* when the second weight 7200*b* is lifted from the base 6410.

The third weight 7200*c* may selectively engage the fourth weight 7200*d* to provide an engagement for retention and/or for lifting the fourth weight 7200*d* with the third weight 7200*c*, such as in a manner as described above. For example, the fourth weight 7200*d* may include a key (e.g., key 7030) for positioning (e.g., positionable) with a pocket (e.g., pocket 6926) of the third weight 7200*c* to rotate a disc (e.g., second disc 6906) of the third weight 7200*c* between retaining and releasing positions. In the retaining position, a flange 7018*c* of the third weight 7200*c* (e.g., first flange 6918) may engage a tab 7234*d* of the fourth weight 7200*d* (e.g., tab 6934) to provide an engagement for retention and/or for lifting the fourth weight 7200*d* with the third weight 7200*c*, such as described above. In the releasing position, the tab 7234*b* may disengage the flange 7018*c* to decouple the fourth weight 7200*d* from the third weight 7200*c*, such as described above. In this manner, the third weight 7200*c* may selectively engage the fourth weight 7200*d* by rotational position of the key of the fourth weight 7200*d*, which rotationally positions the second disc 6906 of the third weight 7200*c* such that the gap in the flange 7018*c* is positioned in alignment with the tab 7234*d*, which allows the tab 7234*d* to not engage the flange 7018*c* to not lift the fourth weight 7200*d* when the third weight 7200*c* is lifted from the base 6410.

In various examples, the sequential key systems of the first, second, third, and fourth weights 7200*a*, 7200*b*, 7200*c*, 7200*d* may be tied together. For instance, the fourth weight 7200*d* may embody the weight 7000, described above, including the gear 7008 and the first disc 7004. Each of the first weight 7200*a*, second weight 7200*b*, and third weight 7200*c* may embody the weight 6900, described above, including the first disc 6904 and the second disc 6906. In such examples, rotation of the gear 7008 may rotate the first disc 7004 of the fourth weight 7200*d*. The second disc 6906 of the third weight 7200*c* may be rotated by the first disc 7004 of the fourth weight 7200*d*, such as via a key (e.g., 7030) of the first disc 7004 received in a pocket (e.g., 6926) of the second disc 6906 to rotate the second disc 6906, as detailed above.

Rotation of the second disc 6906 of the third weight 7200*c* may then rotate the first disc 6904 of the third weight 7200*c*. In turn, the second disc 6906 of the second weight 7200*b* may be rotated by the first disc 6904 of the third weight 7200*c*, such as via a key (e.g., 7030) of the first disc 6904 received in a pocket (e.g., 6926) of the second disc 6906 to rotate the second disc 6906, as detailed above.

Rotation of the second disc 6906 of the second weight 7200*b* may then rotate the first disc 6904 of the second weight 7200*b*. In turn, the second disc 6906 of the first weight 7200*a* may be rotated by the first disc 6904 of the second weight 7200*b*, such as via a key (e.g., 7030) of the first disc 6904 received in a pocket (e.g., 6926) of the second disc 6906 to rotate the second disc 6906, as detailed above.

Rotation of the second disc 6906 of the first weight 7200*a* may then rotate the first disc 6904 of the first weight 7200*a*. In turn, the handle disc 6734 of the handle assembly 6404 may be rotated by the first disc 6904 of the first weight 7200*a*, such as via a key (e.g., 7030) of the first disc 6904 received in a pocket (e.g., pocket 6744) of the handle disc 6734 to rotate the handle disc 6734, as detailed above.

In this manner, the selection of a weight to be engaged and lifted or disengaged and not lifted may be driven from the outer end of the dumbbell 6401 rotating sequentially the discs of each weight to then cause engagement of the weights from the innermost weight to the outermost weight. For example, the first and second discs of each weight may be positioned by the weight selector assembly 6412 turning the first disc 7004 of the outermost fourth weight 7200*d*, which turns the second disc 6906 of the third weight 7200*c*, which turns the first disc 6904 of the third weight 7200*c*, which turns the second disc 6906 of the second weight 7200*b*, which turns the first disc 6904 of the second weight 7200*b*, which turns the second disc 6906 of the first weight 7200*a*, which turns the first disc 6904 of the first weight 7200*a*, which turns the handle disc 6734 of the handle assembly 6404, and so on.

In the end, the orientation of the handle disc 6734 is determinative if the first weight 7200*a* is lifted off the base 6410 based on the position of the tab 7234*a* relative to the first flange 6740, as positioned by the key of the first disc 6904 of the first weight 7200*a*. Similarly, the orientation of the second disc 6906 of the first weight 7200*a* is determinative if the second weight 7200*b* is lifted off the base 6410 based on the position of the tab 7234*b* relative to the flange 7018*a*, as positioned by the key of the first disc 6904 of the second weight 7200*b*. Similarly, the orientation of the second disc 6906 of the second weight 7200*b* is determinative if the third weight 7200*c* is lifted off the base 6410 based on the position of the tab 7234*c* relative to the flange 7018*b*, as positioned by the key of the first disc 6904 of the third weight 7200*c*. Similarly, the orientation of the second disc 6906 of the third weight 7200*c* is determinative if the fourth weight 7200*d* is lifted off the base 6410 based on the position of the tab 7234*d* relative to the flange 7018*c*, as positioned by the key of the first disc 6904 of the fourth weight 7200*d*.

Depending on the rotational positions of the various discs of the first, second, third, and fourth weights 7200*a*, 7200*b*, 7200*c*, 7200*d*, one or more of the weights may be lifted with the handle assembly 6404. For example, in a first configuration illustrated in FIG. 65D, the discs may be rotated until the first weight 7200*a* may be lifted with the handle assembly 6404 via an engagement of the tab 7234*a* with the first flange 6740 of the handle disc 6734, such as in a manner as described above. At the same time, the first configuration may decouple the tab 7234*b* from the flange 7018*a* to decouple the second weight 7200*b* from the first weight 7200*a*. In this configuration, only the first weight 7200*a* may be lifted with the handle assembly 6404, leaving the second, third, and fourth weights 7200*b*, 7200*c*, 7200*d* in the base 6410.

In a second configuration illustrated in FIG. 65C, the discs may be rotated further until the second weight 7200*b* may be lifted with the first weight 7200*a* via an engagement of the tab 7234*b* with the flange 7018*a*, while still maintaining engagement of the first weight 7200*a* with the handle assembly 6404. At the same time, the second configuration may decouple the tab 7234*c* from the flange 7018*b* to decouple the third weight 7200*c* from the second weight 7200*b*. In this configuration, only the first and second weights 7200*a*, 7200*b* may be lifted with the handle assembly 6404, leaving the third and fourth weights 7200*c*, 7200*d* in the base 6410.

In a third configuration illustrated in FIG. 65B, the discs may be rotated further until the third weight 7200*c* may be lifted with the second weight 7200*b* via an engagement of the tab 7234*c* with the flange 7018*b*, while still maintaining engagement of the second weight 7200*b* with the first weight 7200*a* and engagement of the first weight 7200*a* with the handle assembly 6404. At the same time, the third configuration may decouple the tab 7234*d* from the flange 7018*c* to decouple the fourth weight 7200*d* from the third weight 7200*c*. In this configuration, only the first, second, and third weights 7200*a*, 7200*b*, 7200*c* may be lifted with the handle assembly 6404, leaving the fourth weight 7200*d* in the base 6410.

In a fourth configuration illustrated in FIG. 65A, the discs may be rotated further until the fourth weight 7200*d* may be lifted with the third weight 7200*c* via an engagement of the tab 7234*d* with the flange 7018*c*, while still maintaining engagement of the third weight 7200*c* with the second weight 7200*b*, engagement of the second weight 7200*b* with the first weight 7200*a*, and engagement of the first weight 7200*a* with the handle assembly 6404. In this configuration, each of the first, second, third, and fourth weights 7200*a*, 7200*b*, 7200*c*, 7200*d* may be lifted with the handle assembly 6404.

Any of the features, components, and/or parts, including the arrangements and configurations thereof shown in FIGS. 63-65D, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 63-65D.

Figure 66:
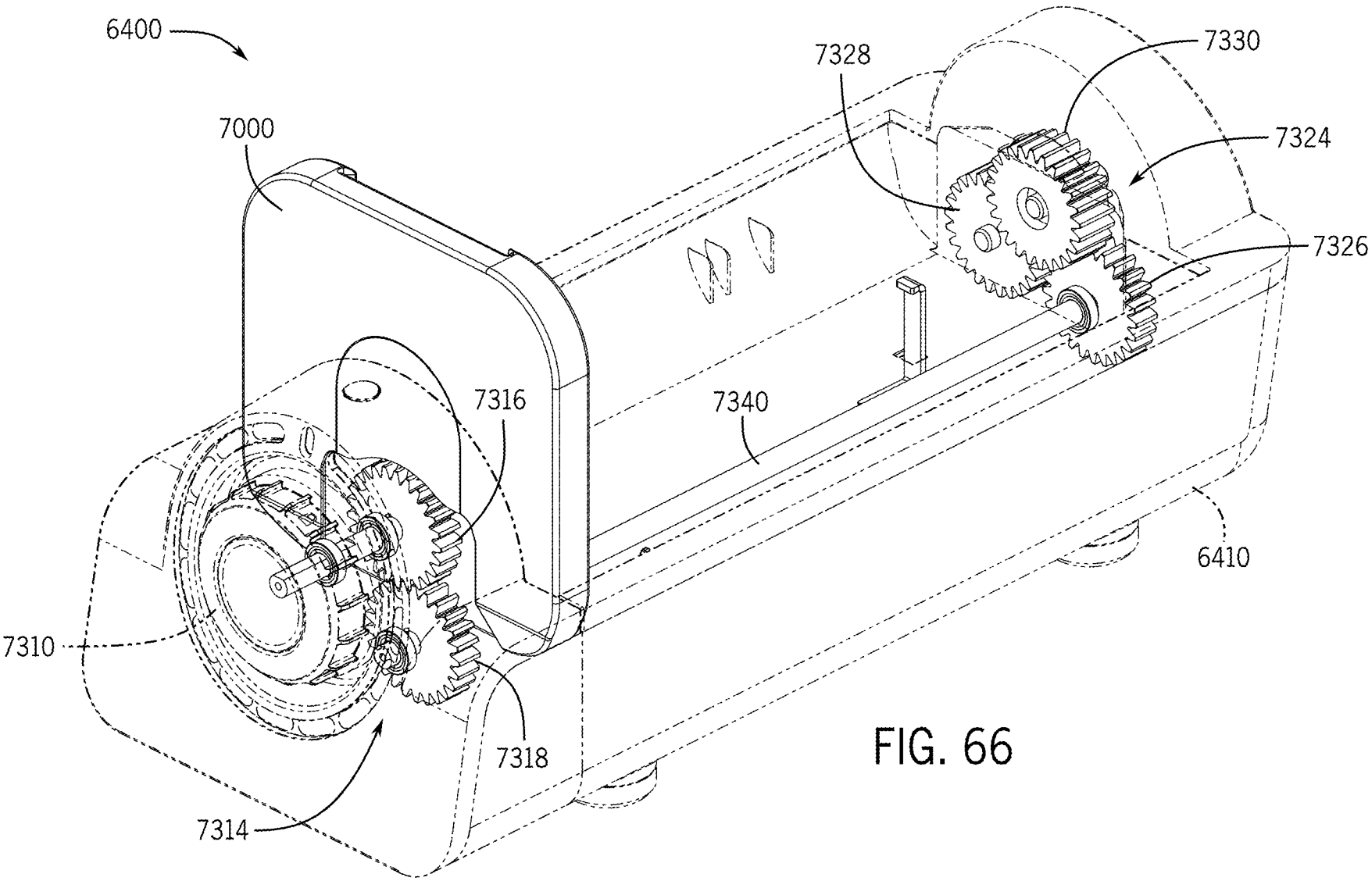
FIG. 66 is an isometric view of a weight selector assembly of the dumbbell system of FIG. 56, with portions of the dumbbell system shown transparent for illustration purposes.

FIG. 66 is an isometric view of the weight selector assembly 6412, with portions of the dumbbell system 6400 shown transparent for illustration purposes. In particular, FIG. 66 illustrates the weight selector assembly 6412, the weight 7000 (e.g., fourth weight 7200*d*) coupled to the weight selector assembly 6412, and the base 6410 transparent for illustration purposes. The weight selector assembly 6412 may be operable to adjust the sequential key system of the dumbbell 6401. For instance, the weight selector assembly 6412 may include one or more gears operated by a rotatable knob 7310 coupled to the base 6410. In one example, a gear of the weight selector assembly 6412 may meshingly engage the gear 7008 of the weight 7000 when the weight 7000 is positioned on the base 6410 to adjust the sequential key system of the dumbbell 6401. For instance, rotation of the knob 7310 may rotate the gear 7008 to operate the sequential key system of the dumbbell 6401 when positioned on the base 6410, such as in a manner as described above.

As shown, the weight selector assembly 6412 may include a first gear train 7314. The first gear train 7314 may be on a first side of the base 6410 and configured to adjust the first weight stack 6420*a* of the dumbbell 6401. For example, the first gear train 7314 may engage the gear 7008 of the weight 7000 to adjust the number of weights coupled to a first end of the handle assembly 6404. The first gear train 7314 may include a first gear 7316 and a second gear 7318. The first gear 7316 may be coupled to the knob 7310 and engaged with the gear 7008 of the weight 7000 to rotate the gear 7008 as the knob 7310 is turned by the user. The second gear 7318 may be in meshed engagement with the first gear 7316, such as positioned below the first gear 7316.

In one example, the weight selector assembly 6412 may include a second gear train 7324. The second gear train 7324 may be on a second side of the base 6410 and configured to adjust the second weight stack 6420*b* of the dumbbell 6401, such as in the same manner with respect to the first weight stack 6420*a*. In one example, the second gear train 7324 may include a third gear 7326, a fourth gear 7328, and a fifth gear 7330. The third gear 7326 may be in meshed engagement with the fourth gear 7328 to rotate the fourth gear 7328 with rotation of the third gear 7326. The fourth gear 7328 may be in meshed engagement with the fifth gear 7330 to rotate the fifth gear 7330 with rotation of the fourth gear 7328. The fifth gear 7330 may engage the gear 7008 of another weight 7000 (not shown for illustration purposes).

In one example, the weight selector assembly 6412 may include a shaft 7340 extending from the first gear train 7314 to the second gear train 7324. As shown, the shaft 7340 may extend within the base 6410 between the second gear 7318 and the third gear 7326. In such examples, operation of the second gear train 7324 may be tied to operation of the first gear train 7314 via the shaft 7340 to tie adjustment of the second gear train 7324 with adjustment of the first gear train 7314. In this manner, respective weight stacks at each end of the base 6410 may be adjusted equally, such as to couple the same number of weights to the opposing ends of the handle assembly 6404 when the dumbbell 6401 is positioned on the base 6410.

In one example, the second gear train 7324 may be configured to ensure that the fifth gear 7330 rotates in a direction opposite the first gear 7316 of the first gear train 7314. For example, when the first gear 7316 is rotated in a clockwise direction relative to the perspective shown in FIG. 66, the second gear train 7324 may cause the fifth gear 7330 to rotate in a counterclockwise direction relative to the same perspective, and vice-versa. In this manner, the dumbbell 6401 may be placed on the base 6410 irrespective of orientation. For example, the user may lift the dumbbell 6401 from the base 6410 in a first orientation and place the dumbbell 6401 back onto the base 6410 in a second orientation different than the first orientation and still maintain weight selection synchronization between the dumbbell 6401 and the base 6410. In this manner, the weight selector assembly 6412 may transfer rotation at one end of the dumbbell 6401 to effectively rotate and select at the other end of the dumbbell 6401, requiring reversal of the gear rotation through the disclosed gear trains.

Reversing the rotational direction of the fifth gear 7330 relative to the first gear 7316 may be accomplished in a variety of manners. For example, the fourth gear 7328 may be an idler gear positioned between the third and fifth gears 7326, 7330 to change the rotational direction of the fifth gear 7330 relative to the third gear 7326, although other configurations are contemplated, including configurations having more or less than three gears. In one example, each of the gears in the second gear train 7324 may be a spur gear, as shown. In another example, at least some of the gears in the second gear train 7324 (e.g., each of the third, fourth, and fifth gears 7326, 7328, 7330) may include a bevel gear, such as to accommodate different space requirements of the base 6410.

Figure 67:
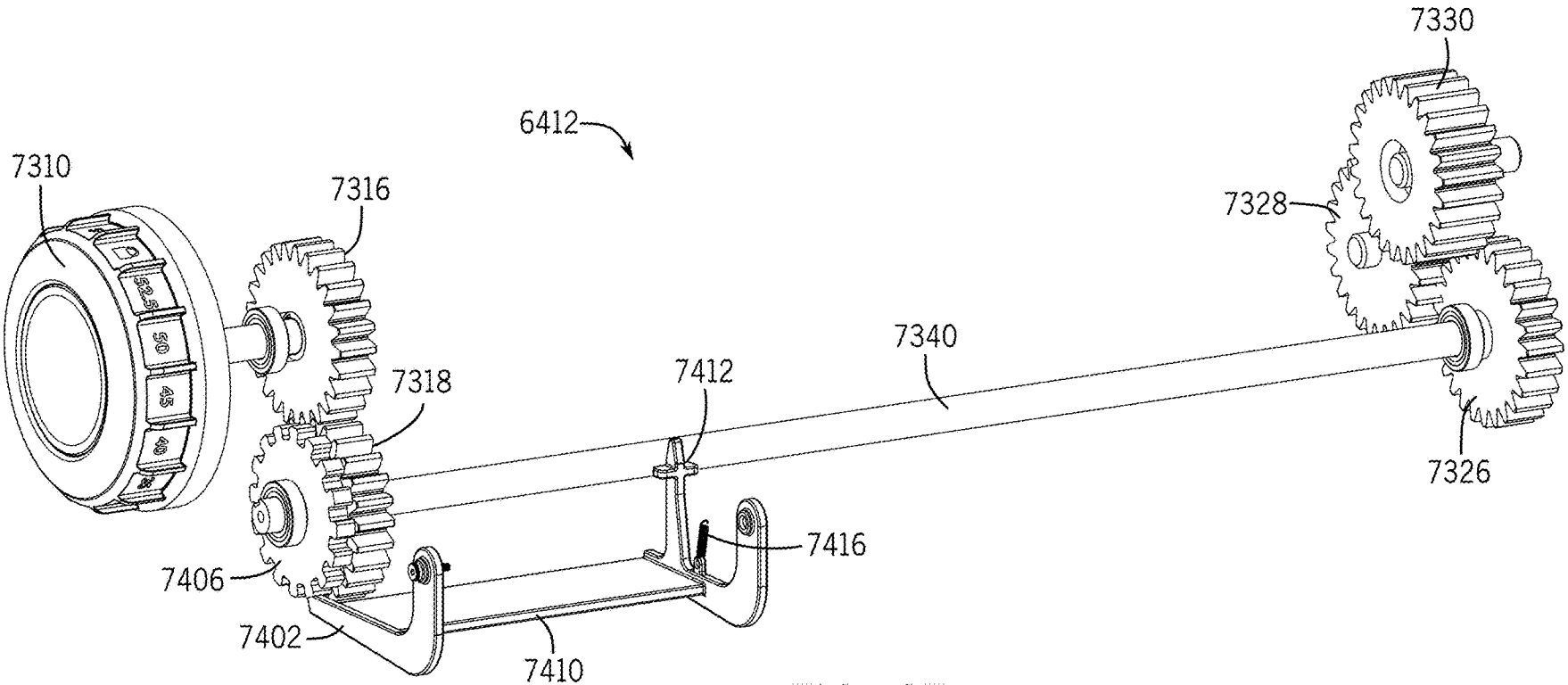
FIG. 67 is another isometric view of the weight selector assembly of FIG. 65.
Figure 68:
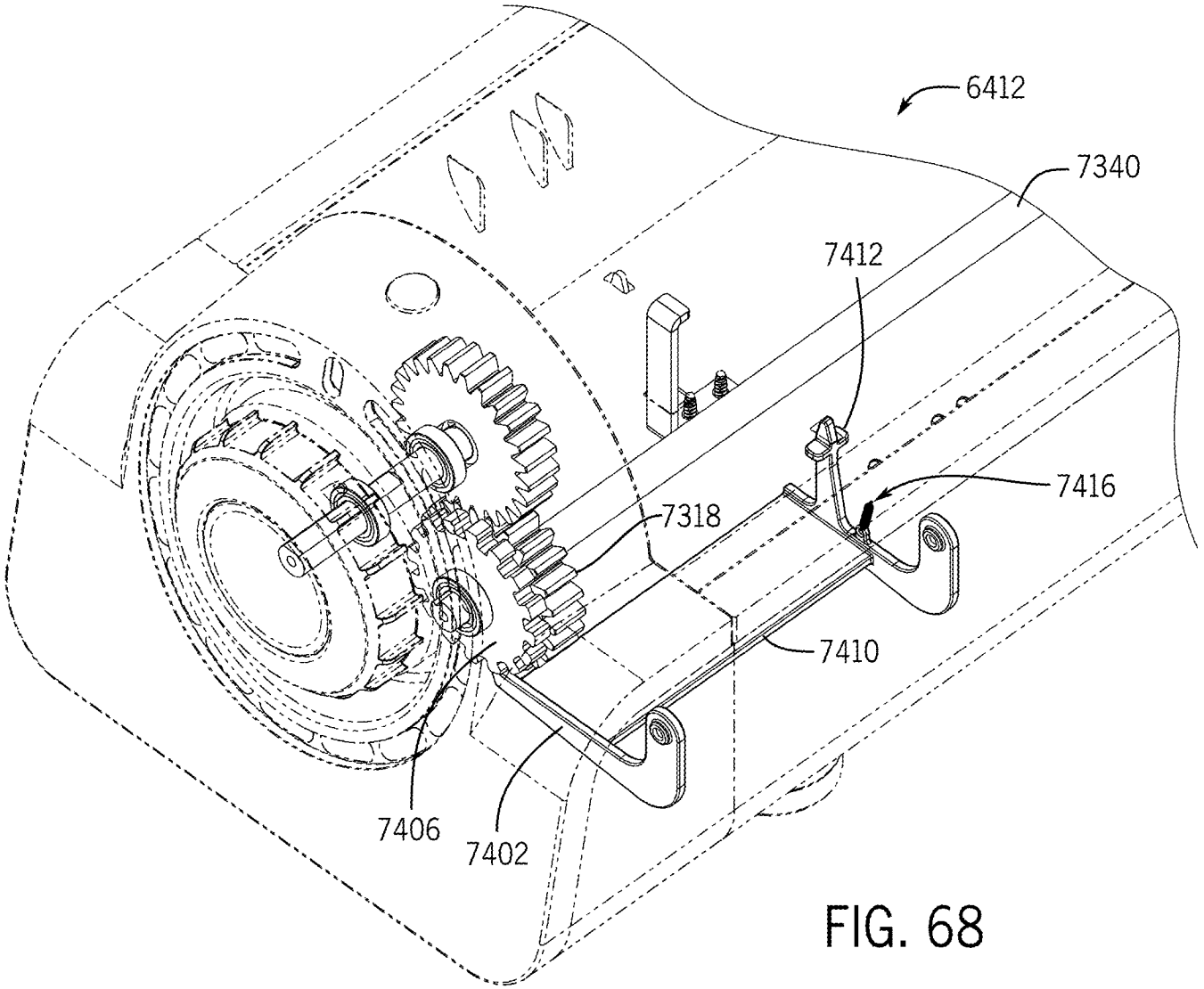
FIG. 68 is a partial isometric view of the weight selector assembly of FIG. 65, with portions of the dumbbell system shown transparent for illustration purposes.
Figure 69:
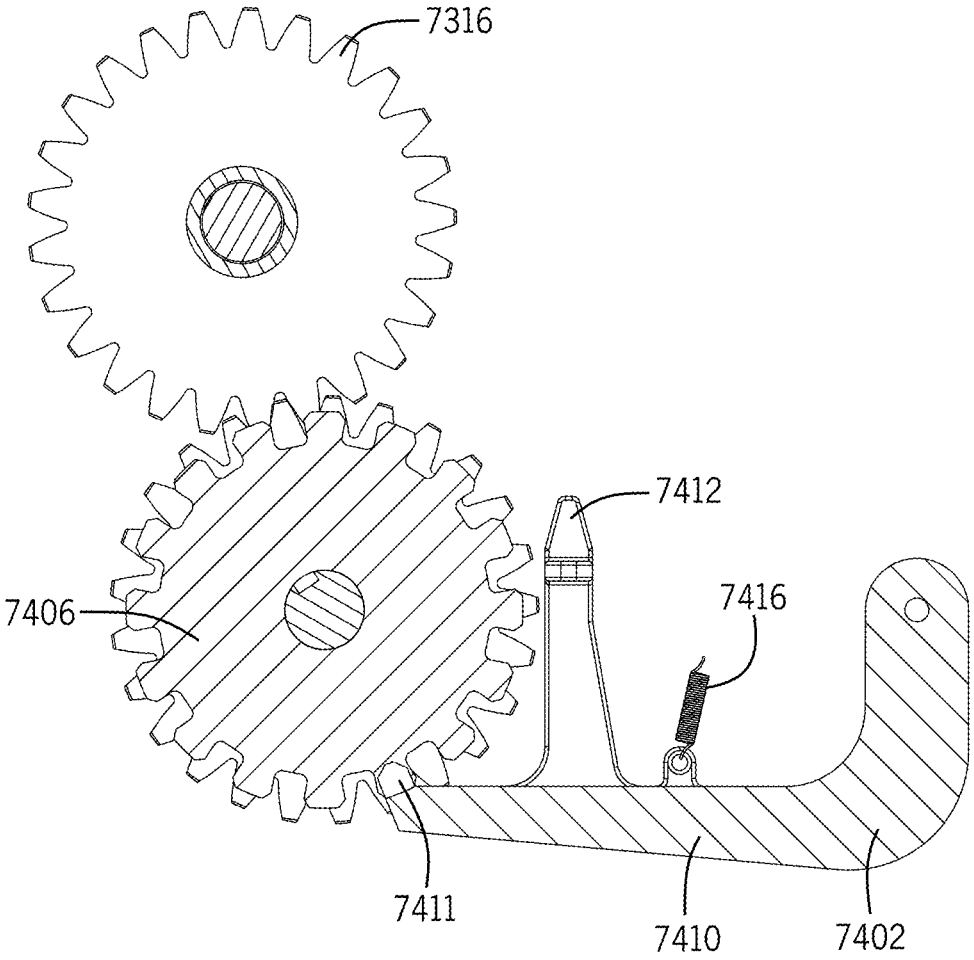
FIG. 69 is a sectional view of the weight selector assembly of FIG. 65.

FIG. 67 is another isometric view of the weight selector assembly 6412. FIG. 68 is a partial isometric view of the weight selector assembly 6412, with portions of the dumbbell system 6400 not shown for illustration purposes. FIG. 69 is a sectional view of the weight selector assembly 6412. As described with reference to FIGS. 67-69, the weight selector assembly 6412 may include a lock mechanism (e.g., a rotation lock, a pinion gear lock, etc.) to selectively lock adjustment of the weight selector assembly 6412. For example, the weight selector assembly 6412 may include a pawl 7402 to selectively engage the first gear train 7314. As shown, the first gear train 7314 may include a lock gear 7406 coupled (in one example, fixed) to the shaft 7340, such as adjacent to the second gear 7318. The pawl 7402 may include an arm 7410 having a tip 7411 (see FIG. 69). The pawl 7402 may be pivotably coupled to the base 6410. For instance, the arm 7410 may have one or more curved links/members pivotably attached at the base 6410. In one example, the pawl 7402 includes a post 7412 extending from the arm 7410. The post 7412 may be spaced away from the tip 7411, and in some examples may also be spaced away in a direction along a length of the base. In one example, the pawl 7402 may be biased by a spring 7416 or otherwise sprung. In such examples, the spring 7416 may bias the pawl 7402 into engagement with the first gear train 7314.

The arm 7410 may be pivotably coupled to the base 6410 to move the pawl 7402 into and out of engagement with the lock gear 7406. For instance, the arm 7410 may pivot in a first direction to move the pawl 7402 (e.g., the tip 7411) into engagement with the lock gear 7406 (see FIG. 69). The arm 7410 may also pivot in a second direction to move the pawl 7402 (e.g., the tip 7411) out of engagement with the lock gear 7406. In such examples, the spring 7416 may bias the pawl 7402 into engagement with the lock gear 7406.

When the handle assembly 6404 is removed from the base 6410, the weight selector assembly 6412 may be locked by the pawl 7402 to limit a loss of weight selection synchronization between the handle assembly 6404 and the base 6410. For example, removal of the handle assembly 6404 from the base 6410 may allow the pawl 7402 to pivot into engagement with the lock gear 7406 (for example, under a biasing force from the spring 7416), thereby preventing adjustment of the first gear train 7314 and the second gear train 7324 when the handle assembly 6404 is removed from the base 6410. Conversely, when the handle assembly 6404 is placed on the base 6410, the biasing force from the spring 7416 may be overcome to pivot the pawl 7402 out of engagement with the lock gear 7406, thereby allowing adjustment of the first gear train 7314 and the second gear train 7324 when the handle assembly 6404 is positioned on the base 6410.

In some examples, selective engagement of the handle assembly 6404 with the post 7412 may position the pawl 7402 in either the locked configuration or the unlocked configuration with the lock gear 7406. For instance, the handle assembly 6404 may engage the post 7412 when placed on the base 6410, causing the arm 7410 to pivot away from the lock gear 7406 to unlock the pawl 7402. Conversely, removing the handle assembly 6404 from the base 6410 may allow the post 7412, and therefore the arm 7410, to pivot upwards, causing the pawl 7406 to engage the lock gear 7406.

Any of the features, components, and/or parts, including the arrangements and configurations thereof shown in FIGS. 66-69, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 66-69.

Figure 70:
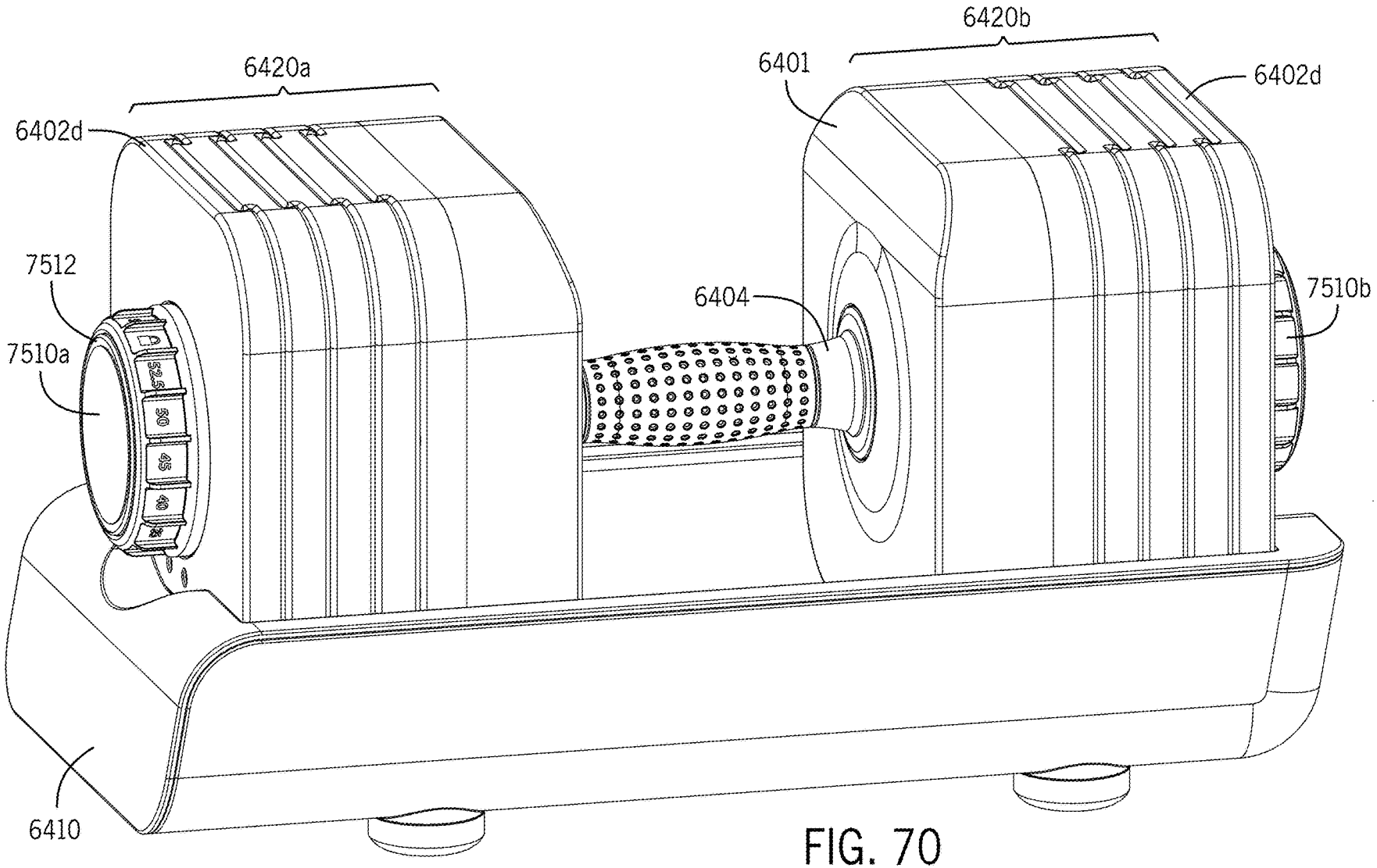
FIG. 70 is an isometric view of another weight selector assembly of an adjustable dumbbell system.
Figure 71A:
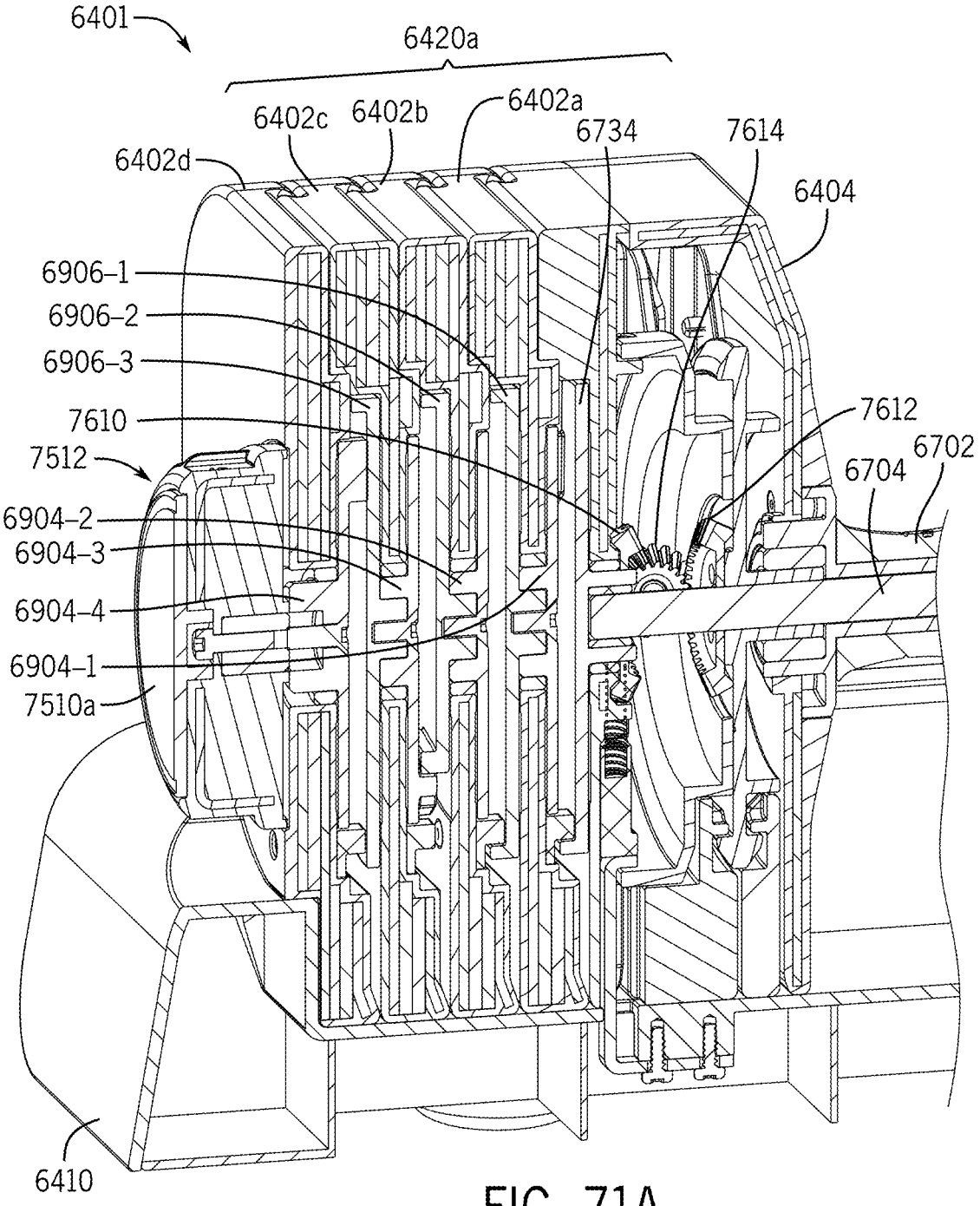
FIGS. 71A-71B are sectional views of the weight selector assembly of FIG. 70.
Figure 71B:
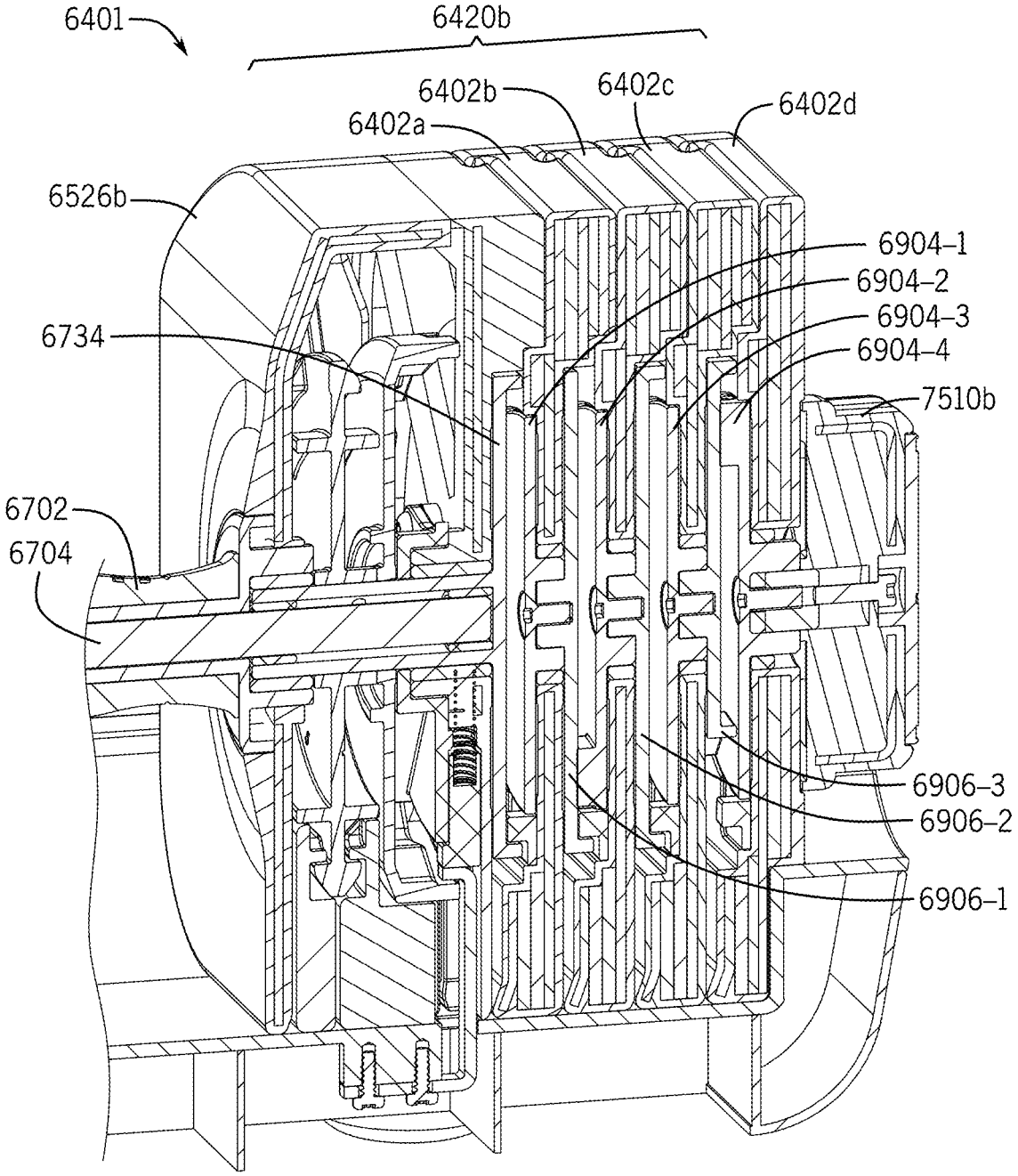

FIGS. 70-71B illustrate various views of another weight selector assembly 7512. Except as otherwise noted below, the weight selector assembly 7512 may be similar to the weight selector assembly 6412, described above. For example, the weight selector assembly 7512 may be operable to adjust the sequential key system of the dumbbell 6401, such as via a rotatable knob 7510, to selectively couple one or more weights 6402 to the handle assembly 6404, as described herein. However, unlike the weight selector assembly 6412, the weight selector assembly 7512 may be disposed or associated with the dumbbell 6401 directly, rather than disposed or associated with the base 6410. Notwithstanding, like weight selector assembly 6412, the weight selector assembly 7512 may be configured to rotate the various disc pairs of the first weight stack **6420*a* and the second weight stack 6420*b* to adjust the weight/load of the dumbbell 6401, as described herein. In some instances, the weight selector assembly 7512 may transfer rotation at one end of the dumbbell 6401 to effectively rotate and select at the other end of the dumbbell 6401, requiring reversal of the gear rotation through the disclosed gear trains. In other instances, the weight selector assembly 7512 may include separate mechanisms to select (e.g., independently) at respective ends of the dumbbell 6401**.

As shown, the weight selector assembly 7512 may include a first knob 7510*a* and a second knob 7510*b*. The first knob 7510*a* may be coupled to the end plate or outermost weight of the first weight stack 6420*a* (e.g., to fourth weight 6402*d* of first weight stack 6420*a*). Similarly, the second knob 7510*b* may be coupled to the end plate or outermost weight of the second weight stack 6420*b* (e.g., to fourth weight 6402*d* of second weight stack 6420*b*). Rotation of the first knob 7510*a* or the second knob 7510*b* may adjust both the first weight stack 6420*a* and the second weight stack 6420*b*. In other embodiments, the first knob 7510*a* may be rotated to adjust the first weight stack 6420*a*, and the second knob 7510*b* may be rotated to adjust the second weight stack 6420*b*.

For clarity in numbering, the first weight 6402*a* includes first disc 6904-1 and second disc 6906-1. Similarly, the second weight 6402*b* includes first disc 6904-2 and second disc 6906-2, the third weight 6402*c* includes first disc 6904-3 and second disc 6906-3, and the fourth weight 6402*d* includes first disc 6904-4. As shown in FIG. 71A, the first knob 7510*a* may be coupled to the inner, first disc 6904-4 of fourth weight 6402*d*, such that the first knob 7510*a* and the first disc 6904-4 rotate together in unison. Like the first knob 7510*a*, the second knob 7510*b* may be coupled to the inner, first disc 6904-4 of the outermost fourth weight 6402*d*, such that the second knob 7510*b* and the first disc 6904-4 rotate together in unison. Depending on the application, one or both of the first knob 7510*a* or the second knob 7510*b* may include a dial indicating a selected weight of the dumbbell 6401.

With continued reference to FIG. 71A, rotation of the first knob 7510*a* rotates the first disc 6904-4 of the fourth weight 6402*d*, which in turn rotates the disc pair of the adjacent third weight 6402*c* via engagement of the first disc 6904-4 of the fourth weight 6402*d* with the second disc 6906-3 of the third weight 6402*c*, as described above. The disc pair of the adjacent second weight 6402*b* may be rotated in turn, such as via engagement of the first disc 6904-3 of the third weight 6402*c* with the second disc 6906-2 of the second weight 6402*b*, as described above. Similarly, the disc pair of the adjacent first weight 6402*a* may also be rotated in turn, such as via engagement of the first disc 6904-2 of the second weight 6402*b* with the second disc 6906-1 of the first weight 6402*a*, as described above. In some examples, rotation of the first disc 6904-1 of the first weight 6402*a* may rotate the handle disc 6734 of the handle assembly 6404, such as in a manner as described above.

In some examples, the handle disc 6734 may be coupled to a first gear 7610 positioned within the first housing 6526*a*, such that the handle disc 6734 and first gear 7610 rotate together in unison. As shown, a second gear 7612 may be coupled to shaft 6704 extending through the grip 6702, such that rotation of the second gear 7612 rotates shaft 6704. In one example, a third gear 7614 may connect the first gear 7610 to the second gear 7612, such that rotation of the first gear 7610 rotates the second gear 7612 via the third gear 7614. In one example, the second gear 7612 may be a bevel gear configured to reverse the rotation directions of the first and second gears 7610, 7612, although other configurations are contemplated. In this manner, the weight selector assembly 7512 may be configured to transfer rotation at one end of the dumbbell 6401 to effectively rotate and select at the other end of the dumbbell 6401 via reversal of the gear rotation through a gear train.

With reference to FIG. 71B, the shaft 6704 may be coupled to the handle disc 6734 of the second housing 6526*b*, such that the shaft 6704 and handle disc 6734 rotate together in unison. In such examples, rotation of the handle disc 6734 may rotate the various disc pairs of the second weight stack 6420*b*. For instance, rotation of the handle disc 6734 may rotate the disc pair of the first weight 6402*a* of the second weight stack 6420*b* via engagement of the handle disc 6734 with the first disc 6904-1 of the first weight 6402*a*. The disc pair of the adjacent second weight 6402*b* of the second weight stack 6420*b* may be rotated subsequently or simultaneously, such as via engagement of the second disc 6906-1 of the first weight 6402*a* with the first disc 6904-2 of the second weight 6402*b*, as described above. Subsequently, or simultaneously, the disc pair of the adjacent third weight 6402*a* of the second weight stack 6420*b* may also be rotated, such as via engagement of the second disc 6906-2 of the second weight 6402*b* with the first disc 6904-3 of the third weight 6402*c*, as described above. Subsequently, or simultaneously, rotation of the second disc 6906-3 of the third weight 6402*c* may rotate the first disc 6904-4 of the fourth weight 6402*d* of the second weight stack 6420*b*, which in turn rotates the second knob 7510*b*.

Depending on the position of the various discs, one or more combinations of weights may be selectively coupled to the handle assembly 6404 to adjust the load of the dumbbell 6401, such as described above. Although described with reference to rotating first knob 7510*a* to selectively orient the discs, the second knob 7510*b* may be rotated in some embodiments. In such embodiments, the various disc pairs may be rotated in a reverse order as described above. In this manner, the user may rotate either the first knob 7510*a* or the second knob 7510*b* to adjust the load of the dumbbell 6401.

In alternative embodiments, the first knob 7510*a* may be rotated to adjust the first weight stack 6420*a* only, and the second knob 7510*b* may be rotated to adjust the second weight stack 6420*b* only. To adjust the second weight stack 6420*b* via the second knob 7510*b* only, the various disc pairs of the second weight stack 6420*b* may be rotated in a reverse order as described above. Although the knobs 7510*a* and 7510*b* may be rotated separately, the weight settings may move in the same direction from the user's perspective. For example, the first knob 7510*a* may rotate in a first direction (e.g., clockwise) and the second knob 7510*b* may rotate in an opposite second direction (e.g., counterclockwise) to adjust the first and second weight stacks 6420*a*, 6420*b*, respectively. In such embodiments, the weights 6402 and/or base 6410 may include features (e.g., keys, slots, pins, etc.) to prevent the dumbbell 6401 from being put backwards into the base 6410.

Any of the features, components, and/or parts, including the arrangements and configurations thereof shown in FIGS. 70-71B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 70-71B.

Figure 72:
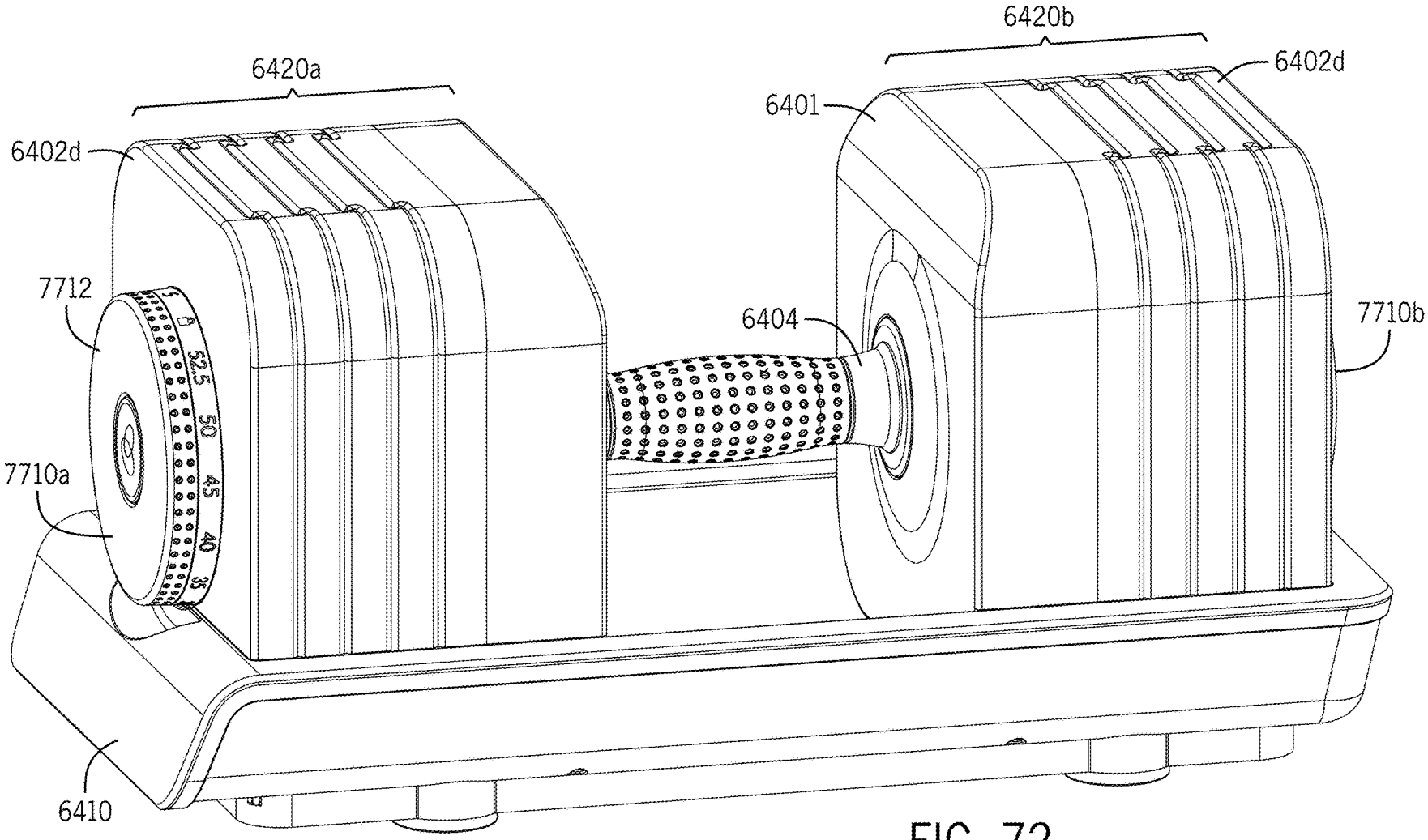
FIG. 72 is an isometric view of another weight selector assembly of an adjustable dumbbell system.
Figure 73A:
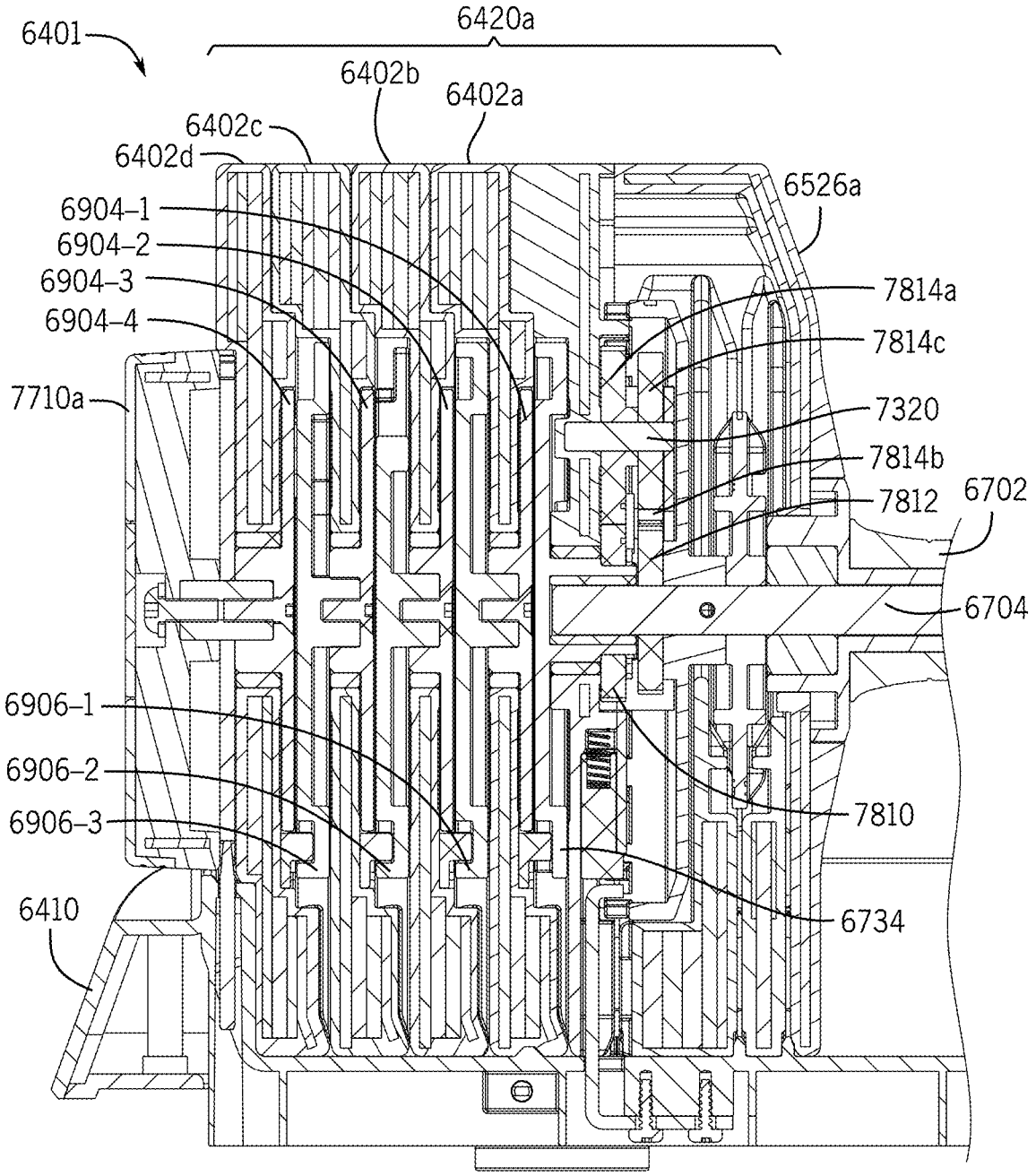
FIGS. 73A-73B are sectional views of the weight selector assembly of FIG. 72.
Figure 73B:
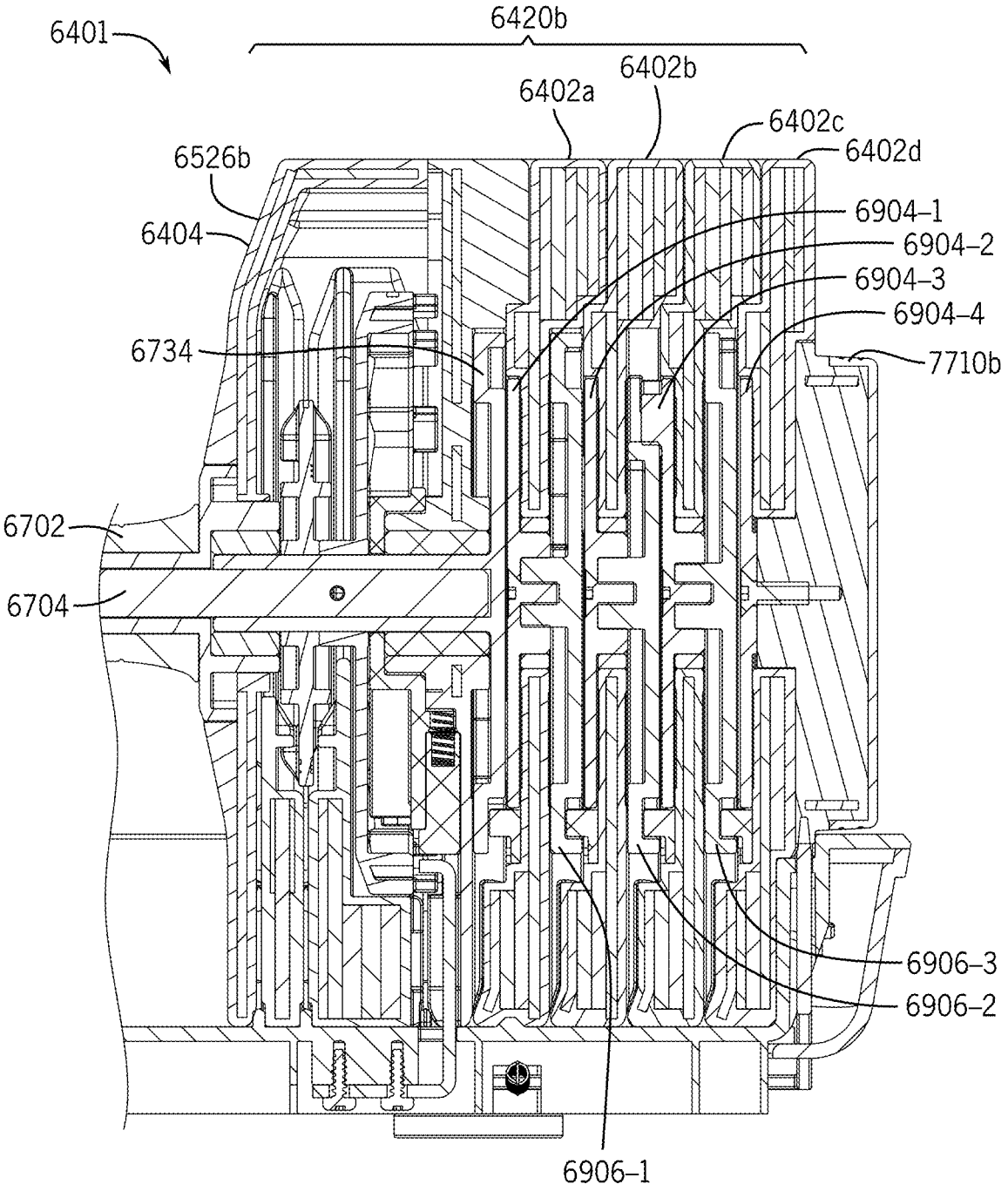
Figure 74:
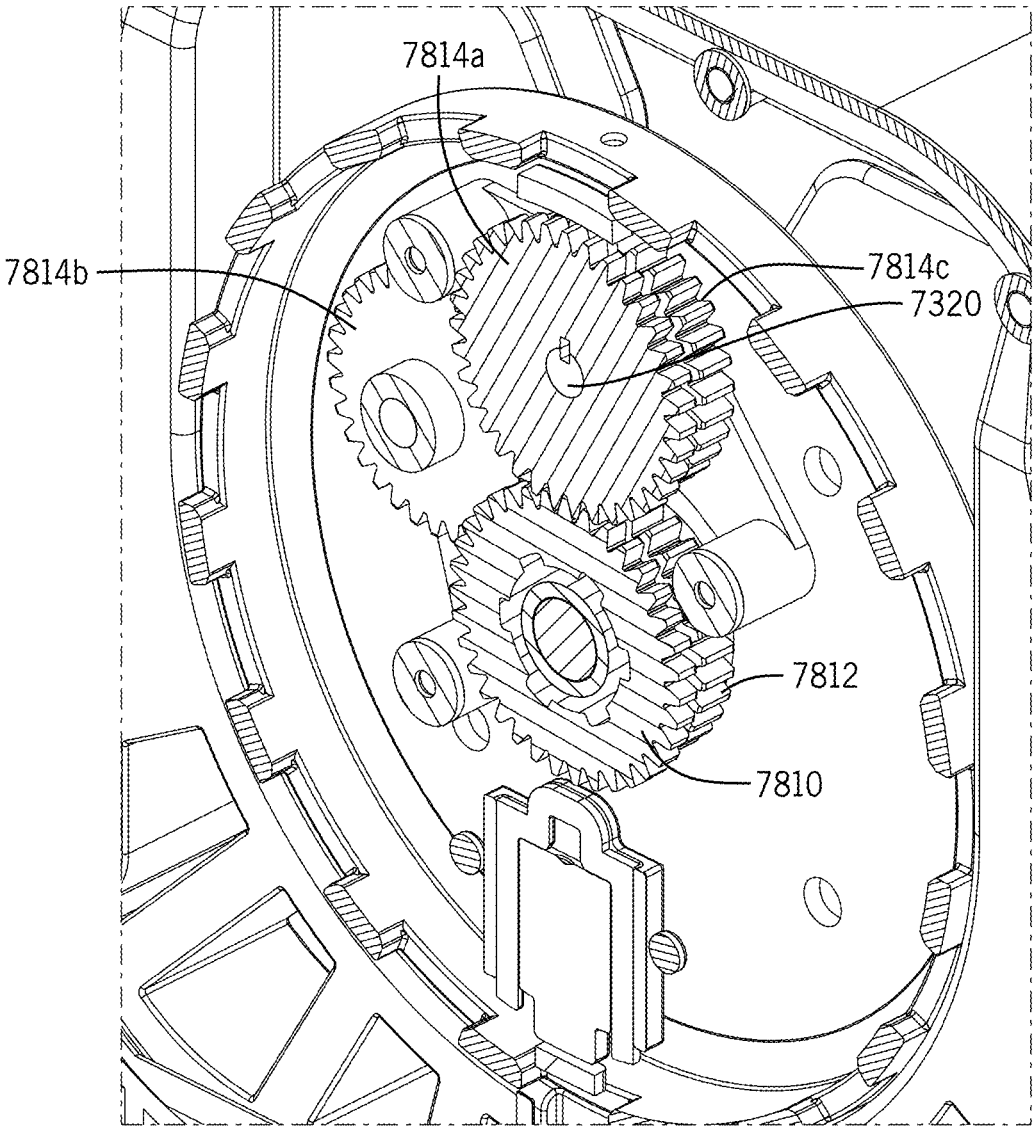
FIG. 74 is another sectional view of the weight selector assembly of FIG. 72.

FIGS. 72-74 illustrate various views of another weight selector assembly 7712. Except as otherwise noted below, the weight selector assembly 7712 may be similar to the weight selector assembly 6412 and/or weight selector assembly 7512, described above. For example, the weight selector assembly 7712 may be operable to adjust the sequential key system of the dumbbell 6401, such as via a rotatable knob 7710, to selectively couple one or more weights 6402 to the handle assembly 6404, such as in a manner as described herein. Similar to weight selector assembly 7512, the weight selector assembly 7712 may be disposed on or associated with the dumbbell 6401 directly, rather than disposed on or associated with the base 6410, such as to rotate the various disc pairs of the first weight stack 6420*a* and the second weight stack 6420*b* to adjust the weight/load of the dumbbell 6401, as described herein. In some instances, the weight selector assembly 7712 may be configured to transfer rotation at one end of the dumbbell 6401 to effectively rotate and select at the other end of the dumbbell 6401 via a reversal of gear rotation through a gear train, as described herein. In other instances, the weight selector assembly 7712 may include separate mechanisms to select (e.g., independently) at respective ends of the dumbbell 6401.

Like weight selector assembly 7512, the weight selector assembly 7712 may include a first knob 7710*a* and a second knob 7710*b*. The first knob 7710*a* may be coupled to the end plate or outermost weight of the first weight stack 6420*a* (e.g., to fourth weight 6402*d* of first weight stack 6420*a*), and fixed to the inner, first disc 6904-4 of the fourth weight 6402*d* (see FIG. 73A), such that the first knob 7710*a* and the first disc 6904-4 rotate together in unison. Similarly, the second knob 7710*b* may be coupled to the end plate or outermost weight of the second weight stack 6420*b* (e.g., to fourth weight 6402*d* of second weight stack 6420*b*), and fixed to the inner, first disc 6904-4 of the fourth weight 6402*d* (see FIG. 73B), such that the second knob 7710*b* and the first disc 6904-4 rotate together in unison. Rotation of the first knob 7710*a* or the second knob 7710*b* may adjust both the first weight stack 6420*a* and the second weight stack 6420*b*. In other embodiments, the first knob 7710*a* may be rotated to adjust the first weight stack 6420*a*, and the second knob 7710*b* may be rotated to adjust the second weight stack 6420*b*.

Referring to FIGS. 73A and 74, the weight selector assembly 7712 may include a first gear 7810 coupled to the handle disc 6734 of the first housing 6526*a*, such that the handle disc 6734 and first gear 7810 rotate together in unison. The weight selector assembly 7712 may also include a second gear 7812 coupled to shaft 6704 extending through the grip 6702, such that rotation of the second gear 7812 rotates shaft 6704.

In some embodiments, a plurality of idler gears 7814 may be positioned between the first and second gears 7810, 7812 to reverse the rotation directions of the first gear 7810 and the second gear 7812. For example, a first idler gear 7814*a* may engage the first gear 7810, and a second idler gear 7814*b* may engage the second gear 7812. In some embodiments, a third idler gear 7814*c* may connect the first idler gear 7814*a* to the second idler gear 7814*b*. For example, the first and third idler gears 7814*a*, 7814*c* may be connected via shaft 7320, such that rotation of the first idler gear 7814*a* rotates the third idler gear 7814*c* on the shaft 7320. In such examples, the third idler gear 7814*c* is connected to rotate the second idler gear 7814*b*.

The various discs (e.g., disc pairs) of the first and second weight stacks 6420*a*, 6420*b* may be rotated in manner similar to that described above with reference to FIGS. 70-71B. For instance, rotation of the first knob 7710*a* may rotate the first disc 6904-4 of the fourth weight 6402*d* of the first weight stack 6420*a*, which in turn may rotate the disc pair (e.g., second disc 6906-3 and first disc 6904-3) of the third weight 6402*c* of the first weight stack 6420*a*, which in turn may rotate the disc pair (e.g., second disc 6906-2 and first disc 6904-2) of the second weight 6402*b* of the first weight stack 6420*a*, which in turn may rotate the disc pair (e.g., second disc 6906-1 and first disc 6904-1) of the first weight 6402*a* of the first weight stack 6420*a*, which in turn may rotate the handle disc 6734 of the first housing 6526*a* of the handle assembly 6404, such as in a manner as described above. In addition, rotation of the handle disc 6734 of the first housing 6526*a* may rotate the handle disc 6734 of the second housing 6526*b* in a reverse direction, such as via the first gear 7810, second gear 7812, and idler gears 7814. Finally, rotation of the handle disc 6734 of the second housing 6526*b* may rotate the disc pair (e.g., first disc 6904-1 and second disc 6906-1) of the first weight 6402*a* of the second weight stack 6420*b*, which in turn may rotate the disc pair (e.g., first disc 6904-2 and second disc 6906-2) of the second weight 6402*b* of the second weight stack 6420*b*, which in turn may rotate the disc pair (e.g., first disc 6904-3 and second disc 6906-3) of the third weight 6402*c* of the second weight stack 6420*b*, which in turn may rotate the first disc 6904-4 and second knob 7710*b* of the fourth weight 6402*d* of the second weight stack 6420*b*, such as in a manner as described above.

In this manner, one or more combinations of weights may be selectively coupled to the handle assembly 6404 based on the position of the various discs to adjust the load of the dumbbell 6401, such as described above. Although described with reference to rotating first knob 7710*a* to selectively orient the discs, the second knob 7710*b* may be rotated in some embodiments. In this manner, the user may rotate either the first knob 7710*a* or the second knob 7710*b* to adjust the load of the dumbbell 6401.

In alternative embodiments, the first knob 7710*a* may be rotated to adjust the first weight stack 6420*a* only, and the second knob 7710*b* may be rotated to adjust the second weight stack 6420*b* only. To adjust the second weight stack 6420*b* via the second knob 7710*b* only, the various disc pairs of the second weight stack 6420*b* may be rotated in a reverse order as described above. Although the knobs 7710*a* and 7710*b* may be rotated separately, the weight settings may move in the same direction from the user's perspective. For example, the first knob 7710*a* may rotate in a first direction (e.g., clockwise) and the second knob 7710*b* may rotate in an opposite second direction (e.g., counterclockwise) to adjust the first and second weight stacks 6420*a*, 6420*b*, respectively. In such embodiments, the weights 6402 and/or base 6410 may include features (e.g., keys, slots, pins, etc.) to prevent the dumbbell 6401 from being put backwards into the base 6410.

Any of the features, components, and/or parts, including the arrangements and configurations thereof shown in FIGS. 72-74, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 72-74.

FIGS. 75-82B illustrate aspects of a dumbbell system 7900 including an adjustable dumbbell 7901 including a handle assembly 7904 and a plurality of weights selectively coupled to the handle assembly 7904 to adjust the mass of the dumbbell 7901, such as when lifted away from a base 7910. The dumbbell system 7900 may therefore have components or assemblies in common with dumbbell system 100 or other systems described above, and such components or assemblies may share the same function and features as described above. Components and features similar to dumbbell system 100 (or other systems described herein) may not be described in connection with dumbbell system 7900 to avoid unnecessary repetition.

Figure 75:
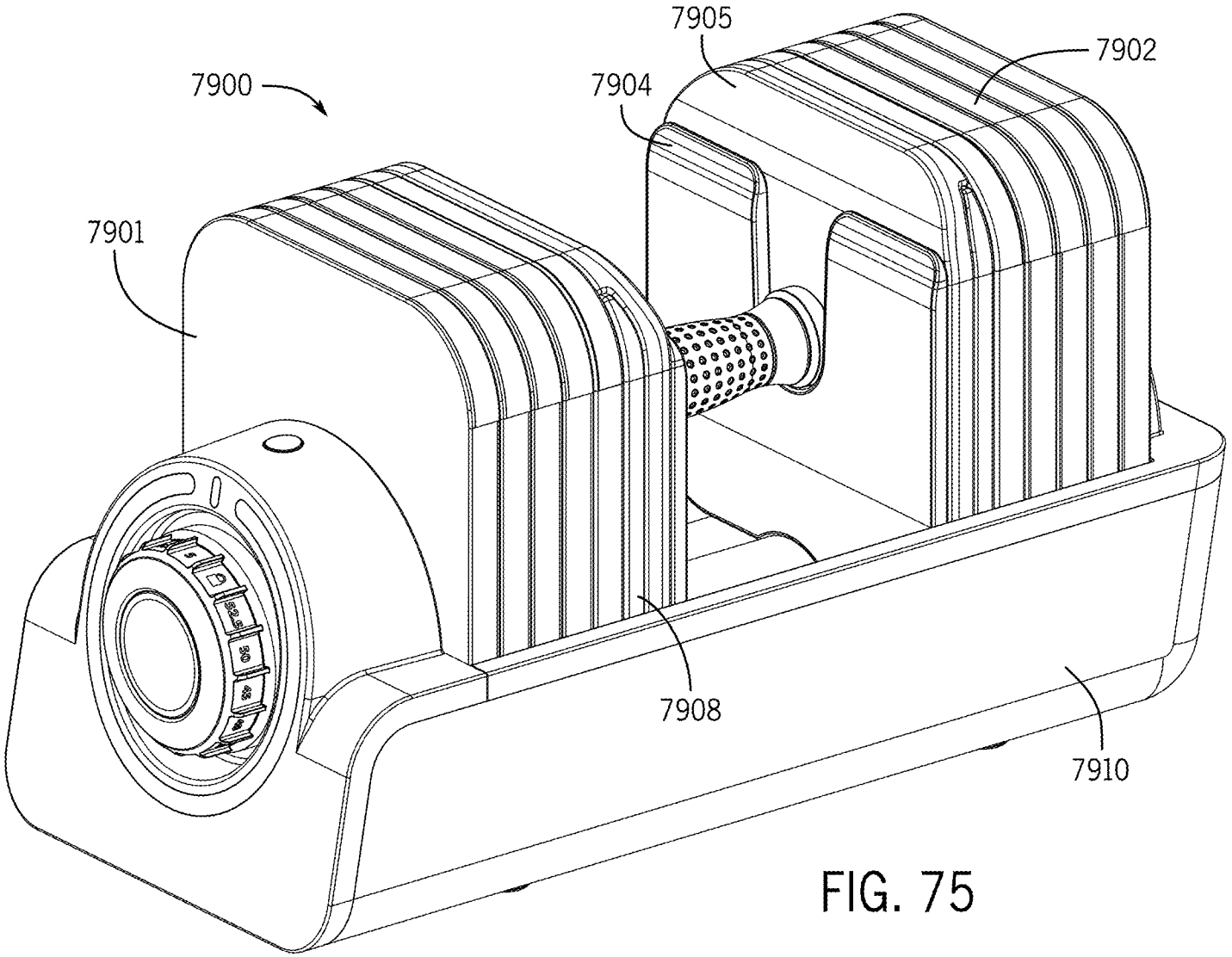
FIG. 75 is an isometric view of an adjustable dumbbell system.

Referring to FIG. 75, the dumbbell 7901 may include any number or type of weights to adjust the mass of the dumbbell 7901, including, for example, main weights 7902, supplemental weights 7908, or handle weights 7905. As shown, the weights may be positioned in a stacked relationship, such as stacked in a face-to-face relationship, to provide a compact form factor for ease of use, although other configurations are contemplated.

The various weights may be selectively coupled to the handle assembly 7904 to provide a desired mass of the dumbbell 7901. For example, one or more weights may be removed or added to decrease or increase the mass of the dumbbell 7901, as desired. In one example, one or more main weights 7902 may be selectively coupled to the handle assembly 7904 to adjust the dumbbell's mass incrementally in a first manner (e.g., in 5 lb increments, in 10 lb increments, etc.). Additionally, or alternatively, at least one supplemental weight 7908 may be selectively coupled to the handle assembly 7904 to adjust the dumbbell's mass incrementally in a second manner (e.g., in 1.25 lb increments, in 2.5 lb increments, etc.). Additionally, or alternatively, at least one handle weight 7905 may be fixed to the handle assembly 7904, such as to provide a default or minimum baseline weight of the dumbbell 7901. In such examples, the main weights 7902 and/or supplemental weights 7908 may be added to the handle weight(s) 7905 to increase the overall mass of the dumbbell 7901.

Figure 76:
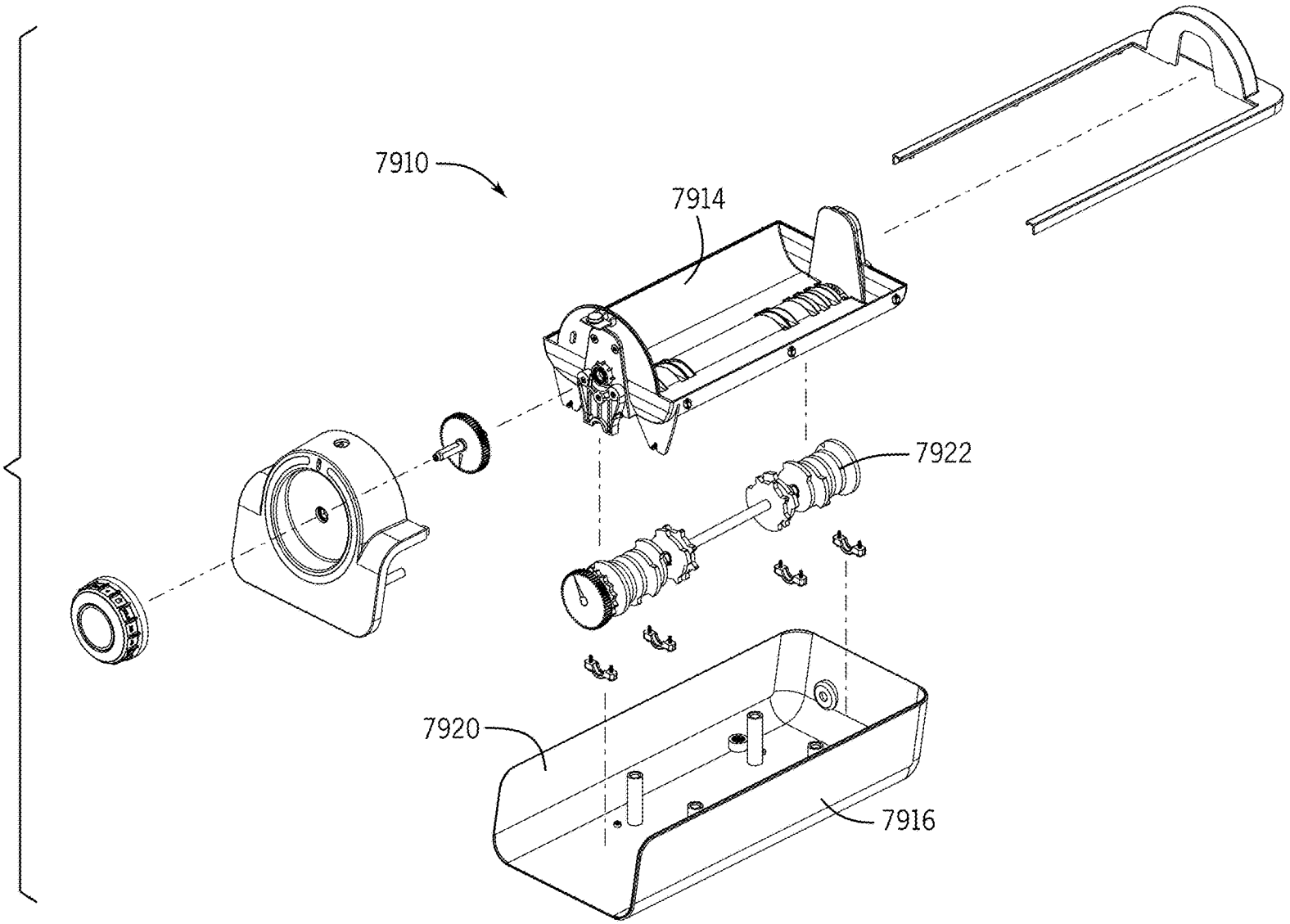
FIG. 76 is an exploded view of a base of the dumbbell system of FIG. 75.

FIG. 76 illustrates an exploded view of the base 7910. The base 7910 may support the handle assembly 7904 and weights, such as in a manner as described above. For example, as shown in FIG. 76, the base 7910 may include a floor portion 7914 and a housing 7916 having side walls 7620 configured to engage and hold the weights and dumbbell 7901 in place. In some examples, the base 7910 includes a weight selector assembly 7922 (e.g., within and at least partially contained by the base 7910). The weight selector assembly 7922 may be operable to selectively attach or detach the weights from the handle assembly 7904, such as in a manner as described above. For example, the weight selector assembly 7922 may selectively engage portions of the weights to operate interconnection mechanisms of the respective weights, as detailed below.

Figure 77A:
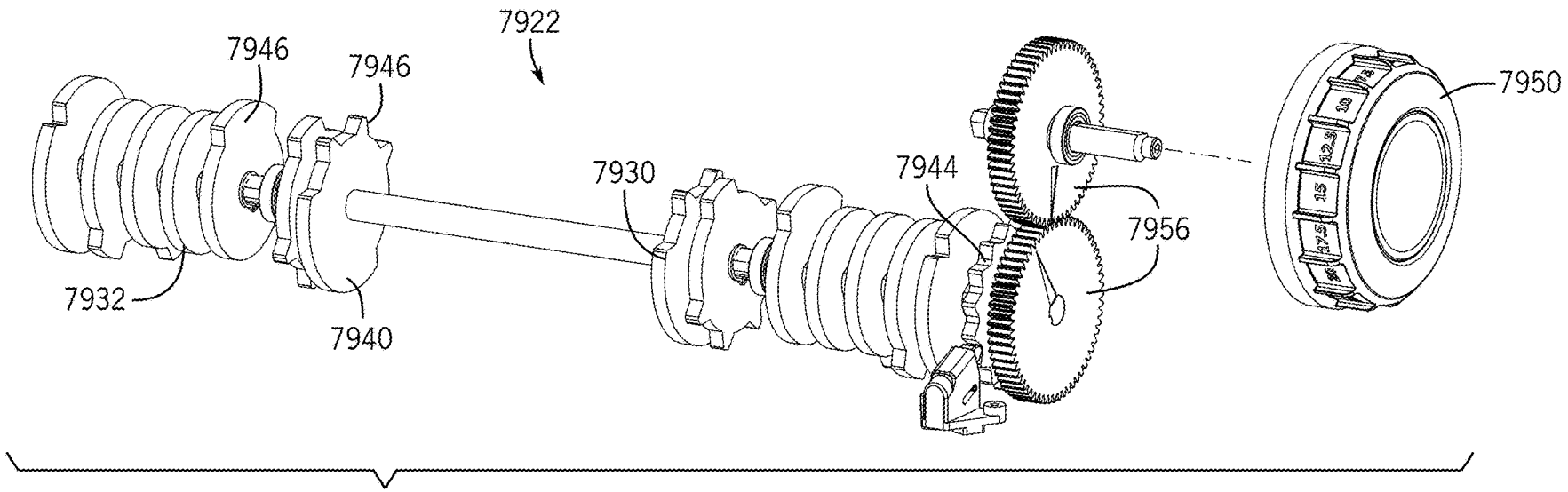
FIG. 77A is an isometric view of a weight selector assembly of the dumbbell system of FIG. 75.
Figure 77B:
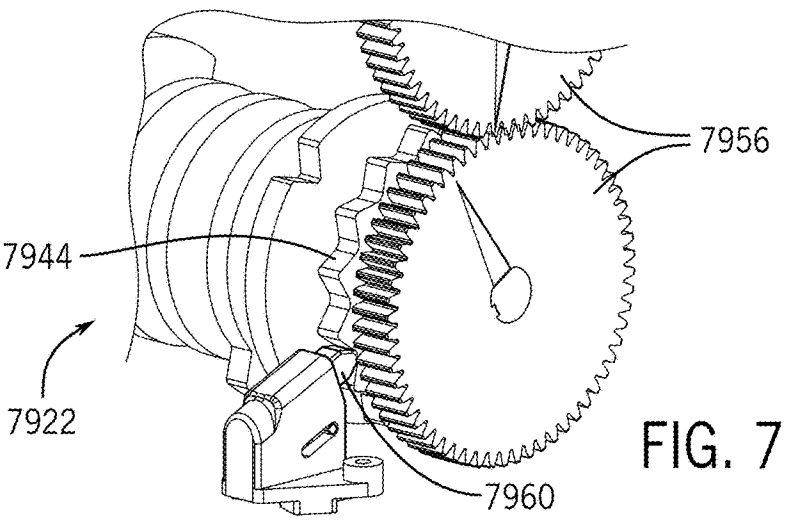
FIG. 77B is an enlarged view of a detent structure of the weight selector assembly of FIG. 77A.

FIGS. 77A-77B illustrate detailed views of the weight selector assembly 7922. Referring to FIGS. 76-77B, the weight selector assembly 7922 may include a cam shaft 7930 including a set of main cams 7932 corresponding to the positions of the main weights 7902 in the base 7910, a set of supplemental cams 7940 corresponding to the positions of the supplemental weights 7908 in the base 7910, and an end gear element 7944. Each main cam 7932 and supplemental cam 7940 may define a protrusion 7946 (e.g., a lobe, bump, or other similar portion having a different radius as compared to another portion of the cam) that may be indexed at various angles or positions of the cam shaft 7930, such that the rotation of the cam shaft 7930 will cause the protrusion 7946 to actuate an interconnection mechanism, as detailed below. The weight selector assembly 7922 (or at least portions thereof) may be positioned centrally below the dumbbell 7901. In such examples, the floor portion 7914 may include one or more cutouts to receive the cams for engagement with the weights.

Rotation of the cam shaft 7930 may cause the engagement or disengagement of the weights with the handle assembly 7904 by interaction between the cams and their respective weights, such as in a manner as described above. For example, rotation of the cam shaft 7930 may selectively actuate or otherwise operate an interconnection mechanism of the respective weights to selectively couple the weights to the handle assembly 7904, as described more fully below.

The cam shaft 7930 may be rotated in many ways. For instance, the weight selector assembly 7922 may include an input member 7950 coupled to the cam shaft 7930. In such examples, user rotation of the input member 7950 may rotate the cam shaft 7930. The input member 7950 may include a dial indicator that provides visual indication of its position and/or an associated weight based on position. In one example, the input member 7950 is coupled to the cam shaft 7930 via one or more gears 7956, such as to position the cam shaft 7930 and/or the input member 7950 as desired (e.g. to achieve a desired form factor). In one example, the cam shaft 7930 may be rotated via power transmission (e.g., a motor), such as in a manner as described above.

As best illustrated in FIGS. 77A-77B, the end gear element 7944 may engage a detent 7960. In one example, the detent 7960 is biased into engagement with the end gear element 7944, such as via a spring. In one example, the detent 7960 aligns the cam shaft 7930 into correct orientation. For instance, a radially-inward-directed biasing force applied by the sprung detent 7960 may bias the cam shaft 7930 into predetermined rotated positions, such as for the purposes detailed above. In such examples, the biasing force (e.g., spring force) is important to ensure no counter-rotation of the cam shaft 7930.

Figure 78:
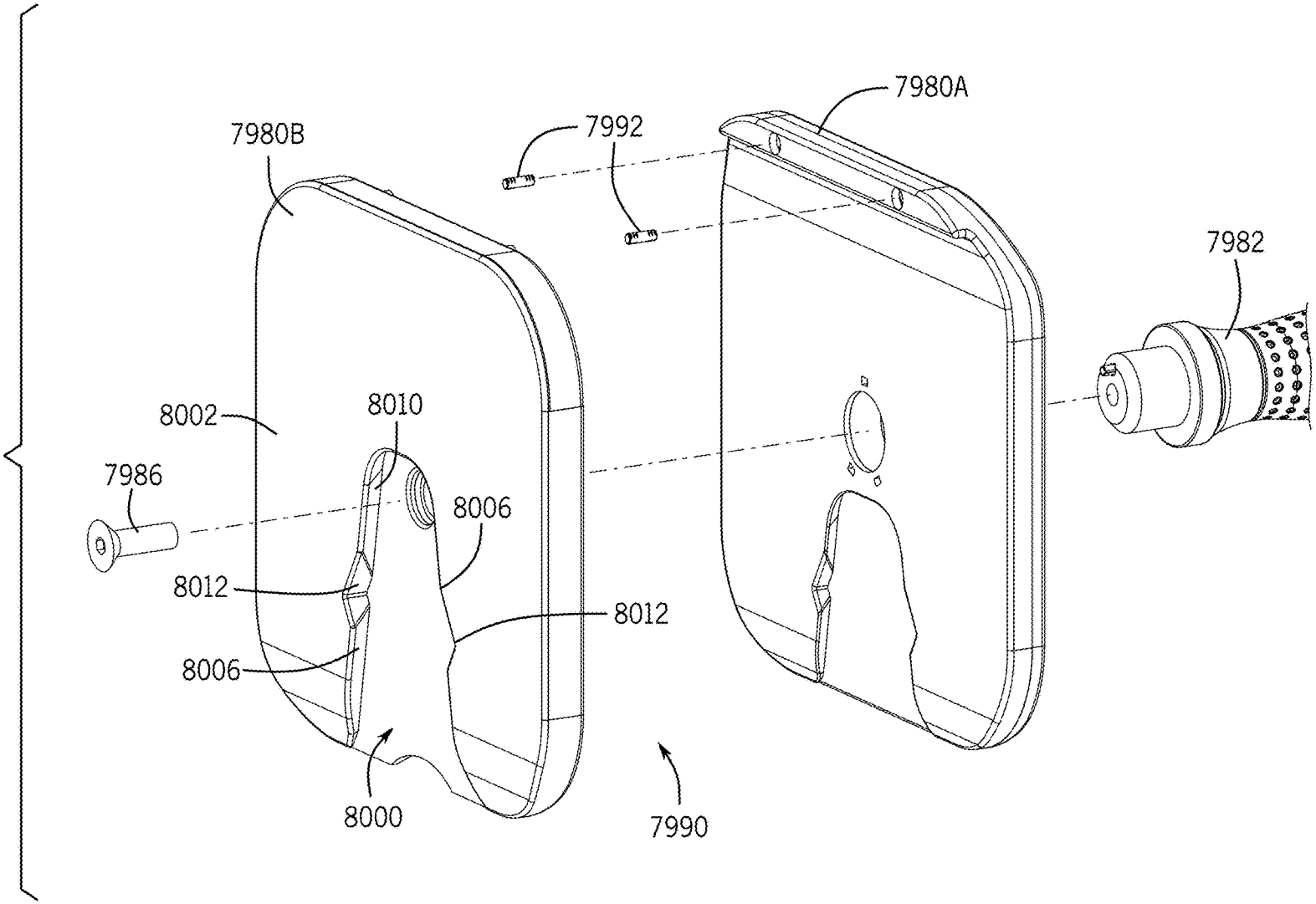
FIG. 78 is a partial isometric view of a handle assembly of the dumbbell system of FIG. 75.

FIG. 78 illustrates an exploded view of multiple handle weights 7980 coupled to the handle assembly 7904. As shown, each end of the handle assembly 7904 may include a first handle weight 7980A and a second handle weight 7980B. The first handle weight 7980A may be coupled to a handle 7982, such as via a fastener 7986. The second handle weight 7980B may be coupled to the first handle weight 7980A, such as via the fastener 7986. In one example, a bushing (not illustrated) may be positioned between the first and second handle weights 7980A, 7980B to define a gap 7990 therebetween. In some examples, one or more dowels 7992 may engage the first and second handle weights 7980A, 7980B (e.g., at a connection between the first and second handle weights 7980A, 7980B) to prevent relative rotation between the handle weights. The first handle weight 7980A may also be keyed to the handle 7982 to prevent relative rotation between the first handle weight 7980A and the handle 7982 about the longitudinal axis of the handle.

In one example, at least one of the first handle weight 7980A or the second handle weight 7980B may include a recess 8000 (e.g., a recessed portion) defined in a face 8002 of the handle weight. The recess 8000 may be defined axially offset from the surrounding face 8002, such as defined by lateral sides 8006. As shown, the surrounding face 8002 may extend around three sides of the recess 8000, such that the recess 8000 is open to a lateral side of the handle weight (e.g., open to the bottom of the handle weight). In one example, the recess 8000 may include a triangular shape, with its base open to the lateral side of the handle weight and its vertex positioned at or at least pointing towards the center of the handle weight. In such examples, the width of the recess 8000 at the lateral side of the handle weight is greater than the width of the recess 8000 at a position inward from the lateral side. In one example, the lateral sides 8006 may include undercut surfaces 8010, similar to undercut surfaces 235, 236, described above. In one example, one or more notches 8012 (e.g., a pair of notches 8012) may be defined in the lateral sides 8006 of the recess 8000. As shown, the face 8002 may be outward-facing, such as facing away from the handle 7982.

Any of the features, components, and/or parts, including the arrangements and configurations thereof shown in FIGS. 75-78, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 75-78.

Figure 79:
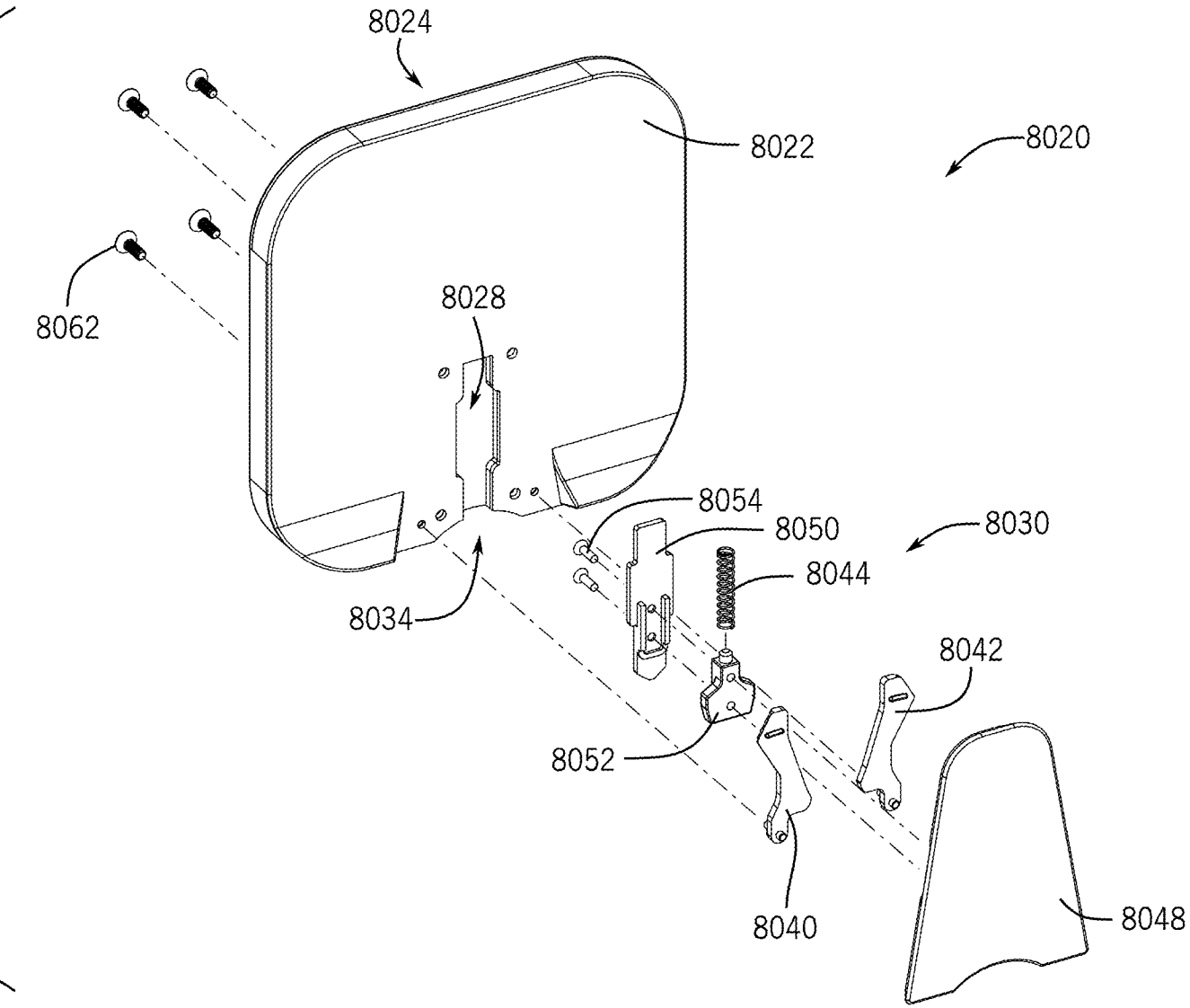
FIG. 79 is an exploded view of a weight assembly of the dumbbell system of FIG. 75.

FIG. 79 is an exploded view of a weight 8020. The weight 8020 may embody the main weight 7902 or the supplemental weight 7908 described above. In one example, the weight 8020 may be a weight plate including a first side 8022 and an opposite second side 8024. The first side 8022 may include a slot 8028 and an interlock or interconnection mechanism 8030. The slot 8028 may extend longitudinally (e.g., radially) along a face of the first side 8022 from an outer side/edge of the weight 8020 towards the center of the weight 8020. In one example, the slot 8028 is open to the bottom side/edge of the weight 8020, such as open to a notch 8034 defined in the bottom side/edge of the weight 8020. The second side 8024 may include a recess 8036 (e.g., recess 8000 shown in FIG. 78) to at least partially receive the interconnection mechanism 8030 of an adjacent weight, as explained below. The first side 8022 may be an inward-facing side of the weight 8020, such as a side facing the handle (e.g., handle 7982) of an associated handle assembly 7904.

As shown, the interconnection mechanism 8030 may include a first pawl 8040, a second pawl 8042, a biasing member 8044 (e.g., a compression spring, leaf spring, elastomeric material, similar structure, or combinations thereof), and a cover 8048 coupled to the first side 8022 of the weight 8020. In some examples, the interconnection mechanism 8030 includes a slide 8050 and a lock member 8052 coupled to the slide 8050 (e.g., via fasteners 8054). In such examples, the slide 8050 may be slidably coupled to the slot 8028. The cover 8048 may keep the first pawl 8040, the second pawl 8042, and the biasing member 8044 protected and housed in a compartment 8060, such as in a manner as described above. As shown, the cover 8048 may be secured to the first side 8022 via fasteners 8062 extending through the weight 8020 from the second side 8024 to the first side 8022.

The interconnection mechanism 8030 may interlock or dovetail with the undercut surfaces 8010 of the recess of an adjacent weight. For example, the cover 8048 may interlock or dovetail with the undercut surfaces 8010 of an adjacent weight to allow lateral movement relative to each other along a vertical direction, such as for example when the handle assembly 7904 is vertically lifted from the base 7910. At the same time, the undercut surfaces 8010 may limit axial withdrawal and horizontal lateral movement of the weight 8020 relative to its coupled neighboring weight. The triangular shapes of the cover 8048 and/or recess may help funnel or guide axial movement of the weight 8020 into place on the base 7910, such as in a manner as described above.

Figure 80B:
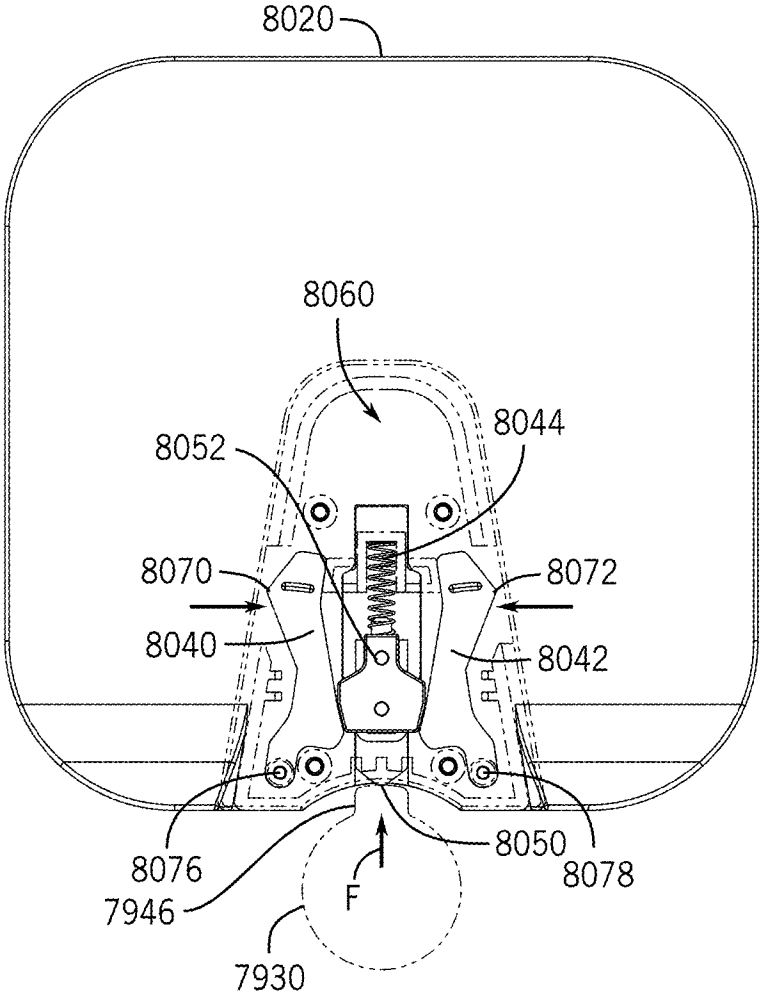
FIG. 80A is an end view of the weight assembly of FIG. 79 and illustrates an interconnection mechanism in a first configuration.
Figure 80A:
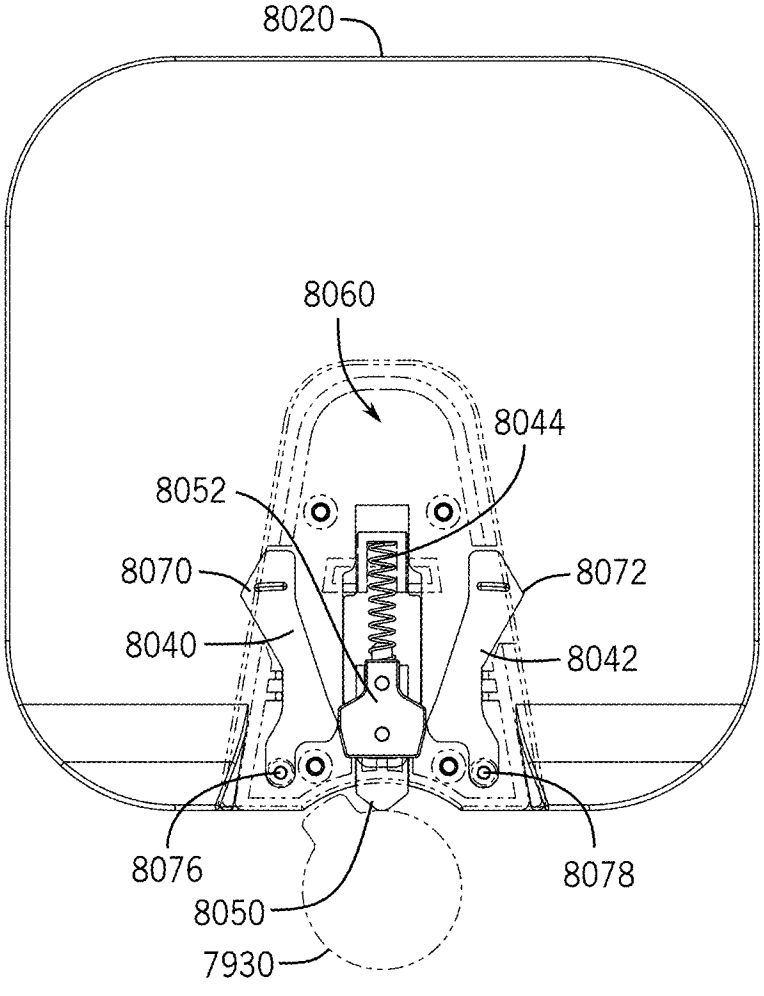

FIGS. 80A and 80B are end views of the weight 8020 in respective first and second configurations. The first configuration may be an engaged configuration, and the second configuration may be a disengaged configuration. In such examples, the interconnection mechanism 8030 is operable between the engaged configuration of FIG. 80A and the disengaged configuration of FIG. 80B to selectively couple the weight 8020 to the handle assembly 7904. For example, in the engaged configuration, the interconnection mechanism 8030 may couple the weight 8020 to the handle assembly 7904 via a handle weight 7905 (e.g., second handle weight 7980B) or another weight coupled to the handle weight 7905. In the disengaged configuration, the weight 8020 is decoupled from the handle assembly 7904.

Referring to FIG. 80A, the cover 8048 may not fully enclose portions of the first pawl 8040 and the second pawl 8042 to permit portions of the pawls (e.g., engagement portions 8070, 8072, such as peaked or triangular portions) to protrude laterally from the compartment 8060. In the engaged configuration, the engagement portions 8070, 8072 extend laterally outward due to a biasing force applied by the biasing member 8044. In one example, the first and second pawls 8040, 8042 rotate outwardly about respective first and second axes 8076, 8078 until the pawls contact side surfaces of the compartment 8060. In this configuration, the engagement portions 8070, 8072 extend from the compartment 8060 to seat or otherwise engage respective notches 8012 in the recess of the second handle weight 7980B or the recess of another weight coupled to the second handle weight 7980B. In this manner, the first pawl 8040 and/or second pawl 8042 may be sprung to the engaged configuration to engage a notch of the second handle weight 7980B or another weight coupled to the second handle weight 7980B. The slide 8050 may also protrude into the notch 8034 at the base of the weight 8020, such as to engage the cam shaft 7930 as detailed below.

Referring to FIG. 80B, the first and second pawls 8040, 8042 may be rotated inwardly until the engagement portions 8070, 8072 disengage the notches 8012 of the neighboring weight. Inward rotation of the first and second pawls 8040, 8042 may occur under spring bias, or the pawls may rotate inwardly as the neighboring weight is lifted away from the weight 8020. For example, the first pawl 8040 and/or the second pawl 8042 (e.g., the engagement portions 8070, 8072) may be ramped to allow the engagement portions 8070, 8072 to easily slide out of the notch 8012 as the neighboring weight is lifted away from the weight 8020. In some examples, the pawl is ramped in both directions to facilitate engagement with and disengagement from the notch 8012.

Referring to FIGS. 80A-80B, the lock member 8052 may be positioned between the first pawl 8040 and the second pawl 8042 and movable between a first position (see FIG. 80A) and a second position (see FIG. 80B). In the first position, the lock member 8052 may prevent the pawls from moving inward to couple the weight 8020 to a neighboring weight (e.g., the second handle weight 7980B or another weight). In the second position, the lock member 8052 may allow the pawls to collapse inward to decouple the weight 8020 from its neighboring weight (e.g., the second handle weight 7980B or another weight). In one example, the slide 8050 is coupled to the lock member 8052 to slide the lock member 8052 between the first and second positions. For example, sliding movement of the slide 8050 within the slot 8028 may slide the lock member 8052 between positions. The biasing member 8044 may bias the lock member 8052 to the first position. As shown, the lock member 8052 may include a wedge. In such examples, the wedge-shape of the lock member 8052 may bias outward rotation of the pawls as the lock member 8052 moves to the first position.

With continued reference to FIGS. 80A-80B, the weight selector assembly 7922 may operate the interconnection mechanism 8030. For example, the cam shaft 7930 may be axially rotated until, at a predetermined rotational position, the protrusion 7946 contacts the slide 8050. The protrusion 7946 may apply a radially (e.g., vertically) outward force F (see FIG. 80B) to the slide 8050 to move the lock member 8052 to the second position as the force F overcomes the biasing force of the biasing member 8044. With the lock member 8052 in the second position, the first and second pawls 8040, 8042 may collapse inward to deselect the weight 8020, such that the weight 8020 is not vertically lifted with the handle assembly 7904 when the handle assembly 7904 is lifted from the base 7910, such as in a manner as described above.

Any of the features, components, and/or parts, including the arrangements and configurations thereof shown in FIGS. 79-80B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 79-80B.

Figure 81:
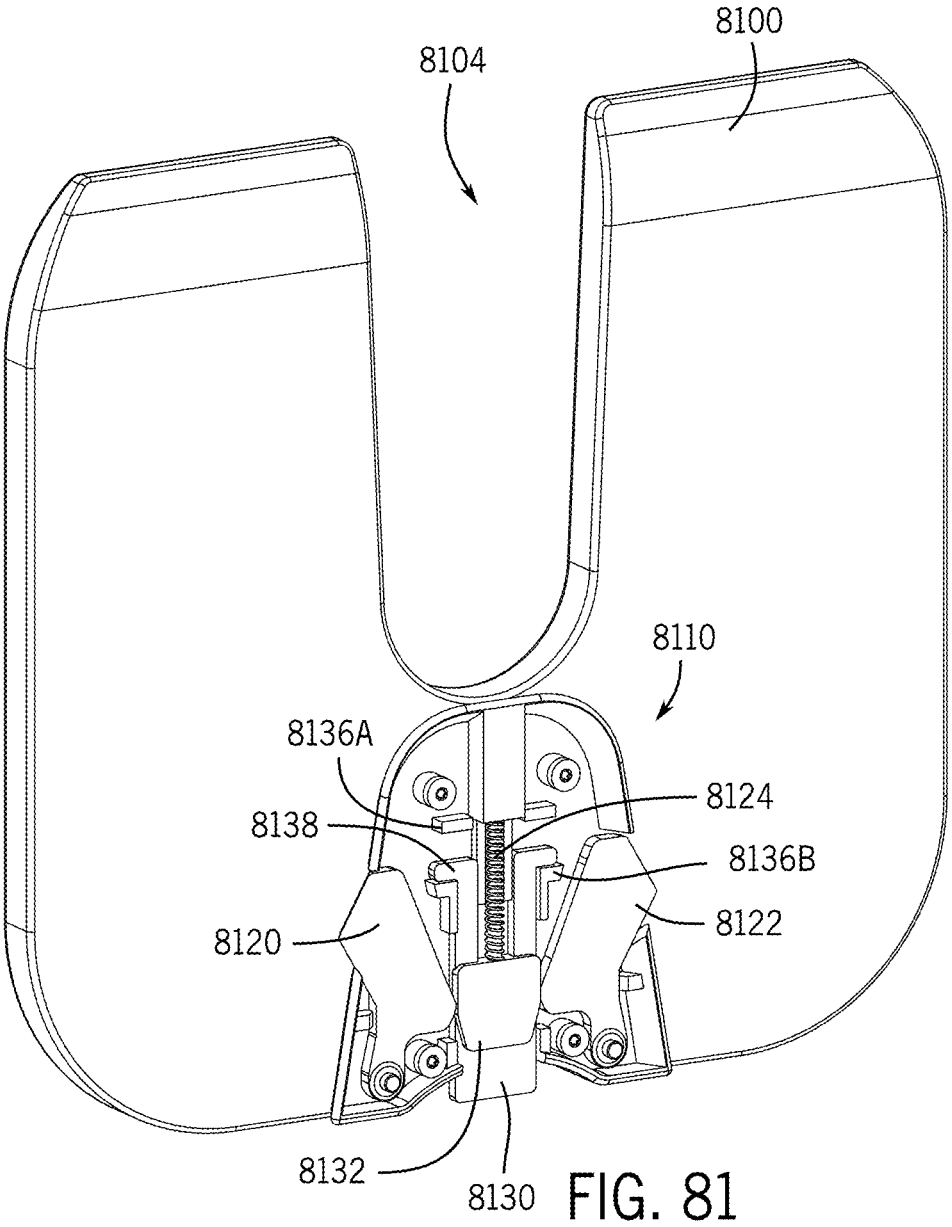

FIG. 81 is an isometric view of another weight 8100 including an interconnection mechanism 8110. The weight 8100 may embody the main weight 7902 or the supplemental weight 7908 described above. As shown, the weight 8100 may include a U-shaped weight plate having a cutout 8104 (e.g., along a vertical centerline of the weight plate). In some examples, the weight 8100 may be positioned within the gap 7990 between the first handle weight 7980A and the second handle weight 7980B. In such examples, the cutout 8104 may accommodate the bushing between the first and second handle weights 7980A, 7980B.

The interconnection mechanism 8110 may be similar to the interconnection mechanism 8030 described above. For example, the interconnection mechanism 8110 may include a first pawl 8120, a second pawl 8122, a biasing member 8124, a slide 8130, a lock member 8132, and a cover 8128 (not shown for illustration purposes), or any combination thereof. In one example, the interconnection mechanism 8110 may include at least one stop 8136 (e.g., an upper stop 8136*a* and a lower stop 8136*b*) to limit movement of the slide 8130. In such examples, the slide 8130 may include a flange 8138 to engage the stop(s) 8136. For instance, the flange 8138 may engage the lower stop 8136*b* to define the first position of the lock member 8132, as shown. The flange 8138 may engage the upper stop 8136*a* to define the second position of the lock member 8132.

Any of the features, components, and/or parts, including the arrangements and configurations thereof shown in FIG. 81, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIG. 81.

Figure 82B:
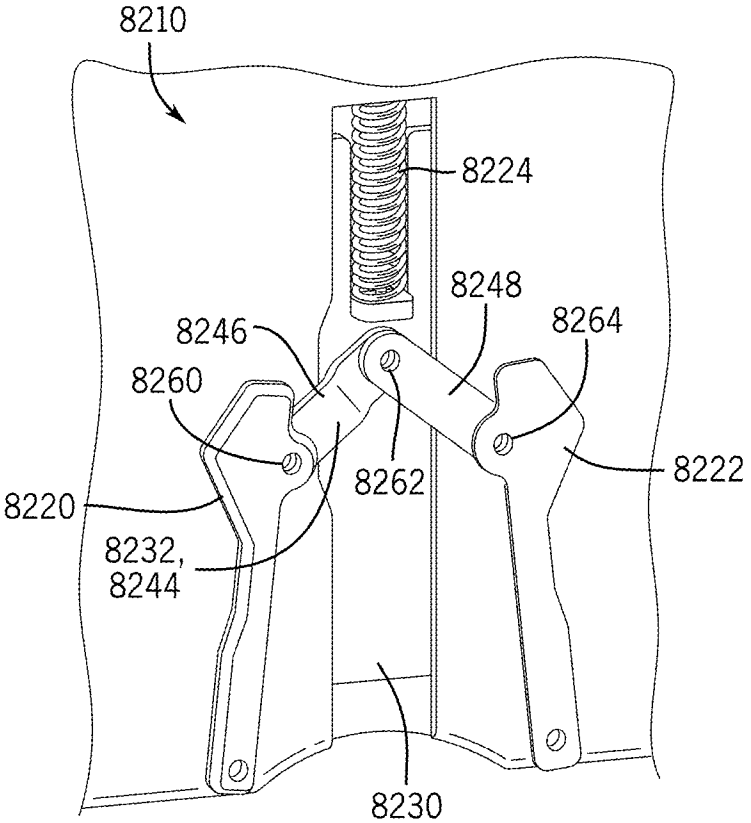
Figure 82A:
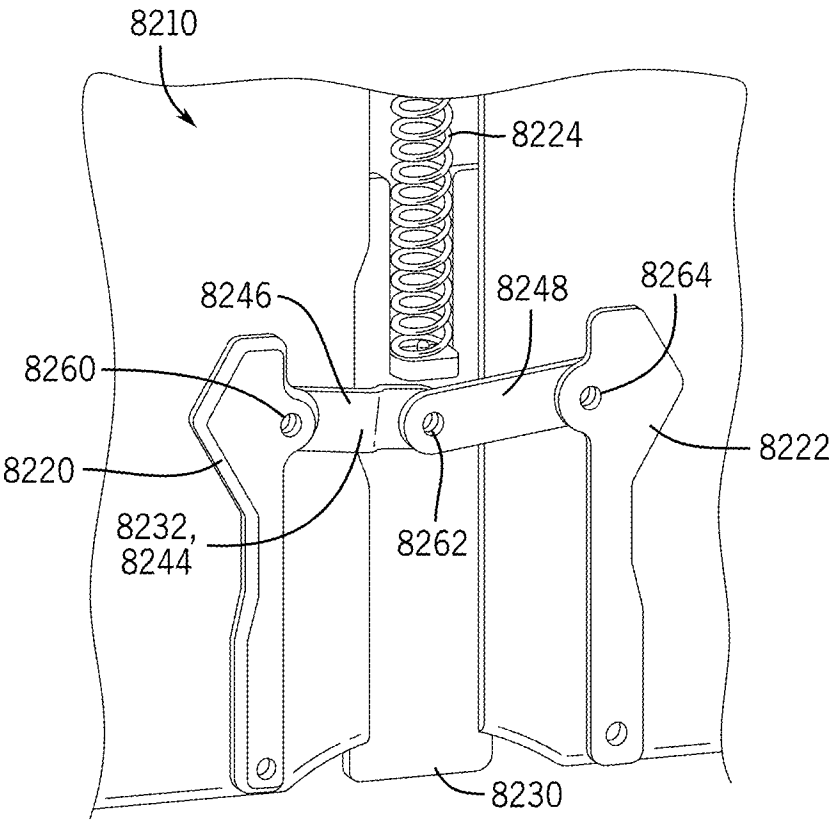

FIG. 82A is a partial isometric view of another interconnection mechanism 8210 in a first, engaged configuration. FIG. 82B is an end view of the interconnection mechanism 8210 in a second, disengaged configuration. The interconnection mechanism 8210 may be similar to the interconnection mechanisms 8030, 8110 described above. For example, the interconnection mechanism 8210 may include a first pawl 8220, a second pawl 8222, a biasing member 8224, a slide 8230, and a lock member 8232, among other similar features, or any combination thereof. The lock member 8232 may include a linkage 8244 coupled to the first and second pawls 8220, 8222. In one example, the linkage 8244 may be coupled to the slide 8230. For instance, the linkage may include a first arm 8246 coupled to the first pawl 8220 and slide 8230, and a second arm 8248 coupled to the second pawl 8222 and slide 8230. As shown, the first arm 8246 may be coupled to the first pawl 8220 and slide 8230 at respective first and second pivot points 8260, 8262. The second arm 8248 may be coupled to the slide 8230 and second pawl 8222 at the second pivot point 8262 and a third pivot point 8264, respectively.

In one example, the linkage 8244 may include an over-center configuration to lock the linkage 8244 in the first configuration or the second configuration. For example, referring to FIG. 82A, a biasing force from the biasing member 8224 may be applied to the linkage 8244 in a direction past center to limit or prevent the linkage 8244 from releasing from the first configuration. In such examples, a counterforce applied to the slide 8230 (e.g., from the cam shaft 7930, as detailed above) may overcome the biasing force to release the linkage 8244 from the over-center configuration. As shown, the first, locking position of the lock member 8232 may include the over-center configuration of the linkage 8244.

Any of the features, components, and/or parts, including the arrangements and configurations thereof shown in FIGS. 82A-82B, may be included, either alone or in any combination, in any of the other examples of devices, features, components, and parts shown in the other figures described herein. Likewise, any of the features, components, and/or parts, including the arrangements and configurations thereof shown and described with reference to the other figures may be included, either alone or in any combination, in the examples of the devices, features, components, and parts shown in FIGS. 82A-82B.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this detailed description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., engaged, attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to refer to and distinguish one feature from another. The drawings are for purposes of illustration only and the dimensions, positions, order and relative sizes reflected in the drawings attached hereto may vary.

What is claimed is:

1. An adjustable dumbbell comprising:

a rotatable handle;

a rod coupled to move along an extension axis;

a first weight selector disc rotatable with a rotation of the handle and configured to selectively engage a first weight plate based on a rotational position of the first weight selector disc relative to the first weight plate; and a second weight selector disc rotatable with the rotation of the handle and configured to selectively engage a second weight plate based on a rotational position of the first weight selector disc relative to the second weight plate, wherein the rotation of the handle extends the rod along the extension axis to selectively engage one or more additional weight plates based on an axial extension of the rod along the extension axis.

2. The adjustable dumbbell of claim 1, further comprising a gear assembly, wherein the rotation of the handle operates the gear assembly to extend the rod along the extension axis.

3. The adjustable dumbbell of claim 2, wherein:

one or more grooves are defined in an outer surface of the rod; and the gear assembly engages the one or more grooves to induce an axial translation of the rod along the extension axis with the rotation of the handle.

4. The adjustable dumbbell of claim 1, further comprising a plurality of additional weight plates including the one or more additional weight plates, wherein each additional weight plate comprises a cutout, the cutouts of the plurality of additional weight plates aligning to receive the rod.

5. The adjustable dumbbell of claim 1, further comprising a plurality of additional weight plates including the one or more additional weight plates, wherein each additional weight plate comprises a protrusion and a recess on opposing sides, the protrusion shaped to fit with the recess of an adjacent weight plate to align and hold the adjacent weight plates together.

6. The adjustable dumbbell of claim 5, wherein the protrusion and recess define a dovetail interface to align and hold the adjacent weight plates together.

7. The adjustable dumbbell of claim 6, wherein each additional weight plate comprises an engagement interface configured to receive the rod along the extension axis, wherein the engagement interface is spaced from the dovetail interface laterally along the face of the additional weight plate.

8. The adjustable dumbbell of claim 7, wherein the engagement interface is an aperture or a cutout.

9. An adjustable dumbbell system comprising:

a first weight plate, a second weight plate, and a plurality of additional weight plates; and a dumbbell comprising:

a handle rotatable about a first axis, a first weight selector disc rotatable with a rotation of the handle about the first axis and configured to selectively engage the first weight plate based on a rotational position of the first weight selector disc relative to the first weight plate, a second weight selector disc rotatable with the rotation of the handle about the first axis and configured to selectively engage the second weight plate based on a rotational position of the second weight selector disc relative to the second weight plate, and a rod coupled to move along a second axis;

wherein the rotation of the handle about the first axis moves the rod along the second axis to selectively couple one or more of the additional weight plates to the dumbbell based on an axial position of the rod along the second axis.

10. The adjustable dumbbell system of claim 9, wherein the first axis is parallel to the second axis.

11. The adjustable dumbbell system of claim 9, further comprising a second rod coupled to move along a third axis, wherein the rotation of the handle about the first axis moves the second rod along the third axis to selectively couple a second one or more of the additional weight plates to the dumbbell based on an axial position of the second rod along the third axis.

12. The adjustable dumbbell system of claim 11, wherein the rotation of the handle moves the rod and the second rod in opposite directions.

13. The adjustable dumbbell system of claim 11, wherein:

the rod selectively couples the one or more of the additional weight plates to a first side of the dumbbell; and the second rod selectively couples the second one or more of the additional weight plates to a second side of the dumbbell.

14. The adjustable dumbbell of claim 11, wherein the second axis is parallel to the third axis.

15. The adjustable dumbbell of claim 9, wherein each additional weight plate comprises a cutout, and wherein the rod selectively extends within the cutouts of the one or more of the additional weight plates to selectively couple the one of more of the additional weight plates to the dumbbell.

16. An adjustable dumbbell comprising:

a rotatable handle;

a first weight plate;

a second weight plate;

a first weight selector disc on a first end of the handle, the first weight selector disc rotatable with a rotation of the handle and configured to selectively engage the first weight plate based on a rotational position of the first weight selector disc relative to the first weight plate; and a second weight selector disc on a second end of the handle, the second weight selector disc rotatable with the rotation of the handle and configured to selectively engage the second weight plate based on a rotational position of the second weight selector disc relative to the second weight plate.

17. The adjustable dumbbell of claim 16, further comprising:

a first housing defining a first opening in a bottom of the dumbbell to receive the first weight plate; and a second housing defining a second opening in the bottom of the dumbbell to receive the second weight plate.

18. The adjustable dumbbell of claim 16, wherein:

the first weight selector disc comprises circumferentially spaced apart teeth that selectively align with a protrusion of the first weight plate to lift the first weight plate with the handle; and the second weight selector disc comprises circumferentially spaced apart teeth that selectively align with a protrusion of the second weight plate to lift the second weight plate with the handle.

19. The adjustable dumbbell of claim 16, further comprising a rod coupled to move along an extension axis, wherein a rotation of the first weight selector disc or the second weight selector disc operates a gear assembly to axially extend the rod along the extension axis to selectively couple one or more additional weight plates to the handle.

20. The adjustable dumbbell of claim 19, wherein the handle rotates about a longitudinal axis of the dumbbell, and wherein the extension axis is parallel to the longitudinal axis.

* * * * *